US006919111B2

(12) United States Patent
Swoboda et al.

(10) Patent No.: US 6,919,111 B2
(45) Date of Patent: Jul. 19, 2005

(54) COATED PAPERBOARDS AND PAPERBOARD CONTAINERS HAVING IMPROVED TACTILE AND BULK INSULATION PROPERTIES

(75) Inventors: Dean P. Swoboda, De Pere, WI (US); Anthony J. Swiontek, Neenah, WI (US); Timothy P. Hartjes, Kimberly, WI (US); Kenneth J. Shanton, West Chicago, IL (US); Erland R. Sandstrom, Menasha, WI (US)

(73) Assignee: Fort James Corporation, Atlanta, GA (US)

( * ) Notice: Subject to any disclaimer, the term of this patent is extended or adjusted under 35 U.S.C. 154(b) by 148 days.

(21) Appl. No.: 10/236,347

(22) Filed: Sep. 6, 2002

(65) Prior Publication Data

US 2003/0152724 A1 Aug. 14, 2003
US 2004/0197500 A9 Aug. 14, 2003

Related U.S. Application Data

(63) Continuation-in-part of application No. 09/018,563, filed on Feb. 4, 1998, now Pat. No. 6,740,373, which is a continuation-in-part of application No. 08/806,947, filed on Feb. 26, 1997, now abandoned.

(51) Int. Cl.[7] ..... B32B 31/14; B32B 31/26

(52) U.S. Cl. ..... 428/34.2; 229/5.81; 229/5.84; 428/511; 428/514; 428/537.5

(58) Field of Search ..... 229/5.81, 5.84; 428/34.2, 511, 514, 537.5, 142, 144, 145, 147, 153, 159, 438

(56) References Cited

U.S. PATENT DOCUMENTS 2,345,543 A 3/1944 Wohnsiedler et al.
2,926,116 A 2/1960 Keim et al.
2,926,154 A 2/1960 Keim et al.

(Continued)

FOREIGN PATENT DOCUMENTS

| | | |
|---|---|---|
| BE | 904013 | 7/1986 |
| EP | 36933 A | 10/1981 |
| EP | 0 462 953 B1 | 10/1993 |
| JP | 06175277 A | 6/1994 |
| WO | WO 97/20009 | 6/1997 |

OTHER PUBLICATIONS

George Treier, "Development of an Unique Lightweight Paper," TAPPI vol. 55, No. 5, May 1972.

B.I. Dussan, et al., "Study of Burn Hazard in Human Tissue and Its Implication on Consumer Product Design," presented at the Heat Transfer Division of the American Society of Mechanical Engineers at the ASME Winter Annual Meetings, Washington, DC, Nov. 28–Dec. 2, 1971.

(Continued)

*Primary Examiner*—Sandra M. Nolan
(74) *Attorney, Agent, or Firm*—Finnegan, Henderson, Farabow, Garrett & Dunner, L.L.P.

(57) ABSTRACT

An improved paperboard has been bulk enhanced by retaining a substantial portion of bulk-enhanced additives including expandable microspheres in a suitable distribution within the paperboard. The cellulosic paperboard web has an overall fiber weight (w) of at least 40 lbs. per 3000 square feet and, at a fiber density of 3, 4.5, 6.5, 7, 8.3, and 9 pounds per 3000 square foot ream at a fiberboard thickness of 0.001 inches, has a GM Taber stiffness of at least about 0.00246 $w^{2.63}$ grams-centimeter/fiber mat density$^{1.63}$, and a GM tensile stiffness of at least about 615+13.18 w pounds per inch. The high retention of the bulk enhancing additives is believed to result from the incorporation of suitable retention aids. The resulting paperboard has better GM Taber stiffness values and GM tensile stiffness than prior art paperboards. The paperboard also has increased strain to failure and is able to be formed into suitable paperboard containers without loss of integrity. The resulting containers have increased hold times when they contain hot or cold food or drink.

63 Claims, 69 Drawing Sheets

U.S. PATENT DOCUMENTS

| | | | |
|---|---|---|---|
| 3,293,114 | A | 12/1966 | Kenaga et al. |
| 3,390,618 | A | 7/1968 | McArdle et al. |
| 3,556,932 | A | 1/1971 | Coscia et al. |
| 3,556,934 | A | 1/1971 | Meyer |
| 3,615,972 | A | 10/1971 | Morehouse et al. |
| 3,864,181 | A | 2/1975 | Wolinski et al. |
| 3,941,634 | A | 3/1976 | Nisser et al. |
| 4,006,273 | A | 2/1977 | Wolinski et al. |
| 4,044,176 | A | 8/1977 | Wolinski et al. |
| 4,206,249 | A | 6/1980 | Suzuki et al. |
| 4,391,833 | A | 7/1983 | Self et al. |
| 4,435,344 | A | 3/1984 | Iioka |
| 4,529,480 | A | 7/1985 | Trokhan |
| 4,619,734 | A | 10/1986 | Andersson |
| 4,637,859 | A | 1/1987 | Trokhan |
| 4,721,499 | A | 1/1988 | Marx et al. |
| 4,721,500 | A | 1/1988 | Van Handel et al. |
| 4,722,943 | A | 2/1988 | Melber et al. |
| 4,722,944 | A | 2/1988 | Mori et al. |
| 4,829,094 | A | 5/1989 | Melber et al. |
| 4,902,722 | A | 2/1990 | Melber |
| 4,913,775 | A | 4/1990 | Langley et al. |
| 5,384,011 | A | 1/1995 | Hazard, Jr. |
| 5,384,012 | A | 1/1995 | Hazard, Jr. |
| 5,490,631 | A | 2/1996 | Iioka et al. |
| 5,514,429 | A | 5/1996 | Kamihgaraguchi et al. |
| 5,529,664 | A | 6/1996 | Trokhan et al. |
| 5,584,966 | A | 12/1996 | Moffett |
| 5,688,371 | A | 11/1997 | König et al. |
| 5,759,624 | A | 6/1998 | Neale et al. |
| 5,766,709 | A | 6/1998 | Geddes et al. |

OTHER PUBLICATIONS

"Wet Strength in Paper and Paperboard," John P. Weidner, ed., TAPPI Monograph Series No. 29, TAPPI Press, 1965. Chapters 1, 2 and 3, pp. 9–37.

"Wet Strength in Paper and Paperboard," John P. Weidner, ed., TAPPI Monograph Series No. 13, TAPPI Press, 1954. Chapters 1, 2 and 3, No title/cover page, pp. 1–28.

RECTANGULAR TAKE-OUT CONTAINER

RECTANGULAR TAKE-OUT CONTAINER

FOOD BUCKET

SIDE VIEW

TOP VIEW

BOWL WITH MICROWAVE SUSCEPTOR LAYER

BOWL WITH MICROWAVE SUSCEPTOR LAYER

1. COATING IS 80% ACRONAL S504 AND 20% EXPANCEL 007
2. FIBER WEIGHT IS LBS/3000 SQ. FEET AND THICKNESS IN INCHES.

1. DENSITY VALUES SHOWN ARE FIBER MAT DENSITIES. (FIBER WEIGHT/CALIPER)

1. DENSITY VALUES SHOWN ARE FIBER MAT DENSITIES. (FIBER WEIGHT/CALIPER)

1. EXPANCEL RETENTION WITH APOLLO + RETEN=83%
2. EXPANCEL RETENTION WITHOUT APOLLO +RETEN=36%

CUP WITH ADDITIONAL INSULATION FEATURE

EXPANDED CROSS-SECTION THROUGH SIDEWALL

1. DENSITY VALUES SHOWN ARE FIBER MAT DENSITIES. (FIBER WEIGHT/CALIPER)

1. DENSITY VALUES SHOWN ARE FIBER MAT DENSITIES. (FIBER WEIGHT/CALIPER)

COATED PAPERBOARDS AND PAPERBOARD CONTAINERS HAVING IMPROVED TACTILE AND BULK INSULATION PROPERTIES

This application is a continuation-in-part of U.S. patent application Ser. No. 09/018,563, filed Feb. 4, 1998, now U.S. Pat. No. 6,740,373, which is a continuation-in-part of U.S. patent application Ser. No. 08/806,947, filed Feb. 26, 1997, now abandoned both of which are incorporated herein by reference, in their entirety.

BACKGROUND OF THE INVENTION

This invention relates generally to processes for forming paperboard products and to the products formed by such processes. More particularly, this invention relates to a method of making disposable paperboard containers with textured coatings and to the texture-coated containers formed by that method. This invention also relates to coatings having superior bulk and insulation properties.

In addition, this invention relates to an improved paperboard, to improved shaped paperboard products, and to methods of making such paperboard and shaped paperboard products, including heat insulating paperboard containers, such as cups, having as their wall surface a foamed layer of thermoplastic film. More particularly, this invention is also directed to an improved bulk-enhanced paperboard, to methods of making such a paperboard, and to shaped paperboard products made from such paperboard.

In one aspect of the present invention, insulating and/or textured coatings having a high coefficient of friction are printed on a paperboard. The printing of the coating is an efficient, precise process allowing as little as about ten percent of the container surface to be coated to achieve beneficial insulation and handling properties. These containers are particularly suitable for use as hot drink containers, since only a small portion of the outer surface of the container has to be printed. Foamed polyolefin insulated coating cannot be printed onto the surface of the paperboard and, consequently, the whole side of the paperboard has to be coated. The coated containers of this invention have superior insulation and bulk properties and have greater inherent cost advantages over the prior art foamed polyolefin extrusion coated containers. Furthermore, the registered, texture coated containers of the present invention exhibit excellent printing clarity and accuracy which cannot be obtained when coatings are prepared from foamed polyolefins.

Disposable paper containers, such as plates, trays, bowls, airline meal containers and cafeteria containers, are commonly produced by pressing flat paperboard blanks into the desired shape between appropriately shaped and heated forming dies. Various protective coatings are typically applied to the blanks before forming to make the resulting paperboard containers moisture-resistant, grease-resistant, more readily printable, etc. Often, printing is also applied to the top surface for decoration. A large number of paper products are produced by this method every year. These products come in many different shapes and sizes, including round, rectangular, and polygonal. Many such containers, including for example airline meal containers, have a number of independent compartments separated by upstanding ridges formed in the inner areas of the containers.

When a container is made by pressing a flat paperboard blank, the blank should contain enough moisture to make the cellulosic fibers in the blank sufficiently plastic to permit it to be formed into the desired three-dimensional container shape. During the pressing operation, most of this moisture escapes from the uncoated bottom surface of the blank as water vapor. Suitable methods of producing paperboard containers from moistened paperboard blanks are generally described in U.S. Pat. Nos. 4,721,499 and 4,721,500, among others.

Many people prefer disposable containers which, when handled, produce a sense of bulkiness and grippability at least suggestive of the more substantial non-disposable containers which they replace. While a sense of bulkiness may be provided to some extent in styrofoam and thick pulp-molded containers, such containers suffer a number of drawbacks. For example, unlike pressed paperboard containers, styrofoam containers are often brittle and they are environmentally unfriendly because they are not biodegradable. Also, styrofoam containers are not cut-resistant and it is difficult to apply printing to the surface of styrofoam containers. Additionally, because of their bulkiness, styrofoam containers take up large amounts of shelf space and are costly to ship. Pulp-molded containers similarly are not cut-resistant and have poor printability characteristics. Additionally, pulp-molded containers typically have weak bottoms. Pressed paperboard containers, however, are cut-resistant, readily printable, strong in all areas, and are far less bulky than styrofoam or pulp-molded containers.

The present invention is an improvement in pressed paperboard containers. In the present invention, environmentally friendly disposable paperboard containers are formed. By printing an insulating and/or textured coating on as little as ten percent of one surface of the paperboard, insulating and/or textured containers are formed which give users handling them a sense of bulkiness and grippability. These new containers rely on efficient processes of press-forming paperboard blanks. The resulting product, which consists primarily of cellulosic material, is nearly entirely biodegradable. Additionally, the product of the present invention may withstand normal microwave conditions without any significant change in caliper, may have substantially better thermal resistance when compared to prior disposable paperboard containers made without such an insulating and/or textured coating, and may tend to stay put when resting on a smooth surface due to the coefficient of friction of the textured coating. It should be noted that prior art polyolefin foamed coatings cannot be pattern applied, and therefore have to cover the whole side of the board.

The data shown in FIGS. 9A and 9B demonstrates that conventional paper plates have a coefficient of kinetic friction of about 0.18, plastic plates have a coefficient of kinetic friction of about 0.2, and foam plates have a kinetic coefficient of friction of slightly under 0.2. The coefficient of kinetic friction of the textured plates of this invention may have values of from about 0.61 to 1.4 and up to about 2.0 and more. Thus, the coefficient of kinetic friction of the texturized plates of this invention is up to at least about seven times greater than for conventional paper plates. Accordingly, the suitable coefficient of kinetic friction for the texturized containers of the present invention may be from about 0.22 to at least about 2.0. In one embodiment, the kinetic coefficient of friction is from about 0.4 to about 0.9. In another embodiment, the kinetic coefficient of friction is from about 0.5 to about 0.7.

The data shown in FIGS. 9A and 9B also demonstrates that conventional paper plates and plastic plates have a static coefficient of friction of 0.19. For foam plates the coefficient of static friction is 0.2. The static coefficient of friction of containers of the present invention is from about 0.2 to 2.0.

In one embodiment, the coefficient of static friction is from about 0.4 to about 1.5. In another embodiment, the coefficient of static friction is from about 0.4 to about 1.0. Thus, the static coefficient of friction of the paperboard of the present invention is up to at least about ten times greater than for conventional plates.

The texture coated cellulosic paperboard must reconcile several conflicting properties to be useful for the manufacture of plates, cups, bowls, canisters, French fry sleeves, hamburger clam shells, rectangular take-out containers, and related articles of manufacture. The coated paperboard should have improved thermal resistance, improved formability, and, to improve economics, the whole board need not be covered with the coating. All of the conventional paperboards can be utilized; but for enhanced insulation properties, the fiber weight (hereinafter "w") of the paperboard should be at least about forty pounds for each three thousand square foot ream. However, for some applications, enhanced properties are achieved for paperboards having a fiber weight of about 10 pounds or less for each three thousand square foot ream. Fiber weight is the weight of fiber in pounds for each three thousand square foot ream. The fiber weight is measured at standard TAPPI conditions which provide that the measurements take place at a fifty percent relative humidity at seventy degrees Fahrenheit. In general, the fiber weight of a 3000 square foot ream is equal to the basis weight of such a ream minus the weight of any coating and/or size press. The fiber mat density of the paperboard utilized in the manufacture of textured containers should be in the range of from at least about 3 to at least about 9 pounds per 3000 square foot ream at a thickness of 0.001 inches. The fiber mat density of the paperboard can be greater that 9 pounds per 3000 square foot ream at a thickness of 0.001 inches. In one embodiment, the fiber mat density is in the range of at least about 4.5 to at least about 8.3 pounds per 3000 square foot ream at a fiberboard thickness of 0.001 inch.

In one embodiment, for a the board at a fiber mat density of 3, 4.5, 6.5, 7, 8.3, and 9 pounds per 3000 square foot ream at a thickness of 0.001 inch, the GM Taber stiffness may be at least about 0.00716 $w^{2.63}$ grams-centimeter/fiber mat density$^{1.63}$. The GM tensile stiffness may be at least about 1890+24.2 w pounds per inch. In another embodiment, the GM Taber stiffness value for paperboards having the fiber mat density given above may be at least about 0.00501 $w^{2.63}$ grams-centimeter/fiber mat density$^{1.63}$. The GM tensile stiffness may be at least about 1323+24.2 w pounds per inch. In yet another embodiment, the GM Taber stiffness may be at least about 0.00246 $w^{2.63}$ grams-centimeter/fiber mat density$^{163}$. The GM tensile stiffness may be at least about 615+13.18 w pounds per inch. The GM Taber stiffness values listed are desired to facilitate the bending of the paperboard into the aforementioned articles of manufacture and to provide these articles with greater rigidity. Likewise, the GM Taber stiffness and GM tensile stiffness prevent the plates, cups, and other articles of manufacture from collapsing when used by the consumer. The articles of manufacture can suitably be prepared from either one-ply or multi-ply paperboard, as disclosed herein. The GM tensile and GM Taber values for the web and one-ply board may be the same. For multi-ply board the overall paperboard GM Taber stiffness and GM tensile stiffness may be the same as for a one-ply paperboard. The aforementioned combination of GM Taber stiffness and GM tensile stiffness provide a paperboard which can readily be converted to useful high quality textured or insulation coated cups, plates, compartmented plates, bowls, canisters, French fry sleeves, hamburger clam shells, rectangular take-out containers, food buckets, and other consumer products and other useful articles of manufacture which have the outer surface partially texture coated and/or insulation coated.

Suitable one-ply and multi-ply paperboards may comprise (a) predominantly cellulosic fibers, (b) bulk and porosity enhancing additives interspersed with the cellulosic fibers in a controlled distribution throughout the thickness of the paperboard, and (c) size press applied binder coating, optionally including a pigment, adjacent both surfaces of the paperboard and penetrating into the board to a controlled extent. In one embodiment, the amount of size press applied is at least about one pound for each three thousand square foot ream of paperboard having a fiber mat density of about 3 to below about 9 pounds per 3000 square foot ream at a board thickness of 0.001 inches. For boards having a fiber mat density of 9 or greater per 3000 square foot ream at a board thickness of 0.001 inches, the amount of size press applied may be at least about six pounds for each three thousand square foot ream.

Prior art bulk-enhanced paper products, such as those disclosed in U.S. Pat. Nos. 3,941,634 and 3,293,114, resulting from the addition of expandable microspheres and other bulk enhancing additives and methods for making such paper suffer from a number of drawbacks. For example, one persistent problem in such papers is poor retention of the expandable microspheres or other bulk enhancing additives on the embryonic paper web made in the course of manufacturing the paperboard. This poor retention results in relatively low bulk enhancement of the resulting paperboard per unit weight of bulk enhancing additive added, making the enhancement process unnecessarily costly. A further problem resulting from the poor retention of microspheres and other bulk enhancers experienced in prior art bulk enhancement methods is fouling of the papermaking apparatus with unretained microspheres and other bulk enhancing additives.

A related problem associated with the addition of microspheres and other bulk enhancing additives in the papermaking process is their uneven distribution within the resulting paperboard. Paperboards prepared using prior art enhancement techniques have exhibited a decided asymmetry, with microspheres and other bulk enhancing additives migrating to one of the outer surfaces of the paper web and causing undesired roughness in the surface of the finished paper and hence interference with the smooth and efficient operation of the papermaking apparatus.

The void volume provided by the microspheres reduces the rate of thermal transfer within the paper, which is desirable in many applications. However, the asymmetric distribution of microspheres experienced in the prior art produces uneven thermal insulating characteristics.

In addition, prior art techniques have not created a satisfactory bulk-enhanced paperboard. Prior art products tend to have low thermal insulative properties. The excessive concentration of microspheres at the paper surface creates dusting, which interferes with the operation of printing presses in which the paperboard is used. The printability of the paperboard itself, that is, the satisfactory retention of printed matter on the paperboard, is also adversely affected by such dusting.

Prior art attempts at addressing the above and other drawbacks and disadvantages of paper containing microspheres and other bulk enhancing additives have been unsatisfactory and have had their own drawbacks and disadvantages. For example, in U.S. Pat. No. 3,941,634, Nisser attempts to address the inadequate retention and non-uniform distribution of microspheres by sandwiching the microspheres between two paper webs formed on two wire screens. The introduction of the second paper web adds complexity and expense to the papermaking process. Furthermore, the Nisser process generally does not optimize thermal insulation characteristics because it does not produce a sufficiently even distribution of microspheres within the resulting paper. The same problems are encountered in U.S. Pat. No. 3,293,114 and make the use of current bulk-enhanced papers in thermal insulation applications problematic.

Another attempted solution to the above and other drawbacks and disadvantages of paper containing microspheres has been to employ a surface sizing formulation to "bury" the microspheres which would otherwise be found on the outer surface of the resulting paper. See for example, *Development of a Unique Lightweight Paper*, by George Treier, TAPPI Vol. 55, No. 5, May 1972. This approach, again, has failed to achieve the desired distribution and retention of microspheres, as well as other desirable paper characteristics. In addition to the expensive film forming materials described in the George Treier article, the Treier process increases the complexity and cost of manufacturing paperboard.

The process of making cups, plates, bowls, canisters, French fry sleeves, hamburger clam shells, rectangular take-out containers, food buckets, and other shaped paper articles by deforming bulk-enhanced paperboards of the prior art to create the desired shapes also suffers from various drawbacks and disadvantages. Such paperboard is generally rendered substantially less deformable after being bulk-enhanced by the additions of microspheres. This reduced deformability interferes particularly with top curl forming in rolled brim containers made from bulk-enhanced paperboard. It also interferes with the drawing of cups, plates, bowls, canisters, French fry sleeves, hamburger clam shells, rectangular take-out containers, and food buckets, the reduced deformability in forming dies, and all other applications requiring deformation of bulk-enhanced paper generally and bulk-enhanced paperboard in particular.

Accordingly, there is a need for an improved, bulk-enhanced paperboard which retains a higher percentage of added bulk enhancers in the center layer of the board than has heretofore been achieved. In the paperboard of the present invention, the distribution of the bulk and porosity enhancing additive may be controlled so that at least about twenty percent of the additive is distributed in the central layer and not more than about 75 percent of the additive is distributed on the periphery of the paperboard with no periphery having more than twice the percent of the additive distributed in the central layer of the paperboard.

The present invention provides a bulk-enhanced cellulosic paperboard which, at a fiber mat density of 3, 4.5, 6.5, 7, 8.3, and 9 pounds per 3000 square foot ream at a fiberboard thickness of 0.00 1 inches, may have a GM Taber stiffness of at least about 0.00716 $w^{2.63}$ grams-centimeter/fiber mat density$^{1.63}$. The GM tensile stiffness may be at least about 1890+24.2 w pounds per inch. In one embodiment, the GM Taber stiffness for the paperboard of this invention having a fiber mat density of 3, 4.5, 6.5, 7, 8.3, and 9 pounds per 3000 square foot ream at a fiberboard thickness of 0.001 inches may be at least about 0.00501 $w^{2.63}$ grams-centimeter/fiber mat density$^{1.63}$. The GM tensile stiffness may be at least about 1323+24.2 w pounds per inch. In yet another embodiment, the GM Taber stiffness may be at least about 0.00246 $w^{2.63}$ grams-centimeter/fiber mat density$^{1.63}$. The GM tensile stiffness may be at least about 615+13.18 w pounds per inch. At a fiber mat density of 3, 4.5, 6.5, 7, and 8.3 pounds per 3000 square foot ream at a fiberboard thickness of 0.001 inches, the GM Taber stiffness may be at least about 0.00120 $w^{2.63}$ grams-centimeter, at least about 0.00062 $w^{2.63}$ grams-centimeter, at least about 0.00034 $w^{2.63}$ grams-centimeter, at least about 0.00030 $w^{2.63}$ grams-centimeter, and at least about 0.00023 $w^{2.63}$ grams-centimeter, respectively. The GM Taber stiffness may be at least about 1890+24.2 w pounds per inch. In another embodiment, the GM Taber stiffness values for a fiber mat density of 3, 4.5, 6.5, 7, and 8.3 pounds per 3000 square foot ream at a fiberboard thickness of 0.001 inches, may be at least about 0.00084 $w^{2.63}$ grams-centimeter, at least about 0.00043 $w^{2.63}$ grams-centimeter, at least about 0.00024 $w^{2.63}$ grams-centimeter, at least about 0.00021 $w^{2.63}$ grams-centimeter, and at least about 0.00016 $w^{2.63}$ grams-centimeter, respectively. The GM tensile stiffness value may be at least about 1323+24.2 w pounds per inch.

There is a further need for an efficient, economical method of ensuring a better distribution of bulk additives in paperboard intended for use in shaping containers and other products in which good insulating characteristics and deformability are desired.

There is a further need for bulk-enhanced paperboard whose manufacture does not cause fouling by unretained microspheres and which operates on conventional papermaking machinery without causing dryer sticking problems and without interfering with printing operations to which the paperboard may be exposed.

SUMMARY OF THE INVENTION

As embodied and broadly described herein, the invention includes a texture coated and/or insulation coated flat paperboard blank having two surfaces from which disposable paperboard containers may be formed by: 1) printing on one surface of the blank with a textured or insulating coating covering at least about ten percent of the surface, possibly about ten to about ninety-five percent of the surface, and possibly about twenty to about sixty percent of the surface; the textured or insulating coating may comprise a liquid polymeric binder mixed with either (a) microspheres, (b) gases, (c) glass beads, (d) hollow glass beads, or (e) a mixture of these wherein said binder, after being mixed with the aforementioned components, expands and cures when appropriately heated; 2) optionally coating the other surface of the blank with conventional grease-resistant, decorative and other coatings; 3) applying heat to expand and cure the surface printed with the textured and/or insulation coating; 4) optionally adding moisture to the two coated blanks; and 5) optionally applying heat and pressure to make a texture and/or insulation coated container. In one embodiment, solid glass beads are replaced with hollow glass beads.

In another embodiment, the invention includes texturized paperboard having a coefficient of kinetic friction of at least about 0.22 to about 1.4 and up to about 2.0 and more. In one embodiment, the coefficient of kinetic friction may be from about 0.22 to about 1.5. In another embodiment, the coefficient of kinetic friction is from about 0.4 to about 0.9. In another embodiment, the coefficient of kinetic friction is from about 0.5 to about 0.7. The invention also includes texturized paperboard having a coefficient of static friction of at least about 0.2 to about 2.0. In one embodiment, the coefficient of static friction is from about 0.4 to about 1.5. In another embodiment, the coefficient of static friction is from about 0.4 to about 1.0.

The present invention also includes liquid coating suitable for printing, comprising a liquid polymeric binder mixed with one of the following: (a) gases, (b) microspheres, (c) glass beads, (d) hollow glass beads, or (e) a mixture of these. The heat hardenable polymeric binder may be liquid when applied to the paperboard blank. Any polymeric binder which is liquid at the application temperature and is compatible with the microspheres, gases, glass beads, hollow glass beads, or a mixture of these, and which cures as a result of heating, can be used. Generally, in its cured state, the polymeric binder may adhere tightly to the substrate and it should not be unduly brittle, since brittle coatings tend to flake and pull away from the paperboard substrate. In one embodiment, the polymeric binder will not harden until expansion of the microspheres or gases is substantially complete.

Examples of thermoplastic polymers which may be used as binders include polymers of ethylenically unsaturated monomers, such as polyethylene, polypropylene, polybutenes, polystyrene, poly (a-methyl styrene), polyvinyl chloride, polyvinyl acetate, polymethyl methacrylate, polyethyl acrylate, polyacrylonitrile and the like; copolymers of ethylenically unsaturated monomers such as copolymers of ethylene and propylene, ethylene and styrene, and polyvinyl acetate, styrene and maleic anhydride, styrene and methyl methacrylate, styrene and ethyl acrylate, styrene and acrylonitrile, methyl methacrylate and ethyl acrylate, methyl methacrylate and acrylonitrile and the like; polymers and copolymers of conjugated dienes such as polybutadiene, polyisoprene, polychloroprene, styrene butadiene rubber, ethylene-propylene-diene rubber, acrylonitrile-styrene butadiene rubber and the like; saturated and unsaturated polyesters including alkyds and other polyesters; nylons and other polyamides; polycarbonates; polyethers; polyurethanes; epoxies; ureaformaldehydes, phenol-formaldehydes and the like.

In addition, such polymers can be formulated with curing or cross-linking agents which activate at microsphere or gas expansion temperatures to provide foamed, cured or cross-linked variations of the foregoing types of polymers. Such curing and cross-linking techniques are well-known in the art and include, for example, the use of free radical generators such as peroxides and the like, compounds reactive with double bonds such as sulfur and the like, or compounds reactive with pendant groups of the polymer chain such as the reaction products of polyisocyanates with pendant hydroxyl groups, the reaction products of polyols with pendant isocyanate groups and the like.

One particularly suitable resin is Acronal S504, which is a styrene acrylic derivate (latex) manufactured by BASF Corporation of Parsippany, N.J., having a solids level of about 50% by weight and a glass transition temperature of about 4 and containing, in mole percent:

| | |
|---|---|
| styrene | 14.8 |
| butyl acrylate | 53.6 |
| acrylonitrile | 25.7 |
| acrylic acid | 5.8 |

Airflex 456 is also suitable. Airflex 456 is a terpolymer emulsion of vinylchloride, ethylene, and vinyl acetate having a glass transition temperature of about 0° to 3° C.

The coating formulation may also include a mineral filler to increase the solids level of the microsphere/polymeric binder or gas/polymeric binder mixture. The mineral filler should be present at a level of about 0 to about 50 percent by weight. In one embodiment, the mineral filler is present at a level of about 20 to about 40 percent by weight. Suitable mineral fillers include, for example, kaolin clays, calcium carbonate, titanium dioxide, zinc oxide, chalk, barite, silica, talc, bentonite, glass powder, alumina, graphite, carbon black, zinc sulfide, alumina silica, and mixtures thereof. Hydrafine clay, which is a hydrated aluminum silicate or kaolin with 0.9–2.5% titanium dioxide manufactured by J.M. Huber Corp. of Macon, Ga. is a suitable mineral filler.

Microspheres are suitable for coating the paperboard and containers of the present invention; however, part or all of the microspheres can suitably be replaced with a gas, solid glass beads, or hollow glass beads. Suitable gases include: air, nitrogen, helium, isobutane, and other $C_1$ to $C_7$ hydrocarbons.

The texturizing agent or insulation agent/polymeric binder mixture may be applied by printing in a generally uniform pattern covering at least about 10% and no more than about 95% of one surface area of the paperboard blank. In one embodiment, coverage will be about 30 to about 50% of one surface area. The textured and/or insulating coating, after heating and curing, may exhibit a caliper ranging from about 0.001 to about 0.015 inches and, in one embodiment, from about 0.005 to about 0.010 inches.

Moreover, one object of the present invention is to provide a bulk-enhanced paperboard meeting the above needs in which a high percentage of bulk enhancing additives are retained and in which those bulk enhancing additives are substantially uniformly distributed in the resulting bulk-enhanced paperboard.

This is accomplished in one embodiment of the invention by providing a cellulosic paperboard web which may include predominantly cellulosic fibers, bulk and porosity enhancing additive interspersed with said cellulosic fibers in a controlled distribution throughout the thickness of the paperboard, and size press applied binder, optionally including a pigment, coating adjacent both surfaces of the paperboard web and penetrating into the paperboard web to a controlled extent. The overall fiber weight "w" of the web may be at least about 40 lbs. per 3000 square foot ream for less stringent requirements such as French fry sleeves. For other applications, in one embodiment the suitable range may be about 60 to about 320 lbs. per 3000 square foot ream. In another embodiment, the suitable range is at least about 70 to about 320 lbs. per 3000 square foot ream. In yet another embodiment, the suitable range is at least about 80 to about 220 lbs. per 3000 square foot ream. However, for some applications the fiber weight may be from as little as 10 to 40 lbs. per 3000 square foot ream, and may be even less that 10 lbs. per 3000 square foot ream.

In one embodiment, both the distribution of the bulk and porosity enhancing additive throughout the thickness of the paperboard, and the penetration of the size press applied binder and optionally pigment coating into the board may be controlled to produce, at a fiber density of 3, 4.5, 6.5, 7, 8.3, and 9 pounds per 3000 square foot ream at a fiberboard thickness of 0.001 inches, a GM Taber stiffness of at least about 0.00716 $w^{2.63}$ grams-centimeter/fiber mat density$^{1.63}$. The GM tensile may be at least about 1890+24.2 w pounds per inch. In another embodiment, the GM Taber stiffness may be at least about 0.00501 $w^{2.63}$ grams-centimeter/fiber mat density$^{1.63}$. The GM tensile stiffness may be at least about 1323+24.2 w pounds per inch. In yet another embodiment, the GM Taber stiffness may be at least about 0.00246 $w^{2.63}$ grams-centimeter/fiber mat density$^{1.63}$. The GM tensile stiffness may be at least about 615+13.18 w pounds per inch. At a fiber mat density of 3, 4.5, 6.5, 7, and 8.3 pounds per 3000 square foot ream at a fiberboard thickness of 0.001 inches, the GM Taber stiffness may be at least about 0.00120 $w^{2.63}$ grams-centimeter, at least about 0.00062 $w^{2.63}$ grams-centimeter, at least about 0.00034 $w^{2.63}$ grams-centimeter, at least about 0.00030 $w^{2.63}$ grams-centimeter, and at least about 0.00023 $w^{2.63}$ grams-centimeter, respectively. The GM tensile stiffness may be at least about 1890+24.2 w pounds per inch. In one embodiment, the GM Taber stiffness values for a board having a fiber mat density of about 3, 4.5, 6.5, 7, and 8.3 pounds per 3000 square foot ream at a fiberboard thickness of 0.001 inches, may be at least about 0.00084 $w^{2.63}$ grams-centimeter, at least about 0.00043 $w^{2.63}$ grams-centimeter, at least about 0.00024 $w^{2.63}$ grams-centimeter, at least about 0.00021 $w^{2.63}$ grams-centimeter, and at least about $0.00016^{2.63}$ grams-centimeter, respectively. The GM tensile stiffness may be at least about 1323+24.2 w pounds per inch.

The formable ultra rigid paperboard exhibits superior bending (GM Taber stiffness) and GM tensile stiffness. Usually, the paperboard has a bulking additive present. This bulking additive is selected from a group consisting of expanded or unexpanded microspheres, continuously or discontinuously coated expanded or unexpanded microspheres, thermally or chemically treated cellulose fibers rendered anfractuous and high bulk additive (HBA) fibers and mixtures of some or all of these bulking additives. The thermally or chemically-treated fibers are disclosed in U.S. Pat. Nos. 5,384,011 and 5,384,012 assigned to the assignee of the instant patent application. Both of these United States patents are incorporated herein by reference in their entirety. Suitably the bulking additives, such as microspheres, are attached to the cellulose fiber prior to the formation of the embryonic web.

Microspheres are heat expandable thermoplastic polymeric hollow spheres containing a thermally activatable expanding agent. Such materials, the method of their manufacture, and considerable information concerning the properties and uses of microspheres are all set forth in U.S. Pat. Nos. 3,615,972; 3,864,181; 4,006,273; and 4,044,176. Microspheres may be prepared from polyvinylidene chloride, polyacrylonitrile, poly-alkyl methacrylates, polystyrene, or vinyl chloride. A wide variety of blowing agents can be employed in microspheres. Commercially available blowing agents may be selected from the lower alkanes such as propane, butane, pentane, and mixtures thereof. Isobutane is one acceptable blowing agent for polyvinylidene chloride microspheres. Suitable microspheres are disclosed in U.S. Pat. Nos. 3,556,934; 3,293,114; and 4,722,944, all incorporated herein by reference. Suitable coated unexpanded and expanded microspheres are disclosed in U.S. Pat. Nos. 4,722,943 and 4,829,094, both incorporated herein by reference.

In one embodiment, a retention aid may be employed. The retention aid may be selected from the group consisting of coagulation agents, flocculation agents, and entrapment agents. A binder may be utilized, usually in conjunction with a pigment.

Sizing agents may also be employed. In one embodiment, about 1 to about 30 pounds of sizing agent for a three thousand square foot ream may be used for paperboards having fiber mat densities of from about 3 to at least about 9 pounds per 3000 square foot ream at a fiberboard thickness of 0.001 inches. In another embodiment, 6–30 pounds of sizing agent may be used for a three thousand square foot ream of paperboard having a fiber mat density greater than about 8.3 pounds per 3000 square foot ream at a fiberboard thickness of 0.001 inches. In still yet another embodiment, 0 to about 6 pounds of sizing agent is used for paperboards having fiber mat densities of from about 3 to at least about 9 pounds per 3000 square foot ream at a fiberboard thickness of 0.001 inches. In another embodiment, about 15 to about 30 pounds of the sizing agent is utilized. In still yet another embodiment, about 16 about 19 pounds of the sizing agent is used for each three thousand square foot ream. By controlling the amount of sizing agent added, the GM tensile stiffness of the board may also be controlled.

In the manufacture of the paperboard, wet strength agents optionally may be utilized. Parez 631 is a suitable wet strength agent. If the end use of the board is as a food container and the wet strength agents come in direct contact with edible material, FDA approved polyamides and acrylamides may be used.

The bulk enhanced paperboard of the present invention may be pressed into high quality articles of manufacture having a high GM Taber stiffness and GM tensile stiffness. Useful articles made from the bulk enhanced paperboard include cartons, folding paper boxes, cups, plates, compartmented plates, bowls, canisters, French fry sleeves, hamburger clam shells, rectangular take-out containers, food buckets, heat insulating containers coated or laminated with a polyolefin and foamed with the water contained in the fiberboard, and food containers with a microwave susceptor layer. The articles of manufacture of the present invention are characterized by having excellent insulation properties. These properties enhance the hot and cold containers of this invention. The GM Taber stiffness and GM tensile stiffness for the one-ply web may be the same as for the one-ply paperboard. For multi-ply boards, the GM Taber stiffness and GM tensile stiffness may be the same as for the one-ply paperboard.

The features of the invention which are believed to be novel are set forth with particularity in the appended claims. The invention, together with further objects, features and advantages thereof, may best be understood by reference to the following detailed description taken in conjunction with the accompanying drawings.

DESCRIPTION

Figure 3:
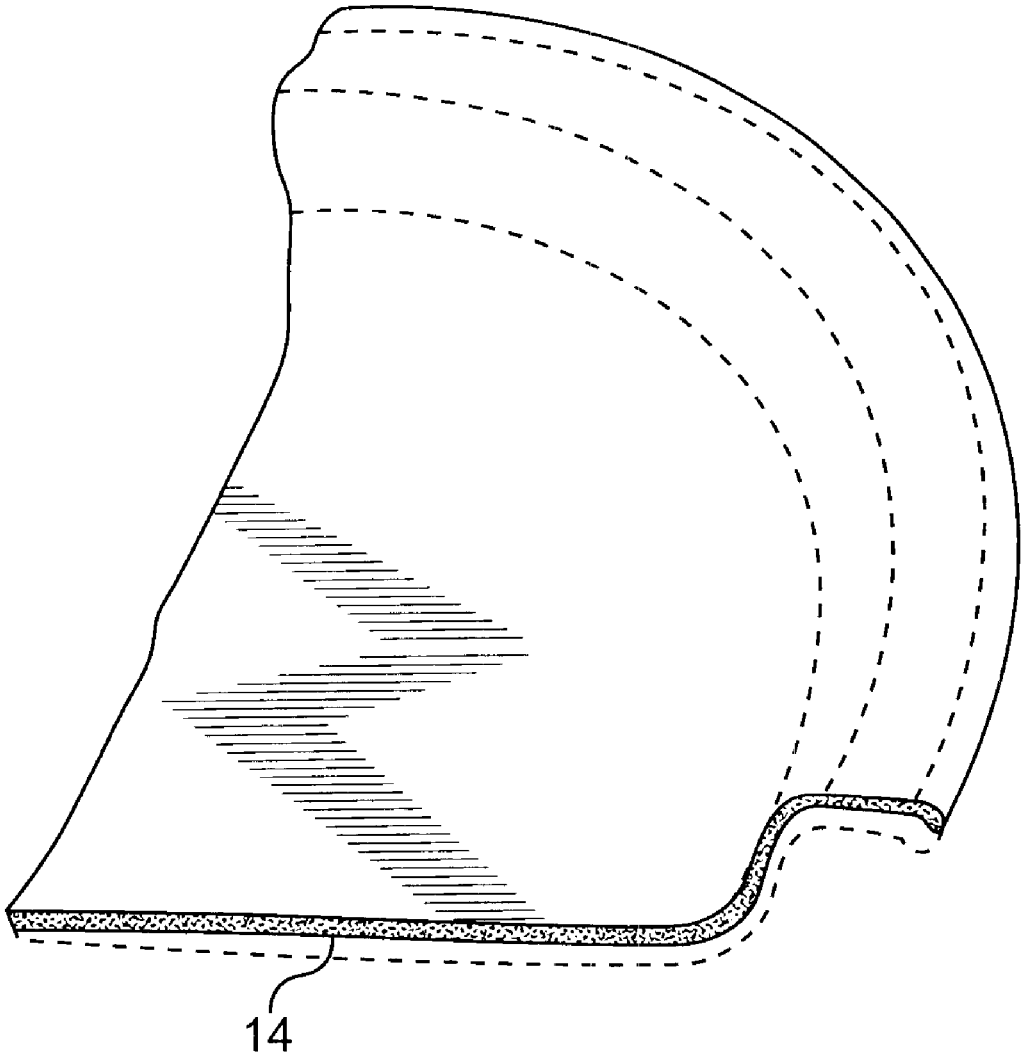
FIG. 3 is a perspective view of a section of a container in accordance with the invention.
Figure 5:
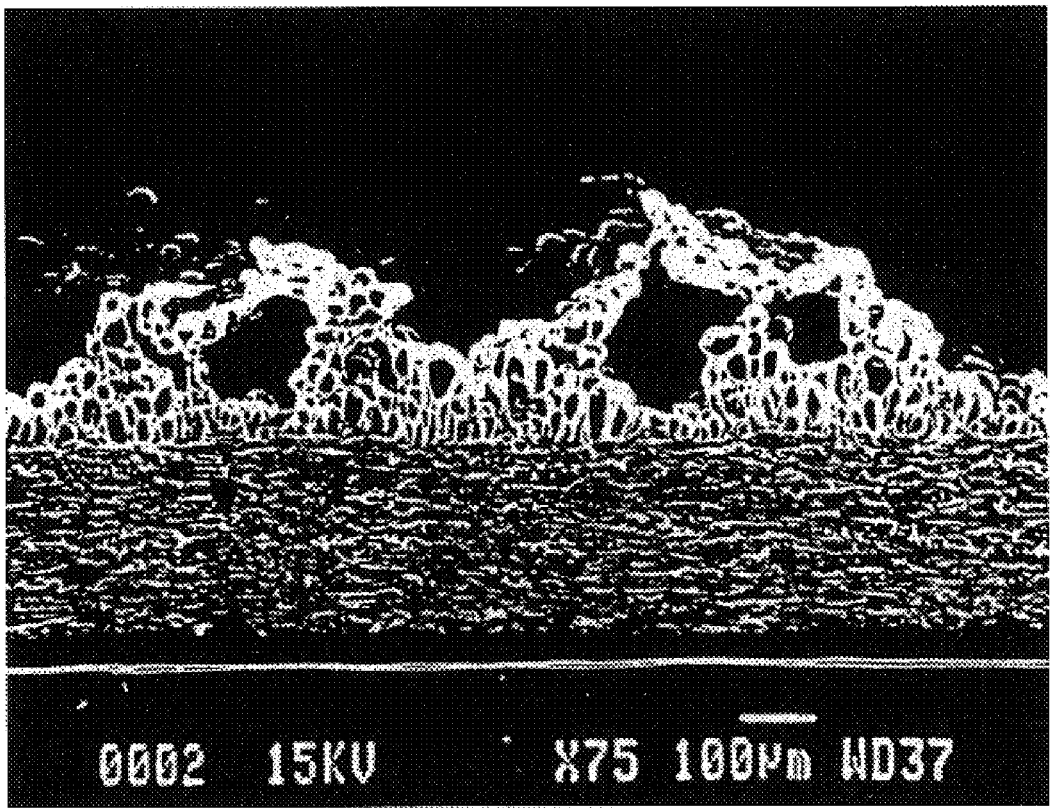
FIG. 5 is a photomicrograph of a 75× magnification of a section through a container prepared in accordance with the present invention having both gas pockets and microsphere pockets.
Figure 6:
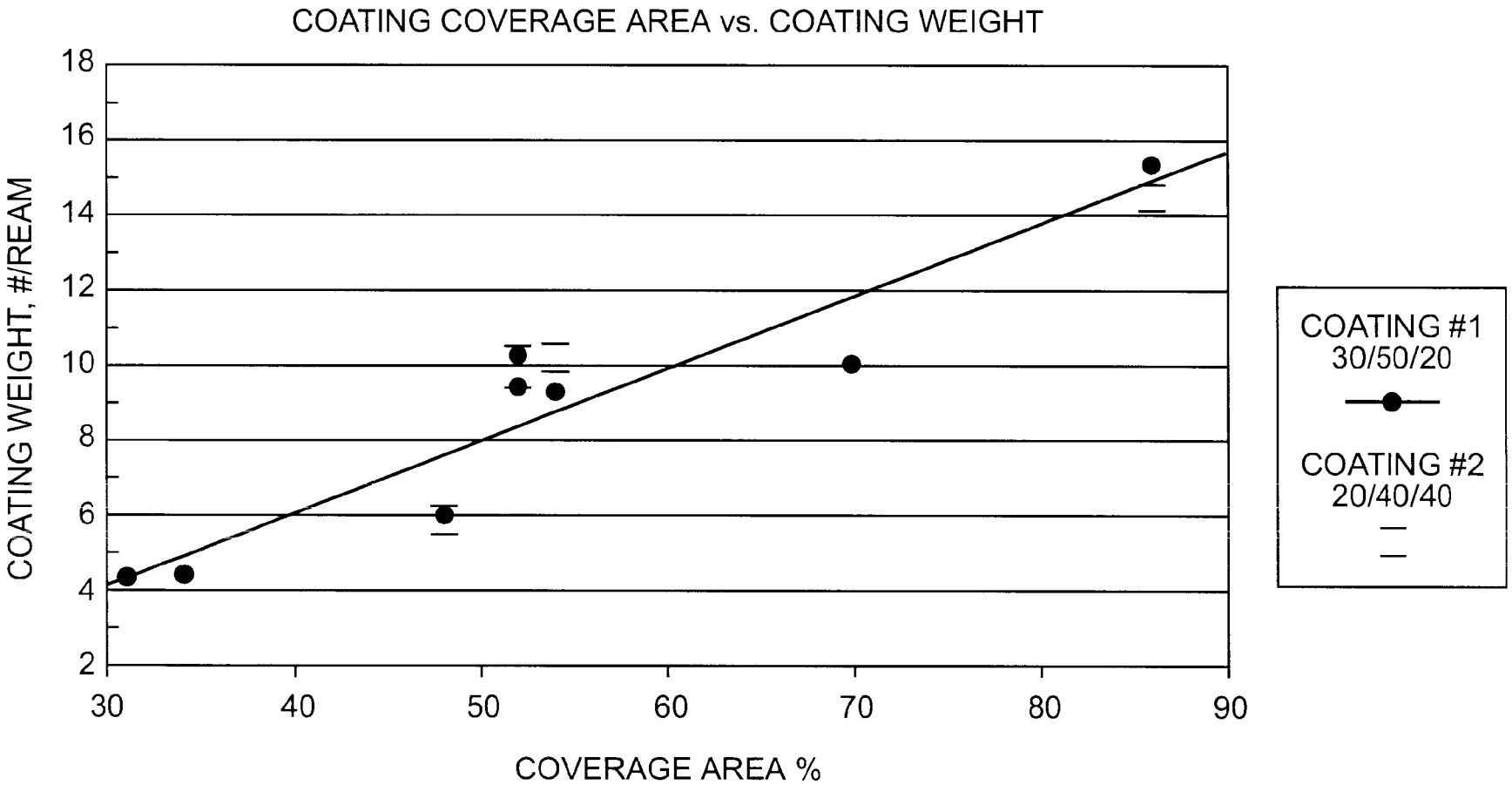
FIG. 6 is a graph illustrating the percent surface texture coated versus the weight of the coating in pounds for each 3000 square foot ream.

In accordance with the invention, a flat paperboard blank 10 is provided, having two surfaces designated top surface 12 and a bottom surface 14. In a commercial scale operation, blank stock, in roll form, would be used and blanks 10 would be die-cut from the roll after coating and optionally moistening and before molding, as discussed below. In one embodiment, the top surface 12 of the blank is coated with conventional coatings represented by topcoat layer 16 and the bottom surface 14 has a patterned coating 18 of a polymeric binder mixture and texturizing and/or insulation agent mixture. In one embodiment, the texturizing and/or insulation agent is selected from microspheres, gases, glass beads, hollow glass beads, and a mixture of these. Suitable gases are air, nitrogen, helium, $C_1$–$C_7$ hydrocarbons and etc. This pattern coating may be printed on surface 14 using conventional printing processes. Suitable printing processes are screen printing and rotogravure printing. After optionally moistening the coated blank, it may be pressed into a desired shape, such as a plate, as shown in FIG. 3. As shown in the cross-sectional enlarged photomicrographic view of FIG. 5, coating 18 includes polymeric binder 20 and expanded microspheres 22.

Topcoat layer 16 may be formed by sizing the paperboard and then applying directly to the sized paperboard a base coat comprising a latex having a glass transition temperature of about −30° C. to about +30° C. and a pigment, and drying the applied base coat. A top coat comprising a latex and a pigment may then be applied directly to the base coat. According to one embodiment, nitrocellulose, lacquer, styrene acrylic polymers and terpolymer emulsions of vinyl chloride, ethylene and vinyl acetate having a glass transition temperature of about 0° to 3° C. may be suitable. In general, the polymeric binder of the liquid texturizing and/or insulation agent/polymeric binder mixture is chosen from at least one of polymers of ethylenically unsaturated monomers, copolymers of ethylenically unsaturated monomers, polymers and copolymers of conjugated dienes, saturated and unsaturated polyesters, polycarbonates, polyethers, polyurethanes, epoxies, ureaformaldehydes, and phenol-formaldehydes. The polymeric binder of the liquid texturizing and/or insulating agent/polymeric binder mixture may be chosen from at least one copolymer of ethylenically unsaturated monomers such as copolymers of ethylene and propylene, ethylene and styrene, and polyvinyl acetate, styrene and maleic anhydride, styrene and methyl methacrylate, styrene and ethyl acrylate, styrene and acrylonitrile, methyl methacrylate and ethyl acrylate, methyl methacrylate and acrylonitrile. The coated paperboard is optionally gloss calendered to produce a grease, oil, and cut resistant coated plate stock with improved varnish gloss and printing quality capable of maintaining these improved properties after being formed into substantially rigid plates, bowls, trays and similar containers.

Figure 1B:
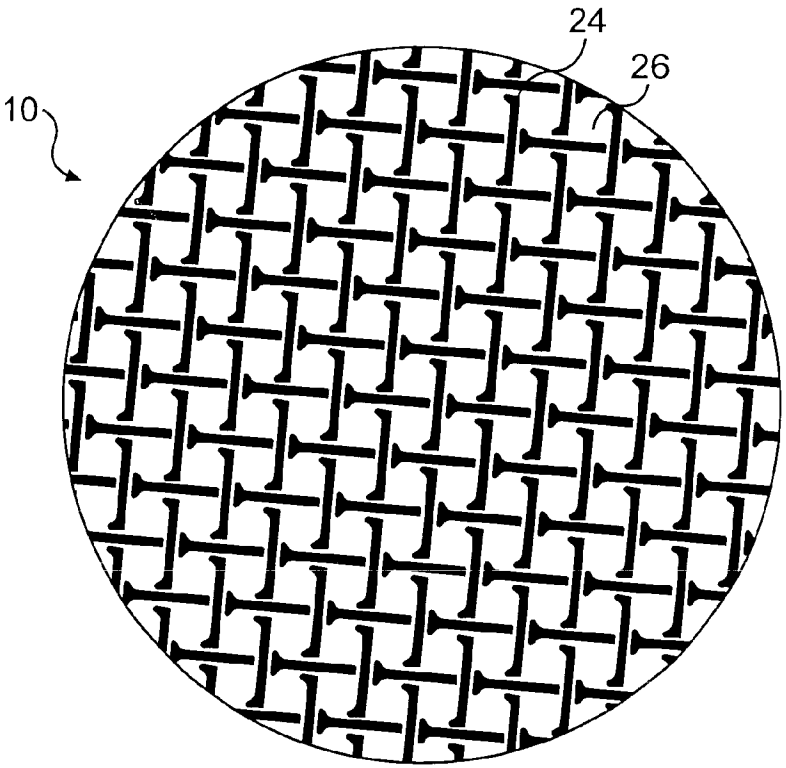
FIG. 1*a* is a view of a paperboard blank for forming a container in accordance with the invention prior to the application of the microsphere/polymer binder mixture and FIG. 1*b* is a bottom view thereof; after application of the microsphere/polymeric binder mixture.

Patterned coating 18, as best seen in the bottom view of FIG. 1*b*, may include textured-coated and/or insulation coated areas 24 and open areas 26 which are free of coating. This permits water vapor to escape during formation of the container, primarily through open areas 26. In the absence of these open areas, the coatings on both the bottom and the top of the containers would blister and pull away.

In addition, the alternating coated and open, or patterned, areas on bottom surface 14 generally can improve the ability of a user to securely grasp the container as compared to products having a smooth bottom surface. Good grip qualities improve consumer confidence in the handling of the product. Also, the textured coating of the container, which is of a low density due to the presence of the hollow expanded microspheres or gases, improves thermal resistance, not only as a result of the insulating properties of the coating itself, but also because there is less hand contact with the paperboard substrate, which further minimizes heat transfer by careful printing of the coating. As little as about ten percent of the outer surface of the container being coated can provide insulation to the hand holding such a container. Suitably about ten to about ninety-five percent of the surface can be coated, and, in one embodiment, about 20 to about 60 percent. Finally, the textured and/or insulation coating increases the coefficient of friction of the outer bottom or outer side surface of the container. As a result, the container will not easily move when one cuts food or otherwise manipulates the container as it rests on a smooth surface such as a tabletop or the lap of the user. This property is particularly useful in applications such as airline meal containers.

The paperboard stock used for blank 10 may have a weight in the range of about 10 pounds to about 400 pounds per ream (3000 square feet) and a thickness or caliper in the range of about 0.008 inches to about 0.055 inches. Paperboard having a basis weight and caliper in the lower end of this range may be used when ease of forming and economic reasons are paramount. Also, for heat insulation and economy, bulk enhanced paperboards may be preferred to conventional paperboard. Suitable bulk enhanced paperboards are described in detail in U.S. Ser. No. 08/716,511 filed on Sep. 20, 1996, and U.S. Ser. No. 08/896,239 filed on Jul. 17, 1997, and both patent applications are incorporated herein by reference, in their entirety.

The bulk enhanced paperboard or conventional paperboard of the present invention may be conveniently pressed and textured and/or insulated into high quality articles of manufacture having excellent insulation properties and high coefficient of friction values. Useful textured articles and insulated articles made from the bulk enhanced paperboard or conventional paperboard include cups, plates, compartmented plates, bowls, canisters, French fry sleeves, hamburger clam shells, rectangular take-out containers, food buckets, hamburger wrap, textured heat insulating containers coated or laminated with a polyolefin, and textured food containers with a microwave susceptor layer. The articles of manufacture are characterized by having excellent insulation properties and ease of handling. Representative containers are set forth in FIGS. 15–27. These properties enhance the textured and/or insulated hot and cold containers of this invention.

In one embodiment, for bulk enhanced paperboard having at a fiber mat density of 3, 4.5, 6.5, 7, 8.3, and 9 pounds per 3000 square foot ream at one thousandths of an inch board thickness (one caliper), the GM Taber stiffness may be at least about 0.00716 $w^{2.63}$ grams-centimeter/fiber mat density$^{1.63}$. The GM tensile stiffness may be at least about 1890+24.2 w pounds per inch. In another embodiment, the GM Taber stiffness at a fiber mat density of 3–9 may be at least about 0.00501 $w^{2.63}$ grams-centimeter/fiber mat density$^{1.63}$. The GM tensile stiffness may be at least about 1323+24.2 w pounds per inch. In yet another embodiment, the GM Taber stiffness at a fiber mat density of 3–9 may be at least about 0.00246 $w^{2.63}$ grams-centimeter/fiber mat density$^{1.63}$. The GM tensile stiffness is at least about 615+13.18 w pounds per inch. In another embodiment, the GM Taber stiffness values for a paperboard having a fiber mat density of 3, 4.5, 6.5, 7, and 8.3 pounds per 3000 square foot ream at one thousandths of an inch board thickness, may be at least about 0.00120 $w^{2.63}$ grams-centimeter, at least about 0.00062 $w^{2.63}$ grams-centimeter, at least about 0.00034 $w^{2.63}$ grams-centimeter, at least about 0.00030 $w^{2.63}$ grams-centimeter, and at least about 0.00023 $w^{2.63}$ grams-centimeter, respectively. The GM tensile stiffness may be at least about 1890+24.2 w pounds per inch. In another embodiment, the GM Taber stiffness values for a board having a fiber mat density of about 3, 4.5, 6.5, 7, and 8.3 pounds per 3000 square foot ream at one thousandths of an inch board thickness may be at least about 0.00084 $w^{2.63}$ grams-centimeter, at least about 0.00043 $w^{2.63}$ grams-centimeter, at least about 0.00024 $w^{2.63}$ grams-centimeter, at least about 0.00021 $w^{2.63}$ grams-centimeter, and at least about 0.00016 $w^{2.63}$ grams-centimeter, respectively. The GM tensile stiffness may be at least about 1323+24.2 w pounds per inch.

The paperboard weight should be balanced against the lower strength and rigidity obtained with the lighter paperboard. No matter what paperboard is selected, the texturized and/or insulated containers of this invention have greater bulkiness, grippability and thermal resistance than prior containers formed of comparable paperboard. It is believed that bulk enhanced paperboards require less cellulosic fiber and therefore are less expensive than conventional paperboards. Bulk enhanced paperboards give higher insulation values, and therefore, lower amounts of the insulating agent may be utilized. Moreover, those of ordinary skill in the art will understand that acceptable insulated containers can be produced using the bulk enhanced paperboard of the present invention without the addition of any additional insulating agent.

The paperboard comprising the blank is typically bleached pulp furnish with double clay coating on one side. The paperboard stock before forming may have a moisture content varying from about 4.0% to about 15.0% by weight. In forming the containers of the invention, the blank may have a moisture content of about 9% to about 11% by weight. In some applications the paperboard has a very low moisture content. In particular, in some applications the moisture content may be as low as 2%.

While various end uses for the containers of the invention are contemplated, typically they are used for holding liquids or foods which have substantial surface moisture. Accordingly, topcoat layer 16 may include one or more layers of a liquid-proof coating material, such as a first layer of polyvinyl acetate emulsion and a second layer of nitrocellulose lacquer to improve gloss, smoothness, printability, moisture resistance, and grease resistance. For aesthetic purposes, top surface 12 may be printed with a design or other printing (not shown) before application of the liquid-proof coatings. In one embodiment, the materials used in the topcoat may be heat resistant.

In one embodiment, the press (not shown) includes male and female die surfaces which define the shape and thickness of the container. At least one die surface may be heated so as to maintain a temperature during pressing of the blank in the range of about 200° F. to about 400° F. The press may impose pressures on the blank in the range of about 300 psi to about 1500 psi.

In accordance with one embodiment of the present invention, either before or after the topcoat is applied, the polymeric binder in combination with one or more of the following selected from the group consisting of microspheres, gases, glass beads, hollow glass beads and a mixture of two or more of these, may be printed on the bottom surface of the blank. In one embodiment, the microsphere/resin mixture is applied after the topcoat is applied and optionally the moisture is introduced after the polymeric binder containing microspheres, gases, glass beads, hollow glass beads, or a mixture of these is applied and cured. In this embodiment, the moisture will enter the paperboard blank through open areas 26 in the textured coating. In another embodiment, the moisture is introduced before application of the top and bottom coatings.

The liquid microsphere/polymeric binder coating may comprise a mixture of expandable microspheres or a mixture of microspheres, gases, glass beads, and hollow glass beads, in a heat-hardenable polymeric binder which is liquid when applied to the paperboard blank. In one embodiment, at least from about 1 to about 50 percent by weight of expandable microspheres may be used in the binder coating. In another embodiment, about 10 to about 30 percent by weight of microspheres may be used in the binder coating. Up to 100 percent of the microspheres can be replaced with glass beads, hollow glass beads, or gases such as air, nitrogen, helium, oxygen, and aliphatic hydrocarbons such as ethane, propane, isobutane, pentane, and heptane. In one embodiment, about 20 to about 60 percent of the microspheres are replaced with glass beads, hollow glass beads, or gases. Any polymeric binder which is liquid at the application temperature and compatible with the microspheres, and which cures as a result of heating can be used. Generally, in its cured state, the polymeric binder should adhere tightly to the substrate and it should not be unduly brittle, since brittle coatings tend to flake and pull away from the paperboard substrate. In one embodiment, the polymeric binder will not harden until expansion of the microspheres and/or gases is substantially complete.

The expandable microspheres may comprise thermoplastic, resinous, generally spherical shells containing a liquid blowing agent. The shells of the particles may include a thermoplastic resin derived from the polymerization of, for example, an alkenyl aromatic monomer, an acrylate monomer, a vinyl ester or a mixture thereof. The blowing agent for these particles may include a volatile fluid-forming agent having a boiling point below the softening point of the resinous shell, for example, aliphatic hydrocarbons including ethane, propane, isobutane, pentane, heptane. The particles may expand upon heating to a temperature sufficient to permit plastic flow of the wall and to volatilize at least a portion of the blowing agent sufficiently to provide adequate pressure to form the shell of the particle.

Suitable expandable microspheres are commercially available. Expancel microspheres, which are manufactured by Expancel Inc. of Sundsvall, Sweden, may be used in one embodiment of the present invention. These white, spherical particles have a thermoplastic shell encapsulating isobutane gas. The thermoplastic shell consists of a copolymer of vinylidene chloride and acrylonitrile that softens and expands as the encapsulated gas increases in pressure upon heating.

In the unexpanded form, the microspheres can be made in a variety of sizes; those readily available in commerce being most often on the order of 2 to 20 microns, and may be from about 3 to 10 microns. It is possible to make microspheres in a wider range of sizes, and the present invention can be used with microspheres in these expanded size ranges. Microspheres can vary in size from at least about 0.1 microns to about 1 millimeter in diameter before expansion. While variations in shape are possible, the available microspheres are characteristically spherical, with the central cavity containing the blowing agent being generally centrally located. Dry, unexpanded microspheres typically have a displacement density of just greater than about 1, typically about 1.1. When such microspheres are expanded, they are typically enlarged in diameter by a factor of 5 to 10 times the diameter of the unexpanded beads, giving rise to a displacement density, when dry, of about 0.1 or less. In one embodiment, the dry displacement density is about 0.03 to about 0.06.

Suitable commercially available microspheres include the following supplied by Expancel Inc.: Expancel® 051, Expancel® 053, Expancel® 053-80, Expancel® 091-80, Expancel® 461, Expancel® 461-20, Expancel 642, Expancel® 551, Expancel® 551-20, Expancel® 551-80, Expancel 820 WU, and Expancel® KK; and Micropearl Microspheres F-30, F-50, and F-80 supplied by Matsumoto Yushi-Seivaku Co. These microspheres are also utilized in preparing the bulk-expanded paperboard as shown in U.S. Ser. No. 08/716,511 filed on Sep. 20, 1996, and U.S. Ser. No. 08/896,239 filed on Jul. 17, 1997, and both patent applications are incorporated herein by reference, in their entirety.

The microspheres are optionally coated. The coating should be finely divided enough to be able to effectively blend with and adhere to the surfaces of the microspheres. The maximum major dimension of the particle size should be no larger than about the diameter of the expanded microspheres, and may be less.

While the coating may be either organic or inorganic, there are ordinarily considerable advantages to the employment of inorganic materials as at least a substantial component of the coating. Such materials are commonly available in the dimensions of interest, they are common inclusions along with the microspheres in a wide diversity of foam formulations, they pose few problems in compounding and formulating end uses of the microspheres, and they are generally less expensive. It is also generally easier to assure that the coating does not itself develop undesirable characteristics in the processing, i.e., by becoming tacky itself or the like.

The coating materials are materials which are pigments, reinforcing fillers, or reinforcing fibers in polymer formulations and, thus, are commonly used in the formulations where the microspheres are to be used. For example, talc, barium sulfate, alumina, such as particularly alumina trihydrate, silica, titanium dioxide, zinc oxide, and the like and mixtures of these may be employed. Other materials of interest include spherical beads, or hollow beads, of ceramics, quartz, glass, or mixtures thereof. Among the fibrous materials of interest are glass fibers, cotton flock, carbon and graphite fibers, and the like.

The retention aids used to expand the paperboard can also be coated continuously or discontinuously on the microspheres. The retention aids which function through coagulation, flocculation, or entrapment of the bulk additive can suitably be coated continuously or discontinuously on the microspheres. Mixtures of the coagulation, flocculation, and entrapment agents may be employed. Suitable coagulants coated on the microspheres include inorganic salts such as alum or aluminum chloride and their polymerization products (e.g., PAC or poly aluminum chloride or synthetic polymers); poly(diallyldimethyl ammonium chloride) (i.e., DADMAC); poly(dimethylamine)-co-epichlorohydrin; polyethylenimine; poly(3-butenyltrimethyl ammoniumchloride); poly(4-ethenylbenzyltrimethylammonium chloride); poly(2,3-epoxypropyltrimethylammonium chloride); poly(5-isoprenyltrimethylammonium chloride); and poly(acryloyloxyethyltrimethylammonium chloride). Other suitable cationic compounds having a high charge to mass ratio which can be coated on microspheres include all polysulfonium compounds, such as, for example the polymer made from the adduct of 2-chloromethyl; 1,3-butadiene and a dialkylsulfide, all polyamines made by the reaction of amines such as, for example, ethylenediamine, diethylenetriamine, triethylenetetraamine or various dialkylamines, with bis-halo, bis.-epoxy, or chlorohydrin compounds such as, for example, 1–2 dichloroethane, 1,5-diepoxyhexane, or epichlorohydrin, all polymers of guanidine such as, for example, the product of guanidine and formaldehyde with or without polyamines.

Macromolecules useful for coating the microspheres include cationic starches (both amylose and amylopectin), cationic polyacrylamide such as for example, poly (acrylamide)-co-diallyldimethyl ammonium chloride; poly (acrylamide)-co-acryloyloxyethyl trimethylammonium chloride, cationic gums, chitosan, and cationic polyacrylates. Natural macromolecules such as, for example, starches and gums, are rendered cationic usually by treating them with 2,3-epoxypropyltrimethylammonium chloride, but other compounds can be used such as, for example, 2-chloroethyl-dialkylamine, acryloyloxyethyldialkyl ammonium chloride, acrylamidoethyltrialkylammonium chloride, etc. Dual additives useful for the dual polymer approach coated on the microspheres are any of those compounds which function as coagulants plus a high molecular weight anionic macromolecule such as, for example, anionic starches, CMC (carboxymethylcellulose), anionic gums, anionic polyacrylamides (e.g., poly(acrylamide)-co-acrylic acid, or a finely dispersed colloidal particle (e.g., colloidal silica, colloidal alumina, bentonite clay, or polymer micro particles marketed by Cite Industries as Polyflex). Natural macromolecules such as, for example, cellulose, starch and gums may be used as coatings for microspheres. These coatings are typically rendered anionic by treating them with chloroacetic acid, but other methods such as phosphorylation can be employed.

Retention agents used in entrapment are suitably coated continuously or discontinuously on the microspheres. Suitable coatings include high molecular weight anionic polyacrylamides or high molecular weight polyethyleneoxides (PEO) and a phenolic resin.

Any natural or synthetic thermoplastic polymer can be employed as the resin in the polymeric binder microsphere, glass bead, gas, or a mixture of these compositions, so long as it is liquid at the application temperature and it adheres well to the paperboard substrate after curing. Thermally cross-linkable or thermosettable polymers which react at microsphere expansion temperatures to a cross-linked or thermoset condition may be used. Of course, in all cases where the containers are intended for use with food, the polymeric binder should be FDA approved.

Moisture may be introduced into the paperboard blank in the form of water or preferably as a moistening/lubricating solution which should be allowed to stand and distribute itself throughout the blank before the molding step. When blank stock in roll form is used, as in commercial scale operations, the blank stock is unrolled, coated as described above, wetted, rerolled, and allowed to stand for up to 24 hours or more before die-cutting and molding is undertaken. In one embodiment, the moistening/lubricating solution comprises a polyolefin wax solution which acts both as a lubricant in the making operation and to introduce moisture in the paperboard blank to give the paperboard blank the required plasticity. The polyolefin wax solution may be obtained in the form of a concentrate container up to about 39% by weight polyolefin wax, as well as an ethoxylated surfactant, with the balance water. In one embodiment, this solution will be diluted with about 50 to about 100 parts water to 1 part of the concentrate. The polyolefin wax solution may be applied, for example, by rolling, spraying, or brushing. In another embodiment, a polyethylene wax is used.

The polymeric binder mixture containing microspheres, glass beads, hollow glass beads, gases, or a mixture of these, or just gas, may also include from about 0 to about 0.5 percent by weight on a solids basis and, in one embodiment, about 0.05 to about 0.2 percent by weight on a solids basis, of a rheology modifier for adjusting the viscosity of the composition as it is applied to the paperboard substrate. Suitable rheology modifiers include polymeric thickeners such as, for example, cellulosic thickeners including hydroxyethyl cellulose, carboxymethyl cellulose, associative thickeners such as nonionic hydrophobically modified ethylene oxide/urethane block copolymers, for example, Acrysol RM. 825 (Rohm and Haas Co.), anionic hydrophobically modified alkali soluble acrylic copolymers, for example, Alcogum L-29 (Alco Chemicals), and alginate thickeners such as, for example, Kelgin MV (Kelco Division of Merck and Company, Inc.). Finally, the microsphere/resin mixture may contain a colorant. For example, Notox Ink, which is manufactured by Colorcon, Inc. of West Point, Pa., may be used.

The microsphere/polymeric binder mixture, the gas/polymeric binder mixture, the microsphere/gas polymeric mixture or the glass bead, hollow glass bead binder mixture may be printed on one surface of the paperboard using an offset rotogravure machine. Alternatively, any comparable system which is capable of applying the required high solids and high coat rates may be used. Screen printing is one method for applying the texturized or insulating coating on the paperboard surface. Following application, the paperboard is passed through a dryer such as an infrared dryer heated to from about 200 to about 500° F. and, in one embodiment, from about 225 to about 300° F., for a period sufficient to cure the polymeric binder and expand the microspheres. This may be followed by application of water or a moistening/lubricating solution as described above, which may be accomplished by conventional means such flexographic application, gravure application, spray application or mask application.

All conventional paperboards can be texture printed. To obtain special features, suitable bulk enhanced paperboards may be utilized.

Figure 35:
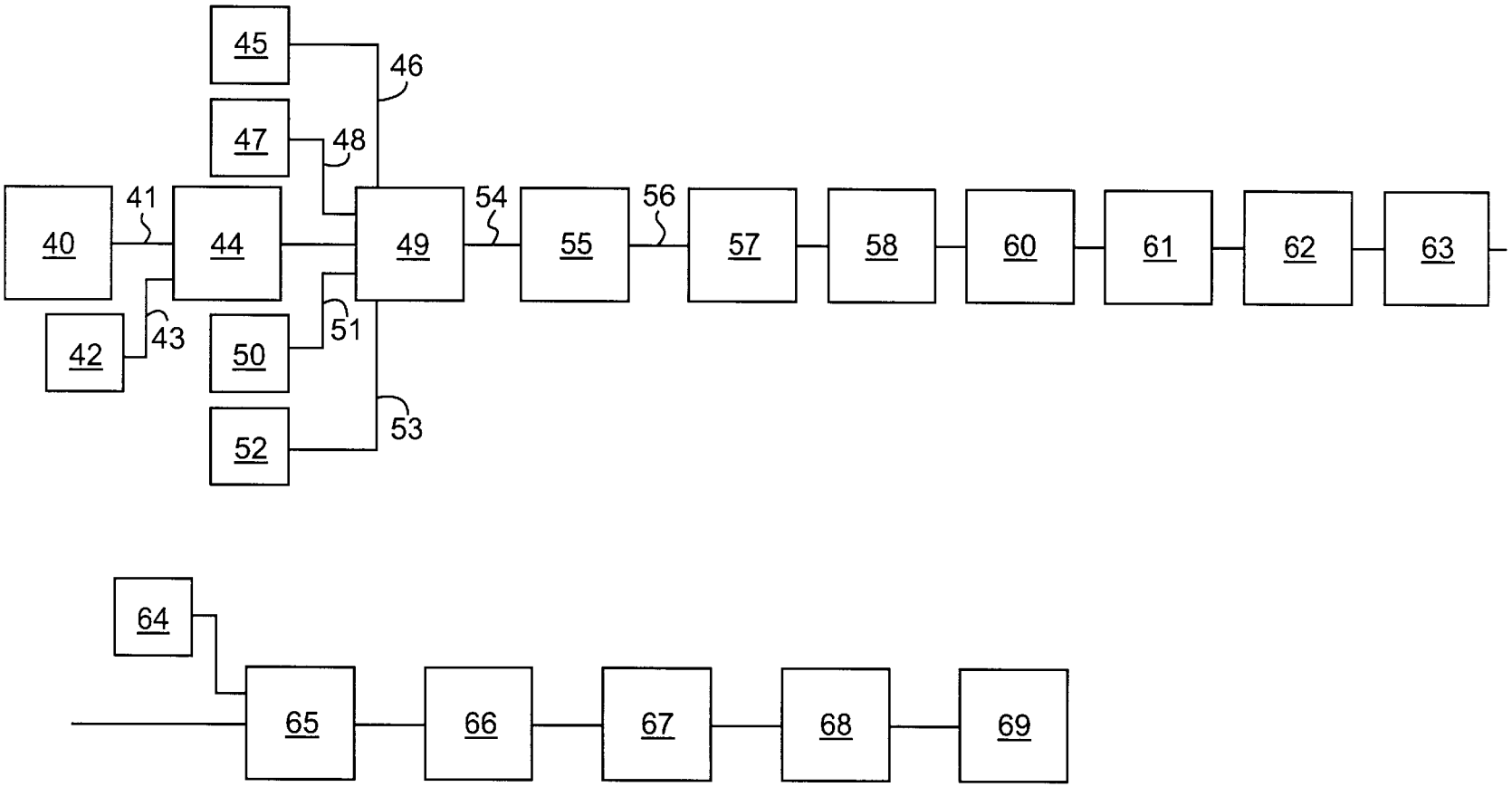
FIGS. 35 and 36 are drawings illustrating an optimum manufacturing process for the containers of this invention.

The cellulosic web may have been subjected to sizing, thereby containing a sizing agent. Any suitable sizing technique known in the art may be used. By way of example, suitable sizing techniques include surface sizing and internal sizing. In FIG. 35 the surface sizing agent is added through line 64 to size press 65. In one embodiment, 0 to about 6 pounds of sizing agent is used for each three thousand square foot ream for paperboards having a fiber mat density of at least about 3 to at least about 9 pounds per 3000 square foot ream at a fiberboard thickness of 0.001 inches. For paperboards having a fiber mat density of at least about 3 to at least about 9 pounds per 3000 square foot ream at a fiberboard thickness of 0.001 inches, about 1 to about 30 pounds of surface sizing may be added to a three thousand square foot ream. In one embodiment, for paperboards having a fiber mat density of greater than about 8.3 for each 3000 square foot ream at a board thickness of 0.001 inches, about 6 to about 30 pounds of surface sizing agent may be added for each three thousand square foot ream. In one embodiment, about 15 to about 30 pounds of surface sizing agents are added for each 3000 square foot ream. In another embodiment, about 16 to about 19 pounds of the surface sizing agent is added for each 3000 square foot ream. The sizing agent functions to keep the GM tensile stiffness of the paperboard within the required parameters. By way of example, suitable surface sizing agents include starch, starch latex copolymers, animal glue, methyl cellulose, carboxymethyl cellulose, polyvinyl alcohol, and wax emulsions. By way of example, suitable commercially available sizing agents containing starch include "PENFORD® GUMS 200," "PENFORD® GUMS 220," "PENFORD® GUMS 230," "PENFORD® GUMS 240," "PENFORD® GUMS 250," "PENFORD® GUMS 260," "PENFORD® GUMS 270," "PENFORD® GUMS 280," "PENFORD® GUMS 290," "PENFORD® GUMS 295," "PENFORD® GUMS 300," "PENFORD® GUMS 330," "PENFORD® GUMS 360," "PENFORD® GUMS 380," "PENFORD® GUMS PENCOTE," "PENFORD® GUMS PENSPRAE® 3800," "PENFORD® GUMS PENSURF," "PENGLOSS®" "APOLLO® 500," "APOLLO® 600," "APOLLO® 600-A," "APOLLO® 700," "APOLLO® 4250," "APOLLO® 4260," "APOLLO® 4280," "ASTRO® GUMS 3010," "ASTRO® GUMS 3020," "ASTROCOTE® 75," "POLARIS® GUMS LV," "ASTRO®×50," "ASTRO®×100," "ASTRO®×101," "ASTRO®×200," "ASTRO® GUM 21," "CALENDER SIZE 2283," "DOUGLAS®-COOKER 3006," "DOUGLAS®-COOKER 3007," "DOUGLAS®-COOKER 3012-T," "DOUGLAS®-COOKER 3018," "DOUGLAS®-COOKER 3019," "DOUGLAS®-COOKER 3040," "CLEARSOL® GUMS 7," "CLEARSOL® GUMS 8," "CLEARSOL® GUMS 9," CLEARSOL® GUMS 10," "DOUGLAS®-ENZYME 3622," "DOUGLAS®-ENZYME E-361 0," "DOUGLAS®-ENZYME E-3615," "DOUGLAS®-ENZYME 3022," "DOUGLAS®-ENZYME 3023," "DOUGLAS®-ENZYME 3024," "DOUGLAS®-ENZYME E," "DOUGLAS®-ENZYME EC," "CROWN THIN BOILING X-10," "CROWN THIN BOILING X-18," "CROWN THIN BOILING XD," "CROWN THIN BOILING XF," "CROWN THIN BOILING XH," "CROWN THIN BOILING XJ," "CROWN THIN BOILING XL," "CROWN THIN BOILING XN," "CROWN THIN BOILING XP," "CROWN THIN BOILING XR," "DOUGLAS®-UNMODIFIED PEARL," and "DOUGLAS®-UNMODIFIED 1200." These sizing agents are all commercially available from Penford Products Co. "PENFORD®," "PENCOTE®," "PENSPRAE®," "PENGLOSS®," "APOLLO®," "ASTRO®," "ASTROCOTE®," "POLARIS®," "DOUGLAS®," and "CLEARSOL®" are all registered trademarks of Penford Products Co. Other suitable starches, including "SILVER MEDAL PEARL™," "PEARL B," "ENZO 32 D," "ENZO 36W," "ENZO 37D," "SUPERFILM 245D," "SUPERFILM 270W," "SUPERFILM 240DW ," "SUPERFILM 245D," "SUPERFILM 270W," "SUPERFILM 280DW," "PERFORMER 1," "PERFORMER 2," "PERFORMER 3," "CALIBER 100," "CALIBER 110," "CALIBER 124," "CALIBER 130," "CALIBER 140," "CALIBER 150," "CALIBER 160," "CALIBER 170," "CHARGE+2," "CHARGE+4," "CHARGE+7," "CHARGE+9," "CHARGE+88," "CHARGE+99," "CHARGE+110," "FILMFLEX 40," "FILMFLEX 50," "FILMFLEX 60," and "FILMFLEX 70" are all commercially available from Cargill, Inc.

In the process for the manufacture of paperboard suitable for use in the paperboard containers of this invention, the usual conventional papermaking fibers are suitable and the bulk enhanced paperboards may be used. Softwood, hardwood, chemical pulp obtained from softwood and/or hardwood chips liberated into fiber by sulfate, sulfite, sulfide or other chemical pulping processes may be used. Mechanical pulp may be obtained by mechanical treatment of softwood and/or hardwood. Recycled fiber and other refined fiber may suitably be utilized in the paperboard manufacturing process.

Papermaking fibers used to form the high bulk paperboard useful for the manufacture of texture coated paperboard containers of the present invention include cellulosic fiber commonly referred to as wood pulp fibers, liberated in the pulping process from softwood (gymnosperms or coniferous trees) and hardwoods (angiosperms or deciduous trees). The particular tree and pulping process used to liberate the tracheid are not critical. Cellulosic fibers from diverse material origins may be used to form the web including cottonwood and non-woody fibers liberated from sabai grass, rice straw, banana leaves, paper mulberry (i.e., bast fiber), abaca leaves, pineapple leaves, esparto grass leaves, and fibers from the genus *Hesperaloe* in the family *Agavaceae*. Also recycled fibers which may contain any of the above fiber sources in different percentages can be used in the manufacture of the paperboard.

Papermaking fibers can be liberated from their source material by any one of the number of chemical pulping processes familiar to one experienced in the art including sulfate, sulfite, polysulfite, soda pulping, etc. The pulp can be bleached if desired by chemical means including the use of chlorine, chlorine dioxide, oxygen, hydrogen peroxide, etc. Furthermore, papermaking fibers can be liberated from source material by any one of a number of mechanical/chemical pulping processes familiar to anyone experienced in the art including mechanical pulping, thermomechanical pulping, and chemi-thermomechanical pulping. These mechanical pulps can be bleached, if one wishes, by a number of familiar bleaching schemes including alkaline peroxide and ozone bleaching.

Generally, in our process the range of hardwood to softwood varies from 0 to 100% to 100 to 0%. In one embodiment, the range for hardwood to softwood is about 20 to about 80 to about 80 to about 20. In another embodiment, the range of hardwood comprises about 40 to about 60 percent of the furnish and the softwood comprises about 60 to about 40 percent of the furnish.

Figure 36:
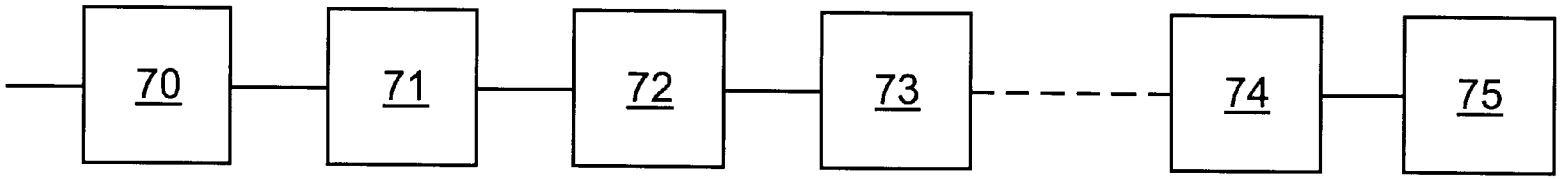

In FIGS. 35 and 36 it is shown how a representative paperboard is manufactured and a textured and/or insulated paperboard prepared therefrom. In FIG. 35 it is shown that feedstock is pumped into the mix box 40. Alum and other internal sizing agents are added to the feedstock along line 41 prior to it being pumped into the machine chest (44). Optionally a wet strength agent such a Parez or Kymene is added to the feedstock through line (43) at the machine chest (44). Suitable wet strength agents are nitrogen containing polyamides. For food service products, if the food comes in contact with the wet strength agent, it has to be approved by the FDA. Representative polyamides are listed in European Patent Application 91850148.7 relating to polyamide epichlorohydrin (PAE) wet strength resins and that patent application is incorporated herein by reference. Parez 631 NC which is a glyoxylated polyacrylamide is a suitable wet strength agent. In the stuff box (49) starch is charged through line (46), and optionally blue dye is charged through line (48); for pH control, a base such as caustic is charged through line (51) for bulk enhanced paperboard a retention aid is charged through line (53). For regular paperboards, no retention aid or bulk additive is utilized. The cationic starch is added through line (54) and prior to the cleaners (55). The bulk enhancing additive is optionally added after the mixture has been cleaned at the cleaners (55) and prior to the time it has reached the screens (57). The embryonic paperboard web is formed on the fourdrinier wire (58). The water is removed through a water removal apparatus (60). Initially the water is removed from the bottom side of the sheet through the fourdrinier table and from the top side of the web through the BelBond vacuum system. The web is heated with steam through steam showers (61), and the paperboard web is pressed in the press section (62) and dried in the dryer sections (63). Starch is supplied through line 64 to the size press (65). The web is passed through calender stacks (66) to smooth the web. Coating section (67) represents one to six coaters. The binder and optionally pigment is coated on both sides of the paperboard. Usually about three to six coatings are provided. For paper cup and related applications, usually the paperboard is not coated. The coated or uncoated paperboard is calendered in the gloss calender (68) and rolled on the reel (69). Referring to FIG. 36, the paperboard is placed in a printing press (70) to print the textured coating on one side. Suitably a rotogravure press, flexopress, lithopress or screen printing is utilized. Two to eight colors may be printed on the reel. The printed reel is placed in a coater (71) where optionally two plate coatings are applied. Optionally, the reeled web is suitably moistened in a wetting applicator (72) (Dahlgren Press). The moistened web is wound onto a reel (73). The paperboard from reel (73) is fed into the die press (74) where the paperboard is scored and cut. This blank is fed into the die (75) which is capable of forming the desired articles of manufacture such as cups, FIGS. 25, 26, and 41; plates, FIG. 18; compartmented plates, FIG. 21; bowls, FIG. 19; canisters, FIG. 20; French fry sleeves, FIG. 22; hamburger clam shells, FIG. 24; rectangular take-out containers, FIG. 23; food buckets, FIG. 27; and other consumer products including cartons and folding paper boxes. A moistened web is utilized in the manufacture of articles which require significant deformation of the board. Representative articles requiring significant deformation of the board are plates and bowls shown in FIGS. 15, 18, and 19.

The paperboard material may be texture and/or insulation coated on one side and suitably on the other side insulated with a useful coating polymer prior to formation of the paperboard shells used in forming the containers in accordance with the present invention. Polymers suitable for this purpose are polymers having a melting point below 270° C. and having a glass transition temperature ($T_g$) in the range of about −150° to about +120° C. Suitable polymers are polyolefins such as polyethylene arid polypropylene, nitrocellulose, polyethylene terephthalate, Saran and styrene acrylic acid copolymers. Representative coating polymers include methyl cellulose, carboxymethyl cellulose acetate copolymer, vinyl acetate copolymer, styrene butadiene copolymer, and styrene-acrylic copolymer. The preferred polymer is a high density polyethylene for cups and other articles of manufacture.

As noted hereinabove, an additional means in aiding in the passing of the paperboard material into the forming die is the addition of a lubricant to the polyolefin or polyethylene coating which is applied to the paperboard material. By adding such lubricant, the leading edge of the paperboard material will not be prematurely caught in the forming die and thus permitted to pass completely into the forming die before the initial buckling takes place. It should also be noted that a lubricant may also be applied to the forming die itself.

In conventional containers, polyolefin coating, suitably polyethylene coating is applied to the paperboard material by way of an extruder and it is generally desired that the polyolefin or polyethylene coating adhere to the paperboard material. In one embodiment of the present invention, the polyolefin coating is not the outer coating. Polyolefins may be used as inner coatings or in the middle of the board coated further with another coating. In the paperboard and containers of this invention, the outer coating may be a printed, textured, or insulation coating including one or more of the following: microspheres, gases, glass beads, hollow glass beads, and mixtures of one or more of these. To assist in adherence of the polyolefin to the paperboard, one of three methods are generally used. These methods being one of a corona treatment, flame treatment, or polyethylene imine treatment, better known in the art as a PEI treatment. Optionally the paperboard material is subjected both to a PEI treatment and a flame treatment in accordance with the present invention. This allows the lubricant containing polyolefin or polyethylene coating to adhere to the paperboard material resulting in a paperboard shell which passes further into the forming die when urged thus aiding in the control of the initial buckling point during formation of the brim curl in cups and other articles of manufacture having brims. In one embodiment, the containers of this invention have a printed, registered, textured or insulated, outer coating comprising a binder and texturizing or insulation agents selected from microspheres, gases, glass beads, hollow glass beads, or a mixture of these. In the textured printed containers of this invention, the polyolefin is coated on the inside surface of the container and the textured coating is printed on the outside surface of the container.

Figure 28A:
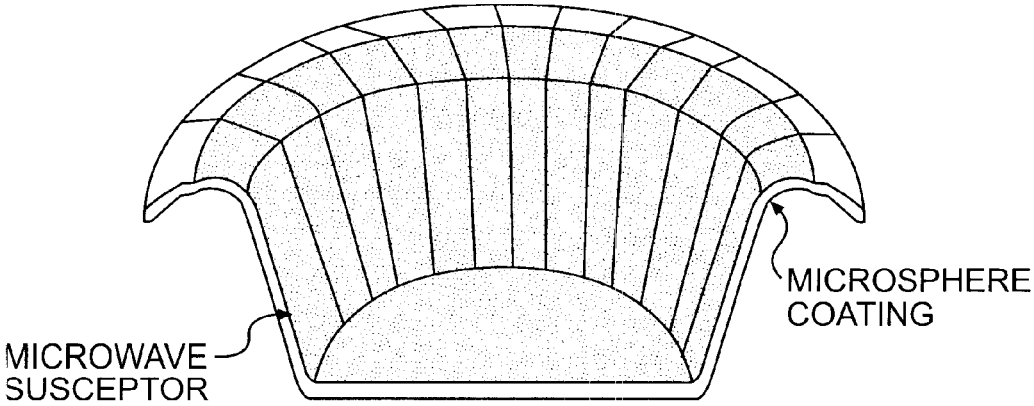
FIG. 28 is a drawing of a texture coated bowl with microwave susceptors.
Figure 28B:
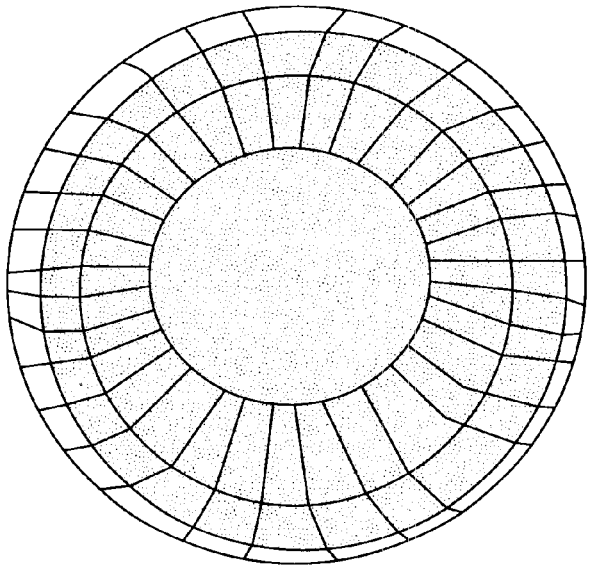
Figure 29:
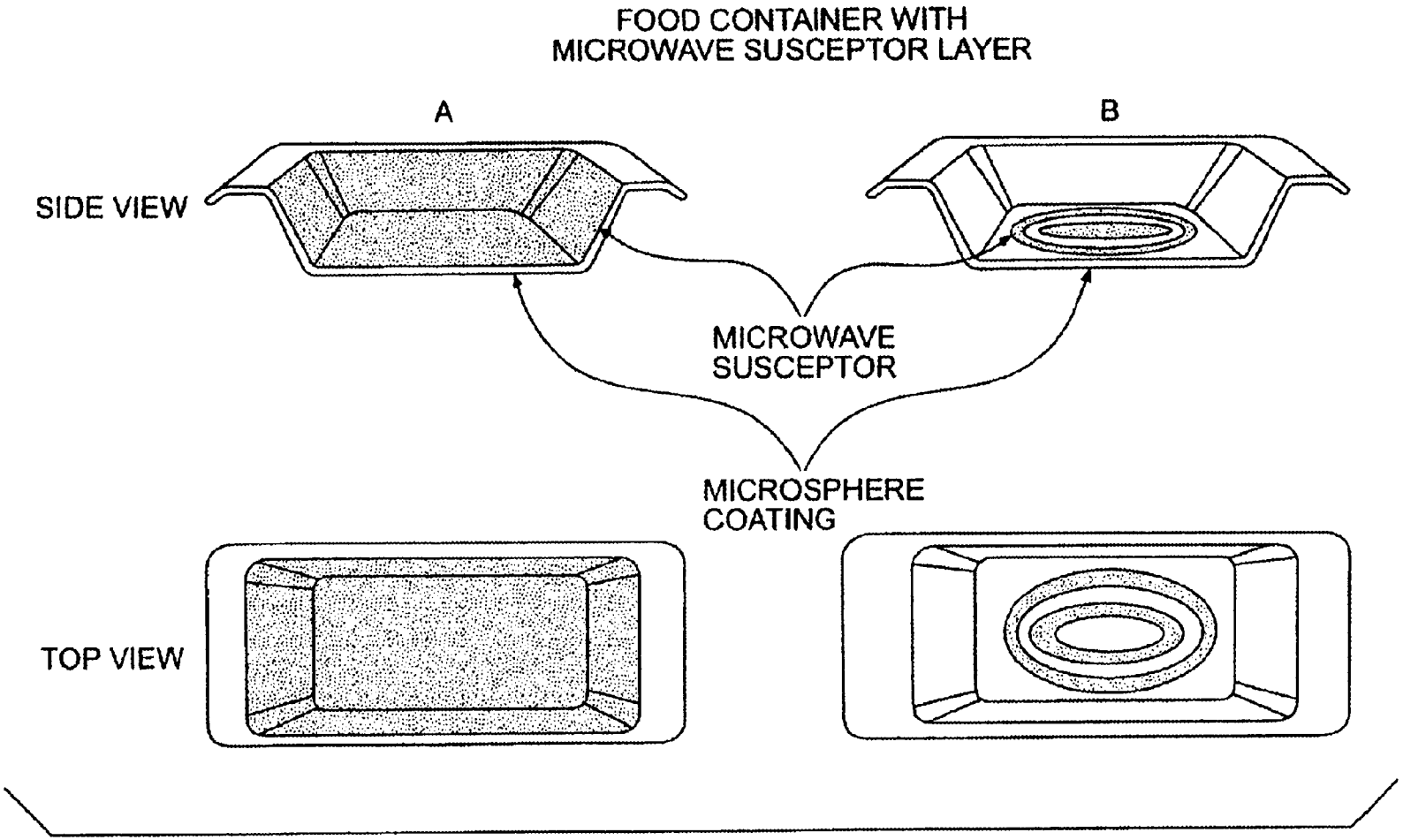
FIG. 29 is a drawing of a texture coated food container with microwave susceptors.

Conveniently for microwave applications as shown in FIGS. 28 and 29, a microwave susceptor layer is laminated on top of the paperboard substrate on which a pigment has been coated. The microwave susceptor layer may comprise alumina and polyester compositions. In one embodiment, polyethylene terephthalate is used as the microwave susceptor layer. In another embodiment, THERMX™ copolyester PCIA 6761 resin is used. The films in general may be metalized polyesters, wherein the metal is aluminum. For non microwave applications one or both sides of the paperboard including any pigment layers may be coated with polyolefins such as polyethylene, and polypropylene or polyesters such as polyethylene terephthalate. On top of the polyolefin layer it may be desirable to insert an aluminum foil type layer which either is directly in contact with the liquid in a container or is covered with a polyolefin layer. Products of this type are useful as juice containers.

The cooking of food and heating of substances with microwave radiation has become increasingly popular and important in recent years because of its speed, economy, and low power consumption. With food products, however, microwave heating has drawbacks. One of the major drawbacks is the inability to brown or sear the food product to make it similar in taste an appearance to conventionally cooked food.

One method involves the use of a metalized coating on paperboard. In this method, metal particles are vacuum deposited onto a film, in one embodiment a polyester film. The film is then laminated onto the paper. The thus metalized paper typically should then be positioned onto a particular part of the food package requiring a windowing operation. The windowing operation requires that the metalized paper be slit before entering the process.

A microwave interactive coating which is capable of being printed on a substrate is also suitable. This coating overcomes the problems inherent in vacuum deposited metal coatings because the coatings can be printed exactly where they are required. Furthermore, coating patterns, coating formulations, and coating thicknesses can all be varied using conventional printing processes. A printing process also allows the use of materials besides metals as microwave reactive materials, as well as providing the possibility for a wide range of heating temperatures and a wide variety of applications.

The microwave interactive printable coating composition comprises a microwave reactive material selected from a conductor or semiconductor, a dielectric, or a ferromagnetic, and a binder.

The microwave interactive printable coating is coated onto a film which is further laminated to a microwave transparent substrate.

In another embodiment, a method of manufacturing a microwave interactive coated substrate is provided. This substrate comprises coating a substrate using a conventional printing process with a microwave interactive printable coating composition comprising a microwave reactive material selected from a conductor or semiconductor, a dielectric, or a ferromagnetic, and a binder.

Microwave reactive materials (MRM) are capable of converting microwave energy to heat. This is accomplished using either the conductive or semiconductive properties, dielectric properties, or ferromagnetic properties of the microwave reactive materials. The materials having these properties will hereafter be referred to as conductors, semiconductors, dielectrics, or ferromagnetics.

The microwave reactive materials included within the scope of this invention include any material which has suitable conductive or semiconductive, dielectric or ferromagnetic properties so that the material is capable of converting microwave radiation to heat energy. The materials can have any one of the above properties or can have a combination of the above properties. Furthermore, the properties of the substrate on which the material is coated, such as the orientation, heat set temperature, and melting point, as well as the adhesion between the coating and the substrate will affect the reactiveness of the materials to microwave energy.

The type and amount of microwave reactive materials used in the coating composition generally determines the degree of interaction with the microwaves and hence the amount of heating. In a preferred embodiment where the material used is conductive, the amount of heat generated is a function of the product of the conductivity of the material and the thickness of the material. In one aspect of this embodiment, when the microwave reactive material is carbon, the microwave reactive material combined with binder will preferably have a resistivity ranging from about 50 ohms per square inch to about 10,000 ohms per square inch. The microwave operations are usually conducted at temperatures in excess of 212° F., usually at temperatures of about 212° F. to about 500° F.

Generally, any metal, alloy, oxide, or any ferrite material which has microwave reactive properties as described above can be used as a microwave reactive material. Microwave reactive materials include suitable compositions comprising aluminum, iron, nickel, copper, silver, carbon, stainless steel, nichrome, magnetite, zinc, tin, iron, tungsten, titanium, and the like. The materials can be used in a powder form, flake form, or any other finely divided form which can be suitably used in printing processes. The microwave reactive materials can be used individually or can be used in combination with other microwave reactive materials.

In one embodiment, the microwave reactive material may be suitable for food packaging. Alternatively, the microwave reactive material may be separated from the food by a film or other protective means.

In one embodiment, the microwave reactive materials demonstrate rapid heating to a desired temperature, with subsequent leveling off of the temperature, without arcing during the material's exposure to microwave radiation. The temperature at which the microwave reactive material levels off is hereinafter referred to as the operating temperature. Generally, the microwave reactive material will operate at a temperature ranging from about 212° F. to about 480° F.

The microwave reactive material is combined with a binder to form a coating composition. Any binder listed in this application is suitable. The binder should have good thermal resistance and suffer little or no degradation at the temperatures generated by the microwave reactive material. It may also have an adhesive ability which will allow it to adhere to the substrate.

In one embodiment of this invention, the microwave reactive material coated substrate shrinks during the heating process at a controlled rate so that the temperature of the coating rises rapidly and then remains at a constant level. In this embodiment the binders chosen may be adhesive enough to bind the microwave reactive material to the substrate during the treatment with microwave energy.

The binder and the microwave reactive material may be generally combined in a suitable ratio such that the microwave reactive material, in the form of a thin film, can convert the microwave radiation to heat to raise the temperature of a food item placed thereon, yet still have sufficient binder to be printable and to adhere to the film. There should also be sufficient binder present to prevent arcing of the microwave reactive material.

Generally, the ratio of the microwave reactive material to binder, on a solids basis, will depend upon the microwave reactive material and binder chosen. In one embodiment where the microwave reactive material is nickel, the microwave reactive material to binder ratio, on a weight basis, may be about 2:1 or higher.

Other materials can be included in the coating composition such as surfactants, dispersion aids, and other conventional additives for printing compositions. The coating can be applied using conventional printing processes such as rotogravure, flexography, and lithography. After the coating composition has been applied, it can be dried using conventional printing ovens normally provided in a printing process.

Generally, any amount of coating can be used. The amount of heat generated will vary according to the amount and type of coating applied to the substrate. In a suitable embodiment, when the coating material is nickel, the amount of coating will range from about 3 to about 11 pounds per 3000 square foot ream.

The coating composition is coated upon the paperboard of this invention or any suitable film material which does not melt at temperatures of about 212° F. to about 500° F. and is attached to the paperboard of this invention.

A desirable feature for the microwave reactive coated substrates is that the substrate should either shrink during the heating process at a controlled rate or in some other manner the interparticle network of the coating should be disrupted so that the temperature of the coating rises rapidly and then remains at a constant level.

In one embodiment of this invention, the coating composition is printed onto an oriented film. The film may be selected from any known films such as polyesters, nylons, polycarbonates, and the like. The film may generally be shrinkable at the operating temperatures of the microwave reactive material, but any film material which shrinks can be used. The film may also have a melting point above the operating temperature of the microwave reactive material, but any film material which shrinks can be used. The film should also have a melting point above the operating temperature of the microwave reactive material. That is, it should melt above 212° F. to about 500° F. One class of films acceptable for use with this invention includes oriented polyester films such as Mylar®.

The thus coated film may then be applied to a microwave transparent bulk enhanced paperboard of this invention. The substrate may also be dimensionally stable at the operating temperature of the microwave reactive material. Suitable substrates are paperboards of this invention.

The film is attached to the substrate using conventional adhesives. The adhesives used should be able to withstand heating temperatures within the operating range of the microwave reactive material that is a temperature of about 212° F. to about 480° F. The adhesive should also be able to control the rate at which the film shrinks.

In one embodiment, suitable microwavable packages comprise a dielectric substrate substantially transparent to microwave radiation having at least a portion of at least one surface thereof coated with a coating composition comprising a dielectric polymeric matrix having incorporated therein (a) particles of a microwave susceptor material; and (b) particles of a blocking agent.

In general, the dielectric substrate may be any material having sufficient thermal and dimensional stability to be useful as a packaging material at the high temperatures which may be desired for browning or rapidly heating foods in a microwave oven (e.g., at temperatures in excess of 212° F.). Useful substrates include polymeric terephthalate films as well as polymethylpentene films and films of other thermally stable polymers such as polyacrylates, polyamides, polycarbonates, polyetherimides, polyimides, and the like.

The dielectrical properties at 915 megahertz and 2450 megahertz of the matrix formed by the deposition of the polymeric material upon the packaging substrate is an important variable in terms of the heat generated in unit time at 2450 MHz. Specifically, the dielectric matrix should, in general, possess a relative dielectric constant of between about 2.0 and about 10, possibly between about 2.1 and about 5, and should generally possess a relative dielectric loss index of between about 0.001 and about 2.5, possibly between about 0.01 to about 0.06. The matrix may also display adhesive characteristics to the substrate, i.e., the bulk enhanced paperboard of this invention, as well as to any additional substrate to which the composite may be laminated to increase dimensional stability. The microwave susceptor materials employed may include any materials which are capable of absorbing the electric or magnetic portion of the microwave field energy and converting that energy into heat. Suitable materials include metals such as powdered nickel, antimony, copper, molybdenum, bronze, iron, chromium, tin, zinc, silver, gold, and aluminum. Other conductive materials such as graphite and semi-conductive materials such as silicon carbides and magnetic material such as metal oxides (if available in particulate form) may also be utilized. Suitable susceptor materials include alloys of copper, zinc, and nickel sold under the designation SF-401 by Obron; as well as leafing aluminum powder.

Suitable susceptor materials employed may be in particulate form. Such particles may be flakes or powders. The size of such particles will vary in accordance with a number of factors, including the particular susceptor material selected, the amount of heat to be generated, the manner in which the coating composition is to be applied, and the like.

Typically, however, when such coating compositions are to be applied in the form of inks, due to limitations of the printing processes, such powders should have diameters of no more than about 50 microns. In general, in such circumstances, particle sizes of between about 0.1 and about 25 microns may be employed. When the susceptor materials are employed in the form of flakes (e.g., such as in the form of leafing aluminum), such flakes are typically of those sizes of flakes routinely used in the gravure ink art for the printing of metallic coatings.

In one embodiment, a suitable blocking agent employed comprises at least one member of the group consisting of calcium salts, zinc salts, zinc oxide, lithopone, silica, and titanium dioxide. In particular, suitable blocking agents may include calcium carbonate, calcium sulfate, zinc oxide, silica, and titanium dioxide, and calcium carbonate.

Suitable blocking agents may be employed in particulate form. The particle size of such blocking agents is generally limited by the particular coating process employed, and when such coating is applied in the form of an ink, such particle size is typically less than about 50 microns. In one embodiment, particle sizes of between about 0.1 and about 25 microns are used for most blocking agents. When calcium carbonate is employed as the blocking agent, particle sizes of between about 1 and about 10 microns may be used, and in one embodiment, particle sizes of between about 3 and about 7 microns may be used.

It is believed that the presence of such blocking agents control the amount of heat generated by the susceptor material. By controlling the ratio and amount of blocking agent and susceptor, and/or by varying the thickness of the ink applied, the amount of heat generated by a pre-selected dosage of microwave radiation may be consistently controlled within a pre-selected range. In applications contemplated by this invention, the temperature will be in excess of 212° F.

Variables which may be taken into account for determining the precise ratios of susceptor to blocking agent needed for any particular use include the physical size, shape, and surface characteristics of the susceptor and blocking agent particles contained in the coating composition, the amount of coating composition to be applied to the bulk enhanced paperboard of this invention, and the portion size, as well as the food to be cooked in such application. By so altering these variable as well as the susceptor:blocking agent ratio employed, one of ordinary skill can easily regulate the compositions utilized herein to heat to high temperatures in a controlled manner in relatively short periods of time in conventional microwave ovens, e.g., to temperatures above 212° F. in 120 seconds when subjected to microwave energy generated in dosages typically produced by such ovens, e.g., at 550 watts at 2450 megahertz.

The susceptor level in the matrix will generally range from about 3 to about 80% by weight of the combined susceptor blocking agent/matrix composition. As noted above, the optimum levels of susceptor material and of blocking agent incorporated into the coating compositions will depend upon a number of factors, depending upon the ultimate end use employed. However, it has been found that, in many instances, weight ratio of about 1:4 or more of blocking agent:susceptor material will effectively prevent heating of the coating composition when subjected to dosages of microwave radiation generated by conventional microwave ovens. Lower ratios of blocking agent to receptor material may result in higher temperatures.

One of ordinary skill in the art can easily determine optimum ratios for any particular application using routine experimentation.

In addition to the blocking agent, polymeric material liquid carrier and susceptor material the coating composition in the microwavable package may optionally contain other conventional additives such as surface modifiers such as waxes and silicones, antifoam agents, surfactants, colorants such as dyes and pigments and the like, which additives are well known to those of ordinary skill in the art.

Suitable microwavable packaging ink composition may comprise a liquid carrier having dispersed or dissolved therein (A) a matrix-forming dielectric polymeric material substantially transparent to microwave radiation; (B) particles of a susceptor material; and (C) particles of a blocking agent.

The liquid carriers which may be employed include those organic solvents conventionally employed in the manufacturing of ink as well as water and mixtures of one or more of the foregoing. Illustrative of such solvents are liquid acetates such as isopropyl acetate and the like; alcohols such as isopropanol, butanol, and the like; ketones such as methyl ethyl ketone and the like. In one embodiment, solvents may include water, isopropyl acetate, and mixtures of isopropyl acetate.

The paperboard used in the manufacture of the texture and/or insulation coated paperboard containers of this invention may be suitably coated with a binder and an inorganic or organic pigment. The binder may be selected from the group consisting of aliphatic acrylate acrylonitrite styrene copolymers, n-butyl acrylate acrylonitrile styrene copolymer, n-amyl acrylate acrylonitrile styrene copolymer, n-propyl acrylate acrylonitrile styrene copolymer, n-ethyl acrylate acrylonitrile styrene copolymer, aliphatic acrylate styrene copolymers, n-butyl acrylate styrene copolymers, n-amyl acrylate styrene copolymer, n-propyl acrylate styrene copolymer, n-ethyl acrylate styrene copolymer, cationic starch, anionic starch, amphoteric starch, starch latex copolymers, animal glue, gelatin, methyl cellulose, carboxymethylcellulose, polyvinyl alcohol, ethylene-vinyl acetate copolymer, vinyl acetate-acrylic copolymer, styrene-butadiene copolymer, ethylene-vinyl chloride copolymer, vinyl acetate polymer, vinyl acetate-ethylene copolymer, acrylic copolymer, styrene-acrylic copolymer, stearylated melamine, hydrophilic epoxy esters and mixtures of these. The pigment may be selected from the group consisting of a clay, chalk, barite, silica, talc, bentonite, glass powder, alumina, titanium dioxide, graphite, carbon black, zinc sulfide, alumina silica, calcium carbonate and mixtures of these.

Figure 41:
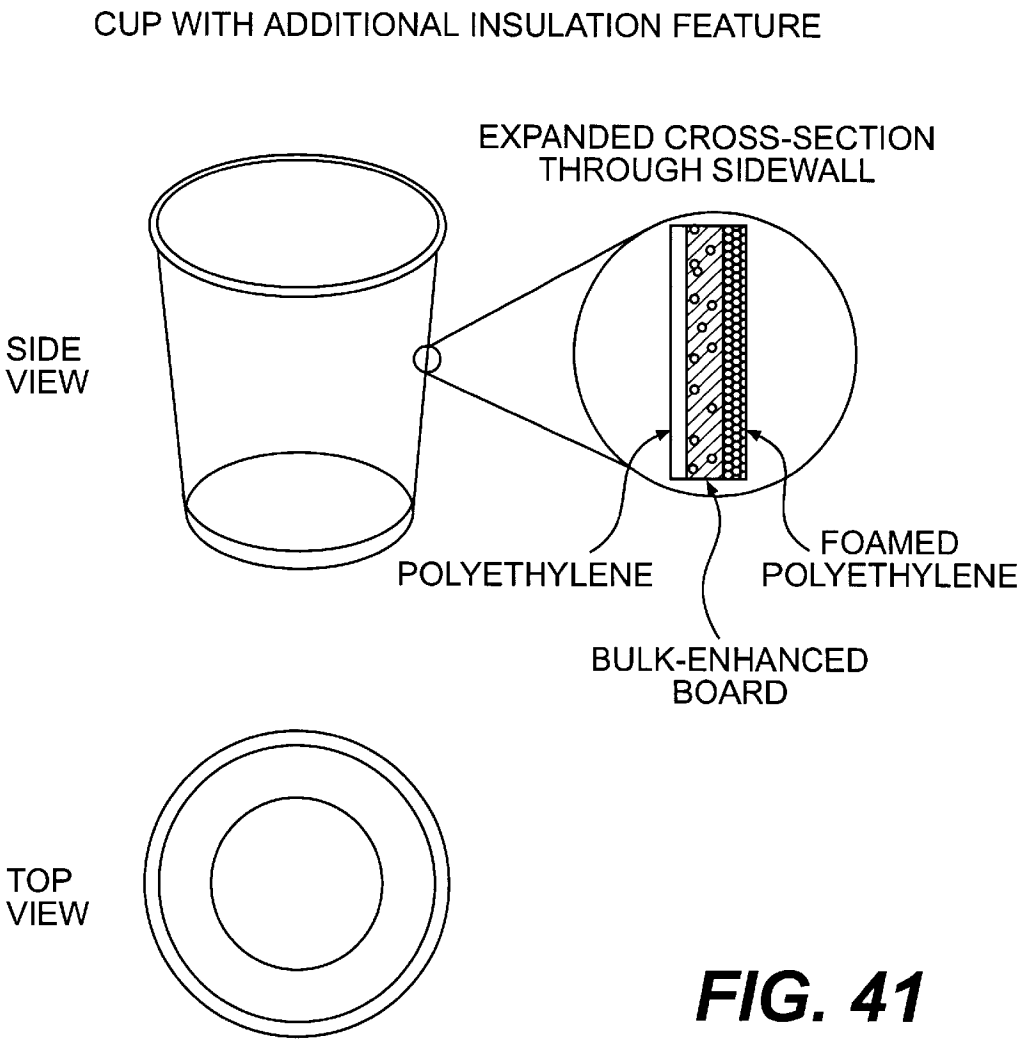
FIG. 41 is a drawing of a heat insulating cup having on its wall surface a foamed layer of thermoplastic film.

In another embodiment of this invention, heat insulating containers, such as cups, are produced as shown in FIG. 41. A paper composite container comprising a body member comprising an inner and an outer surface and a bottom panel member, wherein at least one surface of the container body wall may be suitably coated or laminated with a thermoplastic synthetic resin film. Suitable synthetic resins are polyolefins such as high and low density polyethylenes, polypropylenes, and polyethylene polypropylene copolymers. The other surface of the body wall may be suitably coated or laminated with a thermoplastic synthetic resin film utilized in coating the first surface or an aluminum foil. In one embodiment, both surfaces of the body wall may be laminated or coated with some material, in order to avoid direct escape of moisture from the paperboard into atmosphere when fabricated container is heated.

The heat-insulating paperboard container may be prepared by blanking a container body member from a paperboard sheet of this invention, one surface of which may be coated or laminated with a thermoplastic synthetic resin film, and the other surface of which may be coated or laminated with the same or different thermoplastic synthetic resin film or an aluminum foil and blanking a container bottom member from this paperboard sheet or another paperboard sheet having no lamination or coating and then fabricating them into a paperboard container using a conventional cup-forming machine and heating the so-fabricated paperboard container to foam the film coating or lamination.

A paperboard container having one surface of the body member laminated or coated with the thermoplastic film and the other surface coated or laminated with the same or different thermoplastic film or an aluminum foil may be prepared by other methods, for example, as disclosed in U.S. Pat. No. 3,390,618, a container body member is blanked out from a sheet one surface of which is coated or laminated with a thermoplastic synthetic resin film or an aluminum fill and a container bottom panel member is blanked out from this sheet to another sheet having no film or foil. The paperboard container may be fabricated into container by using a conventional cup-forming machine so that the coated surface faces outward. A thermoplastic synthetic resin film which has been softened by heating is positioned in the opening of the container and the film is drawn by applying suction to line the inner surface of the container.

The thermoplastic synthetic resin layer of the so-manufactured container may be then heated to foam it and form a heat-insulating layer on the wall surface of the container.

Alternatively, as taught by U.S. Pat. No. 4,206,249, a paper container may be fabricated from a body member and bottom panel member blanked out from a sheet having no thermoplastic synthetic resin film or other layer. The inner and outer surfaces of the container are coated with a prepolymer of thermoplastic synthetic resin by spraying it and then the prepolymer is cured by applying ultra-violet rays to form a film in situ. The film on the wall surfaces of the so-formed paper container is then heated to foam it and form a heat-insulating layer on the wall surfaces.

Alternatively, a heat-insulating paper container of this invention may be prepared as follows:

(i) a body blank is cut out from a paperboard sheet of this invention one surface of which is coated or laminated with a thermoplastic synthetic resin film and the other surface of which is coated or laminated with the same or different thermoplastic synthetic film or an aluminum foil and then heated to foam the thermoplastic synthetic resin film to thereby form a heat-insulating layer, or alternatively, said sheet is heated to foam the thermoplastic synthetic resin film, and a body blank having a foamed heat-insulating layer is cut out from the heated sheet;

(ii) a bottom blank is cut out from a paperboard sheet of this invention at least one surface of which is coated or laminated with a thermoplastic synthetic resin film or an aluminum foil or one surface of which is coated or laminated with a thermoplastic synthetic resin film and the other surface of which is coated or laminated with the same or different thermoplastic synthetic resin film or an aluminum foil or which is neither coated nor laminated with such materials, and then said blank is optionally heated. If the sheet has the thermoplastic synthetic resin film or alternatively a paper sheet, one surface of which is coated or laminated with a thermoplastic synthetic resin film and the other surface of which is coated or laminated with the same or different thermoplastic synthetic resin film or an aluminum foil, is optionally heated to foam the thermoplastic synthetic resin film to thereby form a heat-insulating layer, and a bottom blank having a foamed heat-insulating layer is cut out from the heated sheet; and (iii) the body blank having a heat-insulating layer on at least one surface and the bottom blank having or not having a heat-insulating layer are then fabricated into a heat-insulating paper container with a conventional cup-making machine.

Thermoplastic synthetic resin films which may be used in this invention include polyethylene, polypropylene, polyvinyl chloride, polystyrene, polyester, nylon and the like. The term "polyethylene" includes low, medium and high density polyethylenes.

Figure 55A:
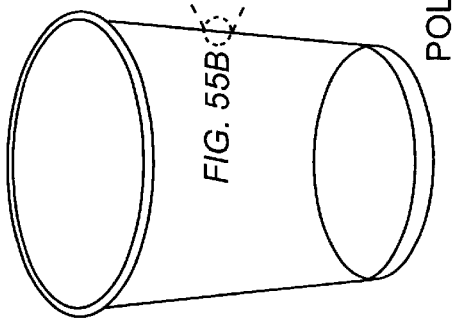
FIG. 55 is a drawing of a heat insulating cup having on its wall surface a foamed layer of thermoplastic film.
Figure 55B:
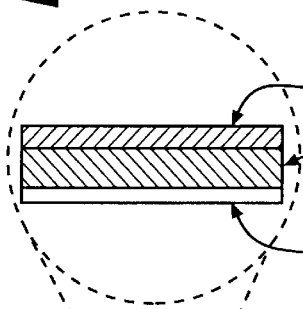
Figure 55C:
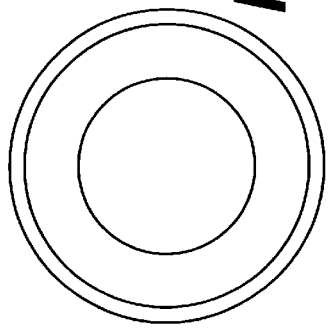

Utilizing the paperboard of this invention improves the thermal properties of the container disclosed in U.S. Pat. No. 4,435,344, which is incorporated by reference herein in its entirety. FIG. 55 illustrates the heat insulating paperboard container in the form of a cup. This cup may have an inner and outer surface which when filled with a liquid at 190° F. exhibits thermal insulative properties such that at room temperature and one atmosphere pressure, the temperature of the outer surface does not reach 140° F.–145° F. in less than thirty seconds. The article by B. I. Dussan et al. entitled *Study of Burn Hazard in Human Tissue and Its Implication on Consumer Product Design*, presented at the Heat Transfer Division of the American Society of Mechanical Engineers at the ASME Winter Annual Meeting, Washington, D.C., Nov. 28–Dec. 2, 1971, discusses skin necrosis and thermal insulation.

In one embodiment of the present invention, the paperboard may have a moisture content of at least about 2 to about 10%. In one embodiment the moisture content is at least about 2%. In another embodiment the moisture content is at least about 4 to about 8.5%. In still yet another embodiment the moisture content is at least about 4.5 to about 8%. Though the heating temperature and heating time will vary depending on the type of the paper sheet and the thermoplastic synthetic resin film used, the heating temperature generally may vary from about 110° C. to about 200° C., and the heating time may vary from about 20 seconds to about 4 minutes. By way of example, when a polyethylene film is used as a thermoplastic synthetic resin film for coating or lamination, the moisture content of the paperboard may be between about 5 to about 8% and the heating temperature may be from about 110° C. to about 150° C., and the heating time may be between about 50 seconds to about 2.5 minutes.

Suitably a cellulosic insulating container, for example a cup, carton, or container, may be manufactured from a cellulosic paperboard comprising (a) predominantly cellulosic fibers; (b) bulk and porosity enhancing additives selected from the group consisting of expanded or unexpanded uncoated microspheres, expanded or unexpanded coated microspheres, expanded or unexpanded microspheres coated discontinuously, high bulk additive (HBA) fibers, and thermally and/or chemically treated cellulosic fibers rendered anfractuous or mixtures of expanded or unexpanded coated, uncoated, or discontinuously coated microspheres and HBA fibers, and thermally or chemically treated anfractuous fibers and mixtures of all or some of the additives interspersed with said cellulosic fibers in a controlled distribution throughout the thickness of said paperboard; and (c) retention aids selected from the group consisting of coagulation agents, flocculation agents, and entrapment agents dispersed within the bulk and porosity enhancing additives cellulosic fibers. The amount of size press binder applied, optionally including a pigment, may be in the range of about 0 to about 6 lbs. per 3000 square foot ream. The binders and pigments may include, but are not limited to, the ones disclosed herein. The useful fiber weight of the web may be in the range of about 40 to about 320 lbs. per 3000 square foot ream. The cellulosic container formed from the web comprising two surfaces and a bottom panel member may be coated or laminated with a thermoplastic synthetic resin film on one surface thereof and coated or laminated with the same or different thermoplastic synthetic resin film or aluminum film on the other surface thereof, wherein the bottom panel member is formed of paperboard which may or may not be coated or laminated with a thermoplastic synthetic resin film or aluminum foil and wherein heating is performed at a temperature and for a time sufficient to form a heat-insulating layer on at least one surface of the container body member by a foaming action of at least one of the thermoplastic films of the container body through the action of the moisture in the paper of the container body member. In one embodiment the thermoplastic resins are polyolefins such as polyethylenes. To insure thermal insulation and appropriate handling, the outer wall of the container may be coated with a polyolefin which is weaker than the polyolefin which is applied to the inner coating. Thus, in one embodiment, low density polyethylene may be applied to the outer coating while high density polyethylene may be applied to the inner coating.

Any heating means such as hot air, electric heat microwaves or infrared heating can be used. Heating, by hot air or electric heat, in a tunnel having transporting means such as conveyor may be used for commercial production. The heat-insulating paperboard container of this invention may also be prepared batchwise by heating in a microwave or electric oven.

The thickness of the thermoplastic synthetic resin film coated or laminated on the paperboard sheet of this invention is not critical to this invention. As a non-limiting guideline, a film having a thickness of about 15$\mu$ to about 80$\mu$ may be used. In one embodiment, the film thickness is about 20$\mu$ to about 50$\mu$. In another embodiment, the film thickness is about 20$\mu$ to about 40$\mu$.

A foamed layer may be provided on a desired surface by changing the type and nature of the thermoplastic synthetic resin films to be coated or laminated on the paperboard surface. For example, when a film material having a relatively high melting point, for example high density polyethylene film, is used on the inner surface of the container body wall and a film material having a relatively low melting point, for example low density polyethylene film, is used on the outer surface of the container body member, only the low density polyethylene film on the outer wall surface is foamed and the high density polyethylene film on the inner wall surface may remain unfoamed. Also, when the inner wall surface of container body member is coated or laminated with an aluminum foil and the outer surface is coated or laminated with a thermoplastic film, the film layer on the outer wall surface can be effectively foamed to form a heat-insulating layer. It should be noted that the reverse is possible.

The cationic wet strength agent used in the manufacture of the paperboard can be selected from among those cationic wet strength agents known in the art such as dialdehyde starch, polyethylenimine, mannogalactan gum, glyoxal, and dialdehyde mannogalactan. A particularly useful class of wet strength agent is cationic glyoxylated vinylamide wet strength resins.

Glyoxylated vinylamide wet strength resins useful herein are described in U.S. Pat. No. 3,556,932 to Coscia. These resins are typically reaction products of glyoxal and preformed water soluble vinylamide polymers. Suitable polyvinylamides include those produced by copolymerizing a vinylamide and a cationic monomer such as 2-vinylpyridine, 2-vinyl-N-methylpyridinium chloride, diallyldimethyl ammonium chloride, etc. Reaction products of acrylamide diallyldimethyl ammonium chloride in a molar ratio of about 99:1 to about 75:25 glyoxal, and polymers of methacrylamide and 2-methyl-5-vinylpyridine in a molar ratio of about 99:1 to about 50:50, and reaction products of glyoxal and polymers of vinyl acetate, acrylamide and diallyldimethyl ammonium chloride in a molar ratio of about 8:40:2 are more specific examples provided by Coscia. These vinylamide polymers may have a molecular weight up to about 1,000,000. In some embodiments the polymers have a molecular weight of less than about 25,000. The vinylamide polymers are reacted with sufficient glyoxal to provide a water soluble thermoset resin. In most cases the molar ratio of glyoxal derived substituents to amide substitutes in the resin is at least about 0.06:1 and most typically about 0.1:1 to about 0.2:1. A commercially available resin useful herein is Parez 631 NC sold by Cite Industries.

The cationic wet strength agent is generally added to the paperboard web in an amount up to about 8 pounds per ton or about 0.4 wt %. Generally, the cationic wet strength agent is provided by the manufacturer as an aqueous solution and is added to the pulp in an amount of about 0.05 to about 0.4 wt % and more typically in an amount of about 0.1 to about 0.2 wt %. Unless otherwise indicated, all weights and weight percentages are indicated herein on a dry basis. Depending on the nature of the resin, the pH of the pulp is adjusted prior to adding the resin. The manufacturer of the resin will usually recommend a pH range for use with the resin. The Parez 631 NC resin can be used at a pH of about 4 to 8.

Other wet strength agents used in preparing the paperboards of this invention can be selected from among those aminoplast resins (e.g., urea-formaldehyde and melamine-formaldehyde) resins and those polyamine-epichlorohydrin, polyamine epichlorohydrin or polyamide-amine epichlorohydrin or polyamide-amine epichlorohydrin resins (collectively "PAE resins") conventionally used in the papermaking art. Representative examples of these resins are described throughout the literature. See, for example, *Wet Strength in Paper and Paperboard*, TAPPI Monograph Series No. 29, TAPPI Press (1952) John P. Weidner, Editor, Chapters 1, 2 and 3 and U.S. Pat. No. 2,345,543 (1944); U.S. Pat. No. 2,926,116 (1965); and U.S. Pat. No. 2,926,154 (1960). Typical examples of some commercially available resins include the PAE resins sold by Hercules under the name Kymene, e.g., Kymene 557H and by Georgia Pacific under the name Amres, e.g., Amres 8855.

Kymene type wet strength agent is added to the paper fiber in an amount up to about 8 pounds per ton or about 0.4 wt % and typically about 0.01 to about 0.2 wt % and still more typically about 1 to about 2 pounds per ton or about 0.5 to about 0.1 wt %. The exact amount will depend on the nature of the fibers and the amount of wet strength required in the product. These resins are generally recommended for use within a predetermined pH range which will vary depending upon the nature of the resin. For example, the Amres resins are typically used at a pH of about 4.5 to about 9. It should be understood that since the use of the bulk enhanced paperboard of the invention will be used to make articles used in connection with food service, all the wet strength additives used to make articles for food service products should have FDA approval if the wet strength agents come into direct contact with the food products.

Suitable binders include cationic starches, anionic starches, amphoteric starches, starch latex copolymers, animal glue, gelatin, methyl cellulose, carboxymethylcellulose, polyvinyl alcohol, ethylene-vinyl acetate copolymer, vinyl-acetate-acrylic copolymer, styrene butadiene copolymer, vinyl acetate-ethylene copolymer, acrylic copolymer, styrene acrylic copolymer, stearylated melamine, hydrophilic epoxy esters. Suitable binders may include aliphatic-acrylate-acrylonitrile styrene copolymers such as the n-butyl-acrylate-acrylonitrile styrene copolymer, the n-amyl-acrylate-acrylonitrile styrene copolymer, the n-propyl-acrylate-acrylonitrile styrene copolymer, the n-ethyl-acrylate acrylonitrile styrene copolymer, and aliphatic acrylate styrene copolymers such as n-butyl acrylate styrene copolymer, n-amyl acrylate styrene copolymer, n-propyl acrylate styrene copolymer, or n-ethyl acrylate styrene copolymers. One styrene-acrylic-acrylonitrile binder that may be used is BASF Acronal S 504. Suitable styrene-acrylic-acrylonitrile binders manufactured by BASF include Acronal S 888 S, and Acronal DSA 2285 X. Suitable styrene acrylonitrile binders manufactured by Dow Chemical Company include Latex XU 30879.50, Latex XU 30978.51, and Latex XU 30955.50. Suitable styrene acrylic polymers manufactured by BASF include Acronal S 304, Acronal S 760, Acronal 296 D, Acronal S 400, Acronal NS 567, Acronal S 702, Acronal S 728, and Acronal NX 4786. Styrene acrylic polymers manufactured by B.F. Goodrich include Carboset® GA-1086, Carboset® GA-2137, Carboset® GA-1161, and Carboset® XPD-2299. Styrene acrylic polymers manufactured by Morton International include Morton 4350, Morez® 101 LS, Morez® 200, Morcryl® 132, Morcryl® 134, Morcryl® 350, Lucidene® 202, Lucidene® 361, and Lucidene® 371. Styrene acrylic polymers manufactured by Reichhold International include Reichhold, Pa. 7002.

The binder used in the manufacture of the paperboard, optionally in conjunction with the pigment, may be applied in the coating section. The clay pigment may be any suitable clay known to the art. For example, suitable pigments include kaolin clay, engineered clays, delaminated clays, structured clays, calcined clays, alumina, silica, aluminosilicates, talc, zinc sulfide, bentonite, glass powder, calcium sulfate, ground calcium carbonates, precipitated calcium carbonates, barite, titanium dioxide, and hollow glass or organic spheres. These pigments may be used individually or in combination with other pigments. In one embodiment, the clay is selected from the group consisting of kaolin clay and conventional delaminated pigment clay. A commercially available delaminated pigment clay is "HYDRAPRINT" slurry, supplied as a dispersion with a slurry solids content of about 68%. "HYDRAPRINT" is a trademark of Huber.

The pigment composition may also comprise other additives that are well known in the art to enhance the properties of coating compositions or are well known in the art to aid in the manufacturing process. For example, suitable additives include defoamers, antifoamers, dispersants, lubricants, film-formers, crosslinkers, thickeners and insolubilizers.

A suitable defoamer includes "Foamaster DF122NS" and "Foamaster VF." "Foamaster DF122NS" is a trademark of Henkel.

A suitable organic dispersant includes "DISPEX N-40" comprising a 40% solids dispersion of sodium polycarboxylate, "DISPEX N-40" is a trademark of Allied Colloids and Berchem® 4290; a complex organic dispersant; and Berchem® 4809, a polyacrylate dispersant supplied by Berchem Inc. Other suitable dispersants are Accumer® 9000 and Accumer® 9500, polyacrylate dispersants; Tamol® 731; Tamol® 850, a sodium salt of polymeric carboxylic acid; Tamol® 960, a sodium salt of a carboxylated acrylic polyelectrolyte; and Tamol® 983, an organic polyacid dispersant. The Tamol dispersants are supplied by the Rohm & Haas Company. Polyphosphates and hexametaphosphates are also suitable dispersants.

A suitable coating lubricant includes "BERCHEM 4095" which is a 100% active coating lubricant based on modified glycerides. "BERCHEM 4095" is a trademark of Berchem. Other suitable lubricants are Berchem® 4000, a polyethylene emulsion; Berchem® 4060, a polyethylene emulsion; Berchem® 4110; Berchem® 4113, a modified diglyceride; Berchem® 4300, a fatty acid dispersion; Berchem ® 4320, a fatty acid dispersion; and Berchem® 4569, a diglyceride emulsion, all supplied by Bercen Inc. In addition, the following lubricants are utilized: HTI Lubricant 1000, calcium stearate; HTI Lubricant 1100, a calcium stearate/polyethylene co-emulsion; and HTI Lubricant 1050, a polyethylene/carnauba wax co-emulsion supplied by Hopton Technologies, Inc.; and Sunkote® 455, calcium stearate supplied by Sequa Chemicals, Inc.

Suitable thickeners including the sodium alginate moiety are: Kelgin® LV, Kelgin® XL, Kelgin® RL, and Kelgin® OL; SCOGIN™ QH, SCOGIN™ LV, and SCOGIN™ QL. Other suitable thickeners are propylene glycol alginates such as Kelcolloid® LVF; treated sodium alginates such as Kelgin® QM and Kelgin® QL. The Kelgin products are supplied by Merck & Co., Inc., and the Scogin products are supplied by Pronova Biopolymer, Inc.

Figure 22:
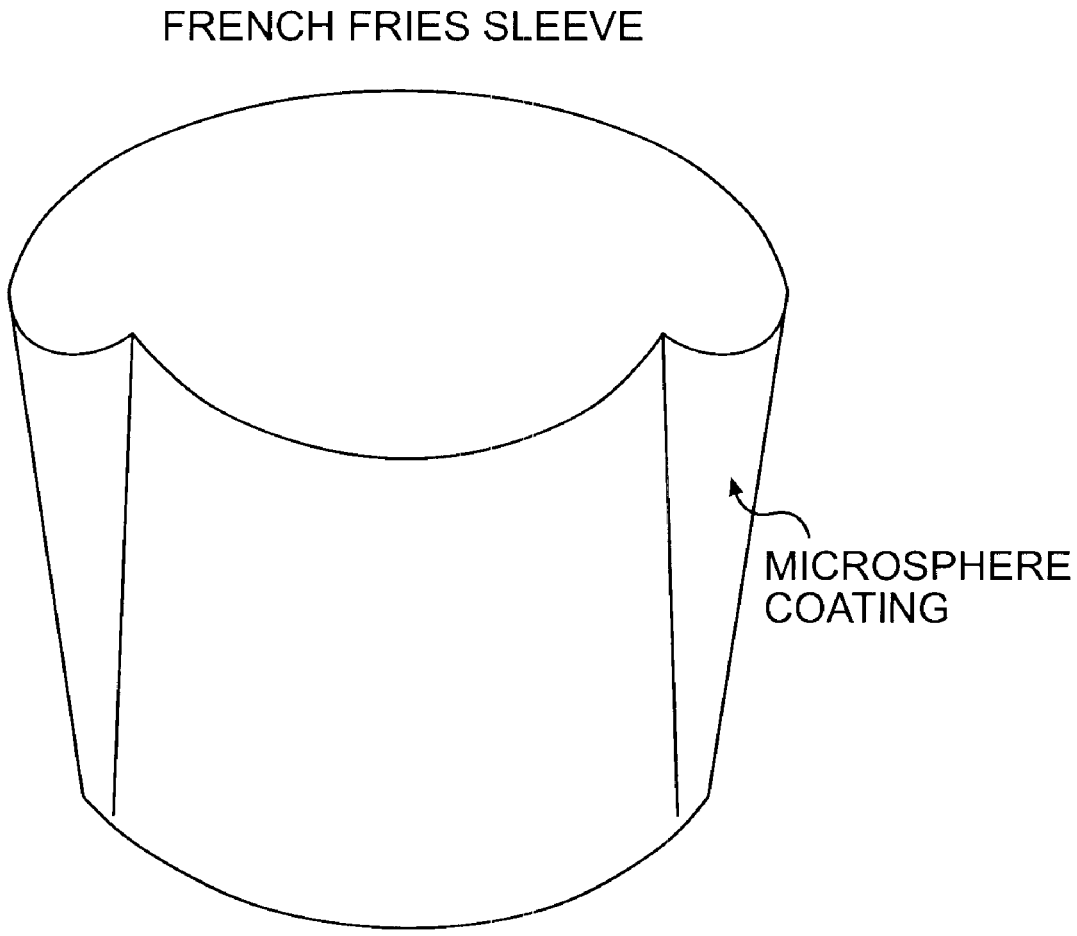
FIG. 22 is a drawing of a French fry sleeve with its outer surface texture coated.
Figure 23A:
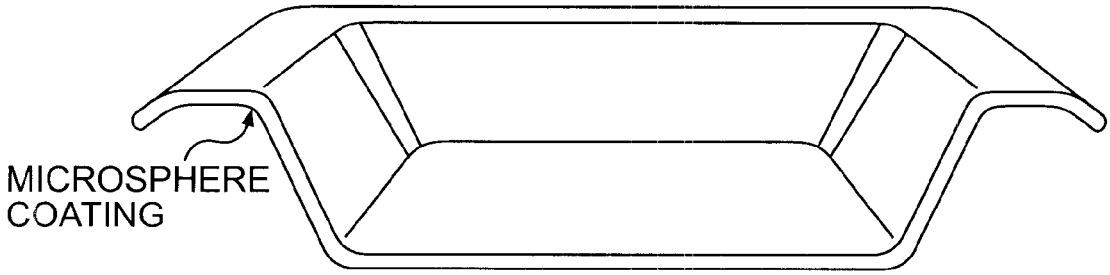
FIG. 23 is a drawing of a rectangular take-out container of this invention with its outer surface texture coated.
Figure 23B:
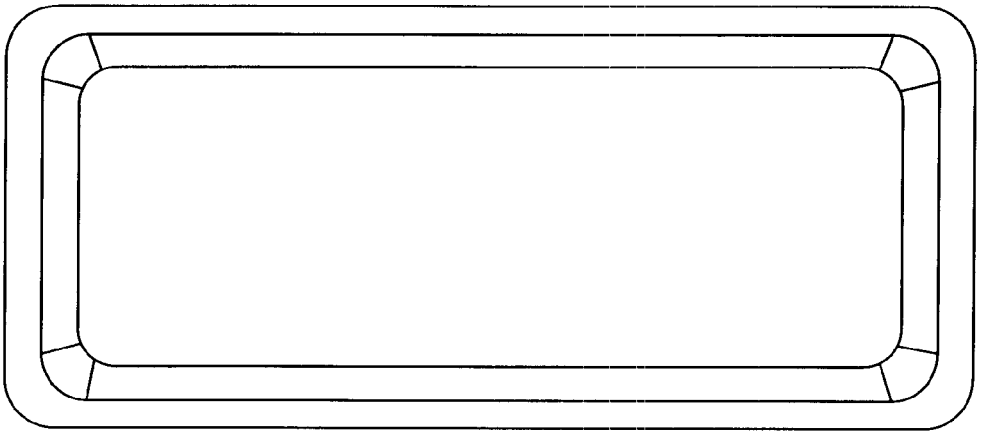
Figure 24A:
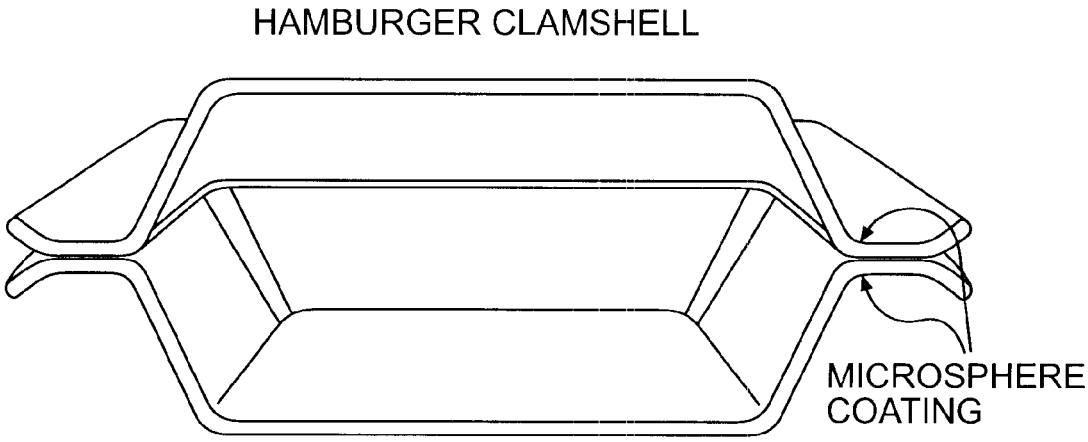
FIG. 24 is a drawing of a hamburger clam shell with its outer surface texture coated.
Figure 24B:
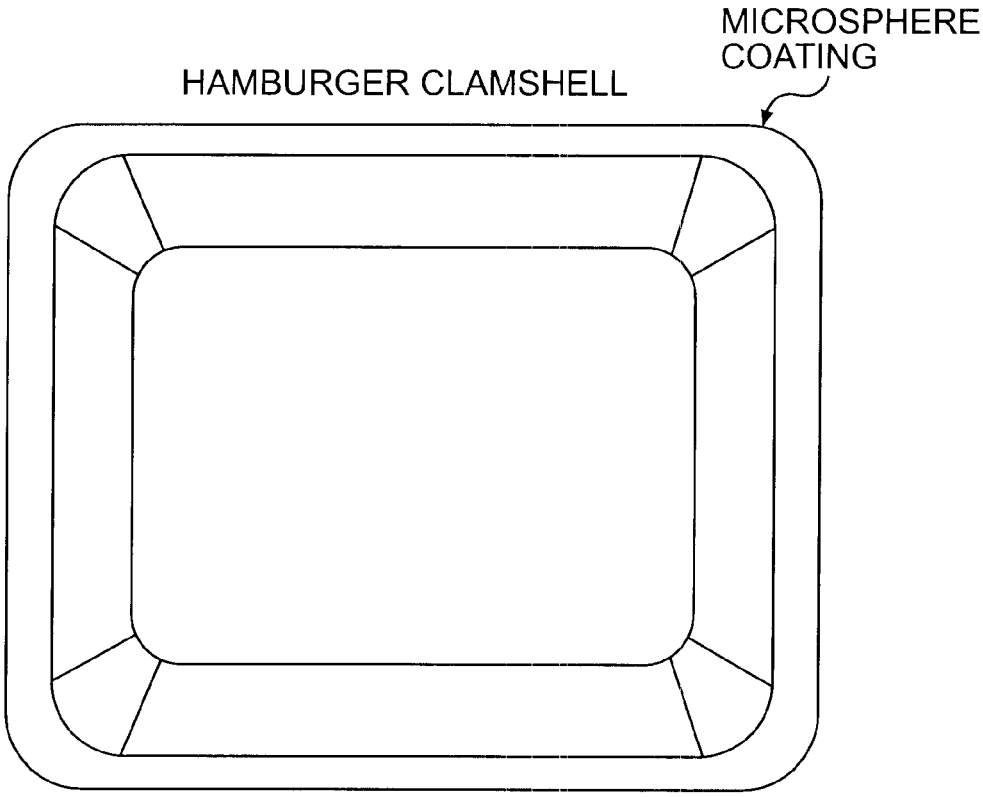
Figure 25:
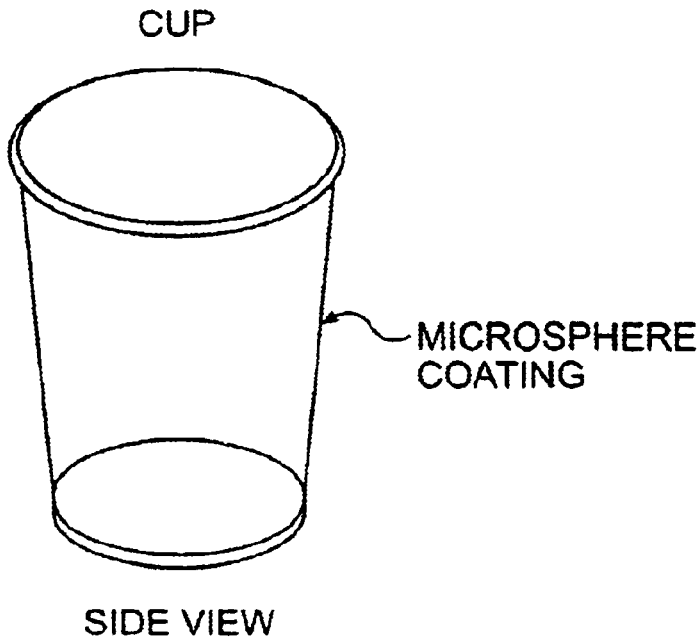
FIGS. 25 and 26 are drawings of a cup with its outer surface texture coated.
Figure 25:
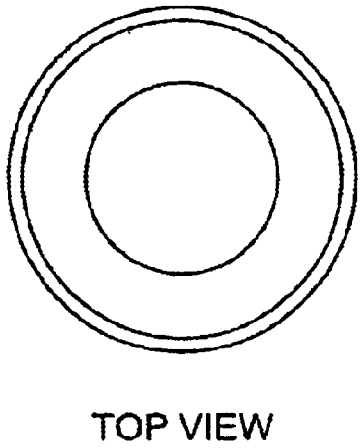
Figure 26:
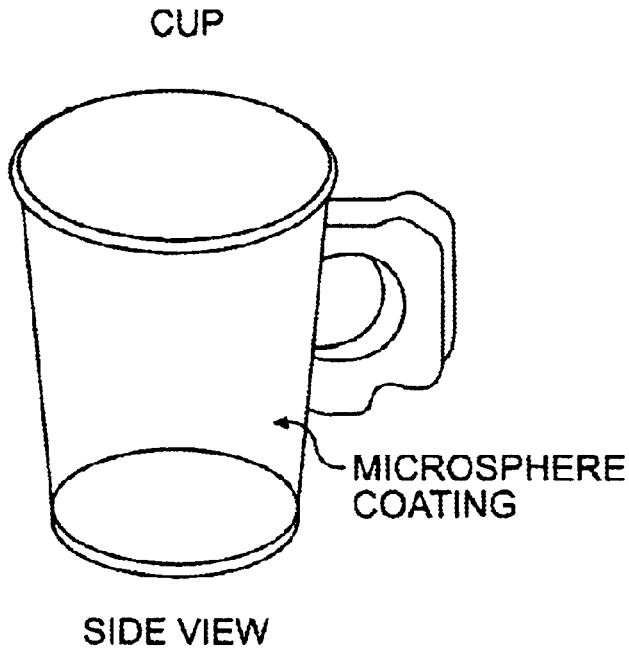
Figure 26:
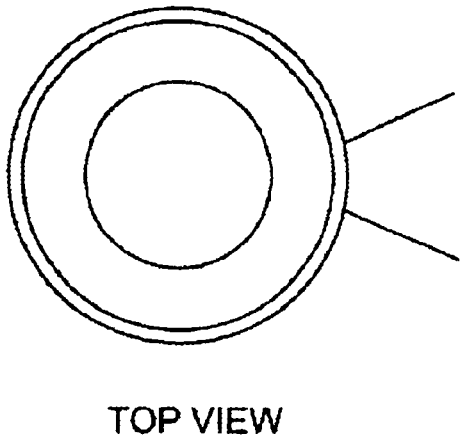
Figure 27:
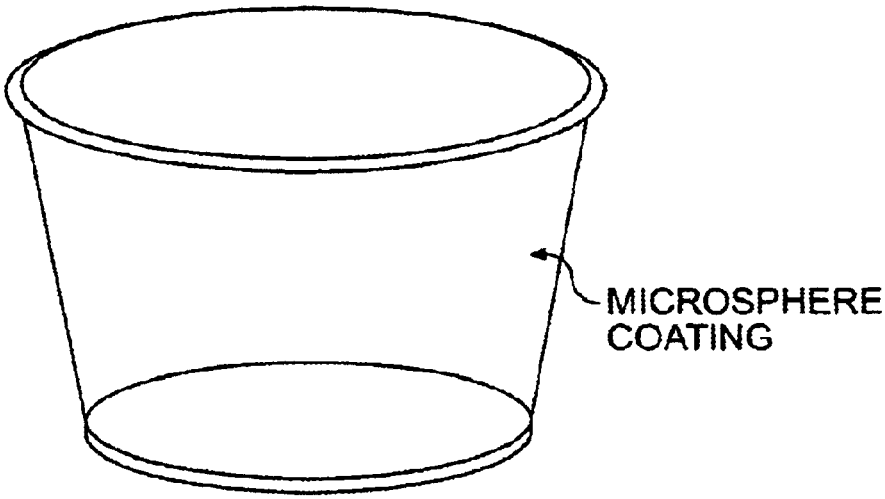
FIG. 27 is a drawing of a food bucket with its outer surface texture coated.
Figure 27:
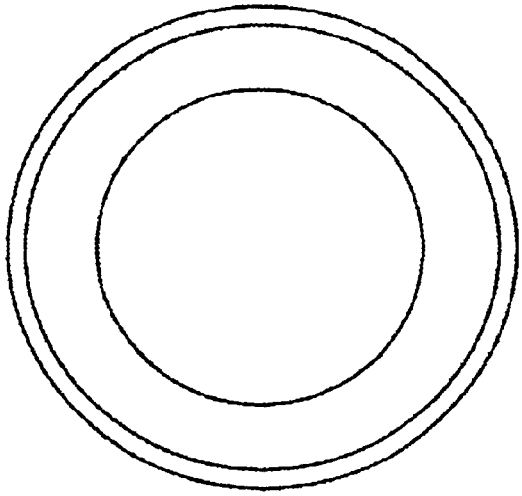

For applications where grease resistance is desired, such as in the formation of French fry sleeves FIG. 22; hamburger clam shells, FIG. 24; and food buckets, FIG. 27, a coating of a fluorine containing polymer moiety may be utilized. This coating may be applied to the paperboard in the coating section as shown in FIG. 35 (67). By way of example, suitable fluorine containing moiety polymers include fluorochemical copolymers. One suitable fluorochemical copolymer is ammonium di-[2-(N-ethyl-heptadecafluorosulfonamido)ethyl]phosphate. Ammonium di-[2-(N-ethyl-heptadecafluorosulfonamido)ethyl] phosphate is commercially available as "SCOTCHBAN FC-807" or "SCOTCHBAN FC-807A" (trademarks of 3M). "SCOTCHBAN FC-807 can be formed by the reaction of 2,2-bis,[Γ,ω-perfluoro $C_{4-20}$ alkylthio)methyl] 1,3-propanediol, polyphosphoric acid and ammonium hydroxide. Other suitable fluorine containing moiety polymers include fluorochemical phosphates. One commercially available fluorochemical phosphate is "SCOTCHBAN FC-809" (a trademark of 3M). "SCOTCHBAN FC-809" is an ammonium salt of a fluoroaliphatic polymer. Other suitable fluorine containing moiety polymers include fluoroalkyl polymers. Suitable fluoroalkyl polymers include poly (2-(N-methyl-heptadecafluorosulfonamido)ethyl acrylate)-co-(2,3-epoxypropylacrylate)-co-(2-ethoxyethylacrylate)-co-(2-(2-methylpropenyloyloxy)ethyl-trimethylammonium chloride), and poly(2-(N-methyl-heptadecafluorosulfonamido)ethyl acrylate)-co-(2,3-epoxypropylacrylate)-co-(2-ethoxyethylacrylate)-co-(2-(2-methylpropenyloyloxy)ethyl-trimethylammonium chloride) commercially available as "SCOTCHBAN FC-845" or "SCOTCHBAN FX-845" (a trademark of 3M). "SCOTCHBAN FC-845" contains 35 to 40 weight percent fluorine and can be produced by the copolymerization of ethanaminium, N,N, N-trimethyl-2-[(2-methyl-1-oxo-2-propenyl)-oxy]-, chloride; 2-propenoic acid, 2-methyl-, oxiranylmethylester; 2-propenoic acid, 2-ethoxyethyl ester; and 2-propenoic acid, 2[[(heptadecafluoro-octyl)sulfonyl]methyl amino]ethyl ester. Another suitable commercially available fluorine containing moiety polymer includes "SEQUAPEL 1422" (a registered trademark of Sequa Chemicals, Inc.). Other suitable commercially available fluorine containing moiety polymers include "LODYNE® P-201" and "LODYNE® P-208E." "LODYNE® P-201" and "LODYNE® P-208E" are registered trademarks of Ciba-Geigy Corporation, Greensboro, N.C. "LODYNE® P-201" comprises a fluorinated organic acid diethanolamine salt having a 34% solids content, the remaining 66% comprising water. "LODYNE® P-208E" comprises a fluorinated alcohol phosphate ester salt having a 24% solids content, a 10% propylene glycol content, and a 66% water content.

The deposition of the mixture onto the wire may be referred to as web laydown and an embryonic paper web is formed thereby. The embryonic web comes off the screen and is carried on various fabrics or felts where it undergoes wet pressing by suitable papermaking apparatus known in the art. After wet pressing, the embryonic web is about 60% water and about 40% papermaking fiber and other solid material discussed previously.

The embryonic web then undergoes further drying processes, such as by means of vacuum boxes, through-air dryers, steam heated dryers, gas-fired dryers, or other suitable methods. When the bulk-enhancing agent comprises expandable microspheres, the drying of the embryonic web is done for a sufficient time and at a sufficient temperature to cause the microspheres to expand by the amount desired for the textured container application. In one preferred laboratory process, after wet-pressing, the paperboard web is further dried using a suitable drying apparatus, such as that of M/K Systems, Inc., Series 8000, advancing the web at 3 feet per minute and exposing it to a temperature of 125° C., one pass per web side.

After a suitable amount of drying, the paper web passes through a nip where it is size-pressed as shown in FIG. 35 (65). A suitable size-press starch may be applied. In one embodiment, the size-press starch has solids which have been increased from the more typical 9.8% to between about 20% and about 40%. In one embodiment, the starch has solids of about 33%. The increased weight of the size-press starch combined with the decrease in fiber density caused by the expansion of the microspheres generate unexpected and significant improvements in the resulting bulk-enhanced paperboard. For instance, because the expanded microspheres increase the "openness" of the resulting paperboard, there is increased penetration of the size-press solids which allows for a greater amount of size-press starch to be retained within the paperboard, and, in turn, which generates thicker size-press layers having higher moduli of elasticity. The higher moduli and thicker size-press layers, in turn, improve bending and GM tensile stiffness of the bulk enhanced paperboard. Improved bending and GM tensile and GM stiffness mean a desired rigidity or stiffness of paperboard may be obtained with a reduced fiber weight of papermaking fibers and other materials. This use of the notably less expensive paperboard enhances the competitiveness of the textured and/or insulated container of this invention. Thus the ability to reduce fiber weight while maintaining a desired rigidity, in turn, reduces raw material costs for the textured containers of this invention.

As discussed above, in one embodiment, bulk enhanced paperboards utilized in the manufacture of the textured and/or insulated containers of this invention have at a fiber mat density of 3, 4.5, 6.5, 7, 8.3, and 9 pounds per 3000 square foot ream at a fiberboard thickness of 0.001 inch, the GM Taber stiffness may be at least about 0.00716 $w^{2.63}$ grams-centimeter/fiber mat density$^{1.63}$. The GM tensile may be at least about 1890+24.2 w pounds per inch. In another embodiment, the GM Taber stiffness may be at least about 0.00501 $w^{2.63}$ grams-centimeter/fiber mat density$^{1.63}$. The GM tensile stiffness may be at least about 1323+24.2 w pounds per inch. In yet another embodiment, the GM Taber stiffness may be at least about 0.00246 $w^{2.63}$ grams-centimeter/fiber mat density$^{1.63}$. The GM tensile stiffness may be at least about 615+13.18 w pounds per inch. These values may be achieved in the paperboard manufacturing process by controlling the dispersion of bulk and porosity additives throughout the thickness of the paperboard and controlling the extent of penetration of the size press applied binder and optionally pigment. The overall fiber weight of the paperboard may be controlled to be at least about 40 lbs. per 3000 square foot ream. In one embodiment, the paperboard weight is in the range of about 60 to about 320 lbs. per 3000 square foot ream. In another embodiment, the paperboard weight is in the range of about 80 to about 220 lbs. per 3000 square foot ream. However, paperboard having an overall fiber weight of about 3 to about 40 pounds per 3000 square foot ream are useful for the manufacture of containers of this invention.

In many applications, substrates prepared from polyolefins, polyesters, polyaramids, and polyanilates can fully or partially replace the cellulosic moiety. These synthetic fibers may be spunbonded, melt blown, or produced by any other suitable method. This invention includes the use of synthetic fibers in combination with cellulosic fiber formed in the papermaking process. Suitable synthetic fibers include Typan® 3141, a spunbonded polypropylene; Reemay® 2033, a spunbonded polyester; Tyvek® 1079, and a spunbonded high density polyethylene.

For certain applications, the textured paperboard may have one side (to be used as the outside wall of the container) printed with the microsphere polymeric binder, glass bead or hollow glass bead polymeric binder, the gas polymeric binder coating, or a mixture of these; and on the other side, the resulting paperboard web may be coated with a polyolefin layer, preferably a polyethylene layer. Such a layer is particularly useful inside a paper cup. This cup has an inner and an outer surface which when filled with a liquid at about 190° F. exhibits thermal insulation properties such that the outer surface where the hand touches the textured insulation coating does not reach a temperature of more than about 145° F. in less than about forty seconds. To apply the polyethylene layer, the paper web or paper blank may be sprayed with a suitable fast-drying adhesive, as is the polyethylene sheet material, after which the polyethylene sheet material and the paper web or blank are laminated together by any suitable means, such as by a press nip.

The paperboard containing bulk enhancing additives has improved formability which is useful in all shaping applications that require deformation of the paperboard. This property of the paperboard is particularly useful in the top curl forming for rolled brim containers such as textured cups. The improved formability of the paperboard also facilitates the drawing of textured plates.

The paperboard and method for its manufacture according to the present invention has the advantage of producing an excellent distribution of expandable microspheres or other bulk enhancers in the paper fiber network, as described in Examples 12 and 14 through 21. The percentage of added bulk enhancer retained in the paperboard web is also improved significantly as demonstrated in Examples 10, Examples 14 through 21, and FIGS. 58A through 58E.

Improving the distribution and retention rate of the microspheres or other bulk enhancers in the paperboard improves its thermal resistance, smoothness, strength, and rigidity. Uniform distribution also eliminates interference with paper machine apparatus when non-thermal grade papers are run after a process employing the bulk enhancing additives of this invention. The paper machine dryer sticking problems are reduced and dusting or other undesirable interference with printing upon the paperboard is also reduced by virtue of the reduced distribution of microspheres in the periphery of the paperboard.

In many food applications it is desirable to coat the textured paperboard or the textured article of manufacture with a wax having a melting point of about 130° F. to about 150° F. The wax is applied on the surface opposite the one on which the textured coating has been printed. The wax treated board or article of manufacture is coated with binders and optionally pigments disclosed herein.

Figure 17B:
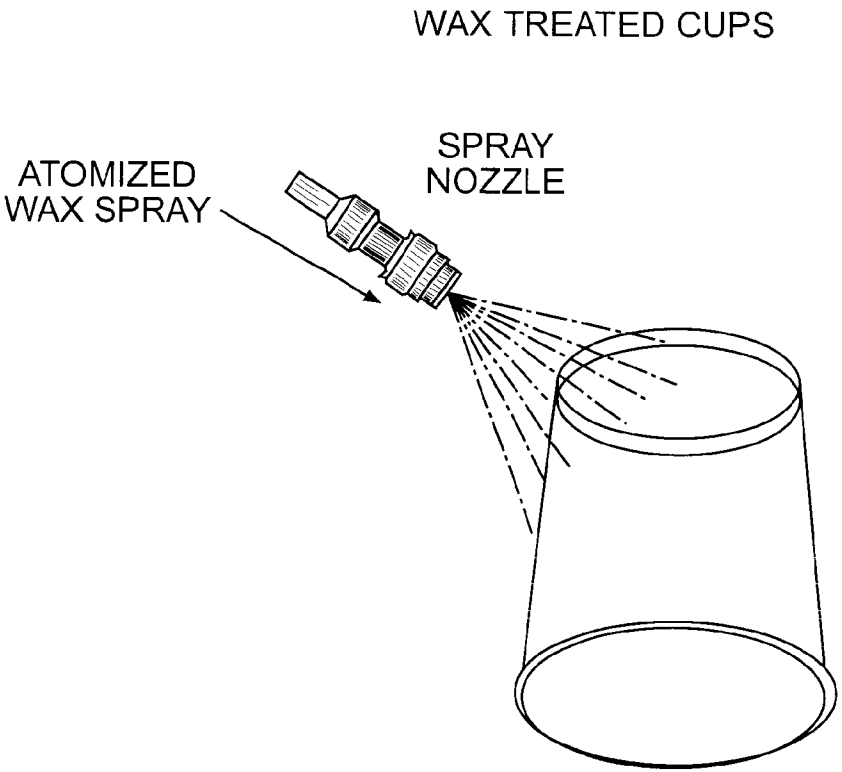
FIGS. 17A and 17B are drawings of a wax treated cup.
Figure 17A:
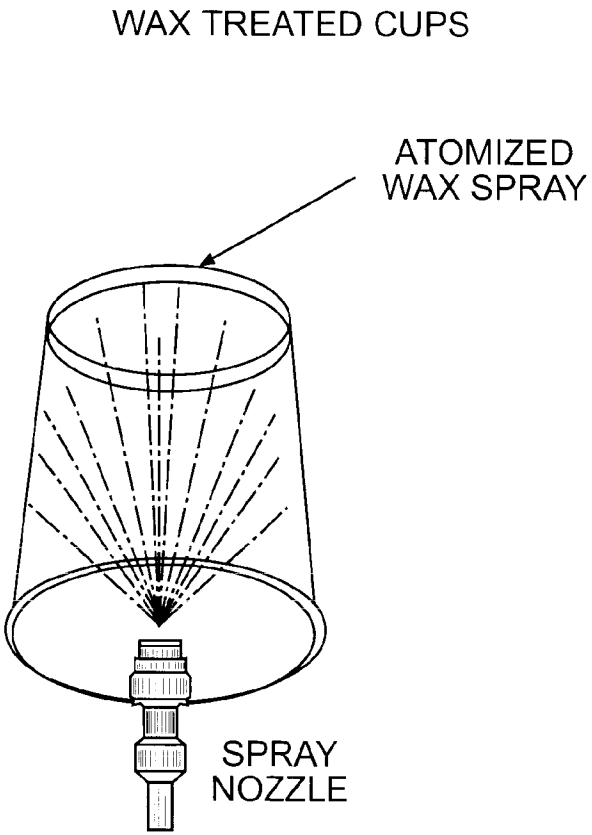
Figure 18A:
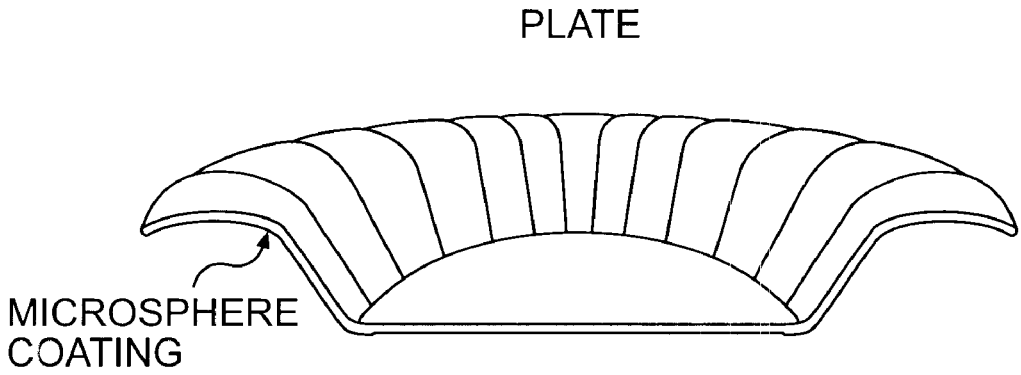
FIG. 18 is a drawing of a plate having a textured microsphere outer coating.
Figure 18B:
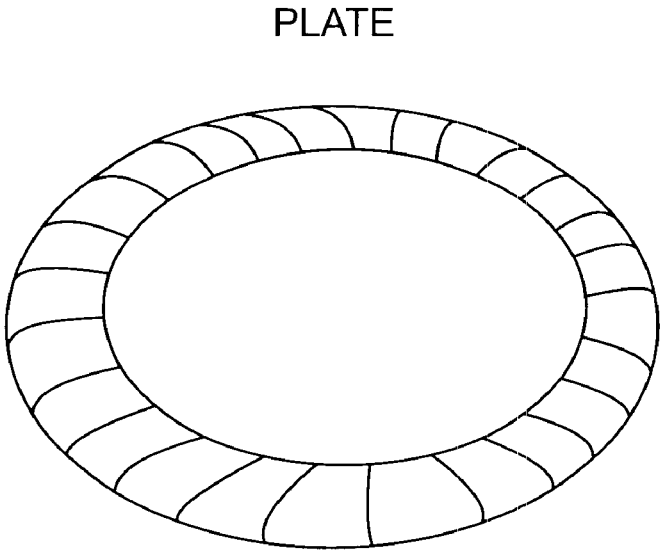
Figure 19A:
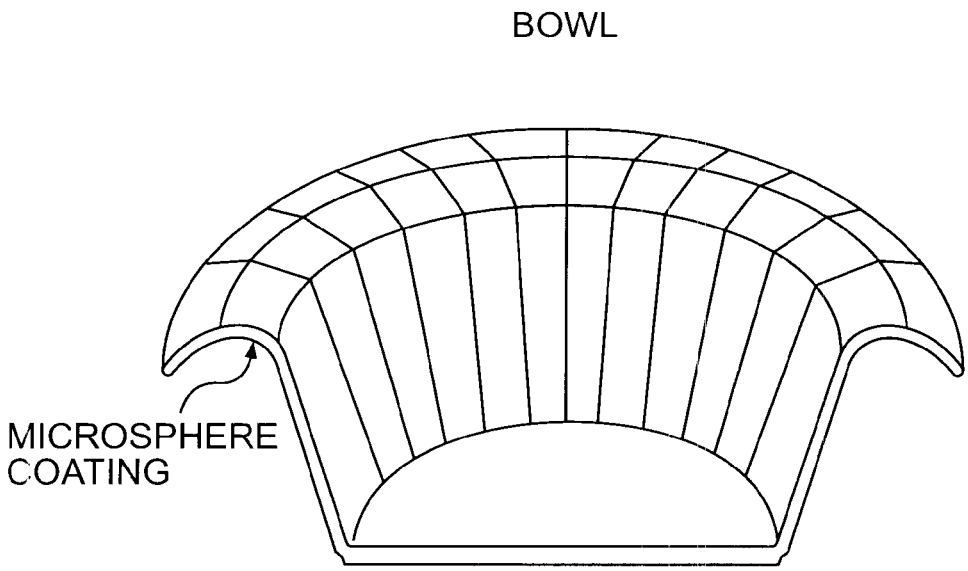
FIG. 19 is a drawing of a bowl of this invention showing the textured coating of the outer bottom of the bowl.
Figure 19B:
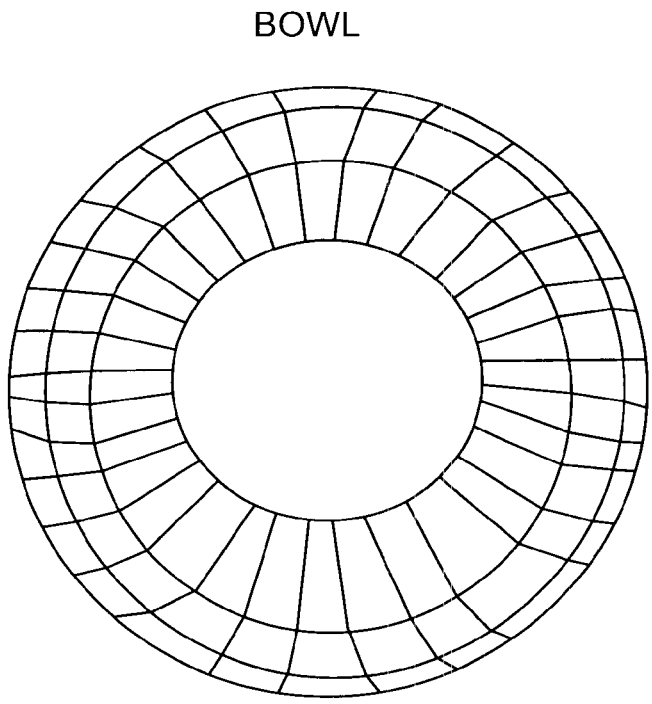
Figure 20A:
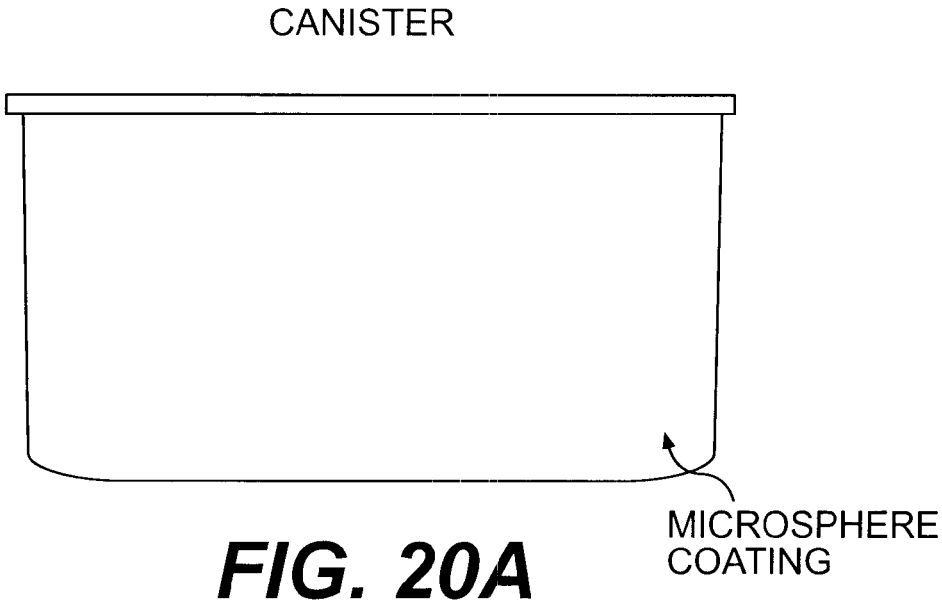
FIG. 20 is a drawing of a canister of this invention having its outer sides texture coated.
Figure 20B:
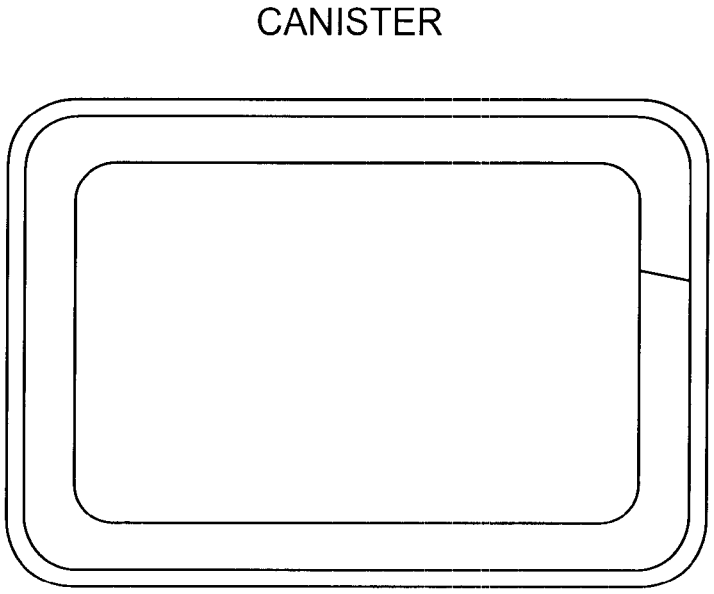
Figure 21A:
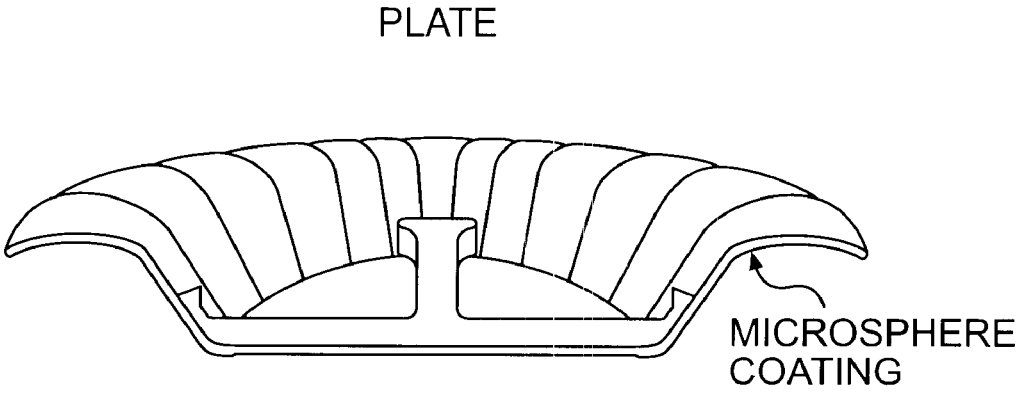
FIG. 21 is a drawing of a compartmented plate of this invention showing the textured coating of the outer bottom of the plate.
Figure 21B:
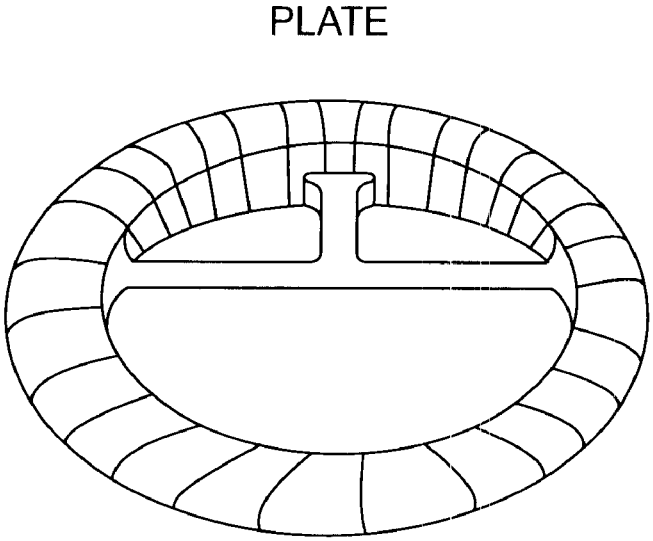
Figure 62:
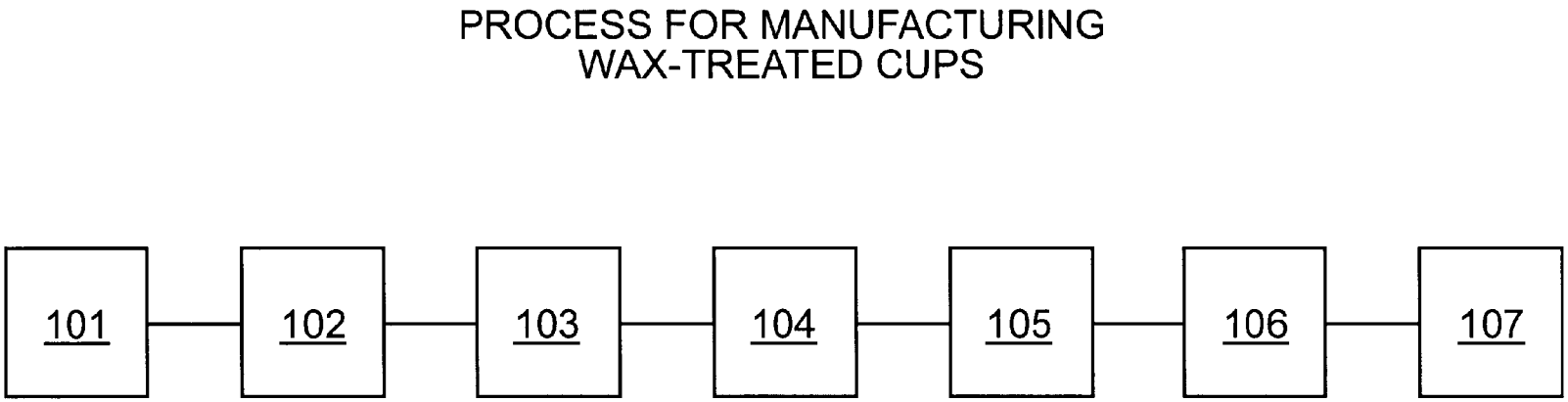
FIG. 62 is a flow diagram illustrating the process for the manufacture of cups coated with wax having a melting point of about 130° F. to about 150° F.

A schematic diagram of the wax treatment process for cups is shown in FIG. 62. The paperboard cups to be treated with wax can be pre-formed on a cup machine (101). A stack of cups is fed into the dispenser (102) in a chute. Single cups are separated from the bottom of a stack of cups by the dispenser and dropped to a conveyor belt for transfer to the treater head where wax is applied (103). The cups are fed onto a turret which revolves the cups through the waxing process. Liquid paraffin or wax is pumped to the spray nozzles for the desired distribution onto the cups. The first spray, FIG. 17A, is located beneath the turret and is positioned to spray the inside of the cup immediately after the start of the spin cycle. Through the spin cycle, the wax is distributed evenly over the inside surface of the cup. A second spray, shown in FIG. 17B, is located just above and outside the spinning cup and is positioned to spray wax on the outside of the cup immediately after the start of the spin cycle. Any excess wax is returned for redistribution through a piping system (104). The treated cups are then returned to a freewheel for transfer to a conveyor belt which is heated to prevent sudden cooling of the wax (105). The cups are then counted either with an automatic electronic counter or a manually operated mechanical counter and then guided into stacks of the desired quantity (106) which are then ready for packing (107).

Waxes suitable for use with the cups conform to the FDA requirements for food packaging and have a melting point in the range of about 130° F. to about 150° F. Examples of waxes that are suitable for this application include Parvan 142 and Parvan 145 which are refined food grade waxes supplied by Exxon Co.; Sunwax 200, a blended food grade wax supplied by Sun Co. Inc; and 1240, a fully refined a paraffin wax supplied by the International Group.

Suitably, an article of manufacture such as a carton, container or cup is prepared from a cellulosic paperboard comprising: (a) predominantly cellulosic fiber; (b) bulk and porosity enhancing additives selected from the group consisting of expanded or unexpanded, uncoated microspheres, expanded or unexpanded coated microspheres, expanded unexpanded microspheres, coated discontinuously, high bulk additive (HBA) fibers, and the thermally and/or chemically treated cellulose fibers rendered anfractuous or mixtures of expanded unexpanded coated, uncoated, or discontinuously coated microspheres and HBA fibers, and thermally or chemically treated anfractuous fibers interspersed with said cellulosic fibers in a controlled distribution throughout the thickness of said paperboard; and (c) retention aids selected from the group consisting of coagulation agents, flocculation agents, and entrapment agents are dispersed with the bulk and porosity enhancing additives and cellulosic fibers; and (d) the amount of size press binder applied optionally including a pigment is in the range of about 0 to about 6 lbs./3000 square foot ream; and (e) suitably the fiber weight of the web is in the range of about 40 to about 320 lbs./3000 square foot ream. All binders and pigments disclosed in this application are satisfactory in the manufacture of the article of manufacture such as a carton, container, or cup.

Suitably, one or both sides of the paperboard, article of manufacture, container, or cups may be coated with a polyolefin or wax. All of the polyolefins and waxes disclosed herein are suitable coatings.

The following examples are intended to be illustrative of the present invention and to teach one of ordinary skill how to make use of the invention. These examples are not intended to limit the invention or its protection in any way.

In the following examples, various trademarked chemical compositions are used. The following is a description of these compositions which have been found to be suitable retention aids.

Cytec Accurac® 181 is a cationic polyacrylamide supplied as a water-in-oil emulsion where the oil is a hydrotreated light petroleum distillate. The molecular weight of the polyacrylamide is in the range of about ten to about twelve million.

Cytec Accurac® 120 is a cationic polyacrylamide supplied as a water-in-oil emulsion where the oil is a hydrolreated light petroleum distillate. The polyacrylamide has a molecular weight of about fifteen million.

Hercules Microform® 2321 is a cationic acrylamide copolymer emulsion mixed with a paraffinic, naphthenic petroleum distillate having a molecular weight in the range of about one hundred thousand to about one million.

Hercules Microform® BCS is a modified bentonite (hydrated aluminum silicate) slurry in water.

Hercules Neuphor® 635 is a white anionic rosin emulsion in aqueous solution.

Hercules Reten® 203 is an aqueous dispersion of a cationic poly (diallyldimethyl ammonium chloride) (i.e., DADMAC) having a molecular weight of about one hundred thousand to about two hundred thousand.

Nalco® 625 is an anionic acrylamide-acrylate polymer water-in-oil emulsion which is a hydro-treated light distillate and has a molecular weight of about 16 to about 18 million.

Nalco® 8674 is a low molecular weight, highly cationic aqueous solution of polyamine.

Nalco Positek® 8678 is a water-soluble anionic micropolymer.

Polymin® PR 971 L is a polyethylenimine having a molecular weight in the range of about five hundred thousand to about two million being supplied by BASF in an aqueous solution.

EXAMPLE 1

A. A coating formulation was optimized for initial silk-screen application on platestock. Tables 1 and 2 below contain pertinent coating information.

TABLE 1

COATING FORMULATIONS

| Component | Coating #1 Component % of Total Solids | Coating #2 Component % of Total Solids | Component % Solids | Component pH | Order of Addition to Mixture |
|---|---|---|---|---|---|
| Expancel 820 | 30 | 20 | 42 | 7.0 | 2 |
| Acronal S504 | 50 | 40 | 50 | 7.4 | 1 |
| Hydrafine Clay | 20 | 40 | 70 | 6.8 | 3 |
| Alcogum L-29 | <1% | <1% | 30 | — | 4 |
| Notox Brown | As desired | — | — | — | 5 |
| Monolith Blue | — | As desired | — | — | 5 |

TABLE 2

COATING CHARACTERISTICS

| | Solids % | Viscosity CPAs | pH |
|---|---|---|---|
| Coating #1 | 52.4 | >10,000 | 7.0 |
| Coating #2 | 54.5 | >13,000 | 7.1 |

Plate samples were screen printed using the following methods and equipment: The screens used were stretched with Saatilene gold monofilament polyester mesh from Majestech Corporation. The mesh count used was 110 threads per inch at a tension level of 17 Newtons/cm, giving a theoretical deposit level of 3.47 cu. in./sq. yd. The screens were coated with Ulano 925WR, a direct water-resistant photo emulsion. They were scoop-coated with 2 coats on each side (wet on wet). After the screens were dried they were exposed with a Nuarac 2000 watt Metal Halide exposing unit. The samples were screen printed using a Saturn 25"×38" model "clam shell" printer manufactured by M & R Printing Equipment, Inc., the squeegee & flood speeds were set at 6. Other settings were: Off-contact at ⅛th", peel adjustment at ½" and the print/flood option on. The squeegee used had a sharp edge with a shore hardness of 70 durometers. The stock was then run through a Tex-Air 410-48 forced air electric dryer manufactured by American Screen Printing Company. The forced air temperature was approximately 265 degrees Fahrenheit and the infra red panels have a temperature of about 800 degrees Fahrenheit. The belt speed was set at 3.

B. FIGS. 4*a*–4*f* and FIG. 38 are representative texture coating patterns. Table 3 and FIGS. 4 and 38 below indicate the approximate coverage area of each pattern and the actual coat weight applied for each coating.

TABLE 3

COVERAGE AREA AND COAT WEIGHT

Figure 38:
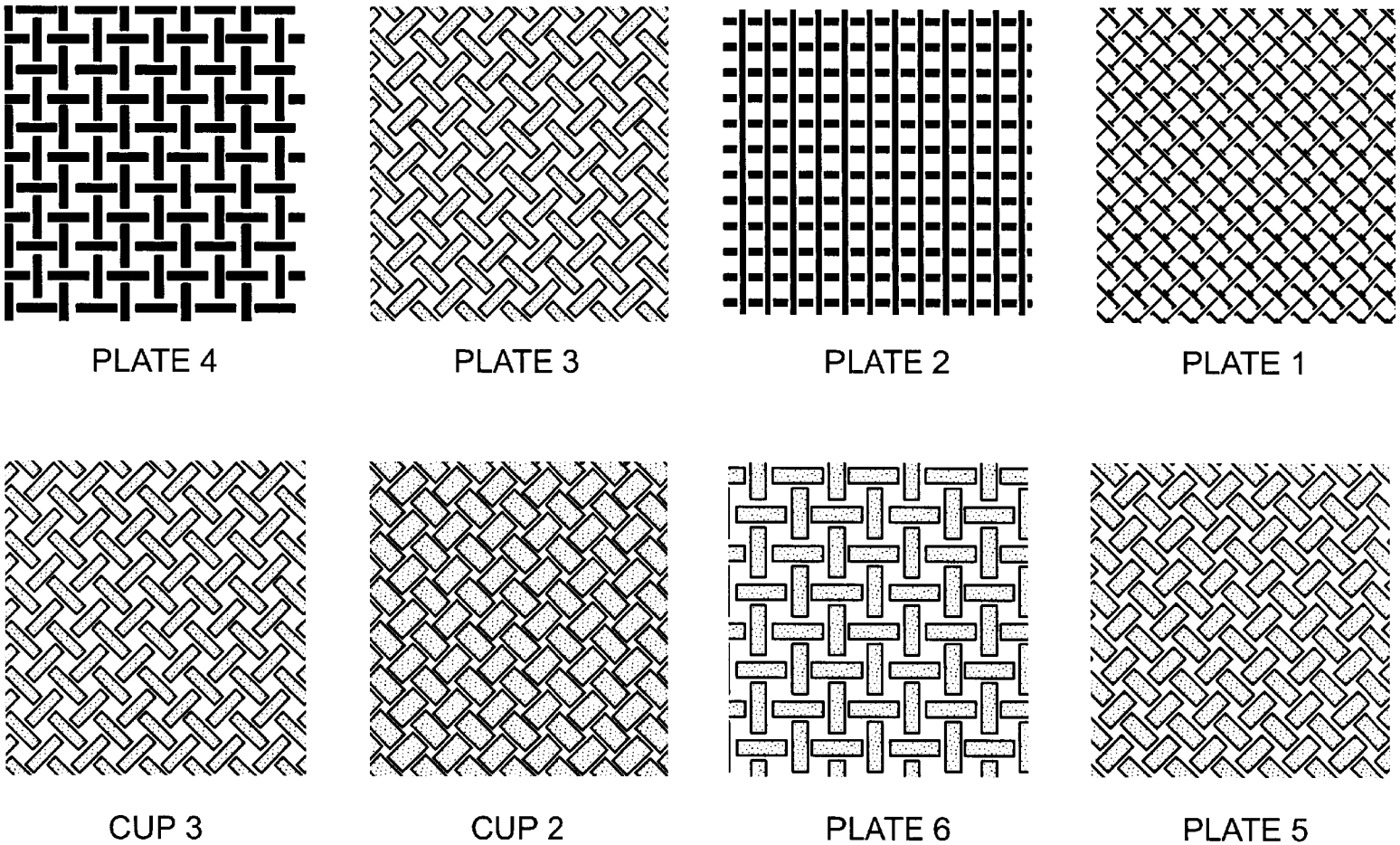
FIG. 38 shows side views of cups and bottom views of plates made in accordance with the present invention showing insulating and/or textured coating arrays.

| Pattern in FIG. 38 | Coverage Area % | Coating #1 Coat Weight Ream Pounds Per 3000 sq. ft ream | Coating #2 Coat Weight Ream Pounds Per 3000 sq. ft. ream |
|---|---|---|---|
| Plate 1 | 34 | 4.8 | — |
| Plate 2 | 48 | 6.0 | 5.8 |
| Plate 3 | 52 | 9.4 | — |
| Plate 4 | 31 | 4.5 | — |
| Plate 5 | 70 | 9.9 | — |
| Plate 6 | 54 | 9.2 | 10.3 |
| Cup 2 | 86 | 15.4 | 14.6 |
| Cup 3 | 52 | 10.7 | 9.7 |

Figure 7:
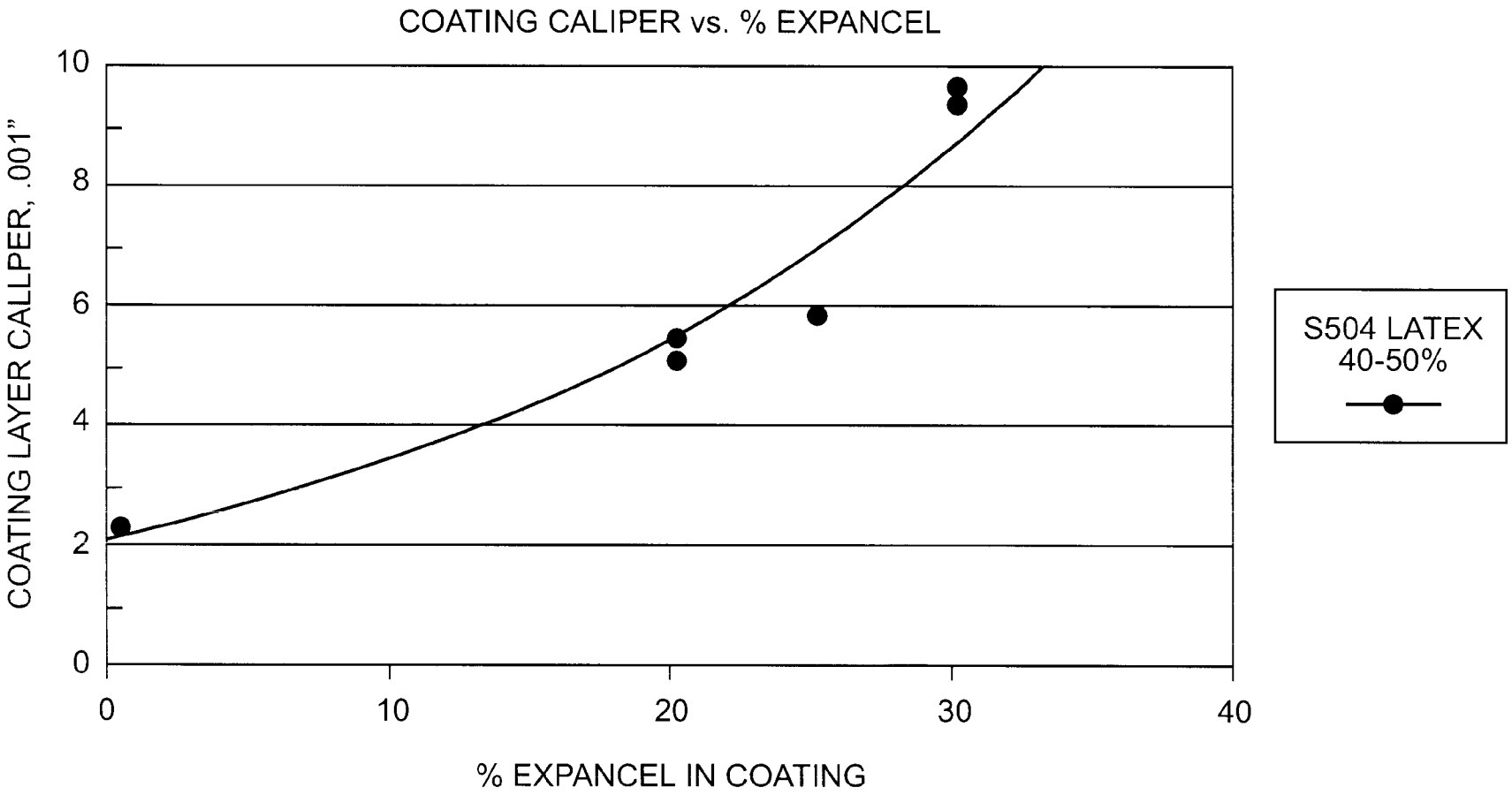
FIG. 7 is a graph illustrating the coating layer caliper versus the percent of the microspheres in the textured coating.
Figure 8:
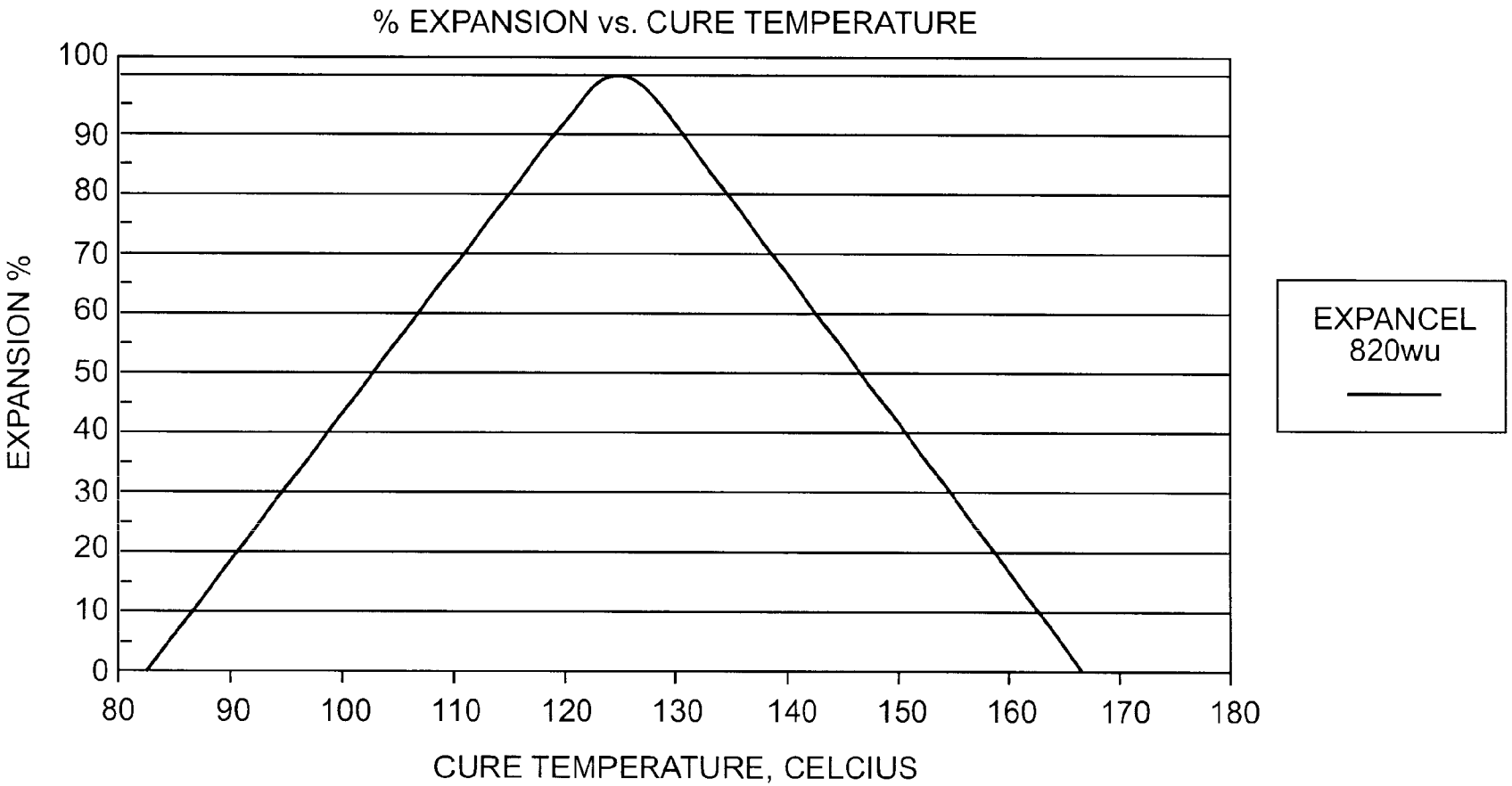
FIG. 8 is a graph illustrating the microsphere expansion in the textured coating in percent versus the cure temperature.

C. Perceptual bulk enhancement is a function of coating thickness and pattern. Actual bulk enhancement is primarily a function of microsphere percentage in the coating formulation, curing temperature of the coating, and the thickness of "wet" coating applied. Another factor that may control expansion of the microspheres is cure time of the polymeric binder. FIG. 7 reveals the change in dry coating caliper that results with microsphere addition. Data include variables where cure temperatures were close to the optimum 125 degrees Celsius and polymeric binder comprising 40–50% of total coating solids. FIG. 8 illustrates the approximate effects of cure temperature on coating expansion from manufacturer literature.

Figure 9A:
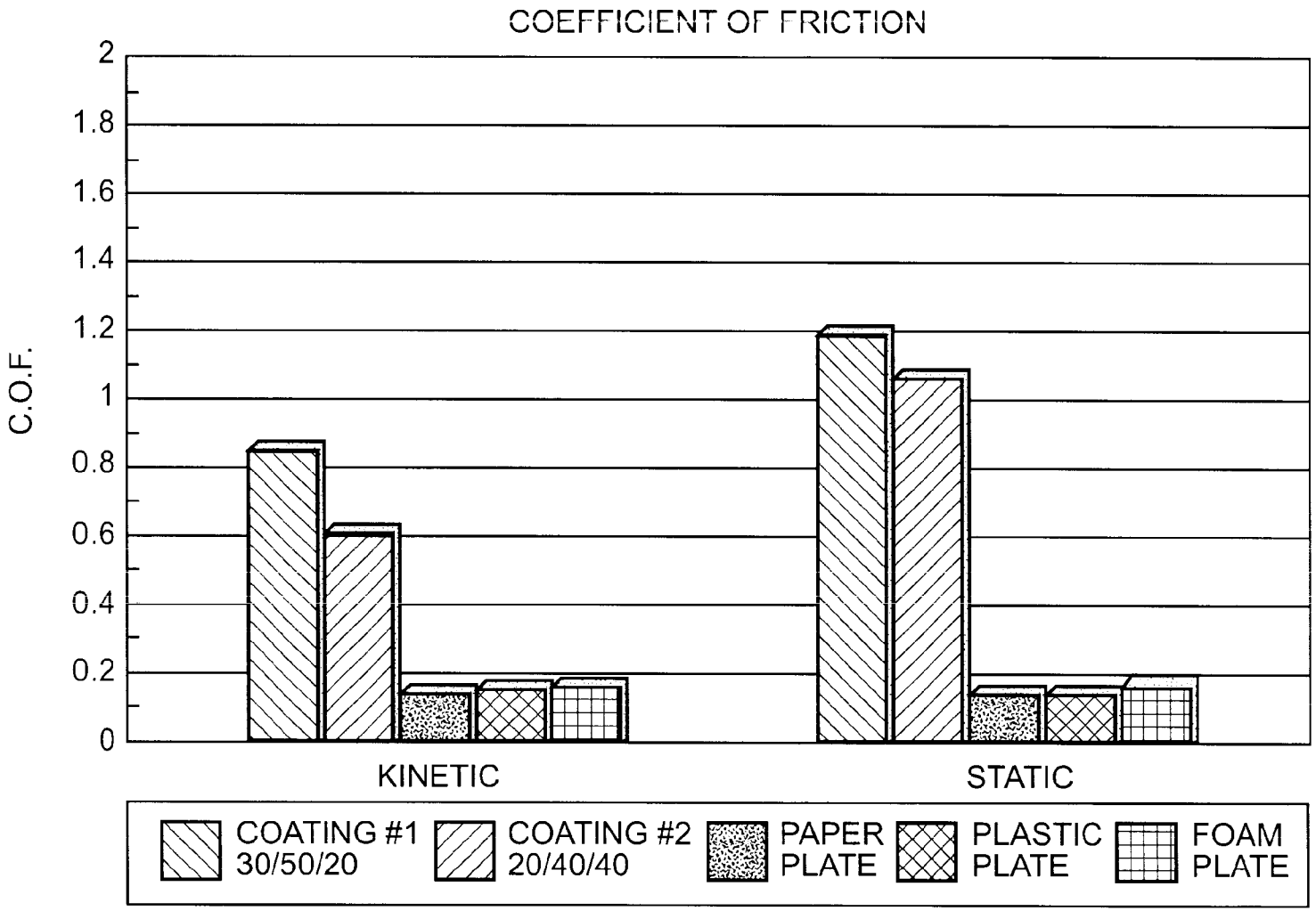
FIG. 9A is a bar graph illustrating the kinetic and static coefficient of friction of the texture coated articles of this invention versus prior art articles.
Figure 9B:
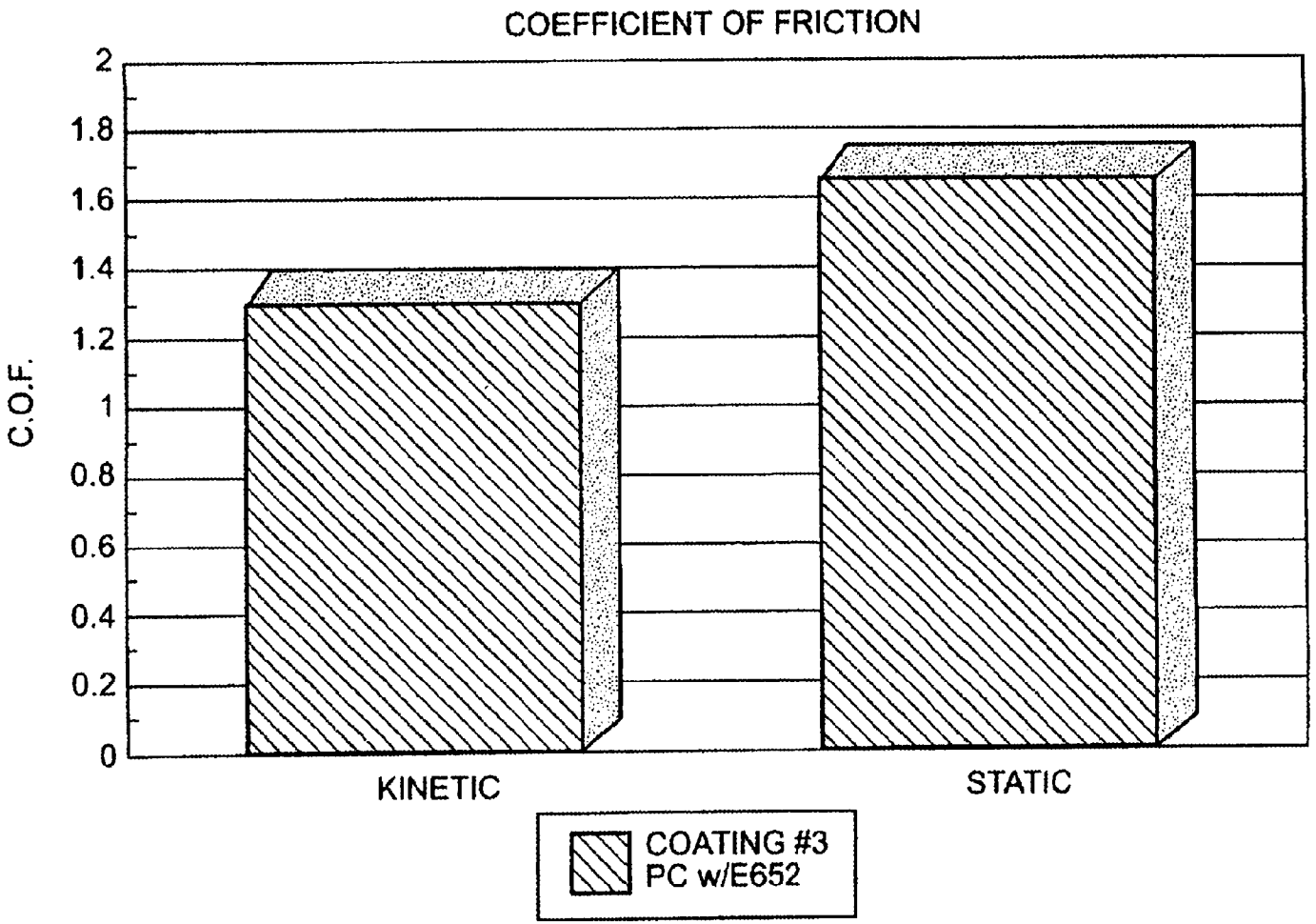
FIG. 9B is a bar graph illustrating the static and kinetic coefficients of friction of a coating in accordance with the present invention.
Figure 10:
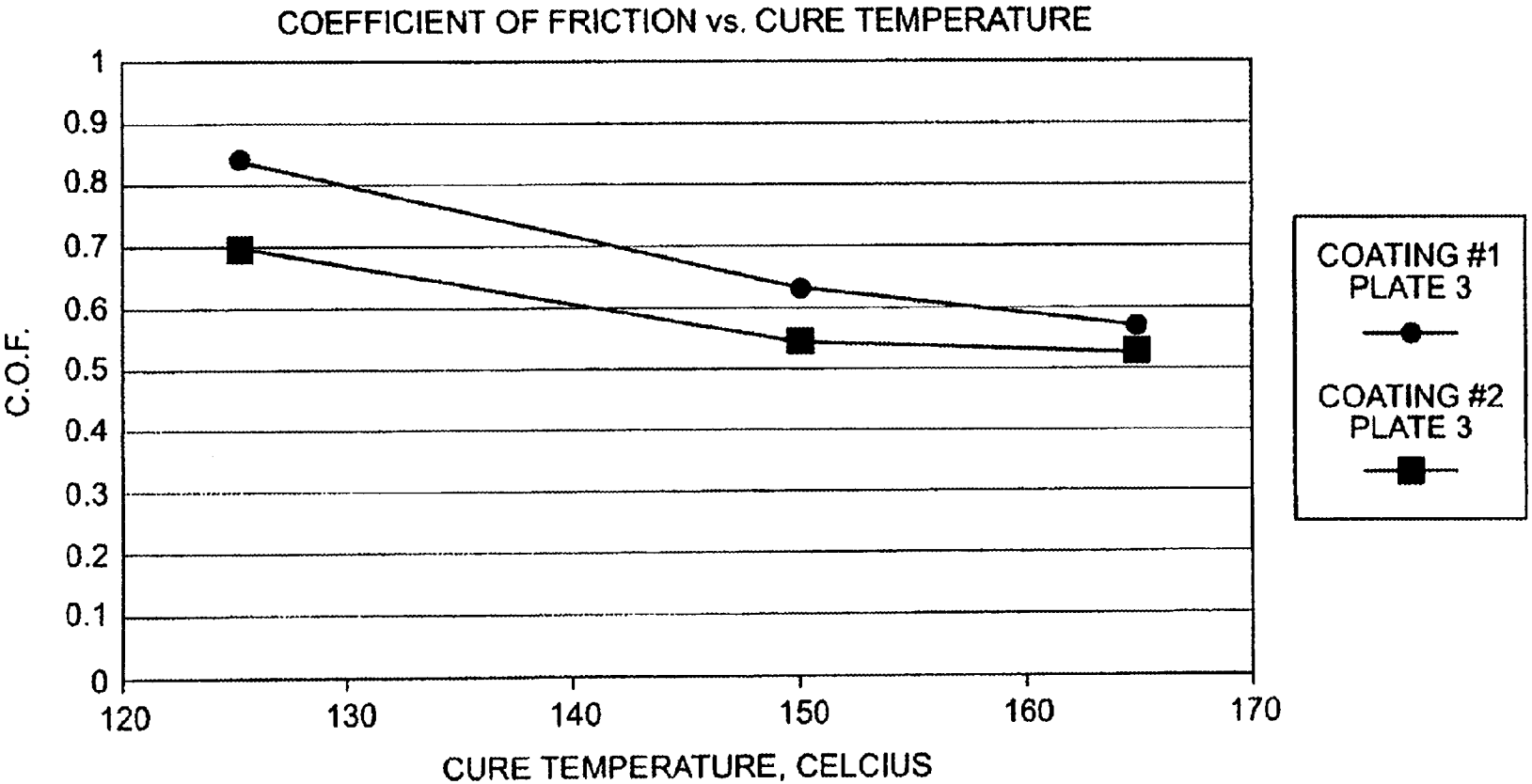
FIG. 10 is a graph illustrating the coefficient of friction of the texture coated surface versus cure temperature.
Figure 11:
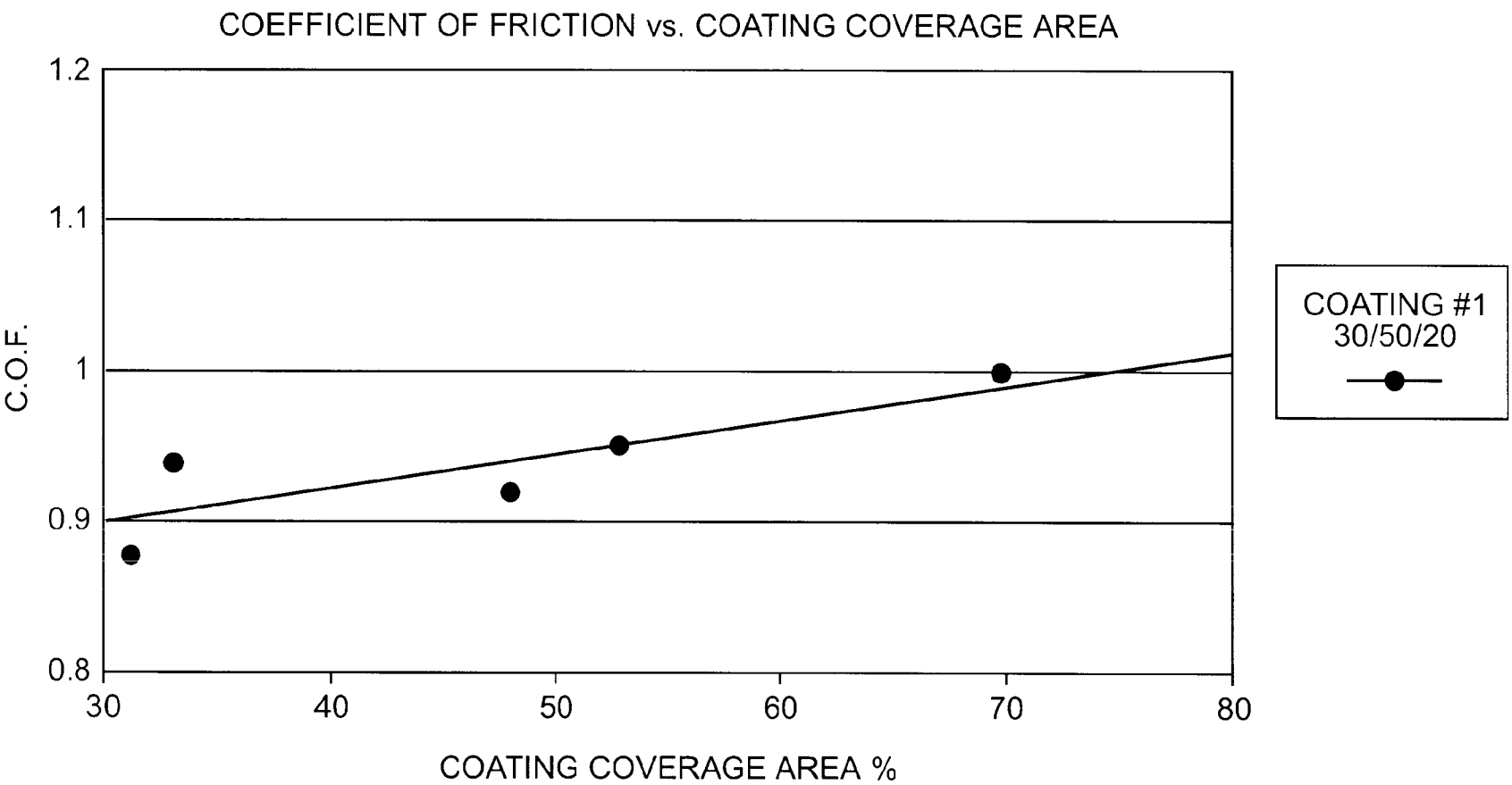
FIG. 11 is a graph illustrating the coefficient of friction versus percent of the surface covered with the textured coating.

D. FIGS. 9A and 9B illustrate the significant increase in kinetic and static coefficients of friction (C.O.F.) the coating offers versus present platestock. A modified TAPPI test method M-549 was used to measure friction. The modification included using a metal plate over which we slide the paper and measure the kinetic coefficient of friction. C.O.F. is a ratio defined as the force (in grams) required to initiate movement of a 500 gram loaded sample divided by 500. The design of FIG. 4C was used for Coating #1 and #2. Coating #3 in FIG. 9B is manufactured by Press Color of Milwaukee, Wis. under the name HiVis#D. The coating is a blend of binding agents, expandable microspheres, and conventional other coating components. FIGS. 9A and 9B through FIG. 11 show the effect of cure temperature and percentage coating coverage area on C.O.F.

Figure 12:
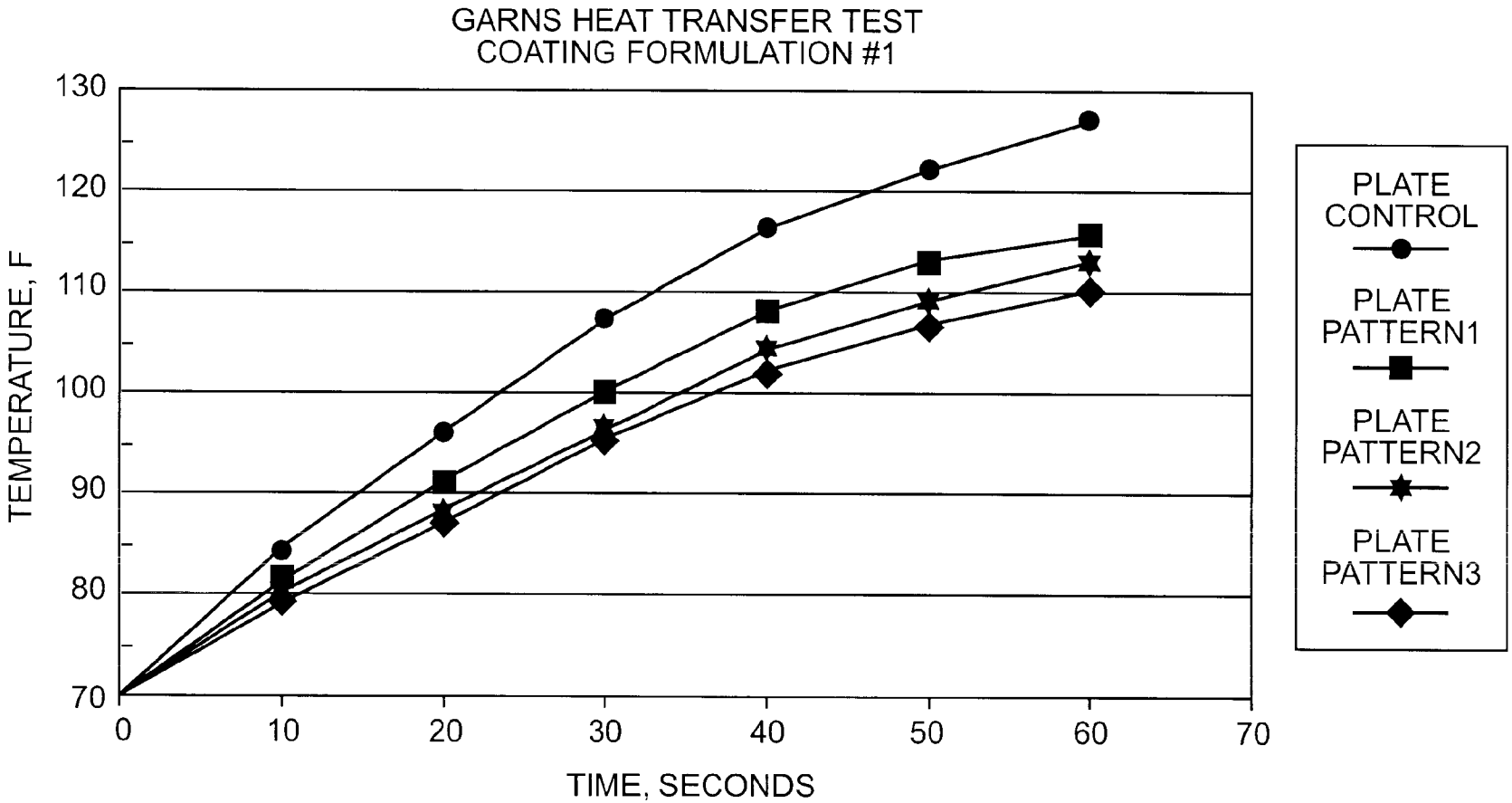
FIGS. 12, 13, and 14 are graphs of the Garns Heat Transfer Test plotting temperature versus time.
Figure 13:
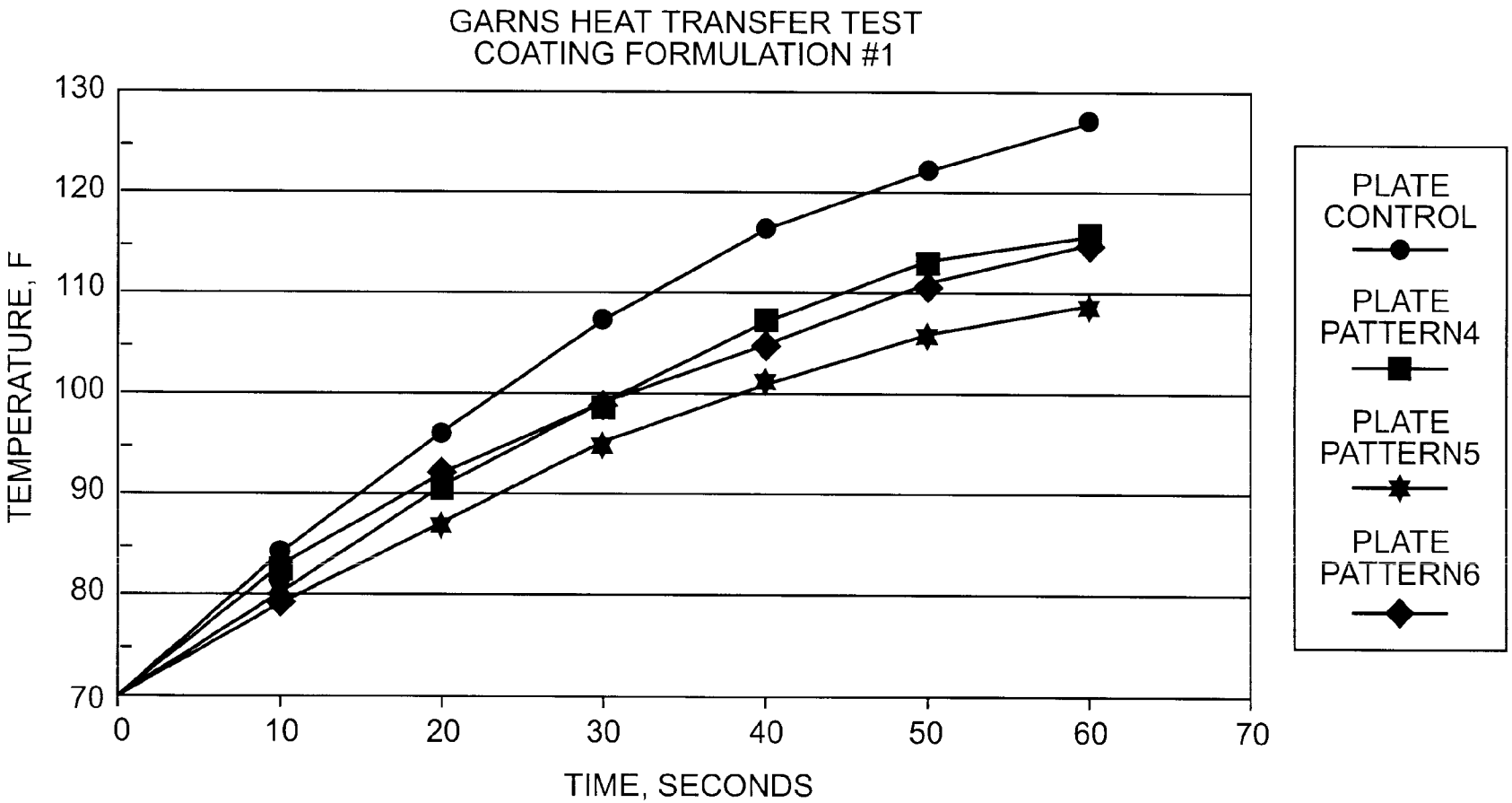
Figure 14:
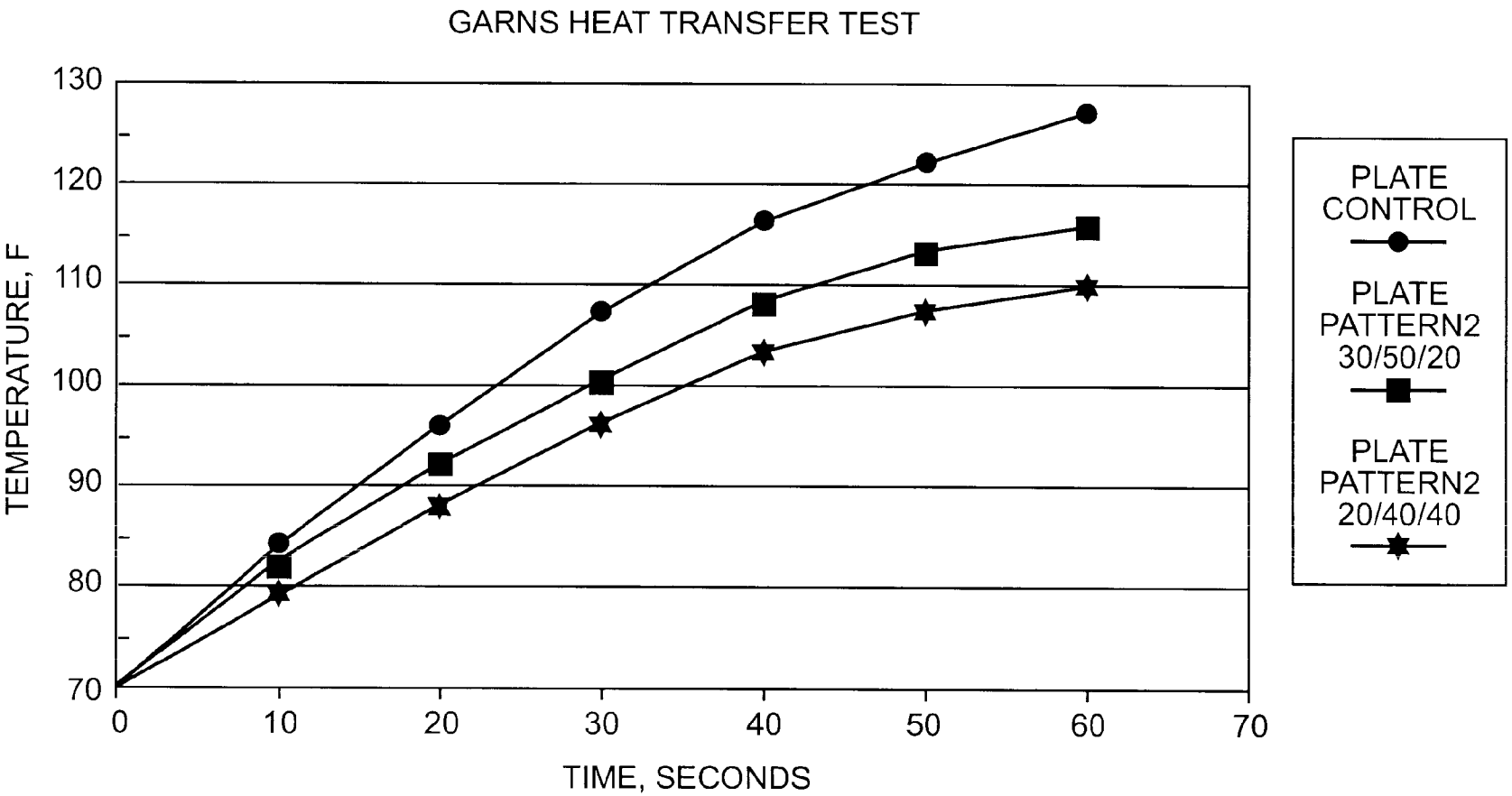
Figure 15:
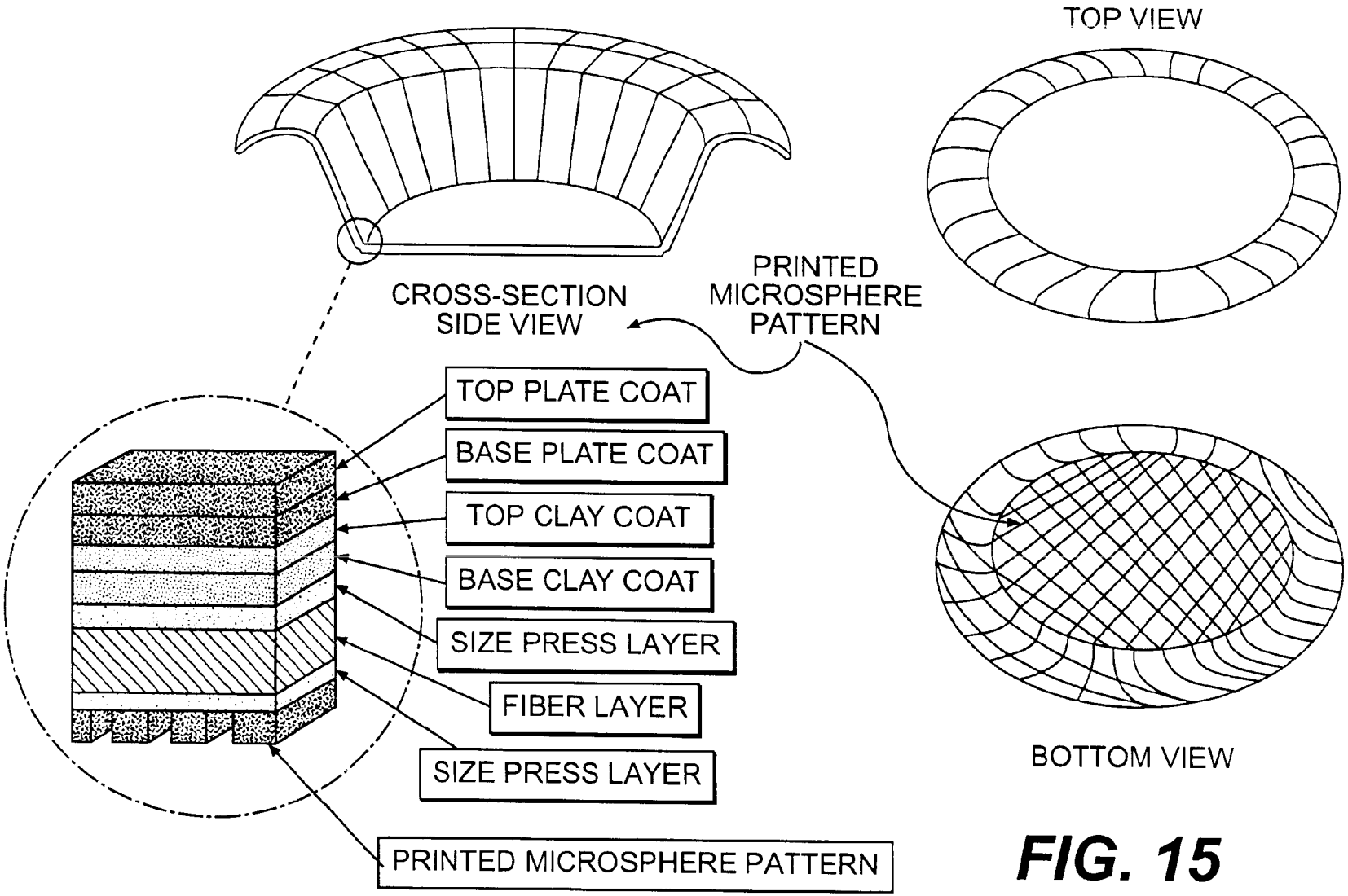
FIG. 15 is a drawing of the plate of this invention illustrating the textured bottom coating and the cross sectional composition of the plate.
Figure 16:
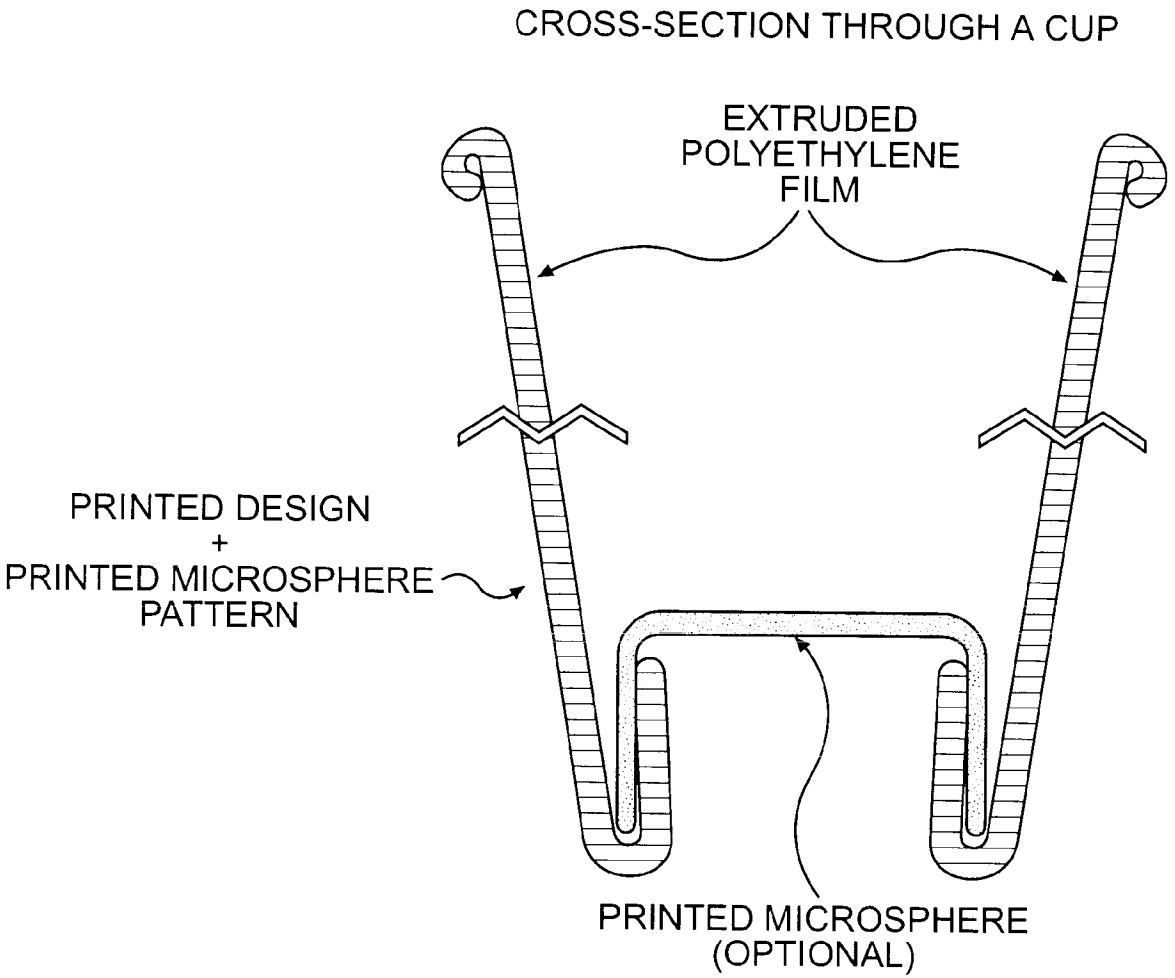
FIG. 16 is a drawing of a cross section of a cup showing the textured microsphere coating.

E. FIGS. 12, 13, and 14 represent the coating's ability to decrease heat transfer z-directionally through a platestock sample coated with the two formulations described earlier, utilizing the various patterns.

The heat transfer is measured by the Garns Heat Transfer Test which comprises plotting temperature versus time as shown in the FIGS. 12 through 14. In this test the sample to be tested is placed on top of a heated block held at a constant 190° F. A thermocouple mounted in a rigid medium is placed on the sample. The thermocouple measures the temperature increase with time. A rigid insulating material is placed on top of the thermocouple containing medium. A weight of approximately 500 grams is placed on top of the insulating material. The better insulated containers show a lower temperature increase over time as is demonstrated by FIGS. 12 through 14.

EXAMPLE 2

Coated Mate Formation

Below is a description of the process for applying textured coating using a Neenah Technical Center Faustel coater rotogravure deck and subsequent product formation. A commercially available coating sold by Industrial Adhesive Corporation of Chicago, Ill., under designation DB-3-DS was used. This coating comprises an acrylic binder to which have been charged a blend of adhesives and 16–30% microspheres. The coating delivers a textured coating with a height of approximately 0.001"–0.010". Applied coating can not be removed from the paper substrate without effort. The coating is applied using the design illustrated in FIG. 4C with a coverage area of 55%. Three pounds of the coating were applied to a 3000 square foot ream of paperboard.

The roll was chemically etched by Gravure, Inc., of Lymon, S.C., using an 85-line screen with a 10–12 pitch wall, 80–85 microns in depth. A 12-inch wide pattern was etched continuously around the roll face. Coating was applied to Naheola Specification 1213 200-pound/ream paperboard at 300 fpm with both gas fired dryers set at 450° F. Sheet temperature exiting the oven section ranged from 180° F.–220° F. These temperatures were not sufficient to expand the microspheres but were sufficient to dry the coating. The board was moistened to approximately 7–9% using a 75 Quad roll and a polyolefin wax solution.

Superstrong® 9-inch plates were formed on the Peerless 28 press using P070 dies at 300° F. Machine speed was set at 50–60 strokes per minute. Microspheres in coating were expanded as the plate was formed at about 300 to about 1500 psi pressure.

EXAMPLE 3

Preparation of Texture Coated Hamburger and Sandwich Wrap

Figure 4A:
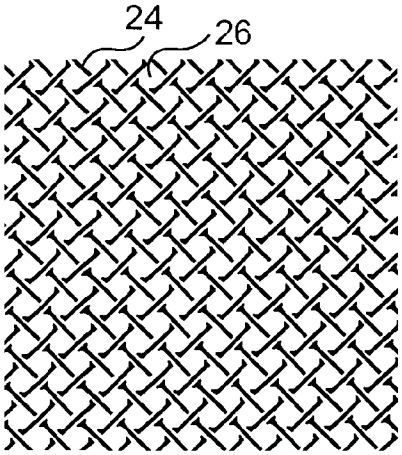
FIGS. 4*a*–4*f* are bottom views of containers made in accordance with the present invention showing alternate texture-coating arrays.
Figure 4B:
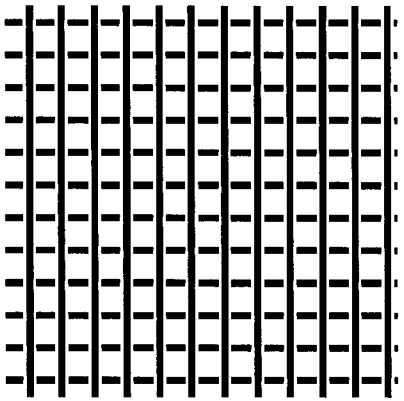
Figure 4C:
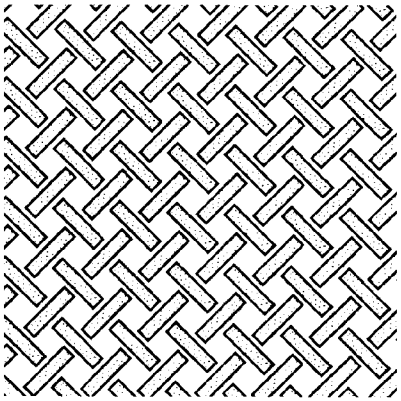
Figure 4D:
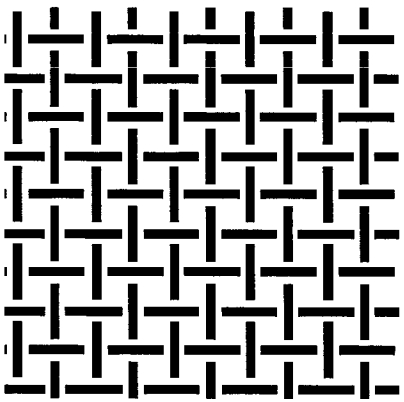
Figure 4E:
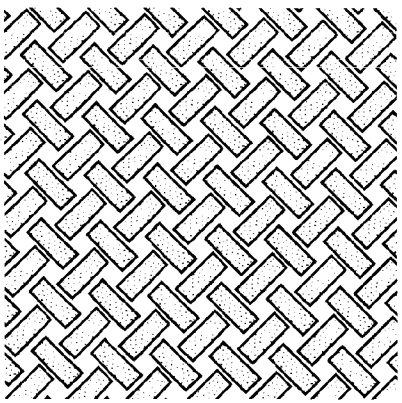
Figure 4F:
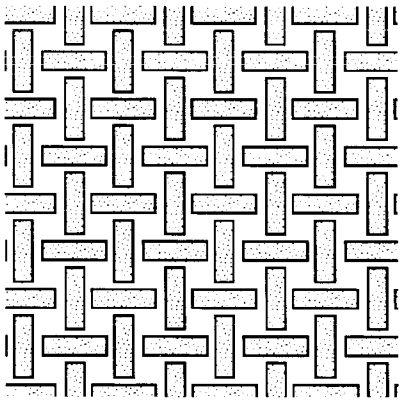

Hamburger and sandwich wrap specimens of 14 mil and 19 mil depths were screen-printed with a textured coating comprising 30% Expancel, 820 microspheres, 50% Acronal S504 latex binder, and 20% clay pigment. Thickener (Alcogum L-29) was added to facilitate screen-printing. A coating weight of thirteen pounds per 3000 square foot ream was applied generating 8 mils of coating caliper. FIG. 4E design was used for the pattern for the screen-printed hamburger or sandwich wrap textured pattern. The coated wrap had a significantly greater thermal insulation for the hand touching the surface, and the wrap had also much improved friction resistance. The thermal and friction resistance is comparable to that obtained when textured plates or cups are produced.

EXAMPLE 4

Sample of Texture Coated Hamburger Wrap

Hamburger wrap specimens of 14 mil and 19 mil depths were screen printed as disclosed in Example 3. The solids formulation were as follows:

TABLE 4

Expancel Coating for Hamburger Graphic on Quilt Wrap

| % Dry Solids | | Compound Solids | Addition order |
|---|---|---|---|
| 29.0 | Expancel 820 microspheres | 45% | 2 |
| 48.0 | BASF Acronal 504 latex | 50% | 1 |
| 19.0 | Hydrafine Clay | 70% | 3 |
| As desired | Alcogum L-29 Thickener | 30% | 7 |
| 4 | Glycerin | 100% | 5 |
| <1 | Drewplus L407 Antifoam | 28% | 4 |
| As desired | Notox Ink | 100% | 6 |

Figure 37:
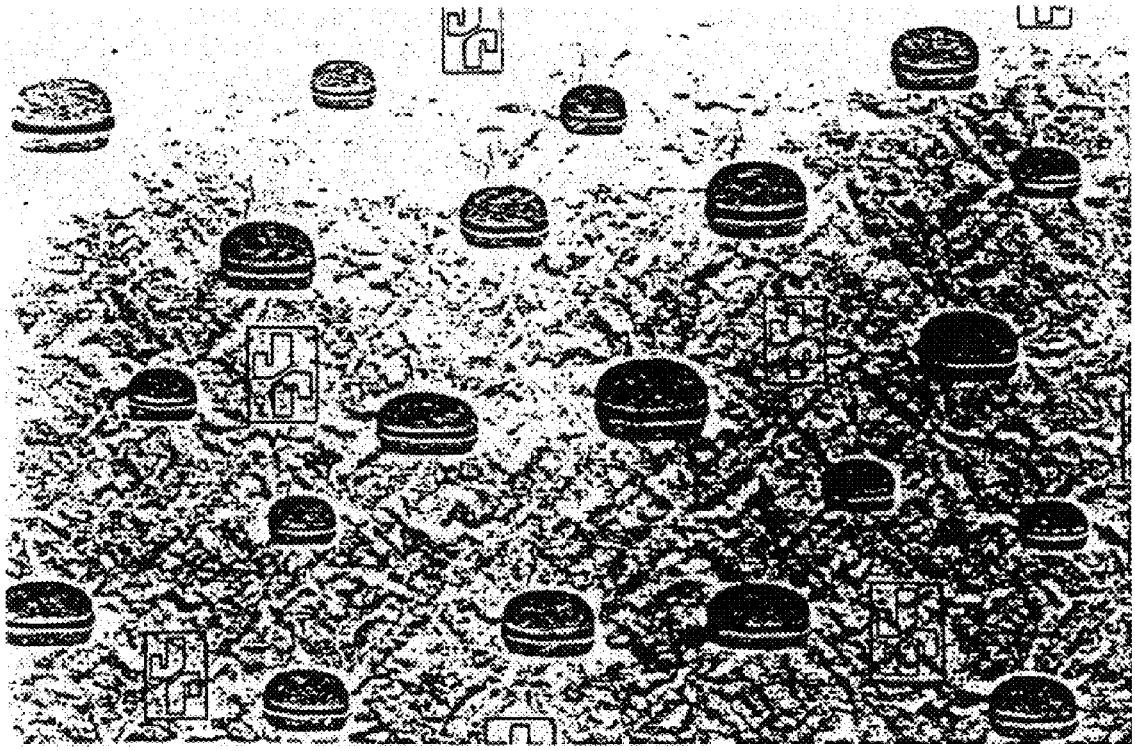
FIG. 37 is a photograph of a section of the texturized hamburger wrap.

The resulting texture coated hamburger wrap is shown in FIG. 37 which is a photograph of a section of the hamburger wrap.

EXAMPLE 5

Insulation Properties Texture Coated Hot Dunk Cup

The following data on the insulating properties of textured coating for hot drink cups was obtained from hold time panel tests measuring how long hot drink cups could be held when filled with 190° F. hot water. The textured coating was screen-printed on the outer surface of the cups using a commercial screen press. The cups were 16-ounce cups made from both the James River commercial sidestock and from bulk-enhanced board sidestock prepared as shown in the Examples of Ser. No. 08/716,511 filed on Sep. 20, 1996. The commercial sidestock had a fiber weight of 126 pounds per 3000 square foot ream and a thickness of 0.0126 inches. Also, the commercial sidestock was size press impregnated with 13 pounds per 3000 square foot ream of clay pigmented oxidized starch. The bulk-enhanced board sidestock had a fiber weight of 105 pounds per 3000 square foot ream and a thickness of 0.017 inches. This board was impregnated with 18 pounds per 3000 square foot ream of clay pigmented oxidized starch. In both cases clay and starch were at a one to one ratio.

Figure 32:
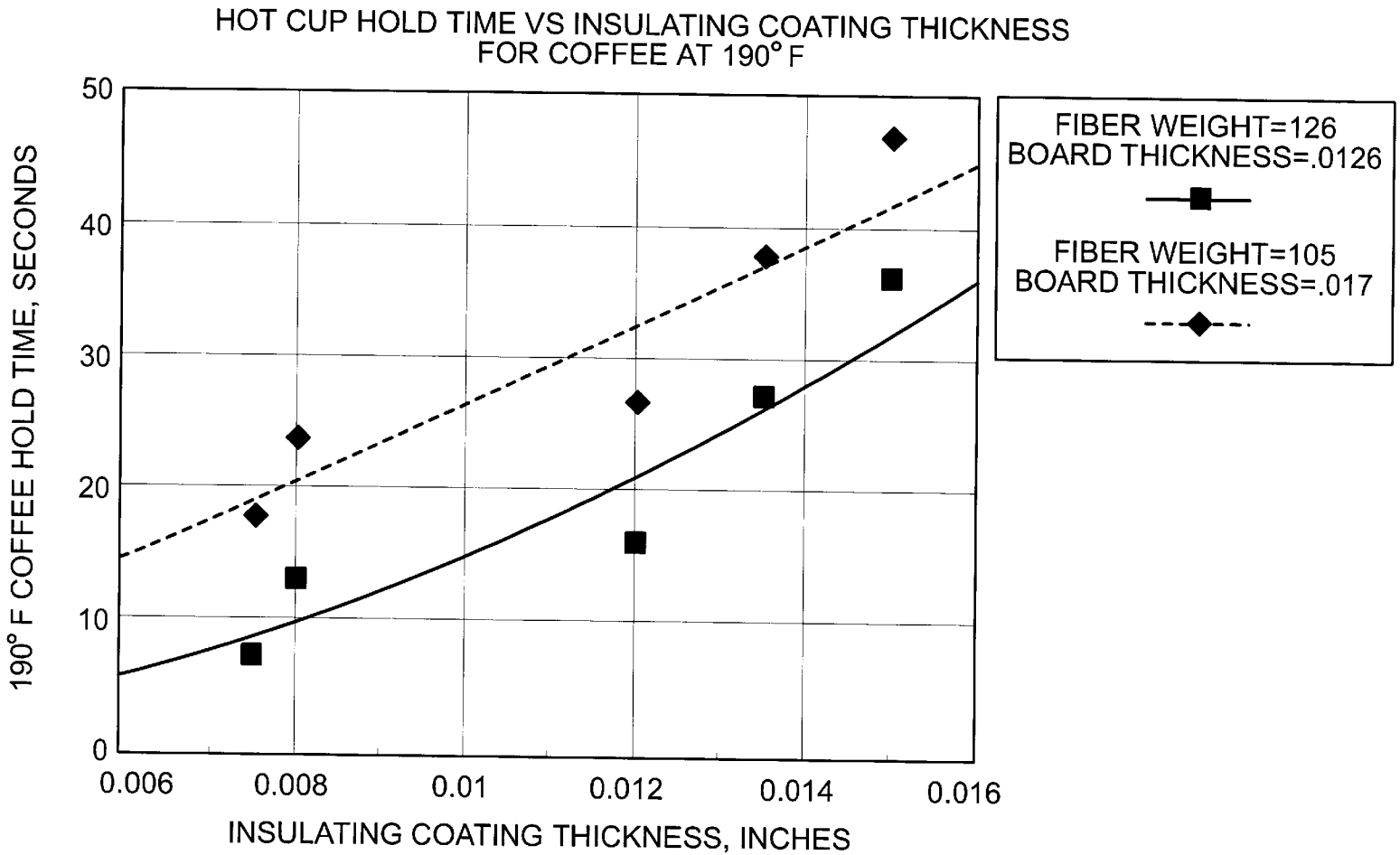
FIGS. 32 and 33 are graphs illustrating the hold time versus fiber mat density.
Figure 33:
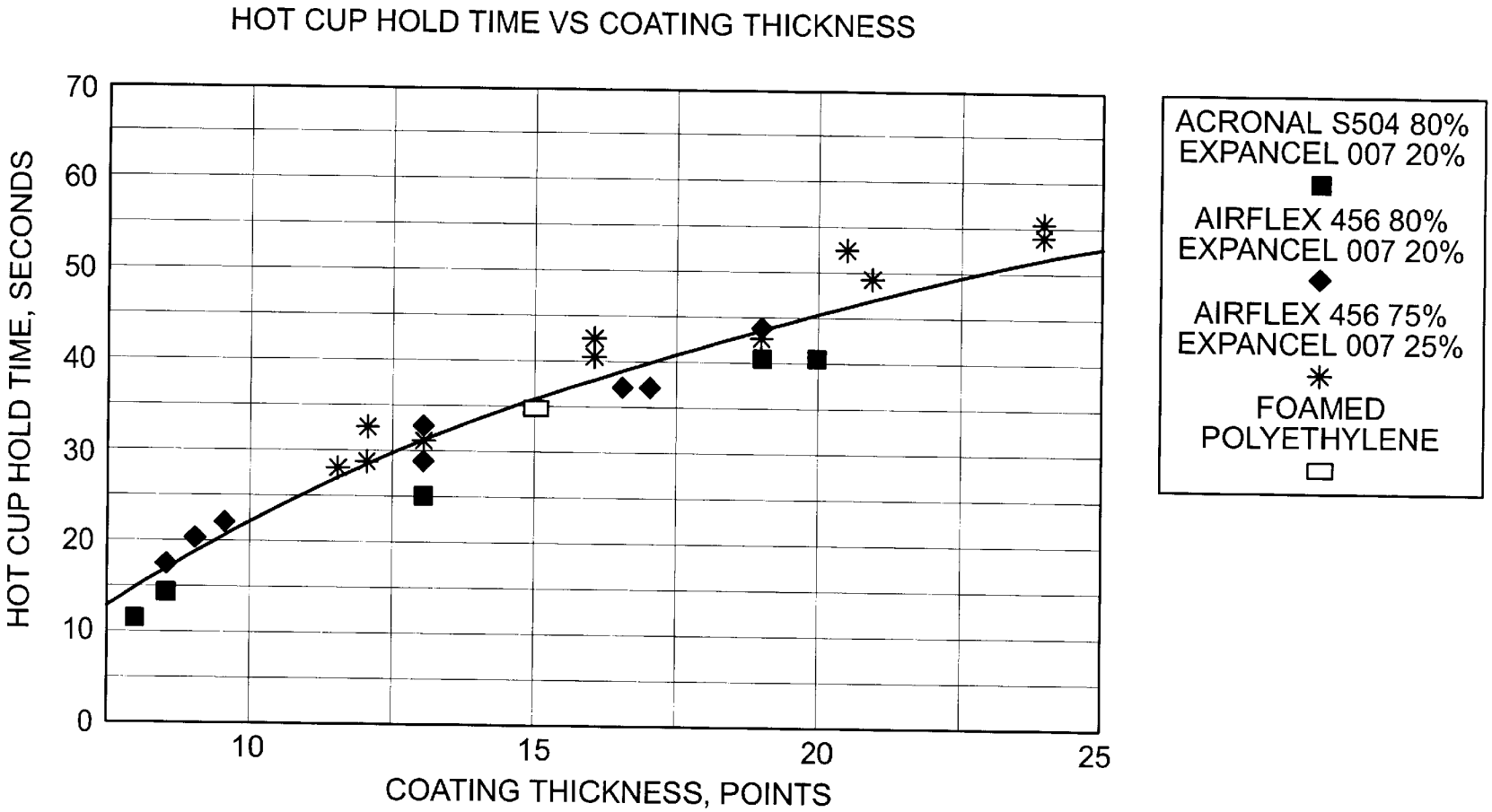
Figure 34:
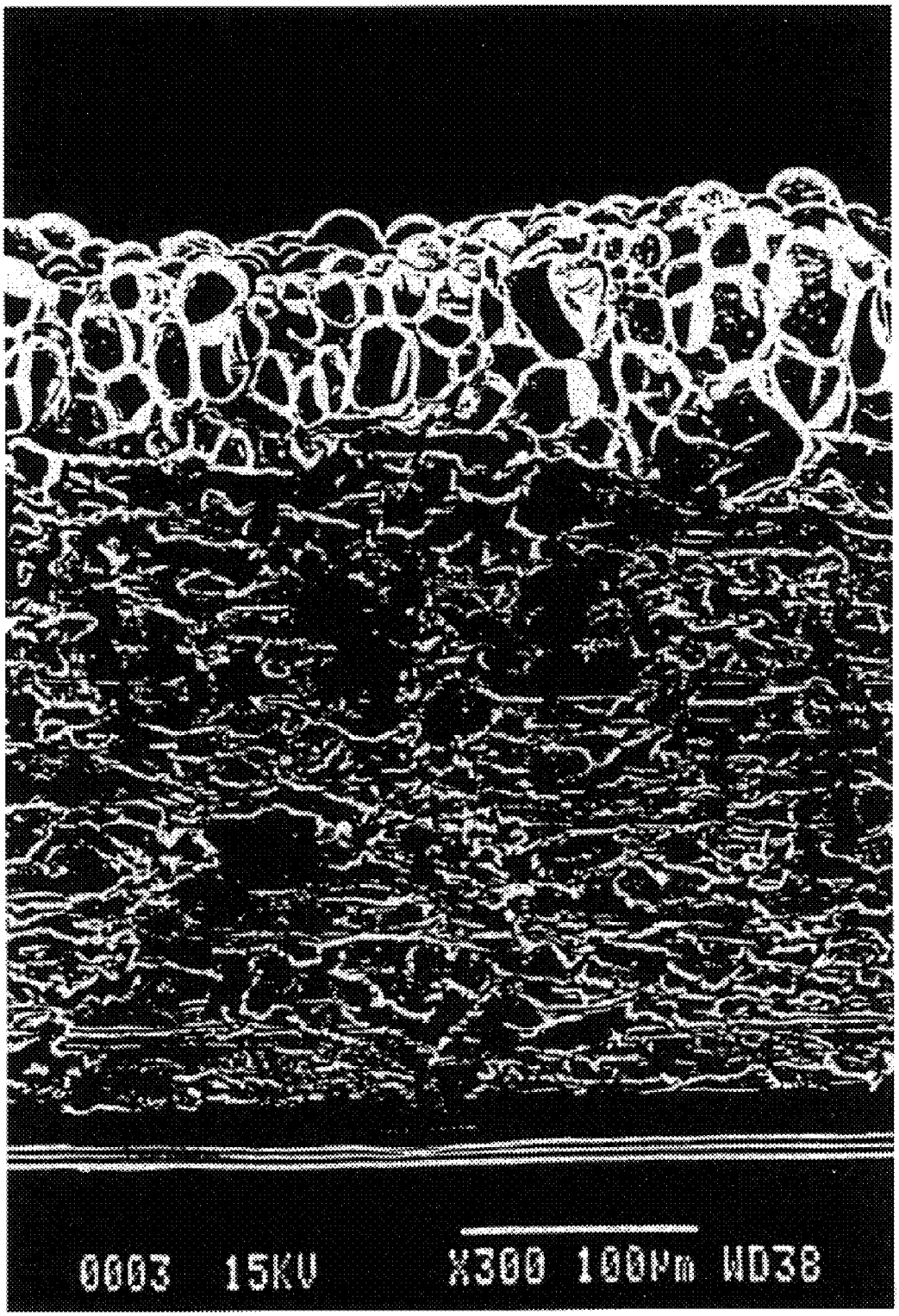
FIG. 34 is a photomicrogram of a 300× magnification of a section through a container prepared in accordance with the present invention showing bulk enhanced paperboard and microsphere textured coating.

Shown in FIGS. 32 and 33 is the number of seconds cups could be held with 190° F. hot water versus the thickness of textured coating and the seconds of hold time just due to the insulating coating. Foamed polyethylene at a thickness of 0.015 inches is also shown along with textured coating. The thermal conductivity of textured coating and foamed polyethylene are similar and therefore they fall on the same coating thickness versus hold time curve. This data shows that texture coating applied at the same thickness as foamed polyethylene will generate similar results and if applied at greater thickness will produce superior results.

Figure 39:
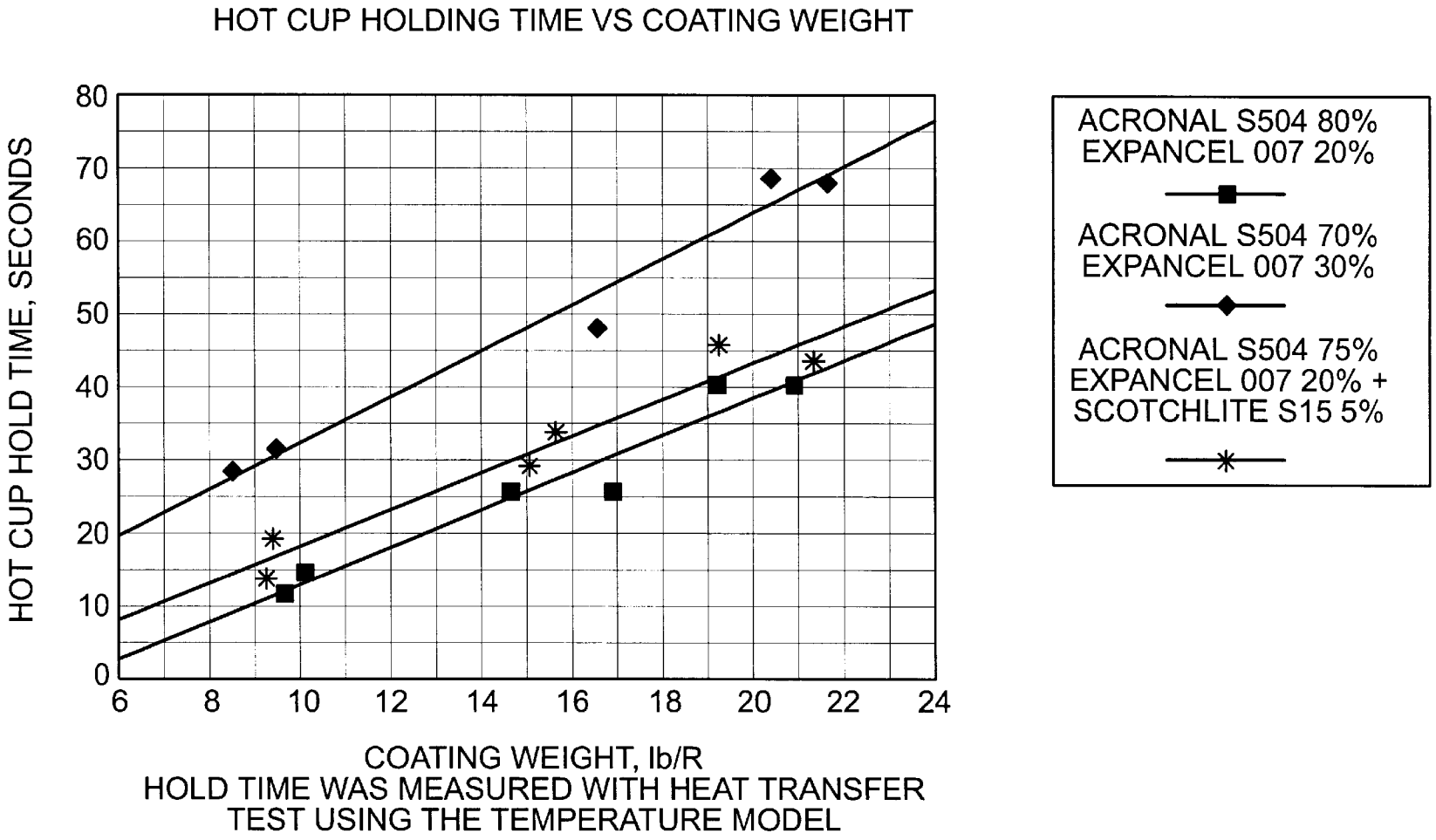
FIG. 39 is a graph comparing the hot cup hold time in seconds versus coating weight in pounds per 3000 square foot ream.

In FIG. 39 data are given for hot cup hold time versus coating weight in pounds per fully coated 3000 square foot ream. The data compares 5% glass and 20% Expancel 007 with 20% and 30% Expancel 007 coatings.

FIG. 32 illustrates the combined impact of insulating textured coating and bulk enhanced board upon hot cup hold time as a function of textured coating thickness. The bulk enhanced board in this case had a fiber mat density of 6.17 pounds per 3000 square feet per 0.001 inch fiberboard thickness as contrasted to James River Corporation's sidestock which had a fiber mat density of 10 pounds per 3000 square feet per 0.001 inch fiberboard thickness. The bulk enhanced board increased hold time 17 seconds while commercial sidestock increased hold time 7 seconds. Bulk enhanced board reduced the thickness of textured coating required for our hold time target of 35 seconds by 3 points (0.003 inches) over that required with commercial sidestock.

Figure 63:
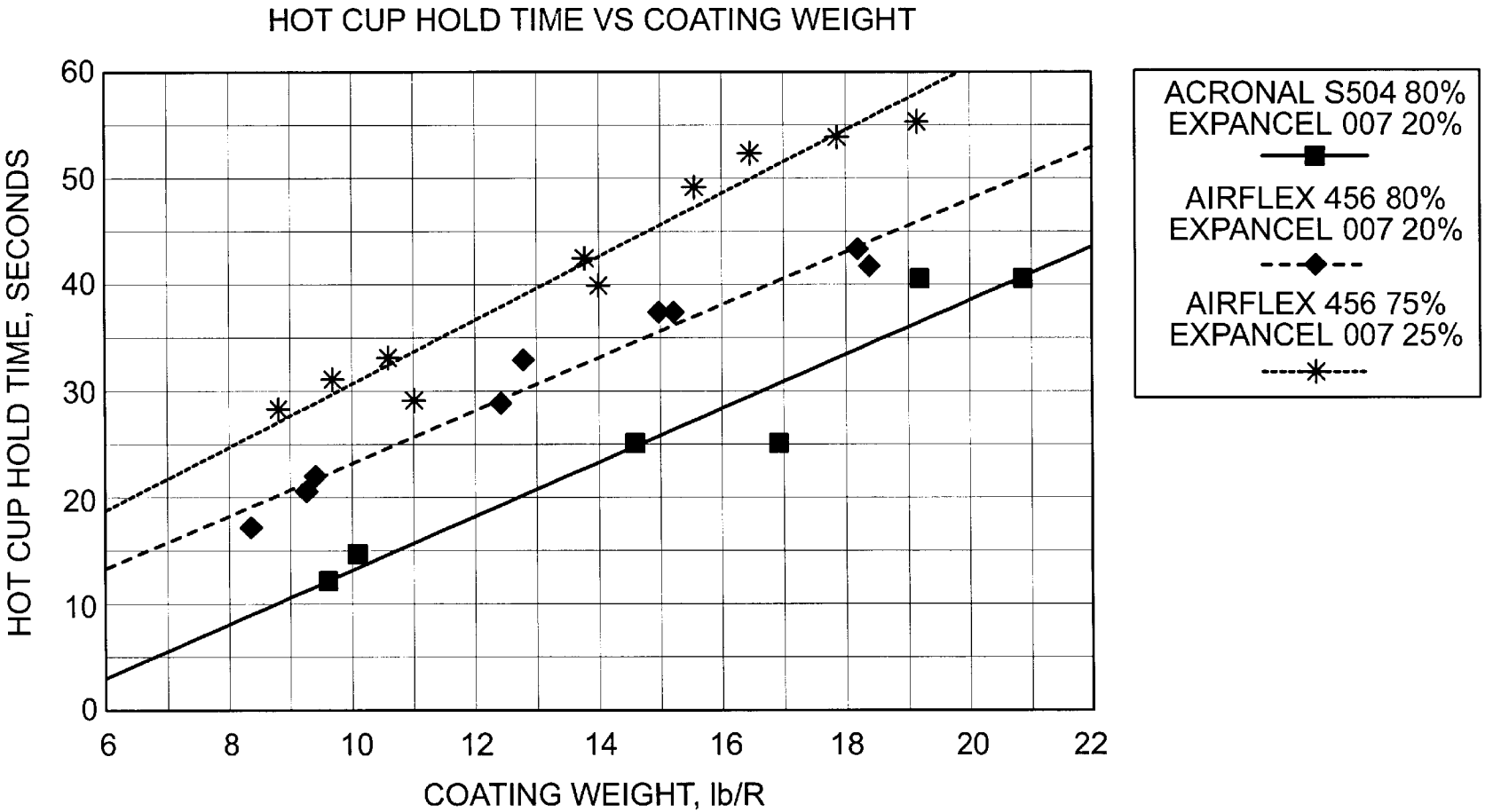
FIG. 63 is a graph showing hot cup hold time versus coating weight for different latexes.

FIG. 33 illustrates the effect of textured coating thickness upon hold time for a variety of textured coating formulations. The coatings of this invention are compared to Perfectouch® technology (foamed polyethylene). The dominant insulating coating variable controlling hot cup hold time is coating thickness. This is true with all the coating formulations shown and foamed polyethylene. This data suggests the thermal conductivity of all these coatings is similar in spite of variation in insulating gas content since the coatings do not have similar densities. The textured coating data in this figure come from the same experiment shown in FIG. 63 where hot cup hold time is shown as a function of coating weight instead of coating thickness. The difference in performance of the three formulations shown in FIG. 63 is due to differences in coating thickness at the same coating weight. Increases in coating thickness at the same coating weight and same microsphere level was accomplished by changing latex from the acrylic dispersion Acronal S504 to the ethylene vinyl chloride Airflex 456. The Airflex latex allowed greater expansion of Expancel 007 due to its lower glass transition temperature. The Acronal latex had a glass transition temperature of 4° C. while the Airflex latex had a glass transition temperature of 0–3° C. Since Airflex was a softer latex, it offered less constraint to the expansion of the microspheres during the drying process.

FIG. 39 illustrates the insulating properties of various insulating agents of this invention. Glass microspheres (Scotchlite S15) were blended with Expancel 007 improving hot cup hold time. Five percent glass microspheres were blended with twenty percent organic microspheres (Expancel 007). The addition of the glass microspheres improved hot cup hold time over the Expancel blown coating alone. The glass microspheres are hollow and filled with air thus serve as superior insulation agents.

Figure 40:
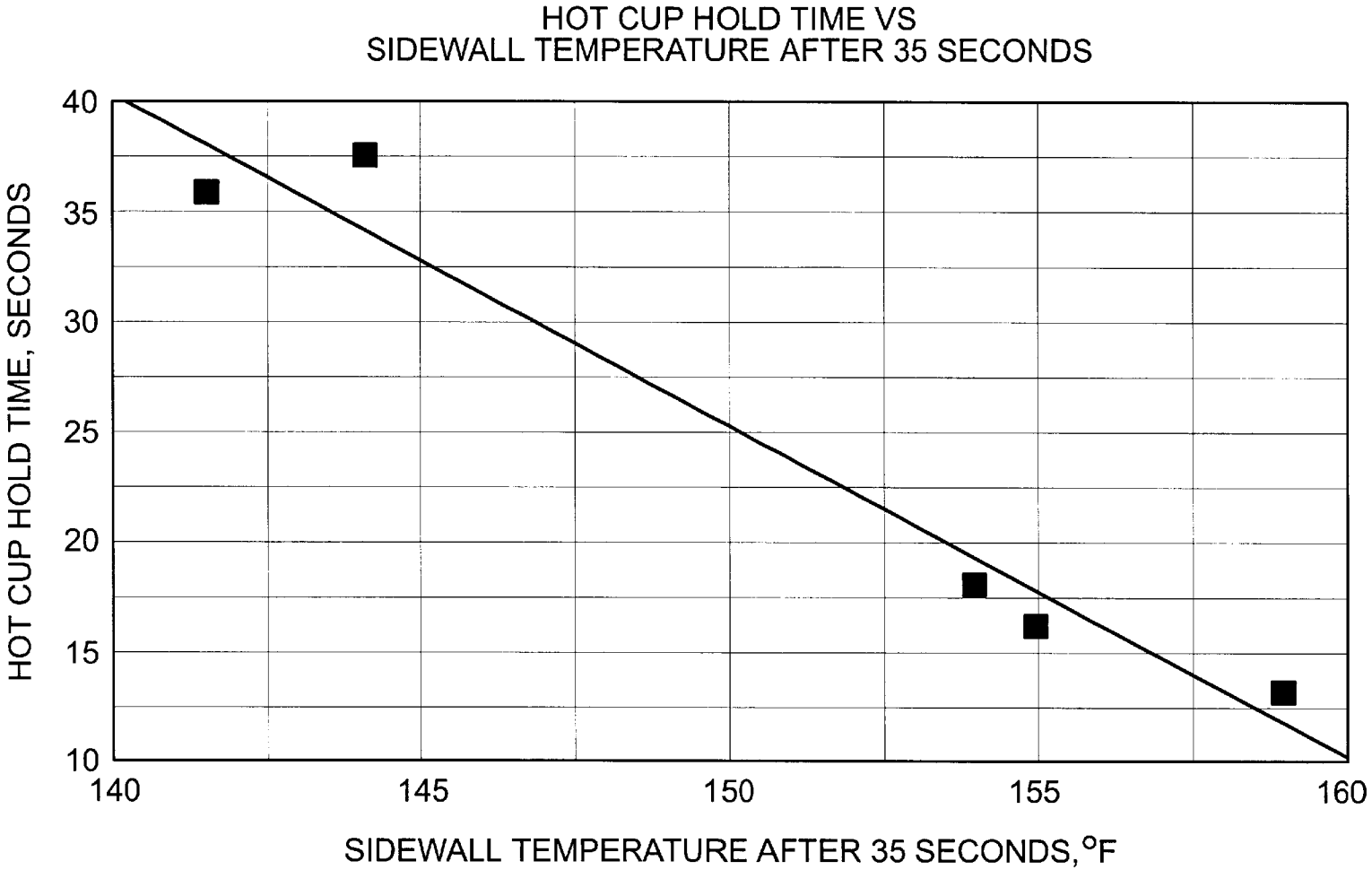
FIG. 40 is a graph showing hot cup hold time versus sidewall temperature.

FIG. 40 shows the sidewall surface temperature after 35 seconds hold time. Plotted is hold time versus side wall temperature for cups that were at and below the hold time target of 35 seconds. The side wall temperature for cups at the target hold time of 35 seconds was 143° F. The human body's ability to cool the fingers when holding the side wall reduced actual skin temperatures below this level preventing any potential injuries.

Suitable latex binders have a glass transition temperature of about −30° C. to +30° C., preferably −10° to +10° C. Representative latexes are set forth in Table 5.

TABLE 5

| LATEX | TYPE | SOLIDS % | Tg ° C. |
|---|---|---|---|
| Acronal S504 | Acrylic Dispersions | 50 | +4 |
| Acronal S728 | Acrylic Dispersions | 50 | +25 |
| Henkel 2a-5393-2 | Acrylic Dispersions | 50 | — |

TABLE 5-continued

| LATEX | TYPE | SOLIDS % | Tg ° C. |
|---|---|---|---|
| Henkel 2b-5393-2 | Acrylic Dispersions | 42 | — |
| Styronal BN 4204 | Styrene-Butadiene | 51 | −28 |
| Styronal ND 430 | Styrene-Butadiene | 50 | −7 |
| Styronal NX 4515X | Styrene-Butadiene | 50 | −4 |
| Styronal BN 4606X | Styrene-Butadiene | 50 | +6 |
| GenCorp 576 | Styrene-Butadiene | 50 | +2 |
| GenCorp 5084 | Styrene-Butadiene | 50 | +20 |
| GenCorp 5092 | Styrene-Butadiene | 50 | −0 |
| GenCorp 5098 | Styrene-Butadiene | 48 | −22 |
| Airflex 100HS | Vinyl Acetate Ethylene | 55 | +7 |
| Airflex 199 | Vinyl Acetate Ethylene | 50 | +24 |
| Airflex 456 | Ethylene Vinyl Chloride | 52 | 0 |
| Airflex 4500 | Ethylene Vinyl Chloride | 50 | +3 |
| Airflex 4514 | Ethylene Vinyl Chloride | 50 | +12 |
| Airflex 4530 | Ethylene Vinyl Chloride | 50 | +29 |

Figure 64:
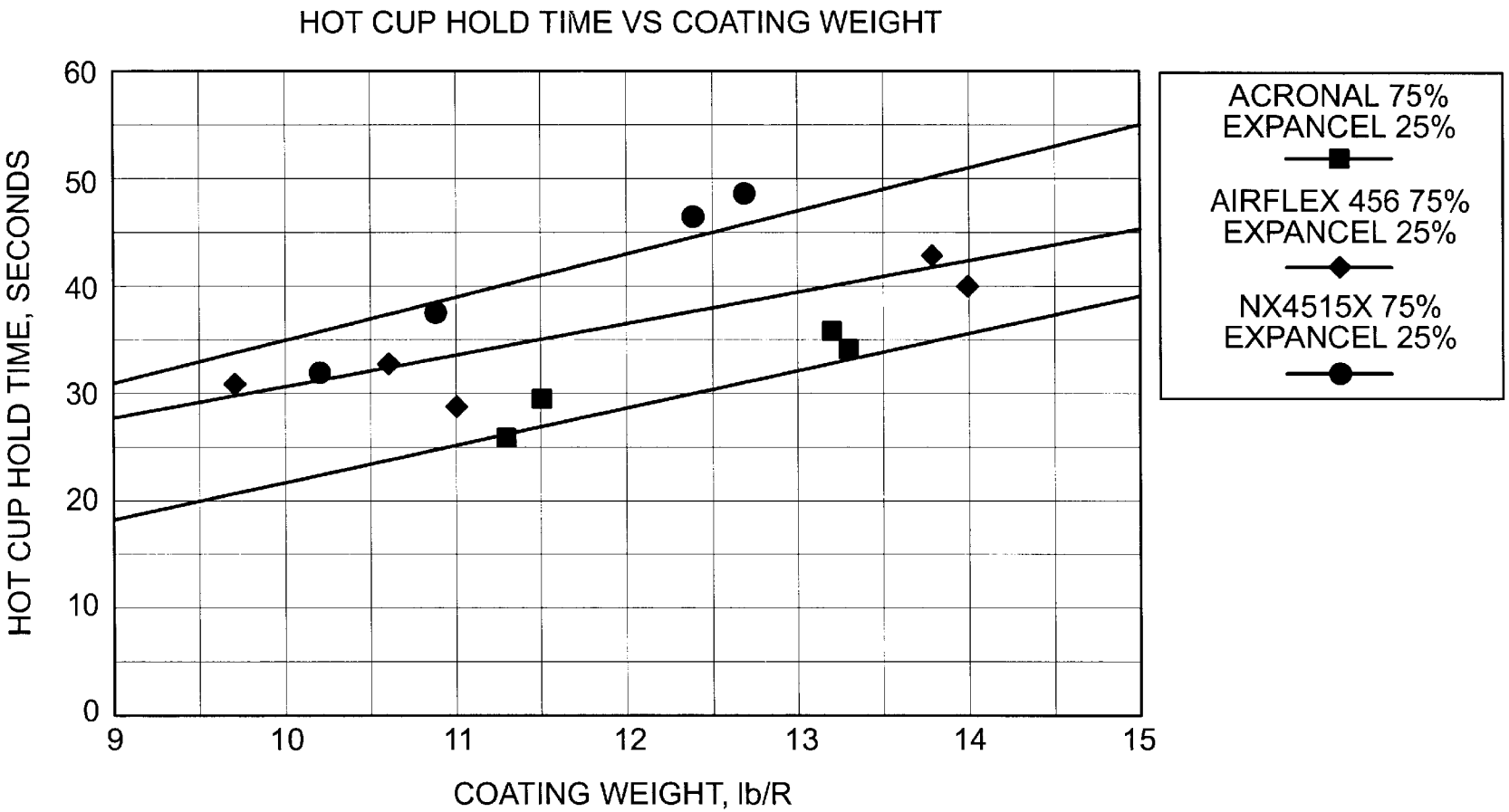
FIG. 64 is a graph showing hot cup hold time versus coating weight for different latexes.

FIG. 64 illustrates the excellent insulation properties Styronal NX451 5X, a styrene-butadiene latex, Acronal S504, an acrylic latex, and Airflex 455, an ethylene vinyl chloride latex. These results show that insulation is improved if the glass transition temperature of the pigment is slightly reduced. The change in Tg affects the rheology of the binder and allows the insulation agent to expand further thus providing higher insulation values.

The advantages of textured or insulated coated cups of this invention over foamed polyethylene cups are as follows:

1. The textured and/or insulation coating can be printed on only those areas required for insulated handling while foamed polyethylene requires total coverage of one side of the cup or container.

2. The textured and/or insulation coating can be printed on in a pattern with open area further reducing the amount of coating required for insulated handling.

3. The textured and/or insulation coating improves grippability due to a much higher static and kinetic coefficients of friction reducing hot fluid spills. The static and kinetic coefficients of friction as shown in FIG. 9 for containers of this invention is 4 to 5 times greater than the kinetic and static coefficients of friction of prior art paper plates, plastic plates, or foamed plates.

4. The textured coating can be incorporated into print designs and logos.

The hold time for these cups is given in FIG. 40.

EXAMPLE 6

Screen Printing

The following method and equipment was suitably utilized to screen-print on one side of the textured and/or insulated paperboard and containers of this invention. The screens used were stretched with Saatilene gold monofilament polyester mesh from Majestech Corporation. The mesh count used was 110 threads per inch at a tension level of 17 Newtons/cm. The theoretical ink deposit is 3.47 cu. in./sq. yd.

The screens were coated with Ulano 925WR, a direct water resistant photo emulsion. They were scoop-coated with two coats on each side (wet on wet). After the screens were dried, they were exposed with a Nuarc 2000 watt Metal Halide exposing unit.

The samples were screen printed using a Saturn 25"×38" model "clam shell" printer manufactured by M & R Printing Equipment, Inc. The squeegee and flood speeds were set at 6. Other settings were: Off-contact at ⅛th", peel adjustment at ½", and the print/flood option on. The squeegee used had a sharp edge with a shore hardness of 70 durometers.

The stock was then run through a Tex-Air 410-48 forced air electric dryer manufactured by American Screen Printing Company. The forced air temperature was approximately 256° F., and the infra red panels at approximately 800° F. The belt speed was set at 3. The gold monofilament polyester mesh was manufactured by Majestech Corporation, Somers, N.Y. The photo emulsion was manufactured by Ulano, Brooklyn, N.Y. The metal halide exposing unit was manufactured by Nuarc Company, Inc., Chicago, Ill. The Saturn "clam shell" printer was manufactured by M & R Printing Equipment, Inc., Glen Ellyn, Ill. The forced air electric dryer was manufactured by American Screen Printing Equipment Co., Chicago, Ill.

The screen printing process mainly involves forcing ink thorough a porous screen stencil to a substrate beneath. A squeegee made of wood or rubber is used to push the ink. The basic equipment includes a table, rigid frame, finely meshed screen, semi-rigid squeegee, stencil materials, and heavy, viscous ink.

The cloth screen is tightly stretched over the frame, and a photo emulsion is applied to it. Film with a positive image is put into vacuum contact with the screen's dry emulsion and exposed to white light. After exposure, the image is washed out with a water spray. The unexposed areas are insoluble and wash out cleanly; exposed areas are painted with a blockout solution that prevents ink from bleeding through the screen. The screen is attached to a table on one side by clamps or hinges or installed in an automatic press location. The screen becomes the image carrier.

The substrate is positioned under the screen and frame. Register tabs are located on the table, or press guides are set in place on the feed table of the press to register each sheet for printing. The screen is lowered and ink is deposited at one end. Then, the squeegee is pressed down and across the length of the screen, forcing the ink through and printing the image.

The ink-film thickness on the substrate is equal to the thickness of the screen's fabric filaments. For fine-line process color work, fine threads or filaments are used, and multiple colors can be removed with solvent sprays after use and the screens reused.

Durable, fine stainless-steel mesh screens capable of reproducing remarkably readable six-point type, along with intricate designs can suitably be utilized.

Both single and multicolor presses can suitably be used. Many are hand fed, with the operator inserting and removing sheets by hand. Some have automatic squeegee impression cycles. The fully automatic machines feed the sheets, register colors, lower the screen and squeegee the print. The sheets are removed to a dryer and then stacked at the other end of the press.

Some presses use round brass screens and print dyes to fabrics from a roll. In-line presses print from one station to another for up to eight or more colors. The process is simple and lends itself to many specialty applications.

Through the use of specially built jigs and printing frames with flexible screens, the process is widely used for printing rounded and irregular surfaces such as containers and tubes. The chief advantage of screen printing is its versatility on many different surfaces, irregular or flat. Screen printing also lays down a smooth, heavy ink-film thickness. Many items are screen printed because they can not be printed any other way.

EXAMPLE 7

Preparation of Bulk Enhanced Paper

In some applications, bulk-enhanced paperboard is suitable. The bulk-enhanced paperboards give greater insulation than conventional boards and also are less expensive than conventional boards since less fiber is used. The manufacture of these boards is disclosed in U.S. Ser. No. 08/716,511 filed on Sep. 20, 1996, and U.S. Ser. No. 08/896,239 filed on Jul. 17, 1997, and both patent applications are incorporated herein by reference, in their entirety. For bulk-enhanced paperboards, retention aids are used to retain the bulk-enhancing additives in the paperboard.

Suitable retention aids function through coagulation, flocculation, or entrapment of the bulk additive. Coagulation comprises a precipitation of initially dispersed colloidal particles. This precipitation is suitably accomplished by charge neutralization or formation of high charge density patches on the particle surfaces. Since natural particles such as fines, fibers, clays, etc., are anionic, coagulation is advantageously accomplished by adding cationic materials to the overall system. Such selected cationic materials suitably have a high charge to mass ratio. Suitable coagulants include inorganic salts such as alum or aluminum chloride and their polymerization products (e.g. PAC or poly aluminum chloride or synthetic polymers); poly(diallyldimethyl ammonium chloride) (i.e., DADMAC); poly(dimethylamine)-co-epichlorohydrin; polyethylenimine; poly(3-butenyltrimethyl ammoniumchloride); poly(4-ethenylbenzyltrimethylammonium chloride); poly(2,3-epoxypropyltrimethylammonium chloride); poly(5-isoprenyltrimethylammonium chloride); and poly(acryloyloxyethyltrimethylammonium chloride). Other suitable cationic compounds having a high charge to mass ratio include all polysulfonium compounds, such as, for example the polymer made from the adduct of 2-chloromethyl; 1,3-butadiene and a dialkylsulfide, all polyamines made by the reaction of amines such as, for example, ethylenediamine, diethylenetriamine, triethylenetetraamine or various dialkylamines, with bis-halo, bis-epoxy, or chlorohydrin compounds such as, for example, 1-2 dichloroethane, 1,5-diepoxyhexane, or epichlorohydrin, all polymers of guanidine such as, for example, the product of guanidine and formaldehyde with or without polyamines. In one embodiment, the coagulant is poly(diallyldimethyl ammonium chloride) (i.e., DADMAC) having a molecular weight of about ninety thousand to two hundred thousand and polyethylenimene having a molecular weight of about forty thousand to five hundred thousand.

Another retention system suitable for the manufacture of bulk enhanced paperboards is flocculation. This is basically the bridging or networking of particles through oppositely charged high molecular weight macromolecules. Alternatively, the bridging is accomplished by employing dual polymer systems. Macromolecules useful for the single additive approach are cationic starches (both amylase and amylopectin), cationic polyacrylamide such as for example, poly(acrylamide)-co-diallyldimethyl ammonium chloride; poly(acrytamide)-co-acryloyloxyethyl trimethylammonium chloride, cationic gums, chitosan, and cationic polyacrylates. Natural macromolecules such as, for example, starches and gums, are rendered cationic usually by treating them with 2,3-epoxypropyltrimethylammonium chloride, but other compounds can be used such as, for example, 2-chloroethyl-dialkylamine, acryloyloxyethyldialkyl ammonium chloride, acrylamidoethyltrialkylammonium chloride, etc. Dual additives useful for the dual polymer approach are any of those compounds which function as coagulants plus a high molecular weight anionic macromolecule such as, for example, anionic starches, CMC (carboxymethylcellulose), anionic gums, anionic polyacrylamides (e.g., poly (acrylamide)-co-acrylic acid), or a finely dispersed colloidal particle (e.g., colloidal silica, colloidal alumina, bentonite clay, or polymer micro particles marketed by Cite Industries as Polyflex). Natural macromolecules such as, for example, cellulose, starch, and gums are typically rendered anionic by treating them with chloroacetic acid, but other methods such as phosphorylation can be employed. Suitable flocculation agents are nitrogen containing organic polymers having a molecular weight of about one hundred thousand to thirty million. In one embodiment, the polymers have a molecular weight of about ten to twenty million. In another embodiment, the polymers have a molecular weight of about twelve to eighteen million. Suitable high molecular weight polymers are polyacrylamides, anionic acrylamide-acrylate polymers, cationic acrylamide copolymers having a molecular weight of about five hundred thousand to thirty million and polyethylenimenes having molecular weights in the range of about five hundred thousand to two million.

The third method for retaining the bulk additive in the bulk enhanced fiberboard is entrapment. This is the mechanical entrapment of particles in the fiber network. Entrapment is suitably achieved by maximizing network formation such as by forming the networks in the presence of high molecular weight anionic polyacrylamides, or high molecular weight polyethyleneoxides (PEO). Alternatively, molecular nets are formed in the network by the reaction of dual additives such as, for example, PEO and a phenolic resin.

EXAMPLE 8

Internal Sizing in the Manufacture of Paperboard

The paperboard useful for the manufacture of textured containers can advantageously be produced under acid, alkaline or neutral sizing conditions. Suitable internal sizing agents include rosin and alum, waxes, fatty acid derivatives, hydrocarbon resins, alkyl ketene dimers, and alkenyl succinic anhydrides. Alkenyl succinic anhydrides are organic chemicals comprising an unsaturated hydrocarbon chain containing pendant succinic anhydride moiety. Monocarboxylic fatty acids having a chain length of $C_8$ to $C_{22}$ are also suitable internal sizing agents. The rosin sizing agents include gum rosin, wood rosin, and tall oil rosin. Suitable $C_8$ to $C_{22}$ fatty acids useful as internal sizing agents include coprylic, capric, lauric, myristic, palmitic, stearic, arachidic, betenic, palmitoleic, oleic, ricinoleic, petroselinic, vaccenic, linoleic, linolenic, eleostearic, licenic, paranirac, gadoleic, arachidonic, cetoleic, and erycic.

EXAMPLE 9

Suitable Aluminum Salts

Alum or aluminum salts used to prepare suitable paperboards are water-soluble, and they may be aluminum sulfate, aluminum chloride, aluminum nitrate, or acid aluminum hydrophosphates in which P:Al=1.1:1–3:1.

When aluminum salts or their mixtures are used, a base is added to form aluminum hydroxide having anionic surface charges. The base used is suitably sodium or potassium hydroxide, sodium or potassium carbonate, sodium or potassium metasilicate, sodium or potassium waterglasses, sodium or potassium phosphate or borate, or sodium or potassium aluminate, or mixtures of these.

Aluminate compounds such as sodium aluminate or potassium aluminate are also used as the water-soluble aluminum salts. In this case, acid is added in order to form, within the pH range 7–9, an aluminum hydroxide having anionic surface charges. The acid used is a mineral acid such as sulfuric acid, hydrochloric acid, nitric acid or phosphoric acid, or organic acids such as oxalic acid, citric acid or tartaric acid. Suitably the acids used may also be acid aluminum salts such as aluminum sulfate, aluminum chloride, aluminum nitrate, or various water-soluble aluminum hydrophosphates.

Suitably water-soluble polymeric aluminum salts, i.e., polyaluminum salts, so-called basic aluminum salts, which are also called polyaluminum hydroxy salts or aluminum hydroxy salts may also used. In addition, the following salts may be utilized: polyaluminum sulfate, polyaluminum chloride and polyaluminum chloride sulfate. The polyaluminum salt does suitably, in addition to the chloride and/or sulfate ion, also contain other anions, e.g., phosphate, polyphosphate, silicate, citrate, oxalate, or several of these.

Commercially available polymeric aluminum salts of this type include PAC (polyaluminum chloride), PAS (polyaluminum sulfate), UPAX 6 (silicate-containing polyaluminum chloride), and PASS (polyaluminum sulfate silicate).

The net formula of the water-soluble polyaluminum salt may be, for example:

$$n[Al_2(OH)_m/Cl)_{6-m}]$$

and its alkalinity may vary so that the m-value ranges from 1 to 5 (alkalinity is respectively 16–83% according to the formula (m:6)×100). In this case the ratio Al/OH is 2:1–1:2.5. n is 2 or higher.

When a polyaluminum compound is used, it may be desirable to add a base in order to optimize the Al/OH ratio, even if all of the polyaluminum compounds in accordance with the invention do work as such.

The base or acid which forms in situ an aluminum hydroxide with the aluminum salt may be added to the fiber suspension, before the aluminum salt, after it, or simultaneously with it.

The aluminum hydroxide may also be formed before the moment of adding, for example in the adding tube, or in advance in sol form.

The amount of the aluminum salt, calculated as $Al_20_3$, is preferably approximately 0.01–1.0% of the dry weight of the pulp.

EXAMPLE 10

An aqueous suspension of paper fibers and the other additives as summarized in Table 6 was used in this example:

TABLE 6

| Order of Addition | Additive | Level of Addition |
|---|---|---|
| 1 | Hardwood Kraft | 75% (600 CSF) |
| 2 | Softwood Kraft | 25% (600 CSF) |
| 3 | Alum | 10 lb./ton |
| 4 | HCl or NaOH | To pH of 4.8 |
| 5 | Cationized Corn Starch (Apollo 600) | 12 lb./ton |
| 6 | Rosin Size (Neuphor 635) | 6 lb./ton |

TABLE 6-continued

| Order of Addition | Additive | Level of Addition |
|---|---|---|
| 7 | Poly-DADMAC (Reten 203) | 2 lb./ton |
| 8 | Expandable Microspheres (Expancel 820) | 0, 10, 20, 40, 80 lb./ton |

The above materials (except microspheres) were sheared for about 30 seconds at 1500 rpm using a Britt jar stirrer to form an aqueous suspension and then introduced into the sheet-forming apparatus at a level of about 0.5% by weight solids. The suspension was formed into 106 lbs. per ream (3000 square feet) sheets using a suitable sheet-forming apparatus, preferably M/K Systems, Inc. (Series 8000), which forms one or more hand sheets of about 13" square as described below. The sheet mold was filled with water at 40° C. and a forming temperature of 40° C. was used.

The suspension was inverted, rather than poured into a sheet mold having a 60-mesh count. The suspension was drained, the sheet mold was opened, and the sheet was couched with blotter stock as described in TAPPI Standard T205.

The embryonic sheet was wet-pressed dynamically, that is by means of a suitable wet-press nip at approximately 3 feet per minute and 60 psi, thereby sandwiching the embryonic sheet between dry blotter stock. After wet-pressing, the hand sheet was dried using suitable drying apparatus, such as that of M/K Systems, Inc. (Series 8000), set at 3 feet per minute, 125° C., one pass per side, which expanded the expandable microspheres contained in the embryonic sheet.

The paper handsheets were size-pressed with a starch and pigment solution having a solids content of about 33% by weight.

The hand sheet was then calendered on a suitable calender, preferably Beloit Wheeler Model 700 operated at 100 feet per minute, 400 psi, and 150° F. Although smoothness of the resulting paperboard may be varied to suit particular applications, in this example, a drink cup application was simulated and a smoothness of about 640 Bendtsen was attained using the calender stack as described above.

Polyethylene sheet material, such as product 5727-001 (2 mil thickness) available from Consolidated Thermoplastics Co., was used to coat one side of the hand sheet. The polyethylene sheet material and hand sheet were sprayed with Fast Tack Adhesive 3102 from Spray On, Inc., of Bedford Heights, Ohio. The polyethylene sheet and hand sheet were disposed and registered with each other and laminated together using a suitable press nip at 3 feet per minute and 50 psig. The laminate was heated with a suitable heating apparatus, such as a heat gun by Master Appliance Corp. of Racine, Wis., to 750° F.–1000° F., thereby enhancing the adhesion and uniformity of the laminate structure.

The resulting hand sheet was cut into nine-ounce cup blanks. A rolled cup brim was formed by top curl forming and other required deformations of the cup blank were accomplished using suitable tooling known in the art.

The above described wet-end chemistry and hand sheet formation steps were conducted with the addition, as noted in Table 6 above, of Expancel 820 microspheres at levels of 10, 20, 40, and 80 pounds per ton and compared with a control which did not include any expandable microspheres.

Figure 47:
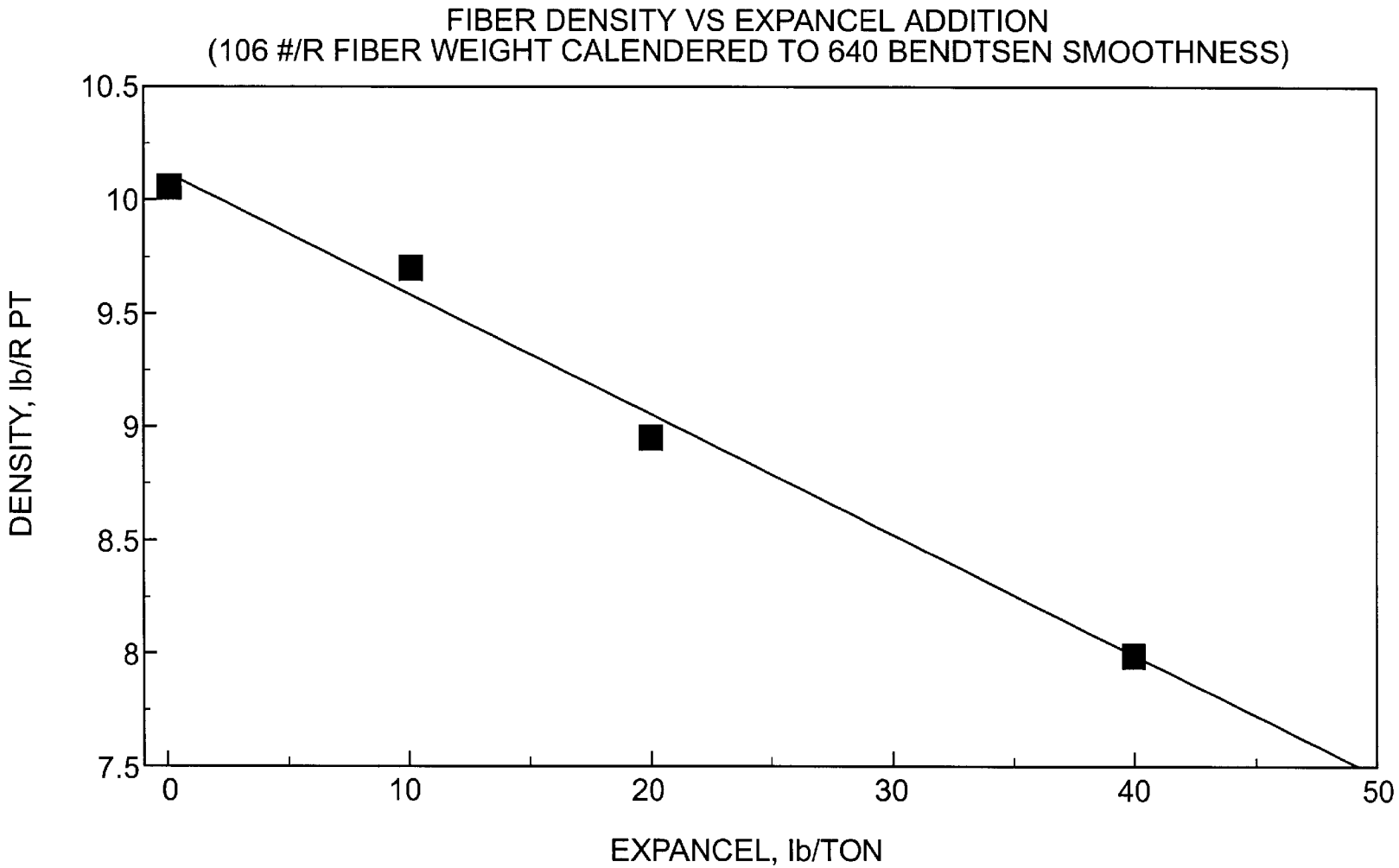
FIG. 47 is a graph illustrating the reduction of fiber density versus amount of bulk enhancing additive added for each ton of paperboard.

The reduction of paper density (i.e., its bulk enhancement) is shown in FIG. 8 after calendering to a 640 Bendtsen smoothness. The decrease in paperboard density corresponding to addition of expandable microspheres in a proportion of 20 lbs. per ton is from 8.8 to 6.6 lbs. per ream per point. FIG. 47 illustrates that there is a twenty-seven percent decrease in density for every one percent addition of microspheres.

Figure 49:
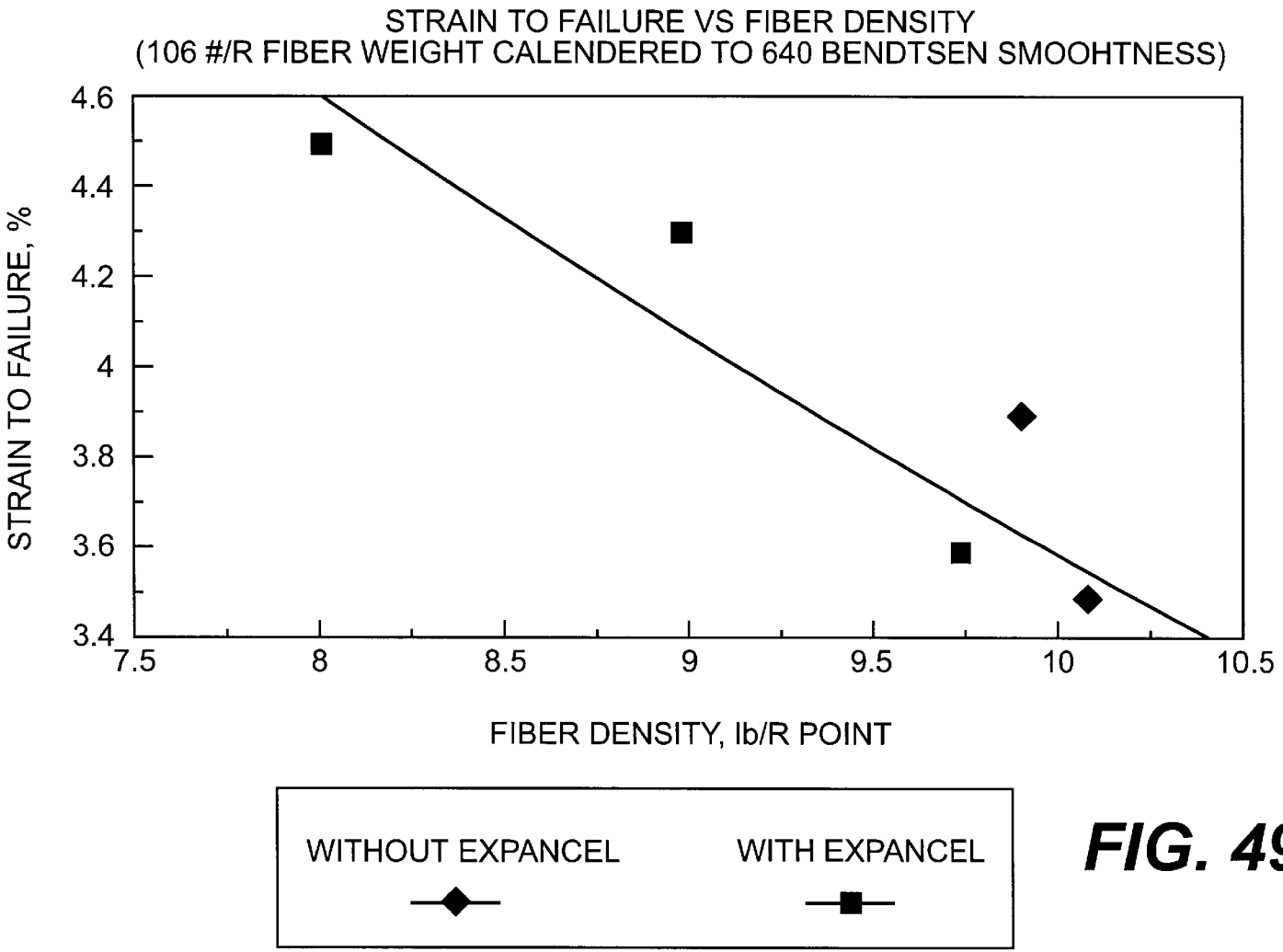
FIG. 49 is a graph illustrating the fiber density in pounds for each 3000 square foot ream versus percent strain-to-failure for paperboards prepared according to the present invention and prior art boards.

The bulk-enhanced paperboard was found to exhibit improved strain to failure (also known as stretch), as shown in FIG. 49, where strain to failure is shown as a function of fiber density. Compared to the control paper without microspheres, strain to failure of paper having about 20 to 40 pounds of expandable microspheres, per ton have a corresponding increase in strain to failure of at least 7.5%. In one particular case, the control paper had a fiber density of about 10.1 pounds per ream per point (0.001 inch fiberboard thickness) and a strain to failure of about 3.5%, while paper to which 13001 Street NW microspheres had been added during formation at a proportion of 40 lbs. per ton had a fiber density of about 8 pounds per ream per point (0.001 inch per fiberboard thickness) and a strain to failure of about 4.5%. This is an improvement of 28%. The improved strain to failure improves formability of the paper, such as top curl forming for rolled brim containers, drawing of plates and bowls in forming dies, and all other applications that require deformation of paperboard.

Figure 50:
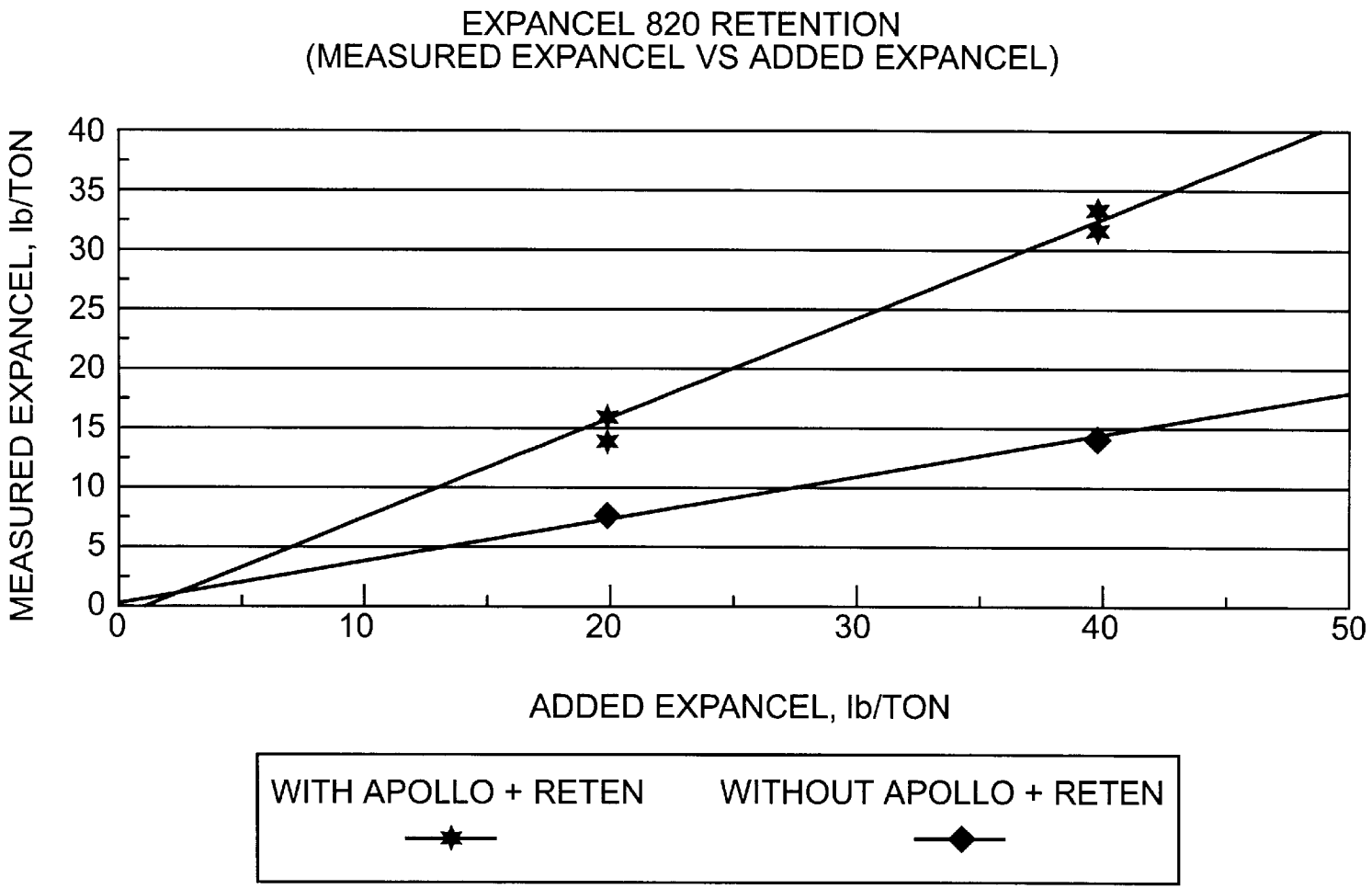
FIG. 50 is a graph illustrating the improved retention of the bulk additive in the presence of a retention aid such as Reten 203.

Tests were also performed to show the Improved retention of expandable microspheres according to the process of the present invention. The results of these tests are shown in FIG. 50. The rate of retention of expandable microspheres, in particular Expancel, 820 microspheres, was only about 36% without usage of the cationized corn starch Apollo 600 in combination with the poly-DADMAC Reten 203, whereas with these two compounds added in the proportions discussed above, retention of expandable microspheres was at a rate of approximately 83%. Retention rates of greater than 50% can be termed to be substantial retention of the expandable microspheres added in the papermaking process. The preferred retention rate is 70% or better.

Figure 51:
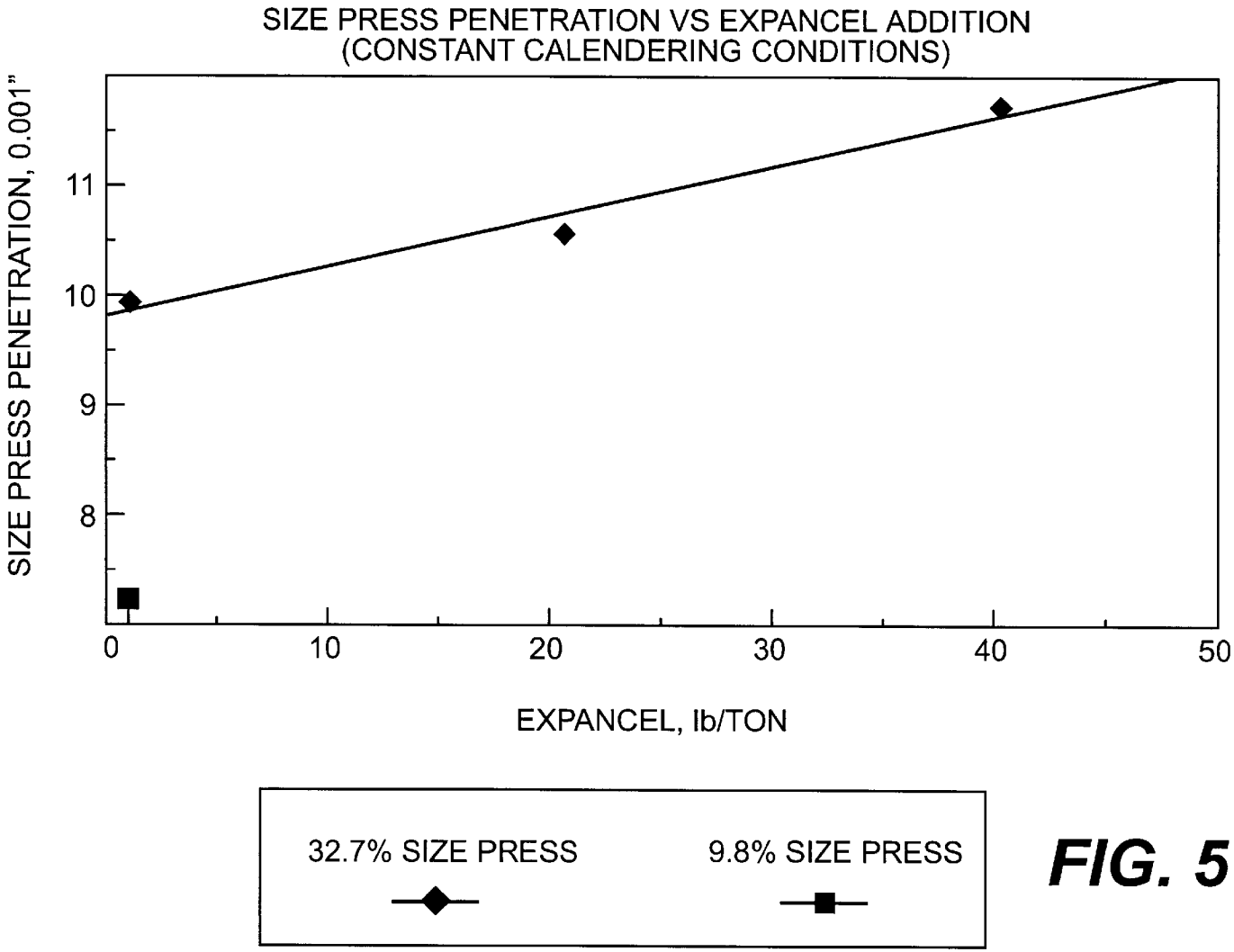
FIG. 51 is a graph illustrating increase in the size press penetration into the paperboard versus amount of the bulk enhancing additive added.
Figure 52:
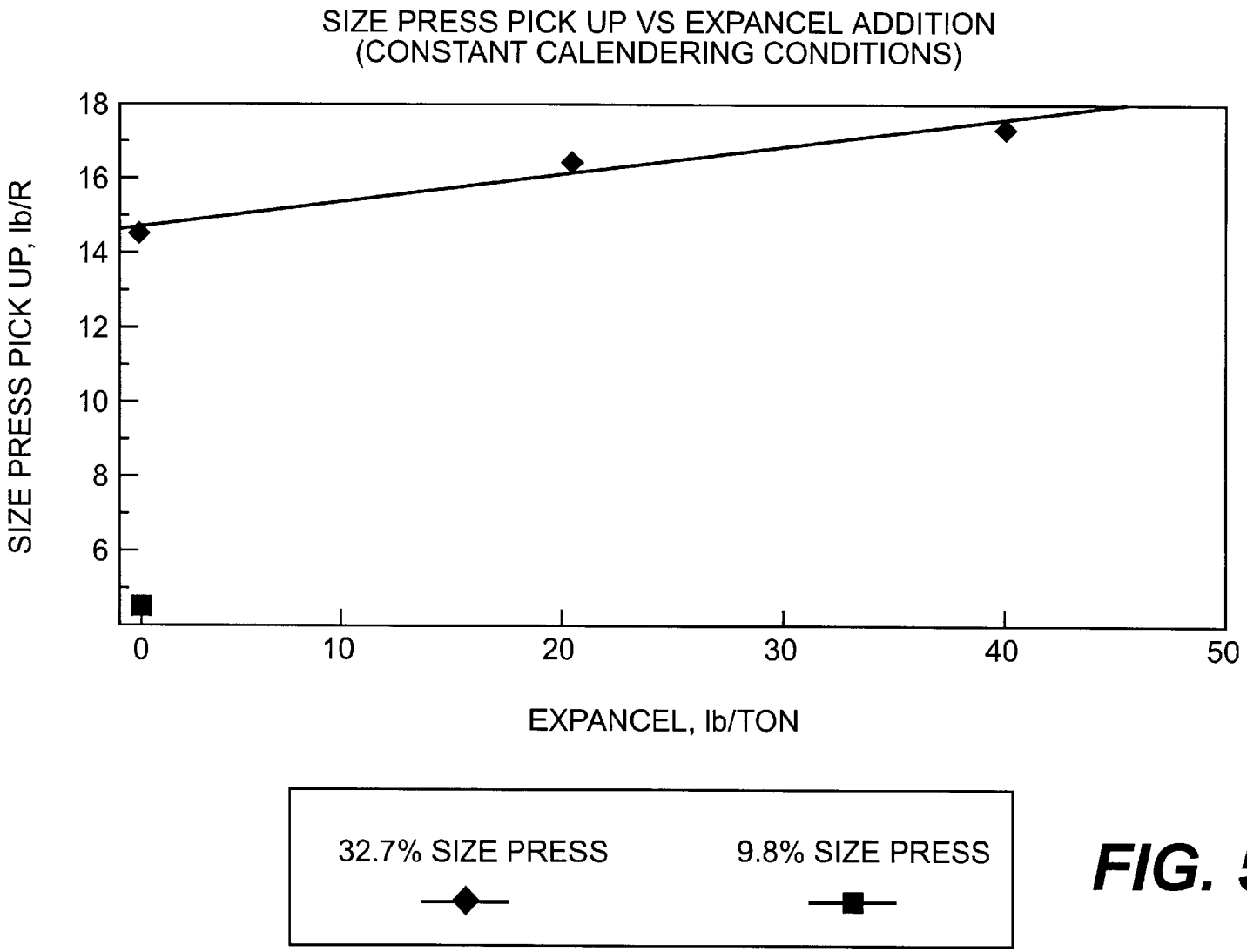
FIG. 52 is a graph illustrating the increase in size press pickup versus the amount of the bulk enhancing additive added.

The resulting paper of this example, which was size-pressed with solids at 33%, was also compared to a control sheet which was size-pressed with solids of only about 10%. The size-press penetration and the size-press pick-up is depicted as a function of addition of expandable microspheres in FIGS. 51 and 52 respectively. It was found that both size-penetration and size-press weight increase at constant solids of about 33% with increasing addition of expandable microspheres. This increase is believed to be due to the decreasing density and increased "openness" of the fiber network resulting from expansion of the microspheres during the drawing process.

Figure 53:
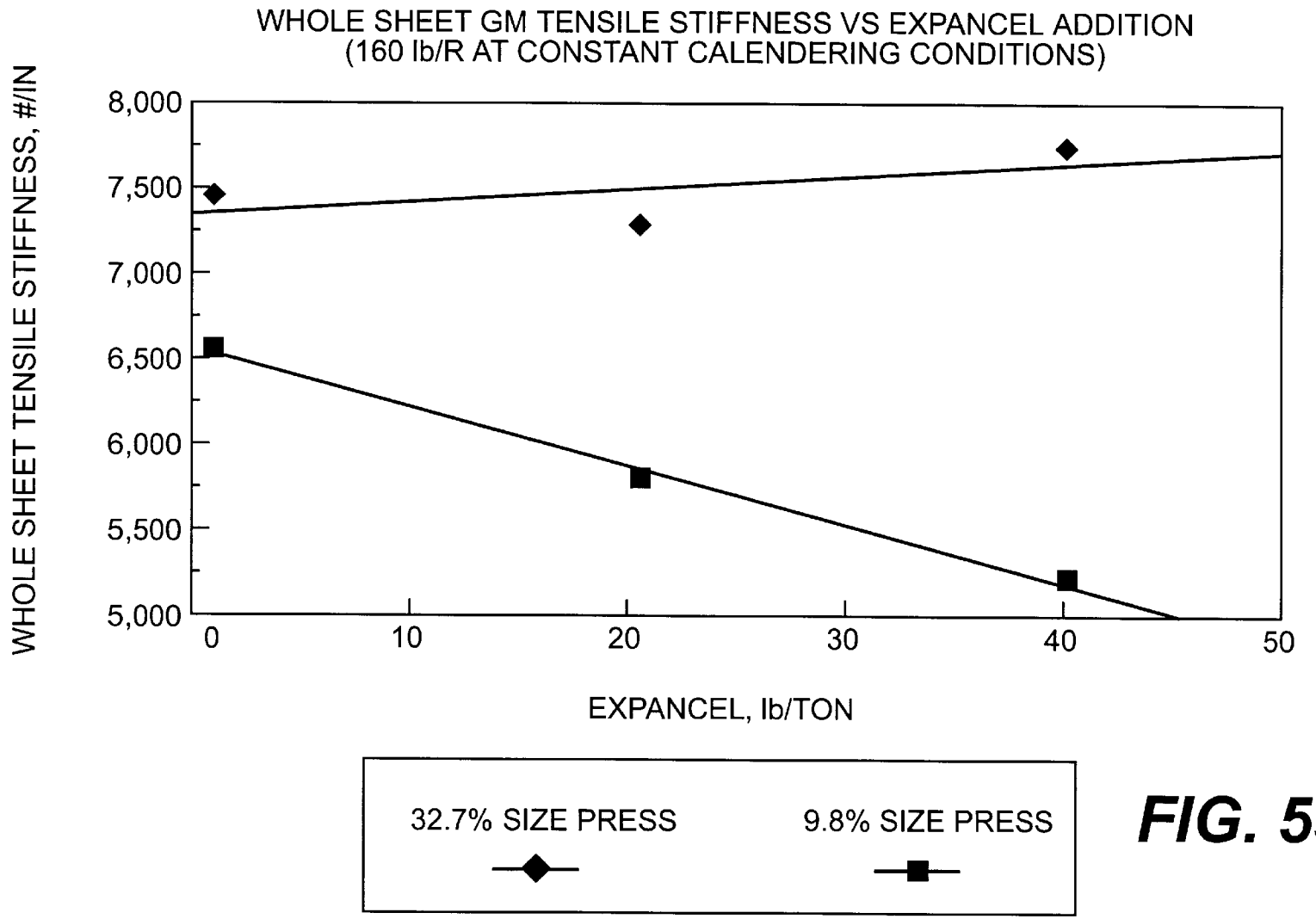
FIG. 53 is a graph illustrating whole sheet GM tensile stiffness versus amount of the bulk enhancing additive added.

It was also found that the increased thickness of the size-press layer and increased size-press weight improved the GM tensile stiffness and formability of the size-press layer, and consequently, the paper itself, as compared to the control size-pressing at only 9.8% solids. The results of these tests are depicted in the graph of FIG. 53 where a whole sheet GM tensile stiffness is indicated as a function of addition of expandable microspheres for the control size-pressing at 9.8% versus that of the present invention at 32.7%. As seen in FIG. 53, the reduction in whole sheet GM tensile stiffness at conventional size-press weights is believed to be due to the inability of the size-press layers to compensate for the loss in strength in the base fiber network caused by its disruption from the addition of the expandable microspheres. Thus the increased GM tensile stiffness of the size-press layers resulting from the high size-press weight compensated for these strength losses as indicated in FIG. 53.

Figure 44:
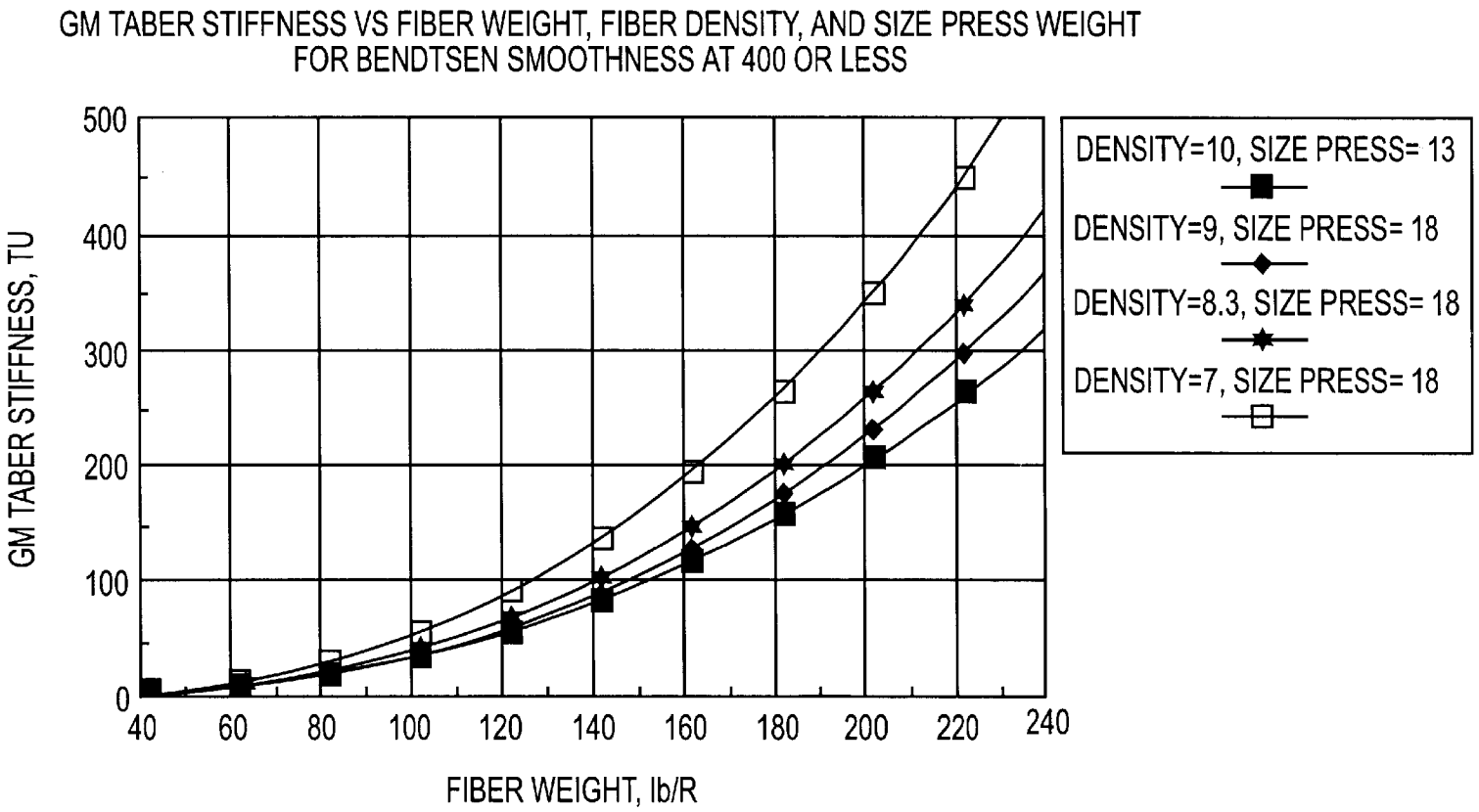
FIG. 44 is a graph illustrating the improved GM Taber stiffness values for paperboards prepared according to the present invention with GM Taber stiffness values for boards available on the market.
Figure 45:
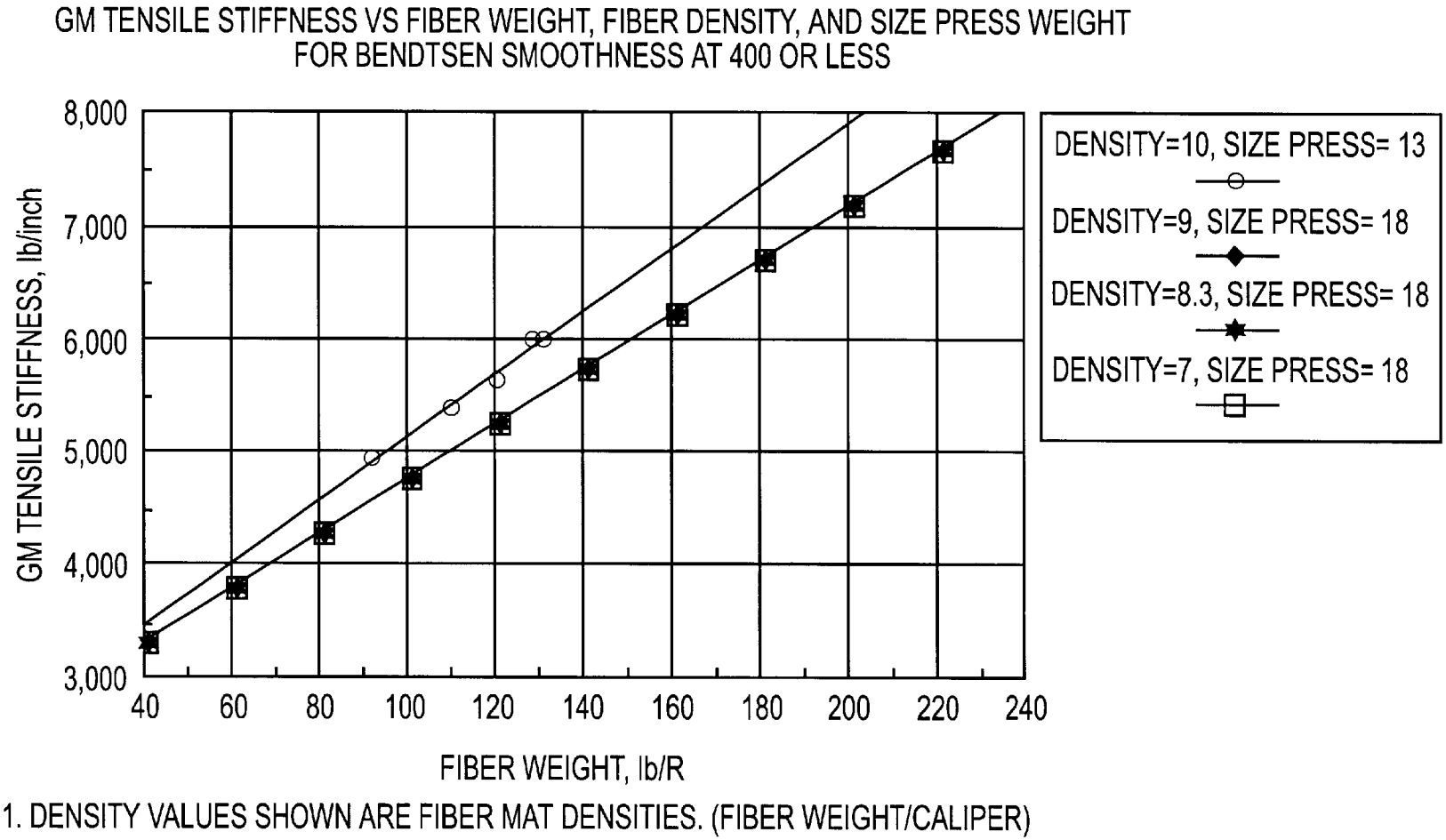
FIG. 45 is a graph illustrating the GM tensile stiffness values for paperboards prepared according to the present invention with GM tensile stiffness values for boards available on the market.
Figure 54:
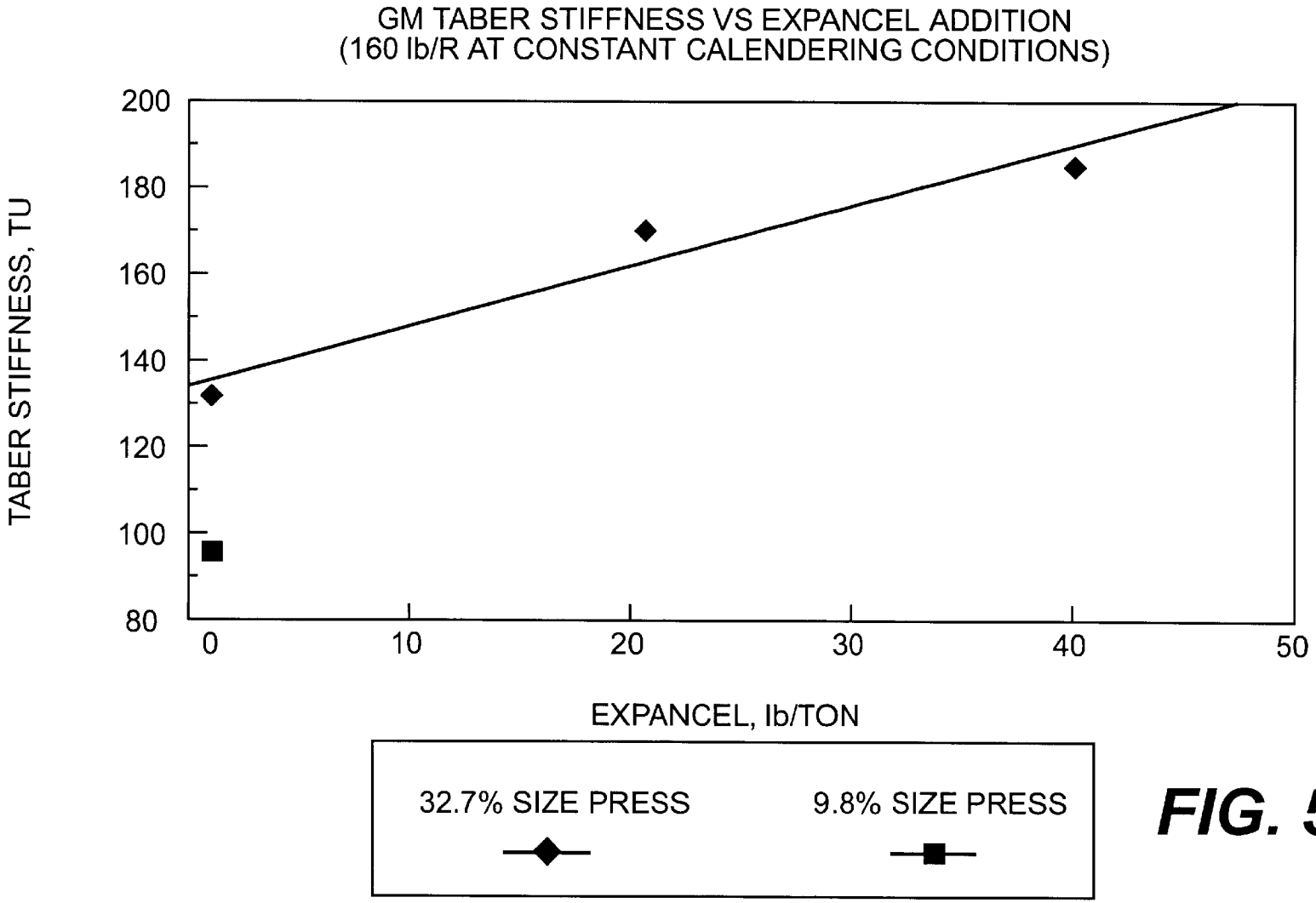
FIG. 54 is a graph illustrating GM Taber stiffness versus the amount of the bulk enhancing additive added.

It was also found that GM Taber stiffness (bending stiffness) was improved due to, it is believed, the combined effects of bulk-enhancement and application of the pigmented size at a high solids level. In other words, the combination of a caliper increase and increased moduli of elasticity on the paper is believed to generate an "I-beam" effect that improves bending stiffness, as shown in FIG. 54 and FIG. 44.

EXAMPLE 11

Figure 46:
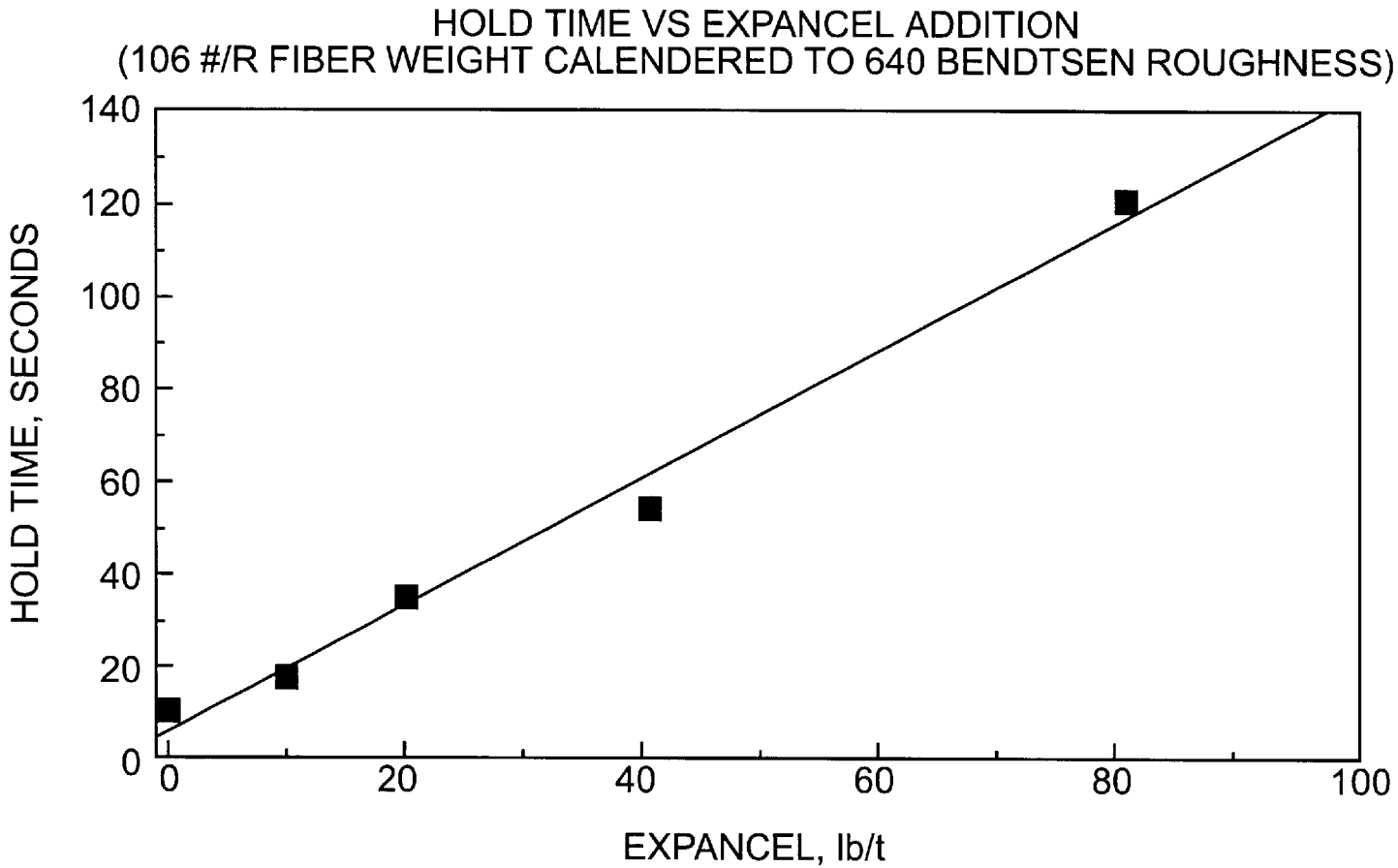
FIG. 46 is a graph illustrating the hold time versus amount of bulk enhancing additive added for each ton of paperboard.

The results of various tests conducted on hot drink cups formed from paperboard formed in Example 10 will now be described. The thermal resistance or thermal insulative properties of the paper were calculated in terms of "hold time," which is defined as the amount of time before a temperature of 128° F. is obtained at the outer surface of a hot drink cup filled with liquid at about 190° F. The results are depicted in the graph of FIG. 46 and show that the ability to hold a hot drink cup without discomfort increases as a function of increased addition of expandable microspheres. FIG. 47 shows the relationship of hold time to the density of the paperboard used to make the hot drink cup of the present invention. As seen there, the lower fiber densities resulting from higher proportions of added expandable microspheres are generally associated with longer hold times. Useful cups have a hold time of at least 30 seconds in the temperature range of 140° F.–145° F. or below.

When the paper was formed into a paper cup, as in this example, the above-described improvements in tensile and bending stiffness improved paper cup rigidity and formability which in turn allowed for a significant reduction in fiber weight of the cup for a desired rigidity. The cup is set forth in FIGS. 25 and 26 and the fiberboard at a fiber mat density of 3, 4.5, 6.5, 7, 8.3, and 9 pounds per 3000 square foot ream at a fiberboard thickness of 0.001 inches, had a GM Taber stiffness of at least about 0.00716 $w^{2.63}$ grams-centimeter/fiber mat density$^{1.63}$, and a GM tensile stiffness of at least about 1890+24.2 w pounds per inch.

EXAMPLE 12

Figure 42:
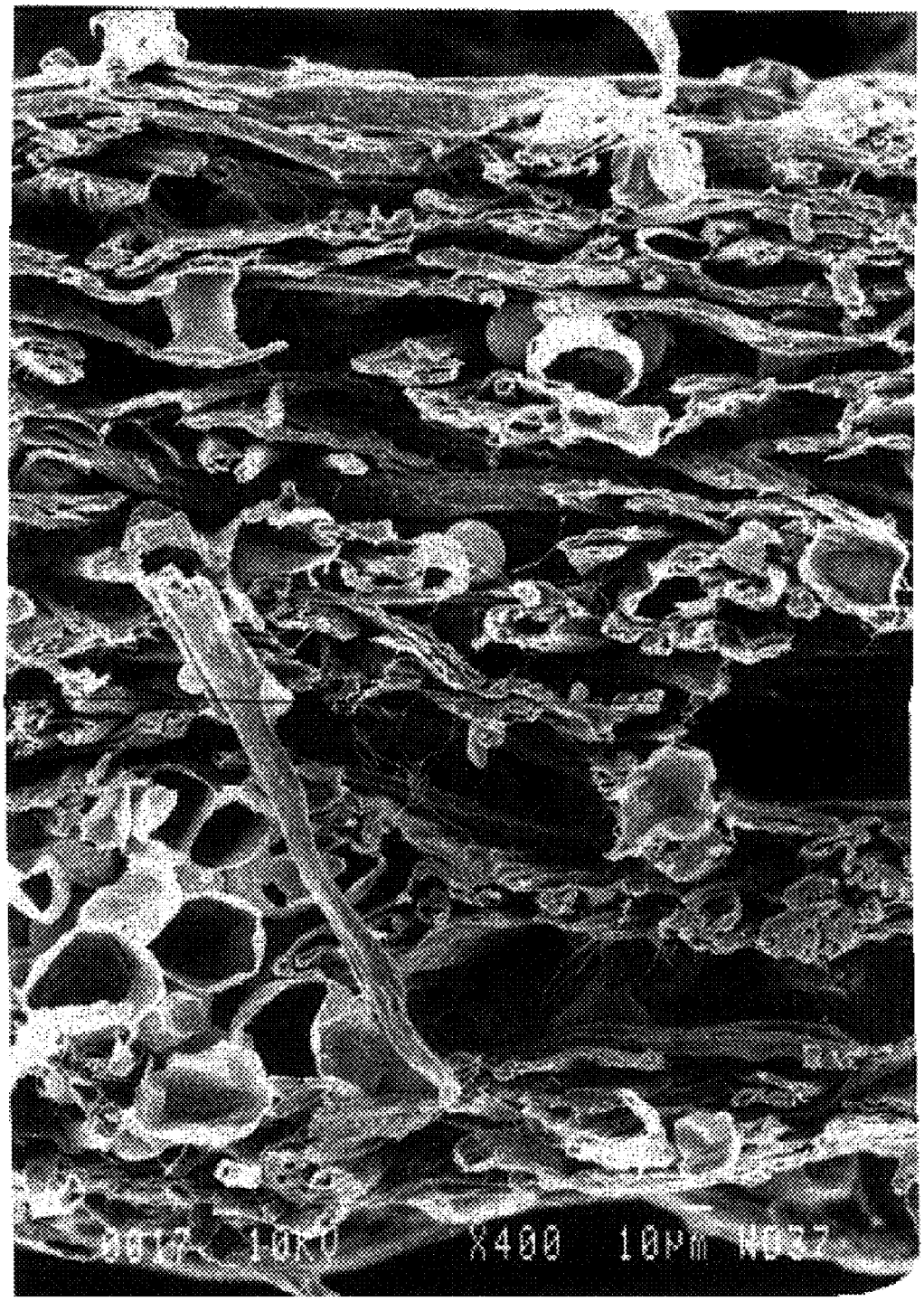
FIG. 42 is a photograph of a cross-sectional view of a paperboard according to the present invention magnified 400 times.
Figure 43:
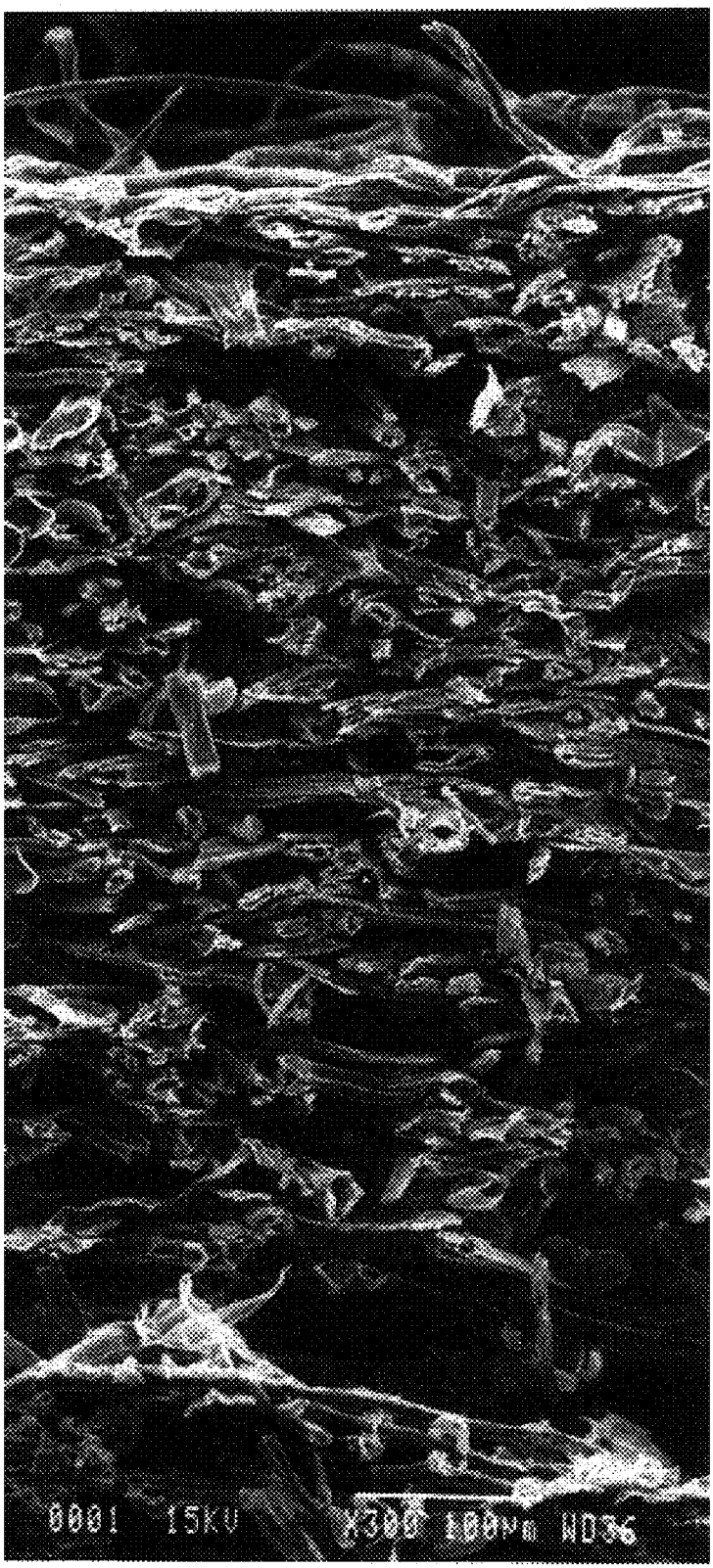
FIG. 43 is a photograph of a cross-sectional view of a paperboard prepared according to the prior art without retention aids magnified 300 times.

In this example, microsphere distribution in bulk-enhanced paperboard prepared as in Example 10 was compared visually to microsphere distribution in a commercial microsphere enhanced paperboard. They were then examined under ×300 and ×400 magnification and microphotographs were taken. Representative microphotographs are reproduced as FIGS. 42 and 43 with equal outer, middle, and inner regions A, B, C and A', B', C' indicated in dotted lines added to the photographs for comparison purposes.

FIG. 64, which shows paperboard prepared as in Example 10, at an ×300 magnification reveals 7 microspheres in outer region A, 8 microspheres in middle region B, and 9 microspheres in bottom region C. In contrast, FIG. 43 at ×400 magnification shows that the commercial prior art product had 31 microspheres in outer region A', 7 microspheres in middle region B', and 8 microspheres in bottom region C'.

EXAMPLE 13

Figure 56A:
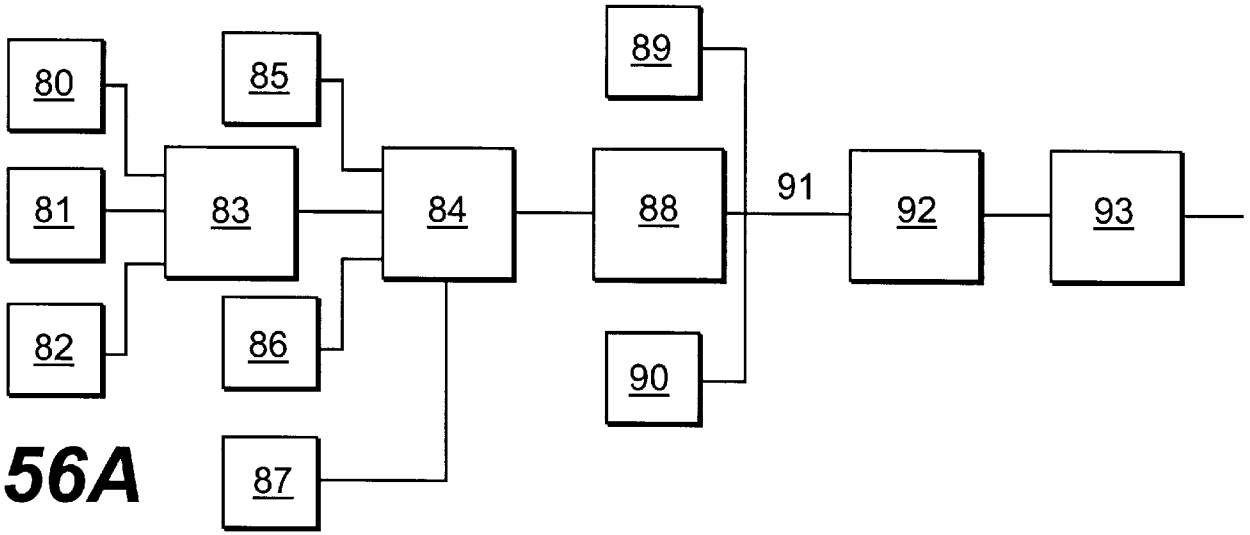
FIG. 56 is a flow diagram illustrating a small scale process for the manufacture of the paperboard.
Figure 56B:
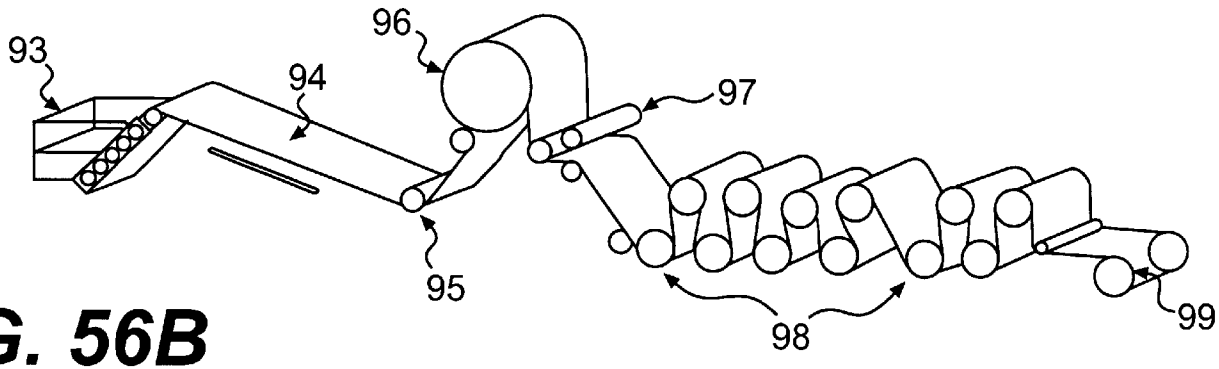
Figure 57:
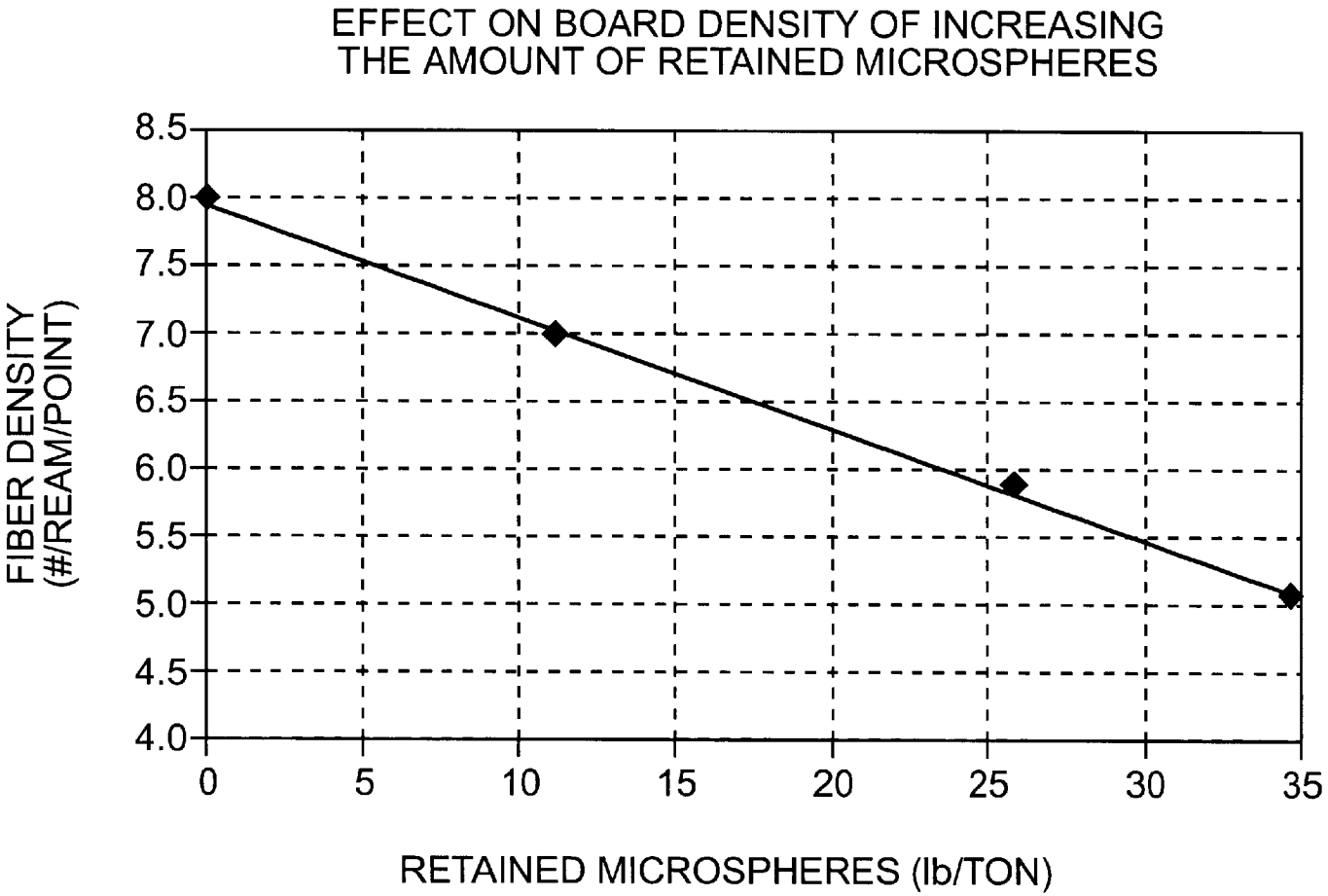
FIG. 57 is a graph illustrating the effect of increasing the amount of retained microspheres on the paperboard density.

These examples were carried out to determine the effect of the expand able microspheres on bulk properties of the paperboard web. This example sets forth the general procedure for carrying out the manufacture of paperboard utilizing different bulk additives and different retention aids. The manufacturing procedure is illustrated in FIG. 56. In subsequent examples specific variations are set forth.

Hardwood Kraft (80) and Softwood Kraft (81) lap pulps (in the ratio of 75%:25%) were pulped and refined together using a Jordan refiner to a Canadian Standard Freeness of 515, pumped to the mix chest (83) and stored in the machine chest (84). Alum (85) was added to the stock and the pH was adjusted to pH 4.8 using sulfuric acid (86) and then rosin size (87) was added. This stock was pumped to the stuff box (88) and then starch (89) and retention aid (90) were added to the stock at the down leg of the stuff box. This stock was then pumped via the fan pump (92) to the headbox of the paper machine (93) to form the web (94) on the wire. This web was then pressed in the press section (95) and drying was started in contact with a Yankee dryer (96), the web was optionally calendered (97) and further drying was carried out using steam-heated drying cans in the drying section (98). The final dry web (~2.0% moisture) was then reeled up (99). The oven-dried fiber weight of the board was 105 lbs./3000 sq. ft. ream.

Run 1. Expancel 820 (91) was added to the stock prepared as described above just ahead of the fan pump (92). The Expancel was added continuously to retain a final ratio of 20 pounds of Expancel for each ton of paperboard. The paperboard formed was tested and it was determined that the caliper had increased.

Figure 30:
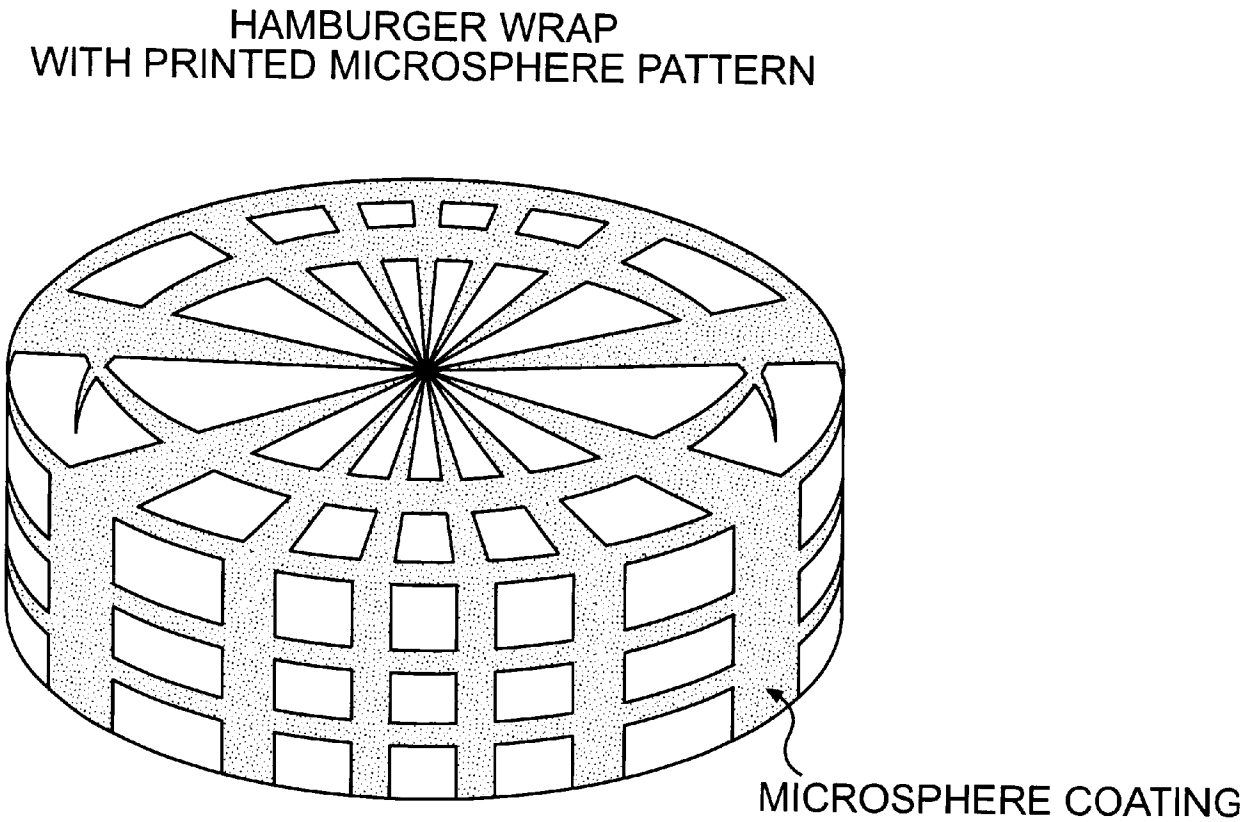
FIG. 30 is a drawing of a hamburger wrap with printed microsphere patterns.
Figure 31:
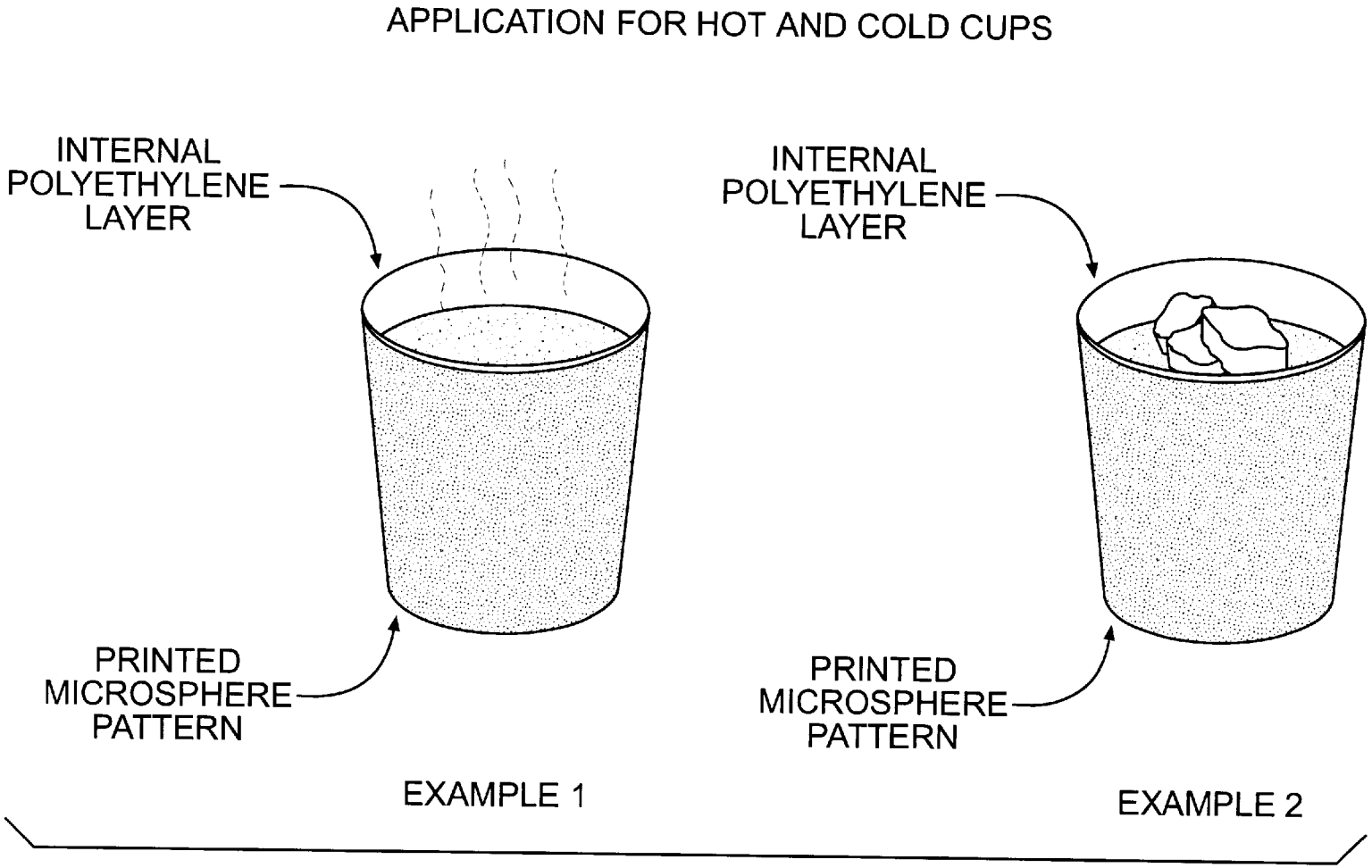
FIG. 31 is a drawing of a hot and cold cup showing textured outer coating and a polyethylene inner coating.

Runs 2 and 3. Runs 2 and 3 are identical to Run 1 except that in Run 2, 40 pounds of the microspheres per ton of paperboard were used while in Run 3, 50 pounds of microspheres were utilized. In all three runs, the caliper of the paperboard increased as is shown in Table 7 and a graphical plot showing the relationship between bulk and the amount of retained microspheres is shown in FIG. 30.

TABLE 7

| | Control | Run 1 | Run 2 | Run 3 |
|---|---|---|---|---|
| Fiber weight (pounds per 3000 sq, ft. ream) | 112 | 112 | 112 | 112 |
| Expancel ® addition (lb./ton) | 0.0 | 20.0 | 40.0 | 50.0 |
| Retention Aid (lb./ton) | 0.0 | 11.1 | 25.8 | 34.6 |
| Retention (%) | 0.0 | 55.5 | 64.5 | 69.2 |
| Caliper ($\mu$) | 14.0 | 16.0 | 19.0 | 22.0 |
| Density (lb./3000 sq. ft. ream/$\mu$) | 8.0 | 7.0 | 5.9 | 5.1 |

EXAMPLE 14

This example illustrates the percent retention of the microspheres in the paperboard when Reten 203 retention aid is utilized. The paperboard was prepared according to the procedure described in Example 13. The data as set forth in FIG. 58A demonstrates that when the retention aid is added just before the formation of the nascent web, such as at the stuff box [FIG. 56 (88)], the retention was 73.4 percent; however, when the retention aid was added at the machine chest [FIG. 56 (84)], the microsphere retention was reduced to 57.1 percent.

In this Run 1 at the machine chest [FIG. 56 (84)], the following chemicals were charged per ton of cellulosic feedstock: Alum, ten pounds; Apollo 600, eight pounds; Neuphor 635, six pounds; Reten 203, one half pounds; Expancel 820WU, forty pounds.

In this Run 2 at the stuff box, [FIG. 56 (88)], the following chemicals were charged per ton of cellulosic feedstock: Apollo 600, eight pounds; Reten, one half pound; at the fan pump [FIG. 56 (92)], 40 pounds of Expancel per ton cellulosic feedstock were added; at the machine chest [FIG. 56 (84)], ten pounds of alum and eight pounds of Neuphor 635 were added for each ton of cellulosic feedstock.

Run 3 is the same as Run 2 except that a total of 50 pounds of Expancel 820 per ton of cellulosic fiber was charged to the system.

EXAMPLE 15

This example illustrates the percent retention of the microspheres in the paperboard when various retention aids were used such as inorganic colloids and organic colloids. The paperboard was prepared according to the procedure described in Example 13. The data are set forth in FIG. 58B. This figure shows that the best retention was obtained with inorganic colloids but that organic colloids and Reten 203 also give superior results. In Run 1 designated Reten 203 in FIG. 58B at the machine chest [FIG. 56 (84)] the following chemicals were charged per ton of cellulosic feedstock: Alum, ten pounds, Apollo 600, eight pounds; Neuphor 635, six pounds; Reten 203, one half pound; Expancel 820WU, forty pounds.

Figure 1A:
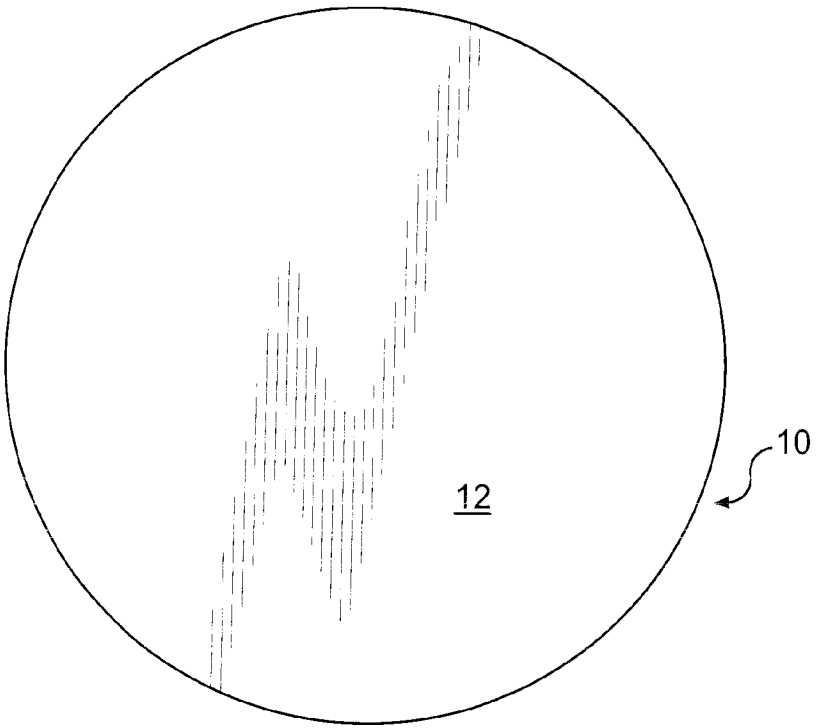
Figure 2:
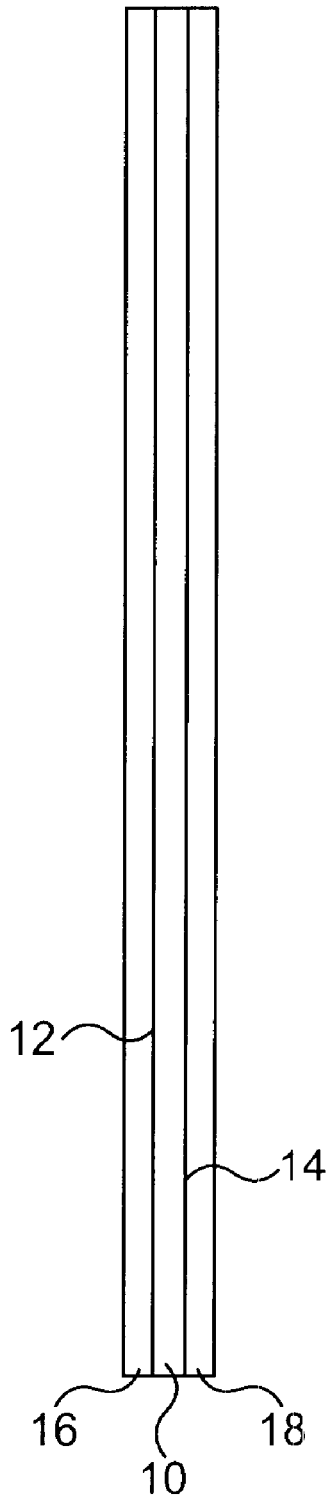
FIG. 2 is a side view of the paperboard blank of FIG. 1.
Figure 58A:
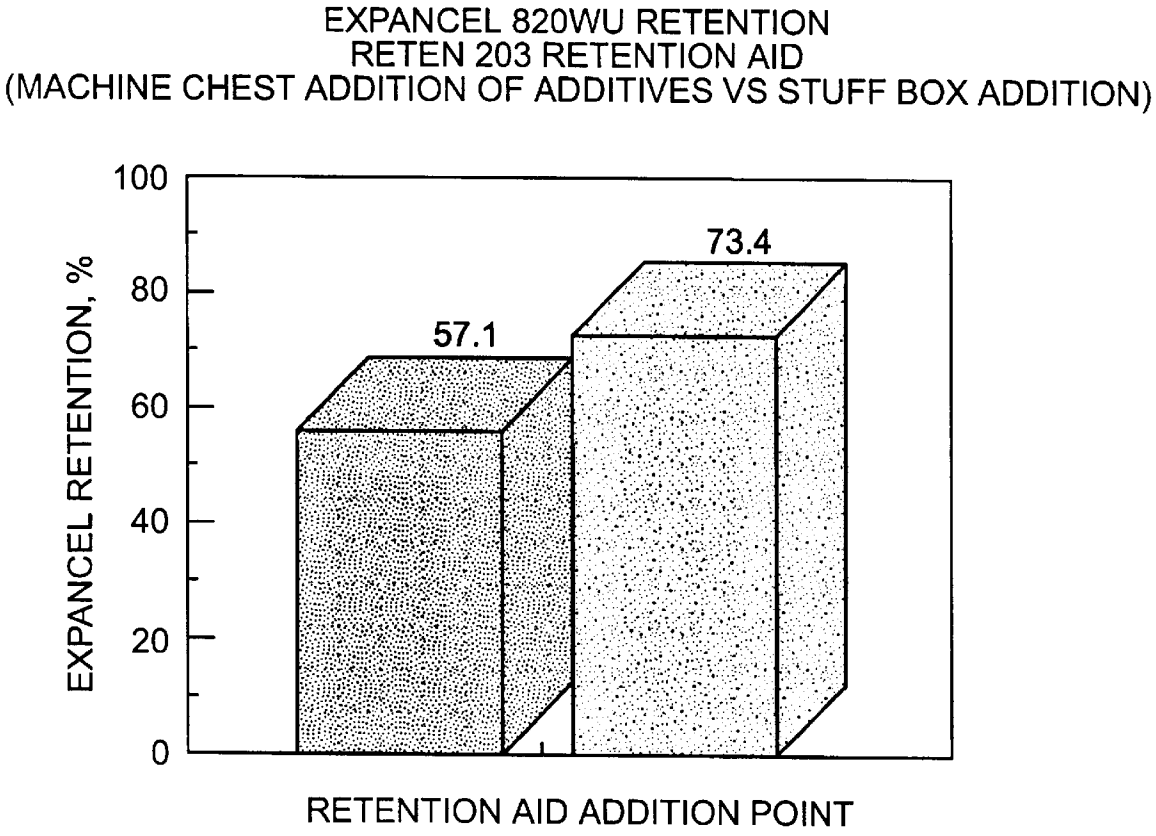
FIG. 58A is a bar graph illustrating the advantage of adding the retention aid to the stuff box [FIG. 56 (88)] versus earlier addition at the machine chest [FIG. 56 (84)].
Figure 58B:
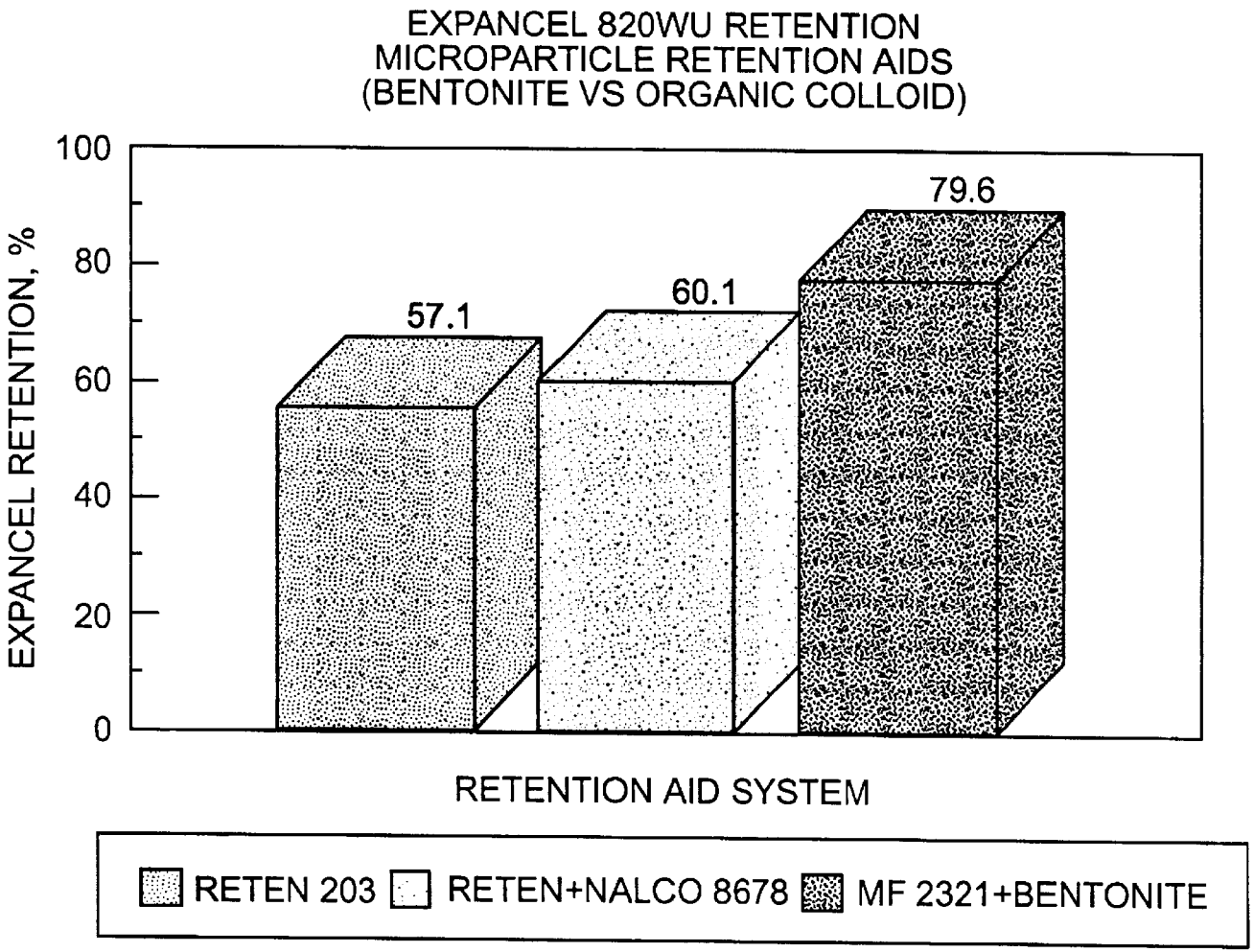
FIG. 58B is a bar graph illustrating the percent microspheres retained utilizing different retention aids.

In Run 2, designated Reten+Nalco 8678 in FIG. 58B, 1.5 pounds of Nalco 8676 for each ton of cellulosic feedstock was charged after the fan pump [FIG. 56 (92)]. In this Run 2, the following chemicals per ton of cellulosic feedstock were charged at the machine chest [FIG. 56 (84)]: Alum, ten pounds; Apollo 600, eight pounds; Reten 203; one half pound; and Expancel 820WU, forty pounds.

In Run 3, designated MF2321+Bentonite in FIG. 58B, 1.5 pounds of Microform BCS were charged after the fan pump [FIG. 56 (92)]. In this Run 3, the following chemicals per ton of cellulosic feedstock were charged at the machine chest [FIG. 56 (84)]: Alum, ten pounds; Apollo 600, eight pounds: and Neuphor 635, six pounds. In this Run 3, the following chemicals per ton of cellulosic feedstock were charged at the stuff box [FIG. 56 (88)]: Expancel 820WU, forty pounds, and Microform 2321, one pound.

EXAMPLE 16

This example illustrates the percent retention of the microspheres in the paperboard when high molecular weight retention aid Accurac 120 functioning as a flocculant was used. The paperboard was prepared according to the procedure described in Example 13. The data are set forth in FIG. 58C. The figure shows that the best retention was obtained with Accurac 120, but Reten 203 also gave superior results.

Figure 58C:
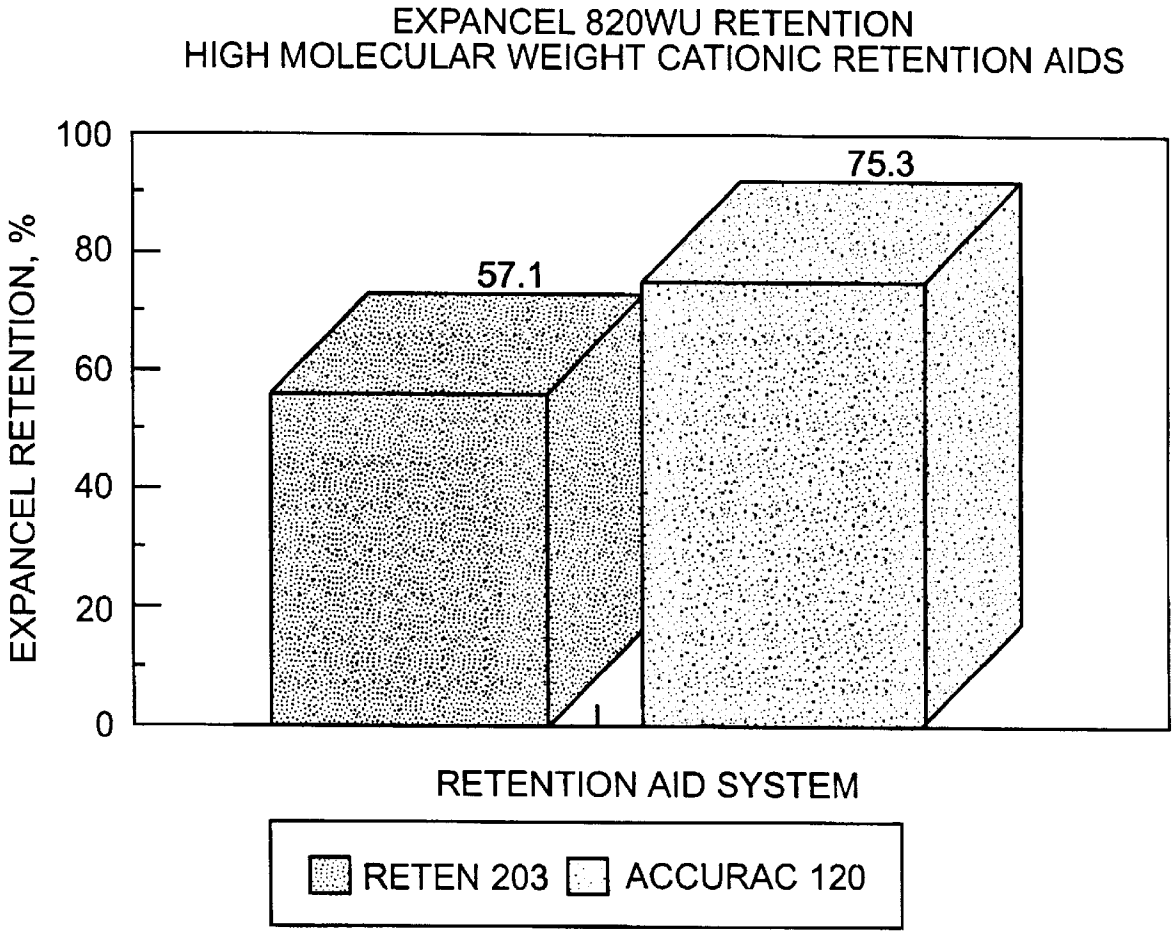
FIG. 58C is a bar graph illustrating the percent microspheres retained utilizing two different retention aid systems.

In Run 1, designated Reten 203 in FIG. 58C, at the machine chest [FIG. 56 (84)]: the following chemicals were charged per ton of cellulosic feedstock: Alum, ten pounds; Apollo 600, eight pounds; Neuphor 635, six pounds; Reten 203, one half pound; and Expancel WU, forty pounds.

In Run 2, designated Accurac 120 in FIG. 58C, the following chemicals per ton of cellulosic feedstock were charged at the machine chest [FIG. 56 (84)]: Alum, ten pounds; Apollo 600, eight pounds: and Neuphor 635, six pounds.

In Run 2, one pound of Accurac 120 was charged at the stuff box [FIG. 56 (88)] for each ton of cellulosic feedstock, and forty pounds of Expancel 820WU for each ton of cellulosic feedstock were charged at the fan pump [FIG. 56 (92)].

EXAMPLE 17

This example illustrates the percent retention of the microspheres in the paperboard when various retention aids were used such as dual polymers. The paperboard was prepared according to the procedure described in Example 13. The data are set forth in FIG. 58D. This figure shows that the best retention was obtained with a Nalco 625 and Reten 203 combination, Reten 203 also gives superior results.

Figure 58D:
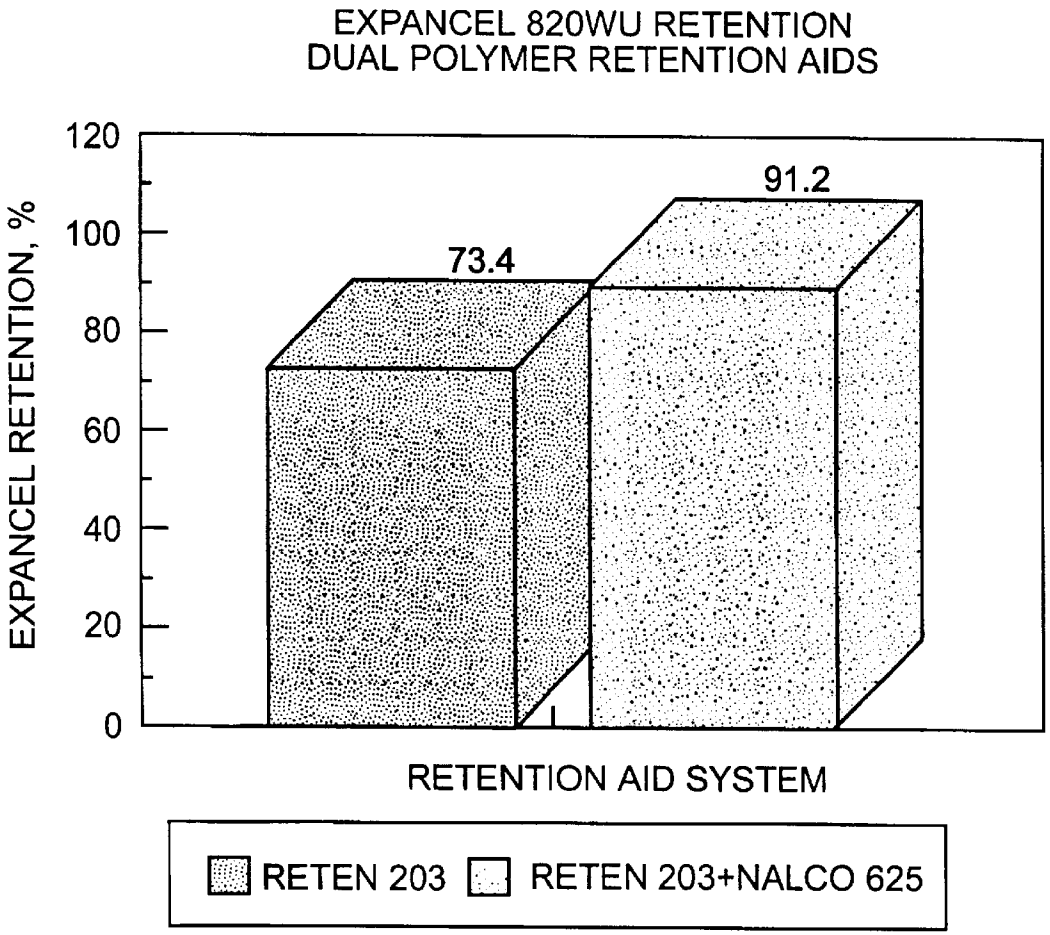
FIG. 58D is a bar graph illustrating the percent microspheres retained when dual polymer retention aids are utilized.

In Run 1, designated Reten 203 in FIG. 58D at the machine chest [FIG. 56 (84)], the following chemicals were charged per ton of cellulosic feedstock: Alum, ten pounds, and Neuphor 635, six pounds. Eight pounds of Apollo 600 and one half pound of Reten 203 for each ton of cellulosic fiber were charged at the stuff box [FIG. 56 (88)]. In this Run 1, forty pounds of Expancel 820WU per ton of cellulosic fiber was added at the fan pump [FIG. 56 (92)].

Run 2 is the same as Run 1 except that fifty pounds of Expancel 820WU were charged per ton of cellulosic fiber.

In Run 3, designated Reten 203+Nalco 625, the following chemicals per ton of cellulosic feedstock were charged at the machine chest [FIG. 56 (84)]: Alum, ten pounds, and Neuphor 635, six pounds. In this Run 3, the following chemicals per ton of cellulosic feedstock were charged at the stuff box [FIG. 56 (88)]: Apollo 600, eight pounds, and Reten 203, one half pound. In Run 3, forty pounds of Expancel 820WU were charged at the fan pump [FIG. 56 (92)], and one pound of Nalco 625 was charged after the fan pump [FIG. 56 (92)].

Run 4 is the same as Run 3 except that fifty pounds of Expancel 820WU per ton of cellulosic fiber were charged at the fan pump [FIG. 56 (92)].

EXAMPLE 18

This example illustrates the percent retention of the microspheres in the paperboard when various retention aids were used such as chemically or thermally rendered anfractuous cellulosic fibers and Reten 203 in combination with the thermal fibers or by itself. The paperboard was prepared according to the procedure described in Example 13. The data are set forth in FIG. 58E. The figure shows that the best retention was obtained with anfractuous fibers based on hardwood in combination with Reten 203. In this instance, as shown by the bar graph in FIG. 58E, ninety percent of the Expancel microspheres were retained in the fiberboard. For the softwood combination, the retention was an excellent 80.6 percent. For Reten 203, the retention was also an excellent 73.4 percent.

Figure 58E:
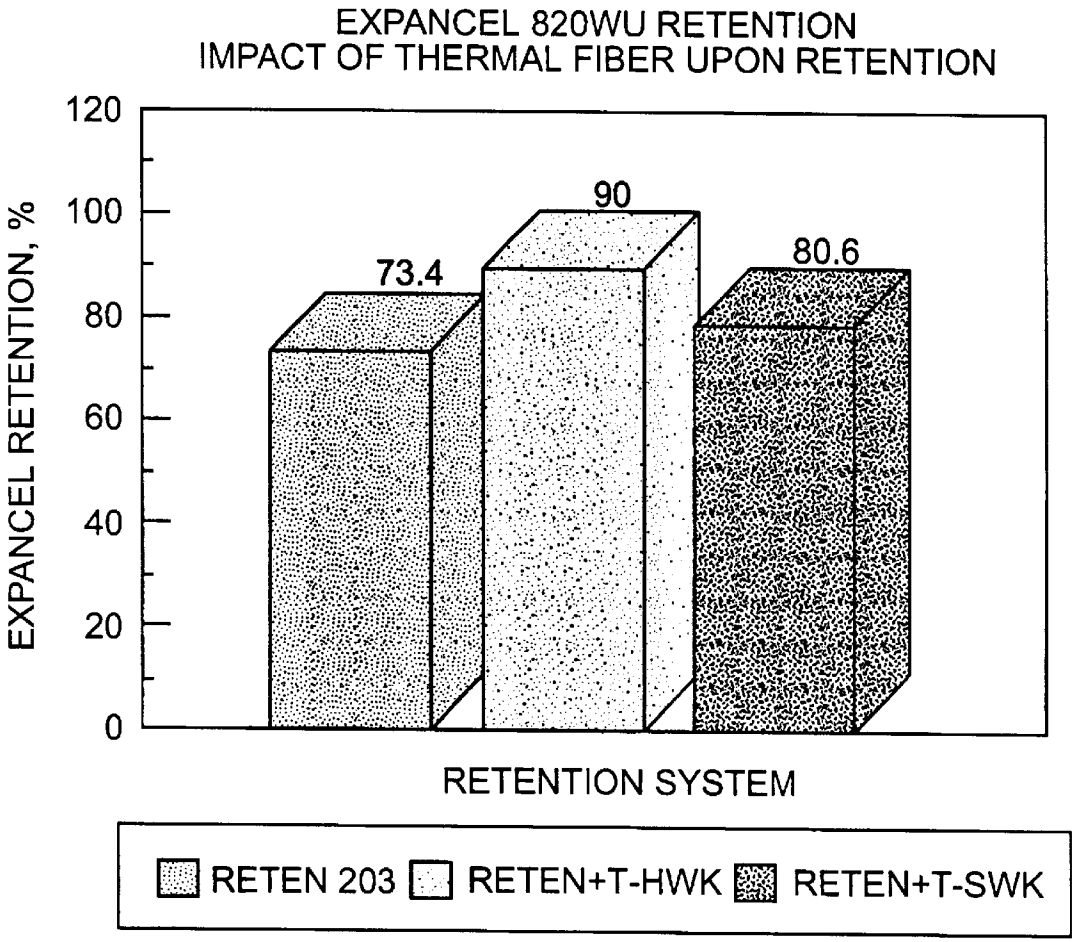
FIG. 58E is a bar graph illustrating the percent microspheres retained into fiber board when thermal fibers in combination with Reten 203 are utilized.
Figure 59:
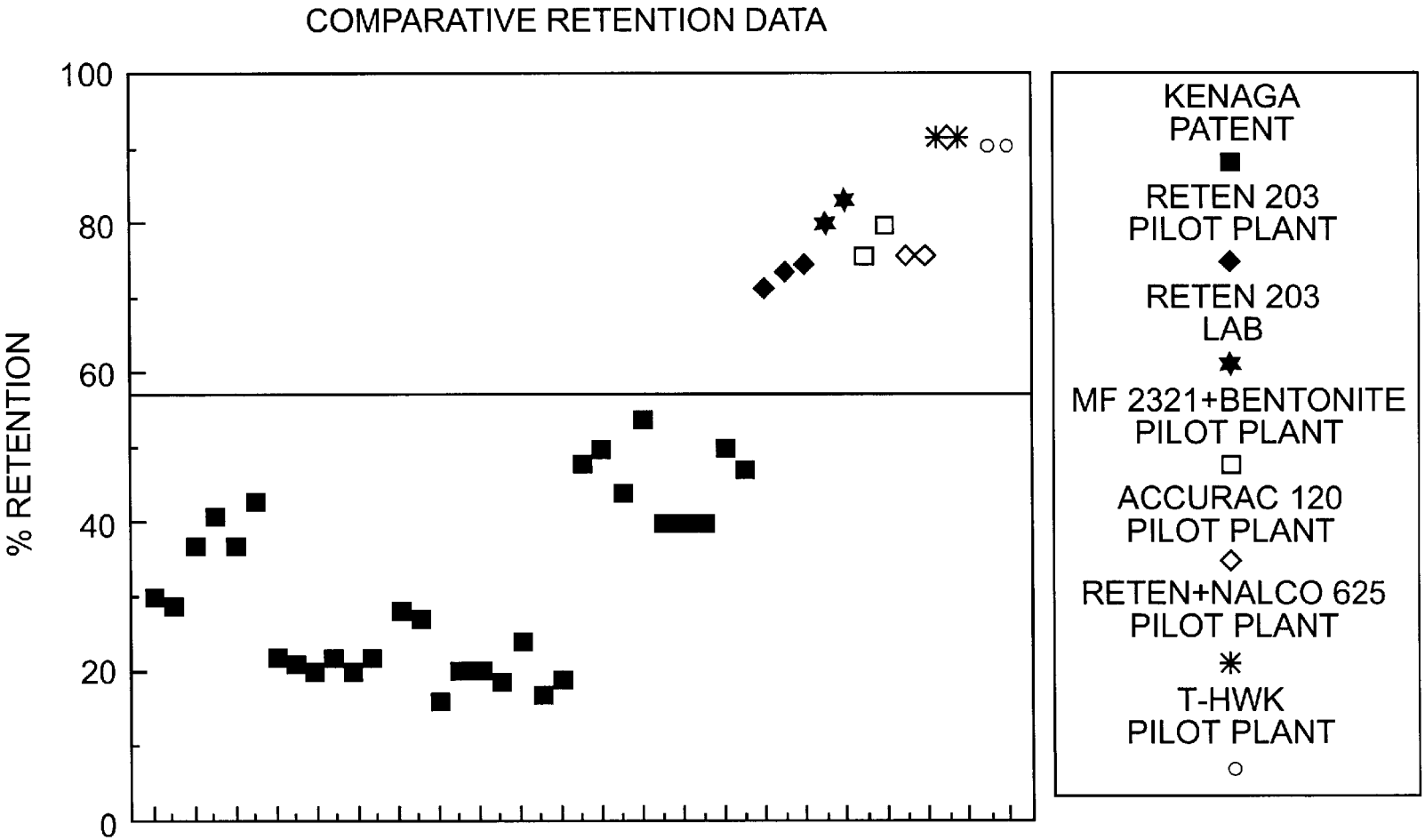
FIG. 59 is a graph illustrating the percent microspheres retained in the fiber board when using the retention aids of this invention in comparison with the retention of microspheres in prior art paper.
Figure 60:
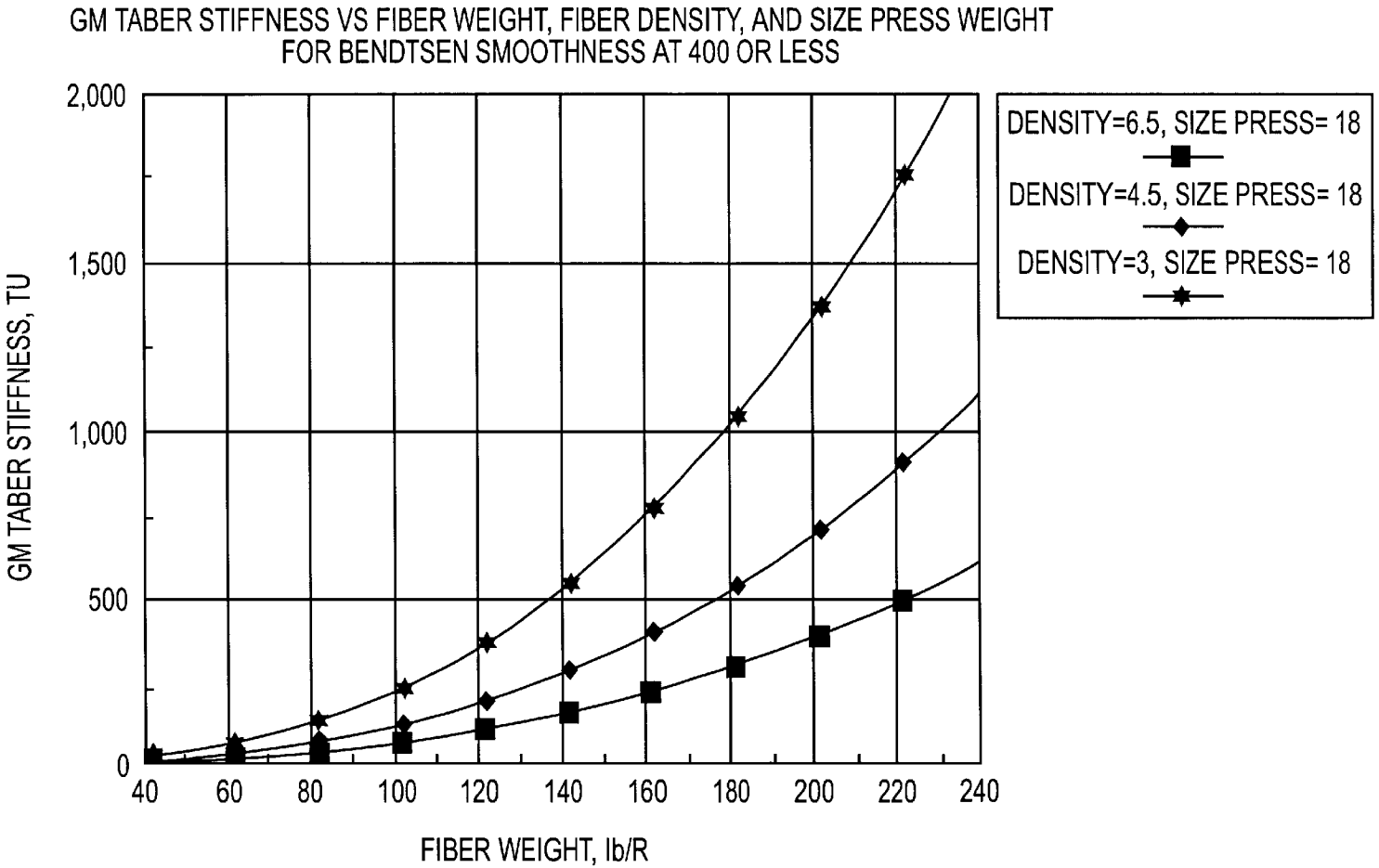
FIG. 60 is a graph illustrating the improved GM Taber stiffness values for paperboards prepared according to the present invention with GM Taber stiffness values for boards available on the market.
Figure 61:
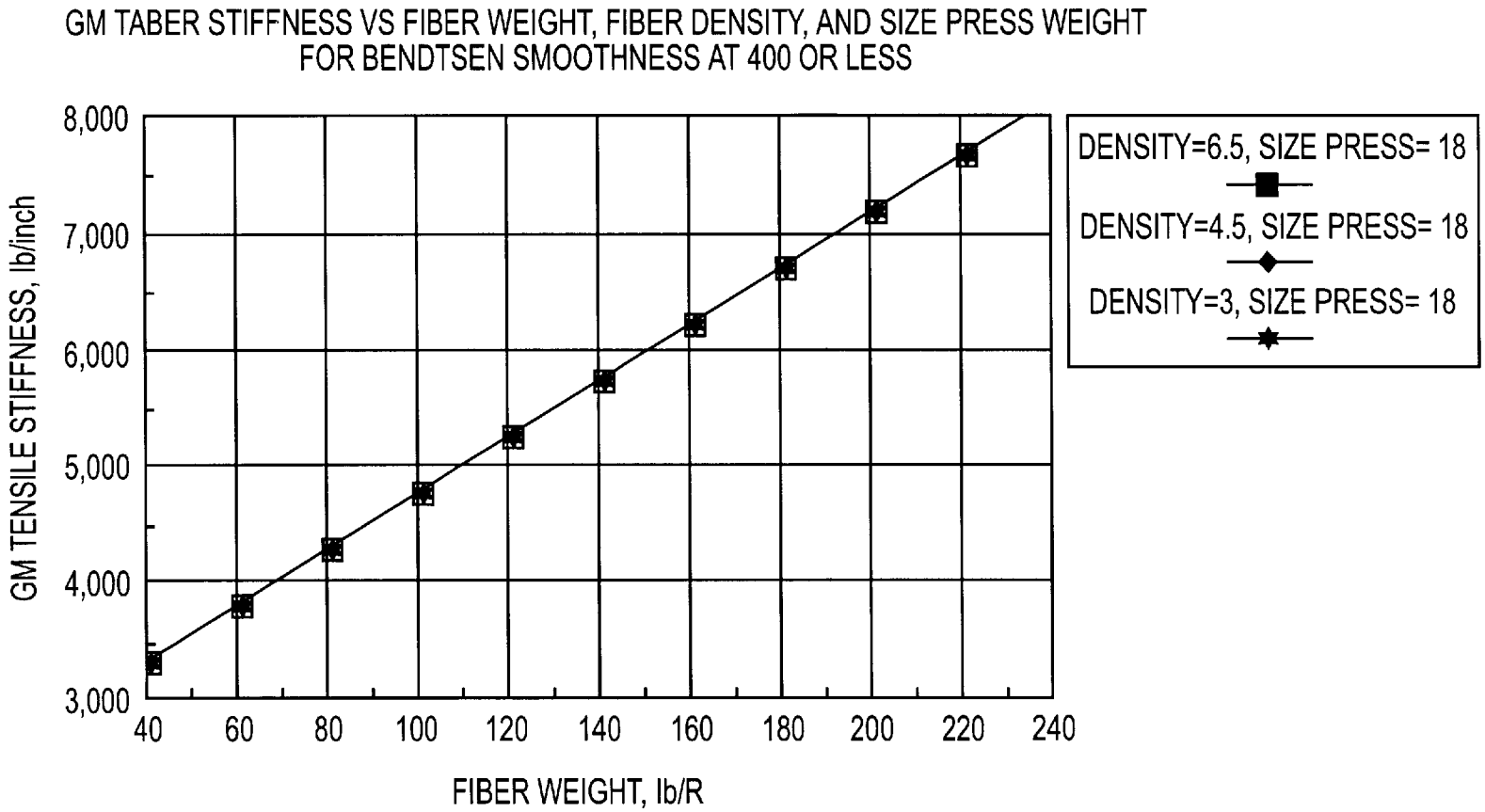
FIG. 61 is a graph illustrating the improved GM tensile stiffness values for boards prepared according to the present invention with boards available on the market.

In Run 1, designated in FIG. 58E as Reten 203, the following chemicals per ton of cellulosic feedstock were charged at the machine chest [FIG. 56 (84)]: Alum, ten pounds, and Neuphor 635, six pounds. In this Run 1, the following chemicals per ton of cellulosic feedstock were charged at the stuff box [FIG. 56 (88)]: Apollo 600, eight pounds, and Reten 203, one half pound. In this Run 1, forty pounds of Expancel 820WU were charged at the fan pump [FIG. 56 (92)] for each ton of cellulosic feedstock.

Run 2 was a repetition of Run 1 except that fifty pounds of Expancel 820WU were also charged at the fan pump [FIG. 56 (92)] for each ton of cellulosic feedstock.

In Run 3, designated in FIG. 58E as Reten+T-HWK, the following chemicals per ton of cellulosic feedstock were charged at the machine chest [FIG. 56 (84)]: Alum, ten pounds; thermal hardwood fiber (T-HWK), four hundred pounds, and Neuphor 635, six pounds. In this Run 3, the following chemicals per ton of cellulosic feedstock were charged at the stuffbox [FIG. 56 (88)]: Apollo 800, eight pounds, and Reten 203, one half pound. Fifty pounds of Expancel 820WU for each ton of cellulosic feedstock were charged at the fan pump [FIG. 56 (92)].

In Run 4, designated in FIG. 58E as Reten+T-SWK, the following chemicals per ton of cellulosic feedstock were charged at the machine chest [FIG. 56 (84)]: Alum, ten pounds, thermal softwood fiber (S+HWK), four hundred pounds, and Neuphor 635, six pounds. In this Run 4, the following chemicals per ton of cellulosic feedstock were charged at the stuff box [FIG. 56 (88)]: Apollo 800, eight pounds, and Reten 203, one half pound. Fifty pounds of Expancel 820WU for each ton of cellulosic feedstock were charged at the fan pump [FIG. 56 (92)].

EXAMPLE 19

Runs were carried out to determine the increase in bulk properties of the paperboard achieved by the addition of the expandable microspheres.

Run 1. Please refer to FIG. 56. Hardwood Kraft (80) and Softwood Kraft (81) lap pulps (in the ratio of 75%:25%) were pulped and refined together using a Jordan refiner to a Canadian Standard Freeness of 523, pumped to the mix chest (83) and stored in the machine chest (84). Alum (85) was added to the stock and the pH was adjusted to pH 4.8 using sulfuric acid (86), and then rosin size (87) was added. This stock was pumped to the stuff box (88) and then starch (8 lb./ton) (89) and retention aid (0.5 lb./ton) (90) were added to the stock at the down leg of the stuff box (88). Expancel® 820 (90) was added to the stock just ahead of the fan pump (92) at the rate of 50 lb./ton of cellulosic feedstock. This stock was then pumped via the fan pump (90) to the headbox of the paper machine (93) to form the web on the wire. This web was then pressed in the press section (95) and drying was started in contact with a Yankee dryer (96), the web was optionally calendered (97) and further drying was carried out using steam-heated drying cans in the drying section (97). The final dry web (~2.0% moisture) was then reeled up (99). The oven-dried fiber weight of the board was 105 lbs./3000 sq. ft.

Figure 48:
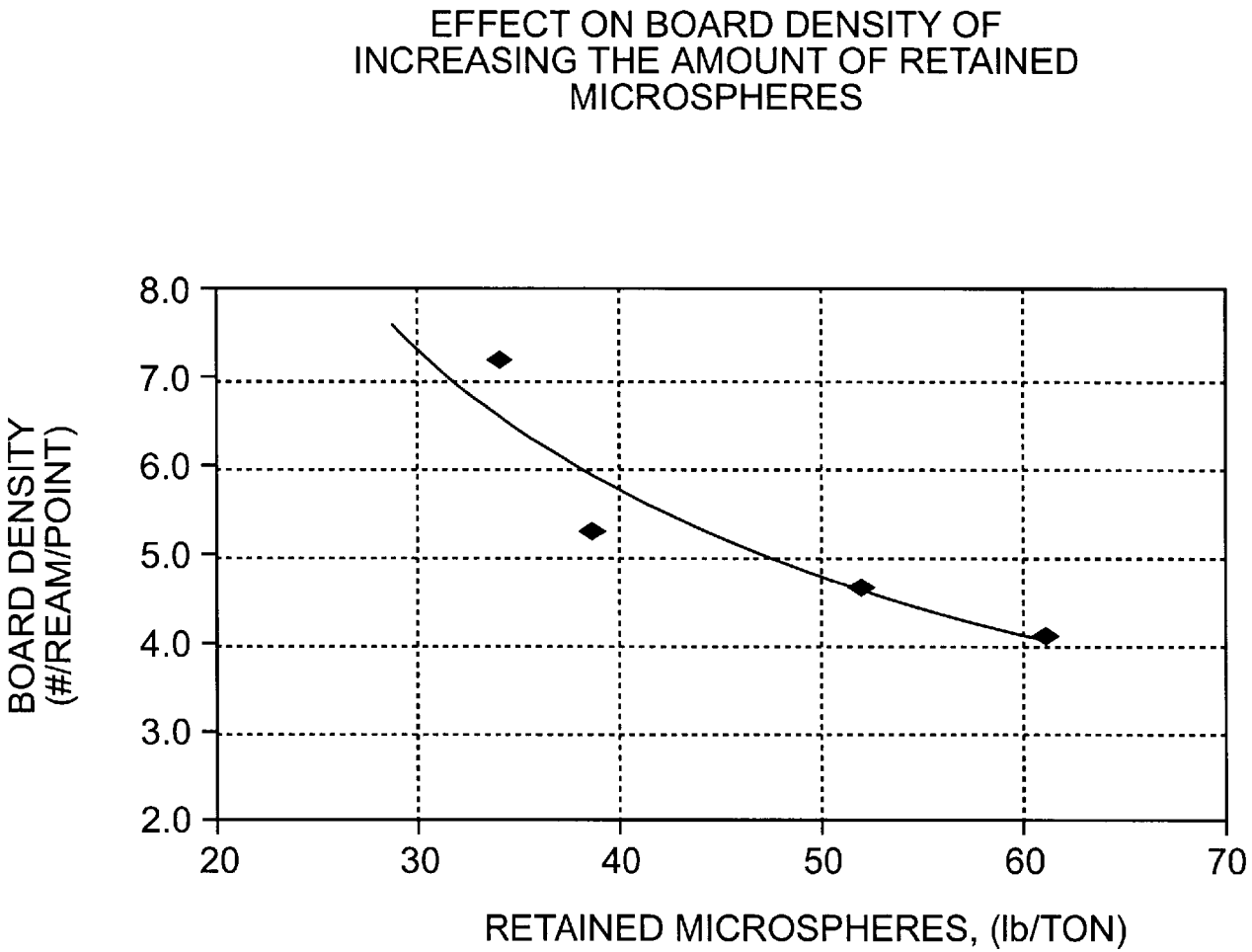
FIG. 48 is a graph illustrating the effect on board density of increasing the amount of retained microspheres.

Runs 2, 3, and 4. Run 1 was then repeated using 60, 80, and 100 lbs. of the microspheres for each ton of the cellulosic feedstock and the caliper was found to increase as shown in Table 8. A graphical plot showing the relationship between bulk and the amount of retained microspheres is shown in FIG. 48.

TABLE 8

| | Run 1 | Run 2 | Run 3 | Run 4 |
|---|---|---|---|---|
| Fiber weight (pounds per 3000 sq, ft. ream) | 112 | 112 | 112 | 112 |
| Expancel ® addition (lb./ton) | 50.0 | 60.0 | 80.0 | 100.0 |
| Retention Aid (lb./ton) | 33.9 | 38.5 | 51.9 | 61.0 |
| Retention (%) | 67.8 | 64.2 | 64.9 | 61.0 |
| Caliper ($\mu$) | 15.5 | 21.0 | 24.0 | 27.0 |
| Density (lb./3000 sq. ft. ream/$\mu$) | 7.23 | 5.34 | 4.67 | 4.15 |

EXAMPLE 20

Twelve runs were conducted using the procedure of Example 19. The superior retention of the microspheres and the excellent properties of the bulk enhanced board produced in Runs 1–12 is set forth in Tables 9 through 11.

TABLE 9A

| | Run 1 | Run 2 | Run 3 | Run 4 | Run 5 | Run 6 | Run 7 | Run 8 | Run 9 | Run 10 | Run 11 | Run 12 |
|---|---|---|---|---|---|---|---|---|---|---|---|---|
| 90 pound ream | | | | | | | | | | | | |
| Expancel-820 | 0 | 50 | 75 | 0 | 50 | 75 | 0 | 50 | 75 | 0 | 50 | 75 |
| Alum | 10 | 10 | 10 | 10 | 10 | 10 | 10 | 10 | 10 | 10 | 10 | 10 |
| Apollo starch | 8 | 8 | 8 | 8 | 8 | 8 | 8 | 8 | 8 | 8 | 8 | 8 |
| Neuphor 635 | 6 | 6 | 6 | 6 | 6 | 6 | 6 | 6 | 6 | 6 | 6 | 6 |
| Accurac 120 | 1.5 | 1.5 | 1.5 | 1.5 | 1.5 | 1.5 | 1.5 | 1.5 | 1.5 | 1.5 | 1.5 | 1.5 |
| HBA | 0 | 0 | 0 | 5 | 5 | 5 | 10 | 10 | 10 | 15 | 15 | 15 |
| SWK | 25 | 25 | 25 | 20 | 20 | 20 | 15 | 15 | 15 | 10 | 10 | 10 |
| HWK | 75 | 75 | 75 | 75 | 75 | 75 | 75 | 75 | 75 | 75 | 75 | 75 |
| DATA | | | | | | | | | | | | |
| Basis Weight | 90 | 90 | 90 | 90 | 90 | 90 | 90 | 90 | 90 | 90 | 90 | 90 |
| Caliper | 12.0 | 16.0 | 20.5 | 12.0 | 17.5 | 22.5 | 13.0 | 19.0 | 23.0 | 16.0 | 19.0 | 26.0 |
| Density | 7.5 | 5.6 | 4.4 | 7.5 | 5.1 | 4.0 | 6.9 | 4.7 | 3.9 | 5.6 | 4.7 | 3.8 |
| Retained | 0.0 | 35.4 | 58.6 | 0 | 36.4 | 60.2 | 0 | 37.3 | 54.3 | 0 | 35.4 | 48.2 |
| % Retention | 0.0 | 70.8 | 78.1 | 0 | 72.8 | 80.3 | 0 | 74.6 | 72.4 | 0 | 70.8 | 64.3 |

TABLE 9B

| | | MUTEK | | | | | |
|---|---|---|---|---|---|---|---|
| | | | Density | CONSISTENCE | | | |
| Run # | | Potential | Charge mV | Headbox $\mu$eq/g | Tray % | FPR % | Note % |
| Blank | 75% HW + 25% SW (+ Alum + Neuphor) | −88.1 | −5.8 | | | | |
| 1 | 1.5#/t Accurac 120 + 0#/t Expancel | NA | NA | NA | NA | NA | 90#/ream |
| 2 | 1.5#/t Accurac 120 + 50#/t Expancel | −36.3 | −10.8 | 0.285 | 0.007 | 97.54 | 90#/ream |
| 3 | 1.5#/t Accurac 120 + 75#/t Expancel | −20.1 | −18.8 | 0.259 | 0.002 | 99.23 | 90#/ream |
| 4 | 5% HBA + 1.5#/t Accurac 120 + 0#/t Expancel | −11.8 | −31.3 | 0.268 | 0.001 | 99.63 | 90#/ream |
| 5 | 5% HBA + 1.5#/t Accurac 120 + 50#/t Expancel | −12.0 | 25.4 | 0.257 | 0.003 | 98.83 | 90#/ream |
| 6 | 5% HBA + 1.5#/t Accurac 120 + 75#/t Expancel | −58.0 | −20.2 | 0.277 | 0.003 | 98.92 | 90#/ream |
| 7 | 10% HBA + 1.5#/t Accurac 120 + 0#/t Expancel | −135.0 | −34.1 | 0.265 | 0.006 | 97.74 | 90#/ream |
| 8 | 10% HBA + 1.5#/t Accurac 120 + 50#/t Expancel | −110.6 | −17.4 | 0.284 | 0.003 | 98.94 | 90#/ream |
| 9 | 10% HBA + 1.5#/t Accurac 120 + 0#/t Expancel | −101.1 | −20.0 | 0.305 | 0.006 | 97.85 | 90#/ream |
| 10 | 15% HBA + 1.5#/t Accurac 120 + 0#/t Expancel | −54.0 | −16.9 | 0.286 | 0.006 | 97.90 | 90#/ream |

TABLE 9B-continued

| Run # | | MUTEK Potential | Charge mV | Density Headbox μeq/g | CONSISTENCE Tray % | FPR % | Note % |
|---|---|---|---|---|---|---|---|
| 11 | 15% HBA + 1.5#/t Accurac 120 + 50#/t Expancel | −54.0 | −16.9 | 0.286 | 0.006 | 97.90 | 90#/ream |
| 12 | 15% HBA + 1.5#/t Accurac 120 + 75#/t Expancel | −75.0 | −20.3 | 0.318 | 0.006 | 98.11 | 90#/ream |

TABLE 10

| Run # | 1 | 2 | 3 | 4 | 5 | 6 | 7 | 8 | 9 | 10 | 11 | 12 |
|---|---|---|---|---|---|---|---|---|---|---|---|---|
| Nip PSIG | "18/19 | "18/19 | "18/19 | "18/19 | "18/19 | "18/19 | "18/19 | "18/19 | "18/19 | "18/19 | "18/19 | "18/19 |
| Yan. Steam PSIG/C' | "0/ 160 | "0/ 160 | "0/ 160 | "0/ 160 | "0/ 160 | "0/ 160 | "0/ 160 | "0/ 160 | "0/ 160 | "0/ 160 | "0/ 160 | "0/ 160 |
| Vacuum of Hg | | | | | | | | | | | | |
| Felt Inside | 15.0 | 15.0 | 15.0 | 15.0 | 15.0 | 15.0 | 15.0 | 15.0 | 15.0 | 15.0 | 15.0 | 15.0 |
| Felt Outside | 18.0 | 18.0 | 18.0 | 18.0 | 18.0 | 18.0 | 18.0 | 18.0 | 18.0 | 18.0 | 18.0 | 18.0 |
| Pickup Shoe | 12.5 | 12.5 | 12.5 | 12.5 | 12.5 | 12.5 | 12.5 | 12.5 | 12.5 | 12.5 | 12.5 | 12.5 |
| Position p.u. Shoe | D-20 | D-20 | D-20 | D-20 | D-20 | D-20 | D-20 | D-20 | D-20 | D-20 | D-20 | D-20 |
| Additives in Chest - Alum | | | | | | | | | | | | |
| Pounds/T Add On | 10.0 | 10.0 | 10.0 | 10.0 | 10.0 | 10.0 | 10.0 | 10.0 | 10.0 | 10.0 | 10.0 | 10.0 |
| OD Pounds Needed | 0.60 | 0.60 | 0.60 | 0.60 | 0.60 | 0.60 | 0.60 | 0.60 | 0.60 | 0.60 | 0.60 | 0.60 |
| Additives in Chest - Neuphor 635 | | | | | | | | | | | | |
| Pounds/T Add On (Sizing) | 6.0 | 6.0 | 6.0 | 6.0 | 6.0 | 6.0 | 6.0 | 6.0 | 6.0 | 6.0 | 6.0 | 6.0 |
| OD Pounds Needed | 0.36 | 0.36 | 0.36 | 0.36 | 0.36 | 0.36 | 0.36 | 0.36 | 0.36 | 0.36 | 0.36 | 0.36 |
| Additives - DN Leg - Apollo 600 | | | | | | | | | | | | |
| Pounds/T Add On (Starch) | 8.0 | 8.0 | 8.0 | 8.0 | 8.0 | 8.0 | 8.0 | 8.0 | 8.0 | 8.0 | 8.0 | 8.0 |
| " % Solids | 5.00 | 5.00 | 5.00 | 5.00 | 5.00 | 5.00 | 5.00 | 5.00 | 5.00 | 5.00 | 5.00 | 5.00 |
| Mil's Added/Min. | 25.4 | 25.4 | 25.4 | 25.4 | 25.4 | 25.4 | 25.4 | 25.4 | 25.4 | 25.4 | 25.4 | 25.4 |
| Additives - DN Leg - Accurac 120 | | | | | | | | | | | | |
| Pounds/T Add On | 1.5 | 1.5 | 1.5 | 1.5 | 1.5 | 1.5 | 1.5 | 1.5 | 1.5 | 1.5 | 1.5 | 1.5 |
| " % Solids | 0.35 | 0.35 | 0.35 | 0.35 | 0.35 | 0.35 | 0.35 | 0.35 | 0.35 | 0.35 | 0.35 | 0.35 |
| Mil's Added/Min. | 68.0 | 68.0 | 68.0 | 68.0 | 68.0 | 68.0 | 68.0 | 68.0 | 68.0 | 68.0 | 68.0 | 68.0 |
| Additives - Fan Pump - Spheres (Keep Under Constant Agitation) | | | | | | | | | | | | |
| Pounds/T Add On | 0.0 | 50.0 | 75.0 | 0.0 | 50.0 | 75.0 | 0.0 | 50.0 | 75.0 | 0.0 | 50.0 | 75.0 |
| " % Solids | 4.00 | 4.00 | 4.00 | 4.00 | 4.00 | 4.00 | 4.00 | 4.00 | 4.00 | 4.00 | 4.00 | 4.00 |
| Mil's Added/Min. | 0.0 | 198.5 | 297.7 | 0.0 | 198.5 | 297.7 | 0.0 | 198.5 | 297.7 | 0.0 | 198.5 | 297.7 |

The order of addition was alum, sulfuric acid to adjust the pH, and neuphor. The HBA pulp was passed through an open refiner to remove nits.

TABLE 11A

| Run # | Conditions 1 | 2 | 3 | 4 | 5 | 6 | 7 | 8 | 9 | 10 | 11 | 12 |
|---|---|---|---|---|---|---|---|---|---|---|---|---|
| Naheola HWK | 75% | 75% | 75% | 75% | 75% | 75% | 75% | 75% | 75% | 75% | 75% | 75% |
| Naheola SWK | 25% | 25% | 25% | 20% | 20% | 20% | 15% | 15% | 15% | 10% | 15% | 15% |
| HBA | 0% | 0% | 0% | 5% | 5% | 5% | 10% | 10% | 10% | 15% | 15% | 15% |
| M.C. Batch Size | 120.0 | 120.0 | 120.0 | 120.0 | 120.0 | 120.0 | 120.0 | 120.0 | 120.0 | 120.0 | 120.0 | 120.0 |
| Starting CSF | 650 | 650 | 650 | 650 | 650 | 650 | 650 | 650 | 650 | 650 | 650 | 650 |
| Refiner Jordan (Cone) Set Points - 95 AMPS/800 RPM | | | | | | | | | | | | |
| Refining Time - Kraft | "40 Min's | "40 Min's | "40 Min's | "40 Min's | "40 Min's | "40 Min's | "40 Min's | "40 Min's | "40 Min's | "40 Min's | "40 Min's | "40 Min's |
| CSF @ M.C. | 505 | 505 | 505 | 524 | 524 | 524 | 526 | 526 | 526 | 604 | 604 | 604 |
| Inches in Tank | 53.0 | 53.0 | 53.0 | 53.0 | 53.0 | 53.0 | 53.0 | 53.0 | 53.0 | 53.0 | 53.0 | 53.0 |

TABLE 11B

| Run # | 1 | 2 | 3 | 4 | 5 | 6 | 7 | 8 | 9 | 10 | 11 | 12 |
|---|---|---|---|---|---|---|---|---|---|---|---|---|
| Headbox Vacuum #1 | 4.0 | 4.0 | 4.0 | 4.0 | 4.0 | 4.0 | 4.0 | 4.0 | 4.0 | 4.0 | 4.0 | 4.0 |
| Headbox Vacuum #2 | 2.5 | 2.5 | 2.5 | 2.5 | 2.5 | 2.5 | 2.5 | 2.5 | 2.5 | 2.5 | 2.5 | 2.5 |
| Headbox Vacuum #3 | 3.5 | 3.5 | 3.5 | 3.5 | 3.5 | 3.5 | 3.5 | 3.5 | 3.5 | 3.5 | 3.5 | 3.5 |
| Headbox Vacuum #4 | 2.0 | 2.0 | 2.0 | 2.0 | 2.0 | 2.0 | 2.0 | 2.0 | 2.0 | 2.0 | 2.0 | 2.0 |
| Inches of H20 #5 | 4.0 | 4.0 | 4.0 | 4.0 | 4.0 | 4.0 | 4.0 | 4.0 | 4.0 | 4.0 | 4.0 | 4.0 |
| Pond Height | "6.5" | "6.5" | "6.5" | "6.5" | "6.5" | "6.5" | "6.5" | "6.5" | "6.5" | "6.5" | "6.5" | "6.5" |
| Manifold Position | "15.0" | "15.0" | "15.0" | "15.0" | "15.0" | "15.0" | "15.0" | "15.0" | "15.0" | "15.0" | "15.0" | "15.0" |
| | | | | | Stock Flow | | | | | | | |
| Loop #1 GPM | 8.53 | 8.53 | 8.53 | 8.53 | 8.53 | 8.53 | 8.53 | 8.53 | 8.53 | 8.53 | 8.53 | 8.53 |
| "% Consistency | 0.99 | 0.99 | 0.99 | 0.99 | 0.99 | 0.99 | 0.99 | 0.99 | 0.99 | 0.99 | 0.99 | 0.99 |
| | | | | | White Water | | | | | | | |
| Loop #3 GPM | 35.0 | 35.0 | 35.0 | 35.0 | 35.0 | 35.0 | 35.0 | 35.0 | 35.0 | 35.0 | 35.0 | 35.0 |
| "% Consistency | 0.24 | 0.24 | 0.24 | 0.24 | 0.24 | 0.24 | 0.24 | 0.24 | 0.24 | 0.24 | 0.24 | 0.24 |
| Machine Chest PH | 4.8 | 4.8 | 4.8 | 4.8 | 4.8 | 4.8 | 4.8 | 4.8 | 4.8 | 4.8 | 4.8 | 4.8 |
| Wire FPM | 20.0 | 20.0 | 20.0 | 20.0 | 20.0 | 20.0 | 20.0 | 20.0 | 20.0 | 20.0 | 20.0 | 20.0 |
| Felt FPM | "2.8/ 20.5 | "2.8/ 20.5 | "2.8/ 20.5 | "2.8/ 20.5 | "2.8/ 20.5 | "2.8/ 20.5 | "2.8/ 20.5 | "2.8/ 20.5 | "2.8/ 20.5 | "2.8/ 20.5 | "2.8/ 20.5 | "2.8/ 20.5 |
| Yankee FPM | 20.3 | 20.3 | 20.3 | 20.3 | 20.3 | 20.3 | 20.3 | 20.3 | 20.3 | 20.3 | 20.3 | 20.3 |
| "% Crepe | −1.5% | −1.5% | −1.5% | −1.5% | −1.5% | −1.5% | −1.5% | −1.5% | −1.5% | −1.5% | −1.5% | −1.5% |
| | | | | | Calendar FPM | | | | | | | |
| Can S/FPM | "−7/ 20.3 | "−7/ 20.3 | "−7/ 20.3 | "−7/ 20.3 | "−7/ 20.3 | "−7/ 20.3 | "−7/ 20.3 | "−7/ 20.3 | "−7/ 20.3 | "−7/ 20.3 | "−7/ 20.3 | "−7/ 20.3 |
| Reel #2 FPM | 20.0 | 20.0 | 20.0 | 20.0 | 20.0 | 20.0 | 20.0 | 20.0 | 20.0 | 20.0 | 20.0 | 20.0 |
| Basis Wt. A.D. @ 2.0% | 91.80 | 91.80 | 91.80 | 91.80 | 91.80 | 91.80 | 91.80 | 91.80 | 91.80 | 91.80 | 91.80 | 91.80 |
| Basis Wt. O.D. | 90.0 | 90.0 | 90.0 | 90.0 | 90.0 | 90.0 | 90.0 | 90.0 | 90.0 | 90.0 | 90.0 | 90.0 |
| Amt. Made | 600 | 600 | 600 | 600 | 600 | 600 | 600 | 600 | 600 | 600 | 600 | 600 |
| Time Start | "10:30 | "2:30 | "1.45 | "11:45 | "12:15 | "1.00 | "10:15 | "10:45 | "11:30 | "1:25 | "2:05 | "2:45 |
| Rolls Needed | 1 | 1 | 1 | 1 | 1 | 1 | 1 | 1 | 1 | 1 | 1 | 1 |
| Min's Needed | 30 | 30 | 30 | 30 | 30 | 30 | 30 | 30 | 30 | 30 | 30 | 30 |
| OD #/Min. | 0.7000 | 0.7000 | 0.7000 | 0.7000 | 0.7000 | 0.7000 | 0.7000 | 0.7000 | 0.7000 | 0.7000 | 0.7000 | 297.7 |

EXAMPLE 21

Thirty runs were conducted using the procedure of Examples 19 and 20. In Table 12 the superior properties of the bulk enhanced board produced in Runs 1–30 are set forth.

TABLE 12

| | Run # | 1 | 2 | 3 | 4 | 5 | 6 | 7 | 8 | 9 | 10 | 11 |
|---|---|---|---|---|---|---|---|---|---|---|---|---|
| | Retention System | Reten | Reten | Reten Nalco | Reten Nalco | Reten Nalco | Accurac | Accurac | Accurac | Polymin | Polymin | Polymin |
| Dry | Tensile Load at Max Load MD 48 T | 41.36 | 24.75 | 29.75 | 28.37 | 40.01 | 38.27 | 31.46 | 31.57 | 42.93 | 34.23 | 28.94 |
| Dry | Stretch % Strain at Max Load MD 48 T | 2.471 | 2.226 | 2.058 | 2.248 | 2.505 | 2.335 | 2.102 | 2.164 | 2.748 | 2.357 | 2.226 |
| Dry | TEA MD 48 T | 0.720 | 0.381 | 0.412 | 0.433 | 0.704 | 0.622 | 0.445 | 0.462 | 0.842 | 0.555 | 0.444 |
| Dry | Modulus psi/1000 MD 48 T | 482.2 | 173.9 | 242.3 | 196.8 | 450.8 | 422.2 | 248.3 | 221.2 | 481.9 | 291.3 | 214.5 |
| Dry | Caliper mils MD 48 T | 10.4 | 17.1 | 15.1 | 16.8 | 10.6 | 11.3 | 14.8 | 16.8 | 10.8 | 13.8 | 15.9 |
| Dry | Tensile Load at Max Load CD 48 T | 25.01 | 19.56 | 23.50 | 19.96 | 29.94 | 27.93 | 22.07 | 20.88 | 26.71 | 22.79 | 20.56 |
| Dry | Stretch % Strain at Max Load CD 48 T | 3.045 | 2.785 | 2.871 | 2.863 | 3.471 | 3.277 | 2.948 | 3.018 | 3.338 | 3.120 | 2.980 |
| Dry | TEA CD 48 T | 0.569 | 0.400 | 0.485 | 0.412 | 0.768 | 0.683 | 0.470 | 0.454 | 0.662 | 0.521 | 0.445 |
| Dry | Modulus psi/1000 CD 48 T | 276.9 | 131.9 | 176.0 | 333.0 | 320.5 | 309.5 | 163.4 | 143.0 | 315.2 | 202.1 | 155.3 |
| Dry | Caliper mils CD 48 T | 10.8 | 17.3 | 15.1 | 16.8 | 10.8 | 10.7 | 15.4 | 16.4 | 10.6 | 13.4 | 15.5 |
| Wet | Tensile Load at Max Load MW 48T | 2.07 | 2.81 | 2.08 | 2.68 | 1.88 | 1.49 | 2.00 | 2.51 | 2.27 | 2.71 | 2.96 |
| Wet | Stretch % Strain at Max Load MW 48 T | 2.172 | 2.927 | 2.100 | 2.852 | 2.002 | 1.777 | 2.143 | 2.383 | 2.236 | 2.744 | 3.102 |
| Wet | TEA MW 48 T | 0.036 | 0.058 | 0.033 | 0.055 | 0.030 | 0.023 | 0.032 | 0.046 | 0.039 | 0.055 | 0.068 |

TABLE 12-continued

| | | | | | | | | | | | | |
|---|---|---|---|---|---|---|---|---|---|---|---|---|
| Wet | Tensile Load at Max Load CW 48 T | 1.63 | 1.87 | 1.75 | 1.59 | 1.46 | 1.08 | 1.31 | 1.73 | 1.81 | 2.20 | 2.20 |
| Wet | Stretch % Strain at Max Load CW 48 T | 3.013 | 3.717 | 2.954 | 2.760 | 2.533 | 2.395 | 2.610 | 3.111 | 3.269 | 3.458 | 3.458 |
| Wet | TEA CW 48 T gm/sqm | 0.038 | 0.050 | 0.037 | 0.032 | 0.028 | 0.020 | 0.026 | 0.040 | 0.3044 | 0.053 | 0.053 |
| Wet | CobbLbl $H_2O$ Absorb | 28.5 | 21.5 | 26.8 | 24.3 | 30.6 | 33.0 | 25.5 | 28.3 | 29.2 | 24.8 | 22.9 |
| Wet | Taber Avg MD units | 22.3 | 37.4 | 36.2 | 44.1 | 37.4 | 23.0 | 33.2 | 41.6 | 23.1 | 32.1 | 36.3 |
| Wet | Taber Avg CD units | 14.8 | 25.5 | 26.9 | 28.2 | 15.4 | 14.3 | 24.4 | 30.8 | 15.5 | 26.1 | 25.7 |
| | Run # | 12 | 13 | 14 | 15 | 16 | 17 | 18 | 19 | 20 | 22 | 30 |
| | Retention System | Polymin Nalco | Polymin Nalco | Polymin Nalco | Reten HBA | Reten HBA | Reten HBA | Accurac HBA | Accurac HBA | Accurac HBA | Accurac HBA | Accurac HBA |
| Dry | Tensile Load at Max Load MD 48 T | 37.82 | 30.80 | 29.40 | 26.89 | 24.04 | 21.36 | 26.58 | 20.72 | 18.33 | 19.30 | 20.25 |
| Dry | Stretch % Strain at Max Load MD 48 T | 2.390 | 2.193 | 2.368 | 2.062 | 2.313 | 2.285 | 1.995 | 2.071 | 1.884 | 1.870 | 2.555 |
| Dry | TEA MD 48 T | 0.637 | 0.470 | 0.479 | 0.395 | 0.397 | 0.343 | 0.377 | 0.299 | 0.241 | 0.248 | 0.361 |
| Dry | Modulus psi/1000 MD 48 T | 456.0 | 247.5 | 199.1 | 251.1 | 156.7 | 117.4 | 230.3 | 125.8 | 98.7 | 103.1 | 59.1 |
| Dry | Caliper mils MD 48 T | 10.3 | 15.0 | 16.6 | 13.5 | 17.8 | 20.4 | 14.7 | 19.3 | 21.9 | 22.7 | 33.3 |
| Dry | Tensile Load at Max Load CD 48 T | 26.07 | 23.24 | 20.41 | 18.61 | 17.49 | 15.24 | 18.39 | 14.63 | 13.55 | 15.49 | 16.06 |
| Dry | Stretch % Strain at Max Load CD 48 T | 3.004 | 2.990 | 2.587 | 2.705 | 2.520 | 2.431 | 2.315 | 2.488 | 2.391 | 2.258 | 2.543 |
| Dry | TEA CD 48 T | 0.581 | 0.501 | 0.375 | 0.376 | 0.265 | 0.319 | 0.311 | 0.263 | 0.232 | 0.254 | 0.295 |
| Dry | Modulus psi/1000 CD 48 T | 306.9 | 180.7 | 137.7 | 173.2 | 112.4 | 86.7 | 166.6 | 82.5 | 69.3 | 84.0 | 49.2 |
| Dry | Caliper mils CD 48 T | 10.6 | 14.6 | 17.4 | 13.4 | 18.3 | 20.2 | 14.3 | 19.7 | 21.7 | 22.0 | 35.5 |
| Wet | Tensile Load at Max Load MW 48T | 1.81 | 2.47 | 2.74 | 0.88 | 1.17 | 1.10 | 0.86 | 1.01 | 1.29 | 1.43 | 1.84 |
| Wet | Stretch % Strain at Max Load MW 48 T | 1.984 | 2.531 | 2.592 | 1.567 | 2.025 | 1.878 | 1.585 | 1.954 | 1.940 | 2.220 | 2.336 |
| Wet | TEA MW 48 T | 0.028 | 0.048 | 0.052 | 0.012 | 0.019 | 0.016 | 0.012 | 0.016 | 0.020 | 0.025 | 0.034 |
| Wet | Tensile Load at Max Load CW 48 T | 1.43 | 1.85 | 2.33 | 0.60 | 0.93 | 0.93 | 0.69 | 0.86 | 0.98 | 0.98 | 0.97 |
| Wet | Stretch % Strain at Max Load CW 48 T | 3.065 | 3.065 | 3.651 | 2.052 | 2.726 | 2.651 | 2.270 | 2.591 | 2.678 | 2.557 | 2.317 |
| Wet | TEA CW 48 T gm/sqm | 0.041 | 0.040 | 0.061 | 0.011 | 0.022 | 0.021 | 0.014 | 0.019 | 0.020 | 0.020 | 0.020 |
| Wet | CobbLbl $H_2O$ Absorb | 31.1 | 25.9 | 23.5 | 28.5 | 27.8 | 27.0 | 33.5 | 27.4 | 25.4 | 27.4 | 28.7 |
| Wet | Taber Avg MD units | 22.1 | 32.5 | 40.3 | 21.2 | 29.7 | 35.4 | 23.1 | 29.4 | 31.6 | 37.6 | 87.5 |
| Wet | Taber Avg CD units | 14.8 | 22.8 | 26.6 | 15.2 | 24.1 | 27.4 | 18.0 | 24.6 | 27.3 | 32.4 | 80.3 |

As is apparent from the foregoing specification and examples, the improved paperboard and the improved methods of the present invention may be used with various alterations and modifications which differ from those described above. The articles of manufacture formed from the paperboard of this invention include cartons, folding paper boxes, cups (FIGS. 25, 26, and 55), plates (FIG. 18), compartmented plates (FIG. 21), bowls (FIG. 19), canisters (FIG. 20), French fry sleeves (FIG. 22), hamburger clam shells (FIG. 24), rectangular take-out containers (FIG. 23), and food buckets (FIG. 27). For this reason, it is to be understood that the foregoing is intended to be merely illustrative and is not to be construed or interpreted as being restrictive or otherwise limiting of the present invention. Rather, the appended claims are to be construed to cover all equivalents falling within the scope and spirit of the invention.

Definitions

GM tensile stiffness and GM Taber stiffness are measured according to the following procedures. Tensile stiffness is defined by the following equation:

$$\text{TENSILE STIFFNESS}=\text{YOUNG'S MODULUS}\times\text{CALIPER}$$

where $$\text{YOUNG'S MODULUS}=\Delta\sigma/\Delta\epsilon$$

Young's Modulus is defined as the change in specimen stress per unit change in strain expressed in pounds per square inch. The stress-strain relationship is expressed as the slope of the initial linear portion of the curve where stress is the y-axis and strain is the x-axis. Caliper is the thickness of a single sheet of the paperboard, expressed in inches, and is measured using TAPPI Test Method T411 om 89.

As the economic value for paperboard in many applications in commerce depends on its GM Taber stiffness or flexural rigidity, this is an important property. Taber stiffness values are determined as set forth in TAPPI method T489 om 92. The Taber-type stiffness test procedure is used to measure the stiffness of paperboard by determining the bending moment, in gram centimeters, necessary to deflect the free end of a 38 mm wide vertically clamped specimen 150 from its center line when the load is applied 50 mm away from the clamp.

Related methods: International Organization for Standardization ISO2493; Technical Association of the Australian and New Zealand Pulp and Paper Industry APPITA P431; British Standard Institution BS13748; Scandinavian Pulp Paper and Board Testing Committee SCAN P-29. Precision of the GM Taber Stiffness Test TAPPI 52(6): 1136 (1969).

The terms GM Taber stiffness, GM tensile stiffness, Canadian Standard Freeness, and Bendtsen Smoothness are defined as follows: GM Taber stiffness is defined as $(T_{MD} \times T_{CD})^{1/2}$ where $T_{MD}$ is the Taber stiffness value in the machine direction (MD) and $T_{CD}$ is the Taber stiffness value in the cross machine direction (CD); GM tensile stiffness is defined as $(t_{MD} \times t_{CD})^{1/2}$ where $t_{MD}$ is the tensile stiffness value in the machine direction (MD) and $t_{CD}$ is the tensile stiffness value in the cross machine direction (CD); Canadian Standard Freeness measurements were carried out according to TAPPI test method T227 om 94; Bendtsen Smoothness means the smoothness of the paperboard is determined by measuring the volume of air leakage across the narrow contacting ring of a smoothness head resting on the paperboard with a Bendtsen-type tester according to the TAPPI procedure UM 535. Related method: SCAN-P21.

Fiber mat density of the paperboard is expressed in pounds for each 3000 square foot ream at a fiberboard thickness of 0.001 inch. In the paper art each 0.001 inch board thickness is referred to as a point.

The GM Taber stiffness is expressed as grams-centimeter divided by fiber mat density to the 1.63 power wherein the fiber mat density of the paperboard is expressed as set forth herein above. The GM tensile stiffness is expressed in pounds per inch.

While the present invention is described above in connection with preferred or illustrative embodiments, these embodiments are not intended to be exhaustive or limiting of the invention. Rather, the invention is intended to cover all alternatives, modifications, and equivalents included within its spirit and scope, as defined by the appended claims.

We claim:

1. A cellulosic multi-ply paperboard comprising:

(a) predominately cellulosic fibers;

(b) bulk and porosity enhancing additive interspersed with said cellulosic fibers in a controlled distribution throughout the thickness of said paperboard; and (c) size press applied binder coating, optionally including a pigment adjacent both surfaces of the paperboard and penetrating into the board to a controlled extent; the overall fiber weight "w" of the paperboard being at least about 40 lbs. per 3000 square foot ream (i) the distribution of the bulk and porosity enhancing additive throughout the thickness of the paperboard, and (ii) the penetration of the size press applied pigment into the board, both being controlled to simultaneously produce at a fiber mat density of 3, 4.5. 6.5, 7, 8.3, and 9 pounds per 3000 square foot ream at a fiberboard thickness of 0.001 inches; and (A) a GM Taber stiffness of at least about 0.00246 $w^{2.63}$ grams-centimeter/fiber mat density$^{1.63}$; and (B) at a fiber mat density of about 3 to about 9 pounds per 3000 square foot ream and fiberboard thickness of 0.001 inches, a GM tensile strength of at least about 615+13.18 w pounds per inch.

2. The paperboard of claim 1, wherein the fiber weight of the paperboard is at least about 60 lbs. per 3000 square foot ream.

3. The paperboard of claim 1, wherein the bulk and porosity enhancing additive interspersed with said cellulosic fibers in a controlled distribution throughout the thickness of said paperboard comprises expanded and/or unexpanded microspheres.

4. The paperboard of claim 3, wherein the expanded and/or unexpanded microspheres comprise a proportion of between about 10 lbs. to about 400 lbs. per ton of fiber, and further comprising a retention aid in an amount sufficient to retain a sufficient portion of the microspheres in all layers within the paperboard.

5. The paperboard of claim 4, wherein the microspheres have a mean diameter ranging between at least about 0.5 to about 60 microns in the unexpanded state and having a maximum expansion of between at least about 4 and about 9 times the mean diameters.

6. The paperboard of claim 4, wherein the retention aid is diallyldimethyl ammonium chloride polymer having a molecular weight in excess of about ninety thousand.

7. The paperboard of claim 4, wherein the retention aid is polyethylenimine having a molecular weight of about forty thousand to about two million.

8. The paperboard of claim 7, wherein the polyethylenimine has a molecular weight of about five hundred thousand to about two million.

9. The paperboard of claim 4, wherein the retention aid is selected from the group consisting of polyacrylomides, acrylamide-acrylate polymers, cationic acrylamide copolymers, and mixtures of these having a molecular weight in the range of at least about one hundred thousand to about thirty million.

10. The paperboard of claim 9, wherein the retention aid has a molecular weight of at least about ten to about twenty million.

11. The paperboard web of claim 1, wherein the bulk and porosity enhancing additive interspersed with said cellulosic fibers in a controlled distribution throughout the thickness of said paperboard comprises a mixture of anfractuous cellulosic fiber subjected to thermal and/or chemical treatment and expanded and/or unexpanded microspheres.

12. The paperboard of claim 1, wherein the bulk and porosity enhancing additive interspersed with said cellulosic fibers in a controlled distribution throughout the thickness of said paperboard comprises a mixture of HBA fiber and expanded and/or unexpanded microspheres.

13. The paperboard of claim 1, wherein the bulk and porosity enhancing additive interspersed throughout the thickness of said paperboard comprises continuously or discontinuously coated expanded and/or unexpanded microspheres.

14. The paperboard of claim 1, wherein the paperboard has been coated with a binder and an inorganic or organic pigment.

15. An article of manufacture formed from the paperboard of claim 14.

16. The article of manufacture of claim 15 in the form of a carton.

17. The article of manufacture of claim 15 in the form of a folding paper box.

18. The paperboard of claim 14, wherein the binder is selected from the group consisting of aliphatic acrylate acrylonitrile styrene copolymers, n-butyl acrylate acrylonitrile styrene copolymer, n-amyl acrylate acrylonitrile styrene copolymer, n-propyl acrylate acrylonitrile styrene copolymer, n-ethyl acrylate acrylonitrile styrene copolymer, aliphatic acrylate styrene copolymers, n-butyl acrylate styrene copolymer, n-amyl acrylate styrene copolymer, n-propyl acrylate styrene copolymer, n-ethyl acrylate styrene copolymer, cationic starch, anionic starch, amphoteric starch, starch latex copolymers. animal glue, gelatin, methyl cellulose, carboxymethylcellulOSe, polyvinyl alcohol, ethylene-vinyl acetate copolymer, vinyl acetate-acrylic copolymer, styrene-butadiene copolymer, ethylene-vinyl chloride copolymer, vinyl acetate polymer, vinyl acetate-ethylene copolymer, acrylic copolymer, styrene-acrylic copolymer, stearylated melamine, hydrophilic epoxy esters, and mixtures of these.

19. The paperboard of claim 14, wherein the pigment is selected from the group consisting of a clay, chalk, barite, silica, talc, bentonite, glass powder, alumina, titanium dioxide, graphite, carbon black, zinc sulfide, alumina silica, calcium carbonate, and mixtures of these.

20. The paperboard of claim 19 wherein the pigment is kaolin clay.

21. A cup formed from the paperboard of claim 1.

22. A plate formed from the paperboard of claim 1.

23. A plate formed from the paperboard of claim 14.

24. The plate of claim 22 in the form of a compartmented plate.

25. A bowl formed from the paperboard of claim 1.

26. A canister formed from the paperboard of claim 1.

27. A rectangular take-out container formed from the paperboard of claim 1.

28. A hamburger clam shell formed from the paperboard of claim 1.

29. A French fry sleeve formed from the paperboard of claim 1.

30. A food bucket container formed from the paperboard of claim 1.

31. An article of manufacture formed from the cellulosic multi-ply paperboard according to claim 1, wherein the bulk and porosity enhancing additive is in the form of expanded and/or unexpanded microspheres.

32. The article of manufacture of claim 31 wherein the fiber weight of the paperboard is at least about 60 lbs. per 3000 square foot ream.

33. The article of manufacture of claim 32 in the form of a cup.

34. The article of manufacture of claim 32 in the form of a plate.

35. The plate of claim 34 in the form of a compartmented plate.

36. The article of manufacture of claim 32 in the form of a bowl.

37. The article of manufacture of claim 32 in the form of a canister.

38. The article of manufacture of claim 32 in the form of a rectangular take-out container.

39. The article of manufacture of claim 32 in the form of a hamburger clam shell.

40. The article of manufacture of claim 32 in the form of a French fry sleeve.

41. The article of manufacture of claim 32 in the form of a food bucket.

42. The article of manufacture of claim 31 coated on one or both sides with a coating resistant to moisture.

43. The article of manufacture of claim 42 in the form of a cup having an inner and outer surface which, when filled with a liquid at 190° F., exhibits thermal insulative properties such that at room temperature and one atmosphere pressure the temperature of the outer surface does not reach a temperature of about 140° F. to about 145° F. in less than thirty seconds.

44. The cellulosic paperboard of claim 1, wherein the paperboard is coated with a grease resistant polymer including the fluorine moiety or is coated on one or both sides with a coating resistant to moisture.

45. The paperboard of claim 44, wherein one or both sides of the paperboard are coated with a chemical composition selected from the group consisting of polyolefin, nitrocellulose, methyl cellulose, carboxy methyl cellulose, ethylvinyl acetate copolymer, vinyl acetate copolymer, styrene butadiene copolymer, vinyl acetate copolymer, vinyl acrylic copolymer, styrene acrylic copolymer, and mixtures of these.

46. An article of manufacture made from the paperboard of claim 45.

47. The article of manufacture of claim 46 in the form of a cup.

48. The cup of claim 47 having an inner and an outer surface which, when filled with a liquid at 190° F., exhibits thermal insulative properties such that at room temperature and one atmosphere pressure the outer surface does not reach a temperature of about 140° F. to about 145° F. in less than thirty seconds.

49. The article of manufacture of claim 46 in the form of a carton.

50. The article of manufacture of claim 46 in the form of a folding paper box.

51. The article of manufacture of claim 46 in the form of a plate.

52. The article of manufacture of claim 46 in the form of a compartmented plate.

53. The article of manufacture of claim 46 in the form of a bowl.

54. The article of manufacture of claim 46 in the form of a canister.

55. The article of manufacture of claim 46 in the form of a rectangular take-out container.

56. The article of manufacture of claim 46 in the form of a hamburger clam shell.

57. The article of manufacture of claim 46 in the form of a French fry sleeve.

58. The article of manufacture of claim 46 in the form of a food bucket.

59. The cup of claim 48, wherein one or both sides of the cup are coated with high density polyethylene.

60. The French fry sleeve of claim 57 prepared from the paperboard of claim 50.

61. The paperboard of claim 1, wherein the paperboard is coated on one or both sides with a wax having a melting point of about 130° F. to about 150° F.

62. An article of manufacture prepared from the paperboard of claim 1, wherein the article of manufacture is coated with a wax having a melting point of about 130° F. to about 150° F.

63. The article of manufacture of claim 62 in the form of a cup.

* * * * *

UNITED STATES PATENT AND TRADEMARK OFFICE

CERTIFICATE OF CORRECTION

PATENT NO. : 6,919,111 B2
APPLICATION NO. : 10/236347
DATED : July 19, 2005
INVENTOR(S) : Dean P. Swoboda et al.

It is certified that error appears in the above-identified patent and that said Letters Patent is hereby corrected as shown below:

Column 65,
Line 1, “copolymers.” should read -- copolymers, --.
Line 2, “carboxymethylcellulOSe,” should read -- carboxymethylcellulose --.

Column 66,
Line 50, “claim 50.” should read -- claim 2. --.

Signed and Sealed this

Twenty-seventh Day of June, 2006

JON W. DUDAS
*Director of the United States Patent and Trademark Office*